US009459032B2

(12) United States Patent
Nishimura et al.

(10) Patent No.: US 9,459,032 B2
(45) Date of Patent: Oct. 4, 2016

(54) AIR CONDITIONING APPARATUS AND REFRIGERANT QUANTITY DETERMINATION METHOD

(75) Inventors: Tadafumi Nishimura, Sakai (JP); Takahiro Yamaguchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1326 days.

(21) Appl. No.: 12/918,911

(22) PCT Filed: Feb. 26, 2009

(86) PCT No.: PCT/JP2009/053484

§ 371 (c)(1),
(2), (4) Date: Aug. 23, 2010

(87) PCT Pub. No.: WO2009/107693

PCT Pub. Date: Sep. 3, 2009

(65) Prior Publication Data

US 2011/0000234 A1 Jan. 6, 2011

(30) Foreign Application Priority Data

Feb. 29, 2008 (JP) ..... 2008-050895

(51) Int. Cl.

| | |
|---|---|
| ***F25B 45/00*** | (2006.01) |
| ***F25B 1/00*** | (2006.01) |
| ***F25B 49/00*** | (2006.01) |
| *F25B 13/00* | (2006.01) |

(52) U.S. Cl.

CPC ..... *F25B 49/005* (2013.01); *F25B 13/00* (2013.01); *F25B 2313/02741* (2013.01);
(Continued)

(58) Field of Classification Search

CPC ..... F25B 2400/0401; F25B 2400/0403; F25B 2400/0409; F25B 2400/0411; F25B 2600/2501; F25B 2700/2104; F25B 2700/04; F25B 13/00; F25B 2313/0231; F25B 45/00; F25B 1/00; F25B 41/00

USPC ..... 62/117, 196.1

See application file for complete search history.

(56) References Cited

U.S. PATENT DOCUMENTS 5,323,844 A * 6/1994 Sumitani et al. ..... 165/240
6,595,024 B1 * 7/2003 Tang et al. ..... 62/498

FOREIGN PATENT DOCUMENTS

JP 52-8588 U 7/1975
JP 1-80623 U 5/1989

(Continued)

OTHER PUBLICATIONS

International Search Report of corresponding PCT Application No. PCT/JP2009/053484.

(Continued)

*Primary Examiner* — Travis Ruby
*Assistant Examiner* — Harry Arant
(74) *Attorney, Agent, or Firm* — Global IP Counselors

(57) ABSTRACT

An air conditioning apparatus and a refrigerant quantity determination method are provided, whereby a refrigerant quantity can be determined in a simple and accurate manner without compromising the reliability of a compressor. A refrigerant circuit (10) has a compressor (21), an outdoor heat exchanger (23) that functions as a condenser, an indoor expansion valve (41, 51), an indoor heat exchanger (42, 52) that functions as an evaporator, an indoor unit interconnection pipe (4*b*, 5*b*), a liquid refrigerant connection pipe (6), a gas refrigerant connection pipe (7), and an outdoor unit interconnection pipe (8). A controller (9) performs liquefaction control for liquefying refrigerant and placing the refrigerant in a portion extending from the indoor expansion valve (41, 51) to the outdoor heat exchanger (23). The controller (9) directly or indirectly regulates the flow rate of refrigerant flowing through a liquid bypass circuit (70) from a liquid reserving portion (Q) toward the gas refrigerant connection pipe (7). A liquid level detection sensor (39) detects at least one of either a volume of liquid refrigerant in the portion where liquid refrigerant accumulates and a physical quantity equivalent to the volume.

24 Claims, 50 Drawing Sheets

(52) U.S. Cl.
CPC ..... *F25B 2400/13* (2013.01); *F25B 2500/19* (2013.01); *F25B 2500/222* (2013.01); *F25B 2600/2501* (2013.01); *F25B 2600/2509* (2013.01); *F25B 2700/04* (2013.01); *F25B 2700/2115* (2013.01); *F25B 2700/21152* (2013.01)

(56) References Cited

FOREIGN PATENT DOCUMENTS

| | | | | | |
|---|---|---|---|---|---|
| JP | 3-186170 | A | | 8/1991 | |
| JP | 2006-23072 | A | | 1/2006 | |
| JP | 2006-292212 | A | | 10/2006 | |
| JP | 2006-313057 | A | * | 11/2006 | |
| JP | 2007240108 | A | * | 9/2007 | ..... F25B 49/02 |
| JP | 2007-263443 | A | | 10/2007 | |
| JP | 2008-8499 | A | | 1/2008 | |
| JP | 2008-32305 | A | | 2/2008 | |
| WO | WO 2007069581 | A1 | * | 6/2007 | |

OTHER PUBLICATIONS

International Preliminary Report of corresponding PCT Application No. PCT/JP2009/053484.

* cited by examiner

AIR CONDITIONING APPARATUS AND REFRIGERANT QUANTITY DETERMINATION METHOD

CROSS-REFERENCE TO RELATED APPLICATIONS

This U.S. National stage application claims priority under 35 U.S.C. §119(a) to Japanese Patent Application No. 2008-050895, filed in Japan on Feb. 29, 2008, the entire contents of which are hereby incorporated herein by reference.

TECHNICAL FIELD

The present invention relates to an air conditioning apparatus and a refrigerant quantity determination method for performing a determination pertaining to the properness of the quantity of refrigerant inside a refrigerant circuit.

BACKGROUND ART

A commonly known air conditioning apparatus is configured as a result of a heat source unit having a compressor and a heat source-side heat exchanger, and a utilization unit having a utilization-side expansion valve and a utilization-side heat exchanger, being interconnected via a liquid refrigerant connection pipe and a gas refrigerant connection pipe. The properness of the quantity of refrigerant inside the refrigerant circuit of this air conditioning apparatus is determined by operating the air conditioning apparatus under a predetermined condition and detecting the degree of subcooling of the refrigerant in the outlet side of the heat source-side heat exchanger. As this operation under a predetermined condition, there is, for example, operation where the degree of superheating of the refrigerant in the outlet of the utilization-side heat exchanger functioning as an evaporator of the refrigerant is controlled such that it becomes a positive value and where the pressure of the refrigerant on the low pressure side of the refrigerant circuit resulting from the compressor is controlled such that it becomes constant (see Japanese Patent Publication No. 2006-023072).

SUMMARY

Technical Problem

However, with the determination method according to Patent Document 1 described above, control sometimes becomes complex when the operation for determining the quantity of refrigerant is performed, due to the effects of the surrounding temperature.

In response to this, for example, refrigerant quantity determination is performed by liquefying the refrigerant inside the refrigerant circuit by condensing the refrigerant with a condenser and detecting the volume or another characteristic thereof, in which case control becomes simpler when the operation for determination is performed.

However, immediately before the determination is performed, most of the refrigerant that will undergo the determination has been successfully liquefied, and the quantity of refrigerant drawn in by the compressor in order to be sent to the condenser therefore decreases. Therefore, a risk is presented that the temperature of the compressor will rise, and there are cases in which the compressor is less reliable.

With the foregoing aspects of the prior art in view, it is an object of the present invention to provide an air conditioning apparatus and a refrigerant quantity determination method wherein the quantity of refrigerant can be determined in a simple manner without compromising the reliability of the compressor.

Solution to Problem

An air conditioning apparatus of a first aspect of the present invention comprises a refrigerant circuit, a controller, a liquid bypass circuit, and a refrigerant quantity detection unit. The refrigerant circuit has a compressor, a condenser for condensing refrigerant, an expansion mechanism, an evaporator for evaporating refrigerant, an evaporator-side interconnection pipe for interconnecting the expansion mechanism and the evaporator, a liquid refrigerant pipe for interconnecting the expansion mechanism and the condenser, a gas refrigerant pipe for interconnecting the evaporator and the compressor, and a gas discharge pipe for interconnecting the compressor and the condenser. The controller performs liquefaction control for causing refrigerant present inside the refrigerant circuit to be present in a liquid state in a liquid reserving portion located between the expansion mechanism and an end of the condenser on the side opposite the expansion mechanism. The liquid bypass circuit interconnects the liquid reserving portion and the gas refrigerant pipe. The refrigerant quantity detection unit detects at least one of either a volume of liquid refrigerant in the liquid reserving portion or a physical quantity equivalent to the volume. It shall be apparent that the refrigerant circuit according to the present aspect may have a configuration capable of performing an operation other than this type of cooling operation, e.g., a heating operation or the like. The detection associated with the quantity of refrigerant according to the present aspect includes detection of the refrigerant quantity itself, detection of whether or not the refrigerant quantity is proper, and the like.

When the refrigerant inside the refrigerant circuit is being liquefied and collected in the liquid reserving portion, there is a risk that the refrigerant quantity circulating in the refrigerant circuit will decrease and the port temperature of the compressor will increase. Therefore, a risk is presented that it will no longer be possible to maintain reliability of the compressor.

As a countermeasure to this, increases in the port temperature of the compressor can be suppressed by supplying the liquid refrigerant of the liquid reserving portion to the suction side of the compressor.

The reliability of the compressor can be maintained thereby even in cases in which the refrigerant inside the refrigerant circuit is liquefied and collected in the liquid reserving portion and determination of the refrigerant quantity is performed.

Particularly in cases in which the capacity in the liquid bypass circuit in the outdoor equipment is less than the capacity of the connection pipe or another component interconnecting the condenser and the evaporator, errors caused by the refrigerant quantity returned to the suction side of the compressor by the liquid bypass circuit will sometimes be an inconsequential degree, in which case high precision of detection can be maintained.

An air conditioning apparatus of a second aspect of the present invention is the air conditioning apparatus of the first aspect of the invention wherein the controller performs temperature stabilization control for stabilizing the temperature of the refrigerant liquefied by the liquefaction control.

According to the present aspect, the density of the liquid refrigerant is stable because the temperature of the liquid refrigerant existing in the liquid reserving portion can be made constant.

Thereby, it is possible to improve the precision of determination in cases in which determination of the refrigerant quantity is performed based on the volume detected by the refrigerant quantity detection unit or a physical quantity equivalent to the volume.

An air conditioning apparatus of a third aspect of the present invention is the air conditioning apparatus of the first or second aspect of the invention, further comprising a subcooling circuit, a subcooling expansion mechanism, and a subcooling heat exchanger. The subcooling circuit branches from between the condenser and the expansion mechanism and is connected to the suction side of the compressor. The subcooling expansion mechanism is provided in the path of the subcooling circuit. The subcooling heat exchanger performs heat exchange between refrigerant expanded by the subcooling expansion mechanism and refrigerant headed from the condenser toward the expansion mechanism. The controller performs the temperature stabilization control by regulating the degree of expansion of the subcooling expansion mechanism.

According to the present aspect, it is possible to achieve refrigerant temperature stabilization control targeting the liquid refrigerant which is the detection target, without using, e.g., a liquid refrigerant temperature regulation heater or another externally fitted apparatus.

An air conditioning apparatus of a fourth aspect of the present invention further comprises flow rate regulation structure or means for directly or indirectly regulating the rate at which refrigerant flows through the liquid bypass circuit from the liquid reserving portion toward the gas refrigerant pipe.

When the refrigerant present in the refrigerant circuit is liquefied and collected, an increase in the discharge pipe temperature of the compressor caused by a decrease in the quantity of refrigerant sucked in by the compressor is minimized by supplying the liquid refrigerant to the suction of the compressor via the liquid bypass circuit. In this case, when the quantity of liquid refrigerant supplied to the suction side of the compressor is too great, the refrigerant temperature of the gas discharge pipe will sometimes suddenly decrease. Thus, when the pressure inside the gas discharge pipe suddenly decreases, bubbling or another problem occurs in some of the liquid refrigerant, thereby posing a risk that it will be difficult to detect an accurate boundary between the gas phase and the liquid phase.

As a countermeasure to this, for the refrigerant flowing through the liquid bypass circuit, the supply rate can be regulated by the flow rate regulation means rather than merely supplying the liquid refrigerant to the suction side of the compressor.

Thereby, the reliability of the compressor can be maintained while maintaining the precision of detecting the refrigerant quantity.

An air conditioning apparatus of a fifth aspect of the present invention is the air conditioning apparatus of the fourth aspect of the invention, wherein the flow rate regulation means has a liquid bypass valve which is provided in the path of the liquid bypass circuit and is capable of regulating the quantity of refrigerant passing therethrough. According to the present aspect, the reliability of the compressor can be maintained while suppressing loss of precision of detecting the refrigerant quantity, by regulating the liquid refrigerant quantity passing through the bypass pipe and returning to the suction side of the compressor.

An air conditioning apparatus of a sixth aspect of the present invention is the air conditioning apparatus of the fifth aspect of the invention, wherein the liquid bypass valve is a liquid bypass expansion mechanism for reducing the pressure of refrigerant passing through. The flow rate regulation means further has a liquid bypass heat exchanger for performing heat exchange between refrigerant heading from the liquid reserving portion toward the liquid bypass expansion mechanism and refrigerant passing through the liquid bypass expansion mechanism toward the gas refrigerant pipe.

According to the present aspect, when the gas phase volume significantly changes due to a temperature change in the case of a gas-liquid mixed state, the quantity of refrigerant passing through the liquid bypass expansion mechanism is also greatly affected by the surrounding temperature and made to fluctuate. Therefore, it is difficult to stably supply liquid refrigerant in the quantity needed in order to sufficiently maintain the reliability of the compressor while preventing loss of precision in detecting the refrigerant quantity.

As a countermeasure to this, a pipe heat exchanger is provided in the present aspect, and heat exchange can be performed between refrigerant not yet depressurized by the liquid bypass expansion valve and refrigerant that has been depressurized. Therefore, in cases in which the capacity of the pipe heat exchanger is sufficient, the refrigerant passing through the liquid bypass expansion mechanism can be brought to a liquid single-phase state. Even in cases in which the surrounding temperature changes, the change in volume in this liquid single-phase refrigerant is small, and it is therefore possible to stabilize the quantity of liquid refrigerant returned to the suction side of the compressor.

An air conditioning apparatus of a seventh aspect of the present invention is the air conditioning apparatus of the sixth aspect of the invention, wherein the controller regulates the degree of depressurization of the refrigerant in the liquid bypass expansion mechanism, thereby causing the heat exchange amount in the liquid bypass heat exchanger to fluctuate so as to regulate the flow rate of a liquid single-phase refrigerant passing through the liquid bypass expansion mechanism while ensuring that the refrigerant flowing into the liquid bypass expansion mechanism is in the liquid single-phase.

According to the present aspect, the expansion mechanism can control the passage rate of the refrigerant quantity within a range whereby the refrigerant passing through is maintained in a liquid single-phase state. Thus, since the refrigerant passing through the expansion mechanism is in a liquid single-phase state rather than a gas-liquid two-phase state in an indeterminate mixture ratio, it is possible to more accurately control the refrigerant quantity supplied to the suction side of the compressor by regulating the capacity for passing refrigerant in the expansion mechanism.

An air conditioning apparatus of an eighth aspect of the present invention is the air conditioning apparatus of any of the fifth through seventh aspects of the invention, wherein the flow rate regulation means has the gas return circuit for interconnecting the gas discharge pipe and the gas refrigerant pipe. The controller regulates the flow rate of refrigerant passing through the liquid bypass valve, thereby regulating the ratio of a mixture of the gas refrigerant fed to the gas refrigerant pipe via the gas return circuit and the liquid refrigerant fed to the gas refrigerant pipe via the liquid bypass circuit.

According to the present aspect, the ratio between the gas refrigerant and liquid refrigerant returned to the suction side of the compressor is regulated, whereby it is possible to more reliably suppress the loss of determination precision resulting from a sudden decrease in refrigerant temperature in the gas discharge pipe while more reliably suppressing increases in the port temperature of the compressor, for example.

An air conditioning apparatus of a ninth aspect of the present invention is the air conditioning apparatus of the fourth aspect of the invention, wherein the flow rate regulation means has a capillary tube provided in the path of the liquid bypass circuit, a gas return circuit for interconnecting the gas discharge pipe and the gas refrigerant pipe, and a gas return valve for regulating the refrigerant quantity heading from the gas discharge pipe toward the gas refrigerant pipe, the gas return valve being provided to the gas return circuit. The controller regulates the flow rate of refrigerant passing through gas return valve, thereby regulating a mixed ratio between the gas refrigerant fed to the gas refrigerant pipe via the gas return circuit and the liquid refrigerant fed to the gas refrigerant pipe via the liquid bypass circuit.

According to the present aspect, the ratio between the gas refrigerant and liquid refrigerant returned to the suction side of the compressor is regulated, whereby it is possible to more reliably suppress the loss of determination precision resulting from a sudden decrease in refrigerant temperature in the gas discharge pipe while more reliably suppressing increases in the port temperature of the compressor or the like.

An air conditioning apparatus of a tenth aspect of the present invention is the air conditioning apparatus of any of the seventh through ninth aspects of the invention, further comprising a discharged refrigerant temperature sensor for detecting the temperature of refrigerant discharged by the compressor. The controller regulates the mixture ratio on the basis of a value detected by the discharged refrigerant temperature sensor.

According to the present aspect, the gas-liquid mixed ratio can be regulated while observing the actual discharged refrigerant temperature.

It is thereby possible to more reliably suppress the loss of determination precision resulting from a sudden decrease in refrigerant temperature in the gas discharge pipe while more reliably suppressing increases in the port temperature of the compressor or the like.

An air conditioning apparatus of an eleventh aspect of the present invention is the air conditioning apparatus of any of the seventh through ninth aspects of the invention, further comprising a compressor hot-area temperature sensor for detecting the temperature of a hot area inside the compressor. The controller regulates the mixture ratio on the basis of a value detected by the compressor hot-area temperature sensor.

According to the present aspect, since control can be performed while the temperature of the actual hot area of the compressor is taken into account, it is possible to reliably suppress abnormal increases in the temperature of the hot area of the compressor.

A refrigerant quantity determination method of a twelfth aspect of the present invention is a method for determining the quantity of refrigerant of an air conditioning apparatus comprising a refrigerant circuit having a compressor, a condenser for condensing refrigerant, an expansion mechanism, an evaporator for evaporating refrigerant, an evaporator-side interconnection pipe for interconnecting the expansion mechanism and the evaporator, a liquid refrigerant pipe for interconnecting the expansion mechanism and the condenser, a gas refrigerant pipe for interconnecting the evaporator and the compressor, and a gas discharge pipe for interconnecting the compressor and the condenser. According to the refrigerant quantity determination method, liquefaction control is performed for causing refrigerant present inside the refrigerant circuit to be present in a liquid state in a liquid reserving portion located between the expansion mechanism and an end of the condenser on the side opposite the expansion mechanism. Before a volume of the liquid refrigerant in the liquid reserving portion or a physical quantity equivalent to the volume is detected, at least some of the refrigerant accumulated in the liquid reserving portion is fed to the gas refrigerant pipe without passing through the evaporator. It shall be apparent that the refrigerant circuit according to the present aspect may have a configuration capable of performing an operation other than this type of cooling operation, e.g., a heating operation or the like. The detection associated with the quantity of refrigerant herein includes detection of the refrigerant quantity itself, detection of whether or not the refrigerant quantity is proper, and the like.

When the refrigerant inside the refrigerant circuit is being liquefied and collected in the liquid reserving portion, there is a risk that the refrigerant quantity circulating in the refrigerant circuit will decrease and the port temperature of the compressor will increase. Therefore, a risk is presented that it will no longer be possible to maintain the reliability of the compressor.

As a countermeasure to this, increases in the port temperature of the compressor can be suppressed according to the present aspect by supplying the liquid refrigerant of the liquid reserving portion to the suction side of the compressor.

Effects of the Invention

In the air conditioning apparatus of the first aspect, the reliability of the compressor can be maintained even in cases in which the refrigerant inside the refrigerant circuit is liquefied and collected in the liquid reserving portion and determination of the refrigerant quantity is performed.

In the air conditioning apparatus of the second aspect, it is possible to improve the precision of determination in cases in which determination of the refrigerant quantity is performed based on the volume detected by the refrigerant quantity detection unit or a physical quantity equivalent to the volume.

In the air conditioning apparatus of the third aspect, it is possible to achieve refrigerant temperature stabilization control targeting the liquid refrigerant to be detected, without using, e.g., a liquid refrigerant temperature regulation heater or another externally fitted apparatus.

In the air conditioning apparatus of the fourth aspect, the reliability of the compressor can be maintained while maintaining the precision of detecting the refrigerant quantity.

In the air conditioning apparatus of the fifth aspect, the reliability of the compressor can be maintained while suppressing loss of precision of detecting the refrigerant quantity, by regulating the liquid refrigerant quantity passing through the bypass pipe and returning to the suction side of the compressor.

In the air conditioning apparatus of the sixth aspect, even in cases in which the surrounding temperature changes, the change in volume in the liquid single-phase refrigerant is small, and it is therefore possible to stabilize the quantity of liquid refrigerant returned to the suction side of the compressor.

In the air conditioning apparatus of the seventh aspect, it is possible to more accurately control the refrigerant quantity supplied to the suction side of the compressor by regulating the capacity for passing refrigerant in the expansion mechanism.

In the air conditioning apparatus of the eighth aspect, it is possible to more reliably suppress the loss of determination precision resulting from a sudden decrease in refrigerant temperature in the gas discharge pipe while more reliably suppressing increases in the port temperature of the compressor, for example.

In the air conditioning apparatus of the ninth aspect, it is possible to more reliably suppress the loss of determination precision resulting from a sudden decrease in refrigerant temperature in the gas discharge pipe while more reliably suppressing increases in the port temperature of the compressor, or the like.

In the air conditioning apparatus of the tenth aspect, it is possible to more reliably suppress the loss of determination precision resulting from a sudden decrease in refrigerant temperature in the gas discharge pipe while more reliably suppressing increases in the port temperature of the compressor, for example.

In the air conditioning apparatus of the eleventh aspect, since control can be performed while being aware of the temperature of the actual hot area of the compressor, it is possible to reliably suppress abnormal increases in the temperature of the hot area of the compressor.

In the refrigerant quantity determination method of the twelfth aspect, the reliability of the compressor can be maintained even in cases in which the refrigerant inside the refrigerant circuit is liquefied and collected in the liquid reserving portion, and determination of the refrigerant quantity is performed.

DETAILED DESCRIPTION OF EMBODIMENT(S)

Examples of using embodiments of an air conditioning apparatus and a refrigerant quantity determination method according to the present invention are described below for each of the embodiments on the basis of the drawings.

<1> First Embodiment

<1.1> Configuration of Air Conditioning Apparatus

Figure 1:
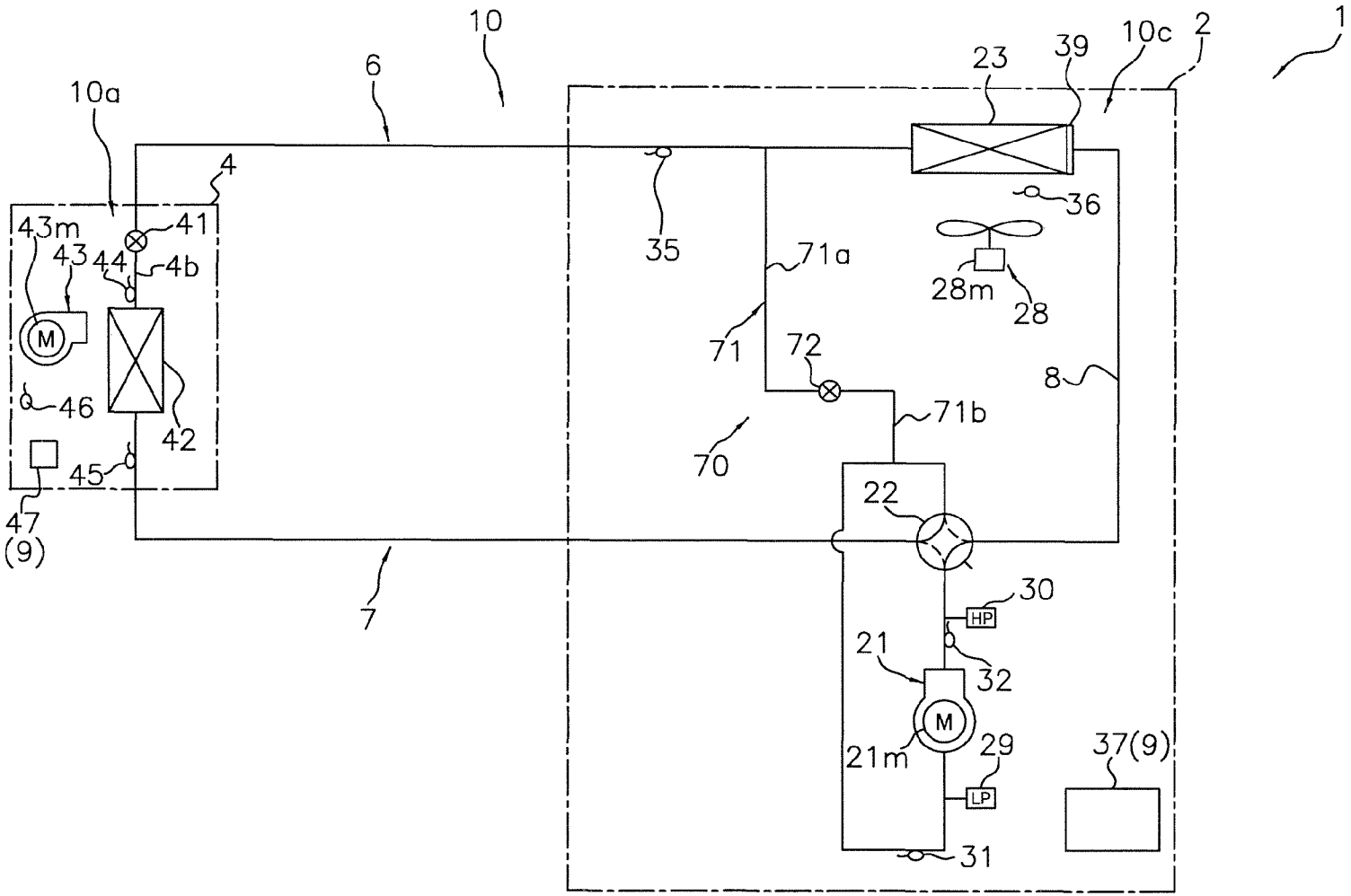
FIG. 1 is a general configuration diagram of an air conditioning apparatus of a first embodiment of the present invention.

FIG. 1 is a general configuration diagram of an air conditioning apparatus 1 pertaining to a first embodiment of the present invention.

An air conditioning apparatus 1 is an apparatus used to cool and heat the inside of a room in a building or the like by performing a vapor compression refrigeration cycle operation.

The air conditioning apparatus 1 is mainly equipped with one outdoor unit 2 serving as a heat source unit, two indoor units 4 serving as utilization units that are connected to the outdoor unit 2, and a liquid refrigerant connection pipe 6 and a gas refrigerant connection pipe 7 serving as refrigerant connection pipes that interconnect the outdoor unit 2 and the indoor units 4. That is, a vapor compression refrigerant circuit 10 of the air conditioning apparatus 1 of the present embodiment is configured as a result of the outdoor unit 2, the indoor units 4, the liquid refrigerant connection pipe 6, and the gas refrigerant connection pipe 7 being connected.

(Indoor Units)

The indoor units 4 are installed by being embedded in or suspended from a ceiling inside a room in a building or the like or by being mounted on a wall surface inside a room. The indoor units 4 are connected to the outdoor unit 2 via the liquid refrigerant connection pipe 6 and the gas refrigerant connection pipe 7 and configure part of the refrigerant circuit 10.

Next, the configuration of the indoor units 4 will be described.

Each of the indoor units 4 mainly has an indoor-side refrigerant circuit 10*a* that configures part of the refrigerant circuit 10. This indoor-side refrigerant circuit 10*a* mainly has an indoor expansion valve 41 serving as a utilization-side expansion mechanism, an indoor heat exchanger 42 serving as a utilization-side heat exchanger, and an indoor equipment interconnection pipe 4*b* for connecting the indoor expansion valve 41 and the indoor heat exchanger 42.

In the present embodiment, the indoor expansion valve 41 is a motor-driven expansion valve connected to the liquid side of the indoor heat exchanger 42 in order to perform, for example, regulation of the flow rate of refrigerant flowing through the inside of the indoor-side refrigerant circuit 10*a*, and the indoor expansion valve 41 is also capable of shutting off passage of the refrigerant.

In the present embodiment, the indoor heat exchanger 42 is a cross-fin type fin-and-tube heat exchanger configured by heat transfer tubes and numerous fins and is a heat exchanger that functions as an evaporator of the refrigerant during cooling operation to cool the room air and functions as a condenser of the refrigerant during heating operation to heat the room air.

In the present embodiment, the indoor unit 4 has an indoor fan 43 serving as a blowing fan for sucking the room air into the inside of the unit, allowing heat to be exchanged with the refrigerant in the indoor heat exchanger 42, and thereafter supplying the air to the inside of the room as supply air. The indoor fan 43 is a fan capable of varying the volume of the air it supplies to the indoor heat exchanger 42. The indoor fan 43 is a centrifugal fan or a multiblade fan driven by a motor 43*m* comprising a DC fan motor or the like.

Further, various types of sensors are disposed in the indoor unit 4. A liquid-side temperature sensor 44 that detects the temperature of the refrigerant (that is, the temperature of the refrigerant corresponding to the condensation temperature during the heating operation or the evaporation temperature during the cooling operation) is disposed on the liquid side of the indoor heat exchanger 42. A gas-side temperature sensor 45 that detects the temperature of the refrigerant is disposed on the gas side of the indoor heat exchanger 42. An indoor temperature sensor 46 that detects the temperature of the room air (that is, the indoor temperature) flowing into the inside of the unit is disposed on a room air suction opening side of the indoor unit 4. The liquid-side temperature sensor 44, the gas-side temperature sensor 45 and the indoor temperature sensor 46 comprise thermistors.

Figure 2:
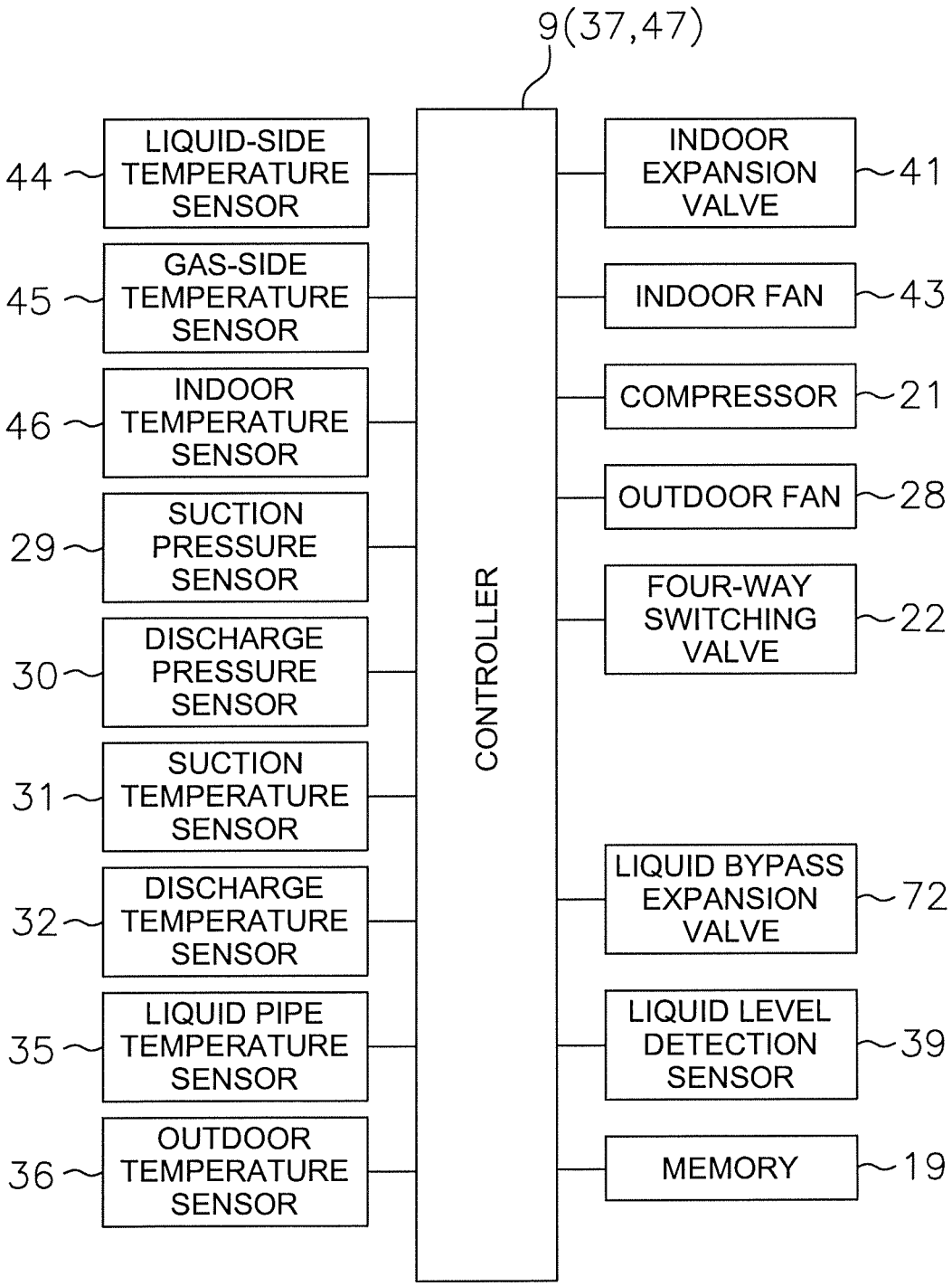
FIG. 2 is a control block diagram of an air conditioning apparatus.

Further, each of the indoor units 4 has an indoor-side controller 47 that controls the operation of each part configuring the indoor unit 4, as shown in FIG. 2. Additionally, the indoor-side controller 47 has a microcomputer and a memory 19 or the like disposed in order to perform control of the indoor unit 4. The microcomputer and memory 19 or the like are configured such that they can exchange control signals and the like with a remote controller (not shown) for individually operating the indoor units 4 and such that they can exchange control signals and the like with the outdoor unit 2 via a transmission line (not shown).

(Outdoor Unit)

The outdoor unit 2 is installed outdoors of a building or the like, configures the refrigerant circuit 10 together with the indoor units 4, and is connected to the indoor units 4 via the liquid refrigerant connection pipe 6 and the gas refrigerant connection pipe 7.

Next, the configuration of the outdoor unit 2 will be described.

The outdoor unit 2 mainly has an outdoor-side refrigerant circuit 10*c* that configures part of the refrigerant circuit 10. The outdoor-side refrigerant circuit 10*c* mainly has a compressor 21, a four-way switching valve 22, an outdoor equipment interconnection pipe 8 for connecting the four-way switching valve 22 and the compressor 21, an outdoor heat exchanger 23 serving as a heat source-side heat exchanger, a liquid level detection sensor 39, a liquid bypass circuit 70, various sensors, and an outdoor-side controller 37.

The compressor 21 is a compressor capable of varying its operating capacity. The compressor 21 is a positive displacement compressor driven by a motor 21*m*. The number of revolutions of the motor 21*m* is controlled by an inverter.

The four-way switching valve 22 is a valve for switching the direction of the flow of the refrigerant during the cooling operation and during the heating operation. During the cooling operation, the four-way switching valve 22 interconnects the discharge side of the compressor 21 and the gas side of the outdoor heat exchanger 23, and also interconnects the suction side of the compressor 21 and the gas refrigerant connection pipe 7 (see the solid lines of the four-way switching valve 22 in FIG. 1). The outdoor heat exchanger 23 can thereby be made to function as a condenser of the refrigerant compressed by the compressor 21, and the indoor heat exchanger 42 can be made to function as an evaporator of the refrigerant condensed in the outdoor heat exchanger 23 during the cooling operation. During the heating operation, the four-way switching valve 22 interconnects the discharge side of the compressor 21 and the gas refrigerant connection pipe 7 and also interconnects the suction side of the compressor 21 and the gas side of the outdoor heat exchanger 23 (see the dotted lines of the four-way switching valve 22 in FIG. 1). The indoor heat exchanger 42 can thereby be made to function as a condenser of the refrigerant compressed by the compressor 21, and the outdoor heat exchanger 23 can be made to function as an evaporator of the refrigerant condensed in the indoor heat exchanger 42 during the heating operation.

Figure 3:
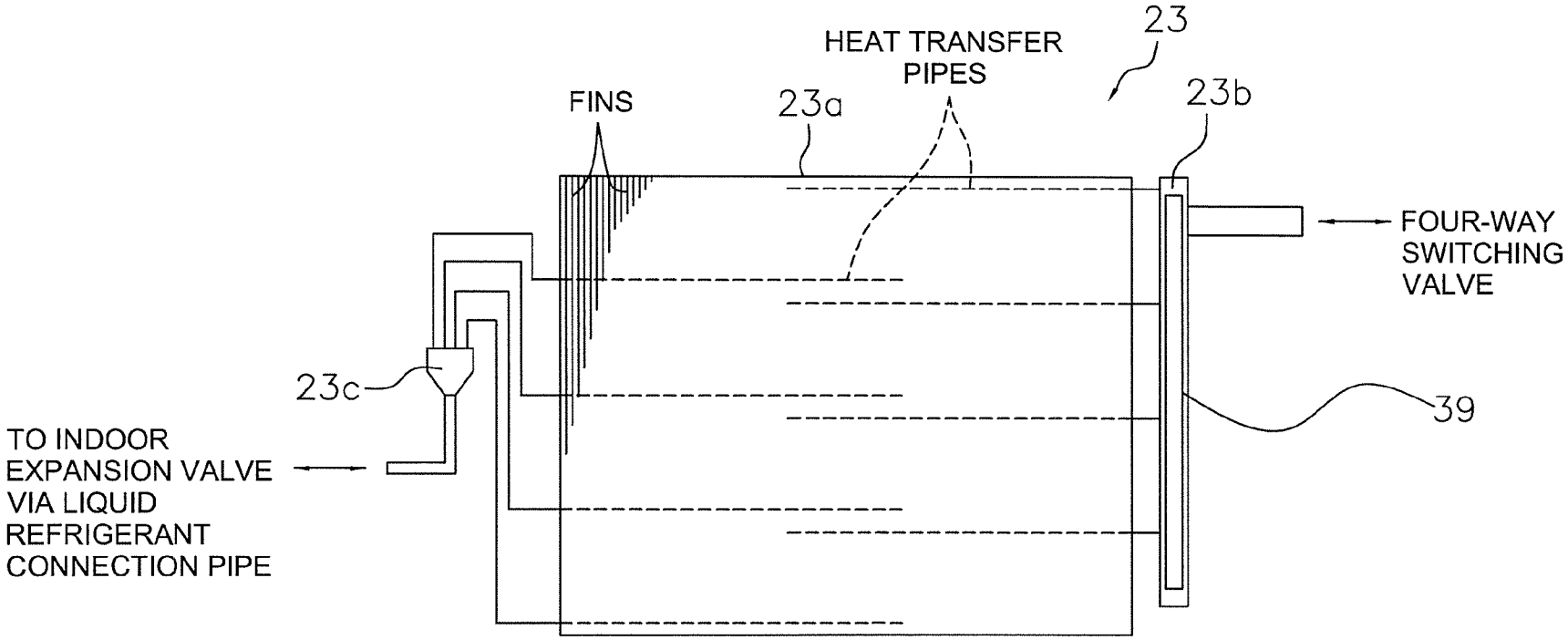
FIG. 3 is a general diagram of the outdoor heat exchanger.

The outdoor heat exchanger 23 is a cross-fin type fin-and-tube heat exchanger and, as shown in FIG. 3, which is a general diagram of the outdoor heat exchanger 23, mainly has a heat exchanger body 23*a* that is configured from heat transfer tubes and numerous fins, a header 23*b* that is connected to the gas side of the heat exchanger body 23*a*, and a distributor 23*c* that is connected to the liquid side of the heat exchanger body 23*a*. The outdoor heat exchanger 23 is a heat exchanger that functions as a condenser of the refrigerant during the cooling operation and as an evaporator of the refrigerant during the heating operation. The gas side of the outdoor heat exchanger 23 is connected to the four-way switching valve 22, and the liquid side of the outdoor heat exchanger 23 is connected to the outdoor expansion valve 38. The outdoor heat exchanger 23 has the heat exchanger body 23*a* and the header 23*b* as shown in FIG. 3. The heat exchanger body 23*a* condenses the gas refrigerant by letting in the high-temperature and high-pressure gas refrigerant pressurized by the compressor 21 at multiple different heights and causing the gas refrigerant to undergo heat exchange with the outside air temperature. To supply the high-temperature and high-pressure gas refrigerant pressurized by the compressor 21 to each of the multiple different heights of the above-described heat exchanger body 23*a*, the header 23*b* branches the gas refrigerant to the each of the heights.

On a side surface of the outdoor heat exchanger 23, as shown in FIG. 3, a liquid level detection sensor 39 is capable of detecting the height of the liquid level, which specifically is the boundary between the gas phase region and the liquid phase region of the refrigerant inside the outdoor heat exchanger 23. The liquid level detection sensor 39 is configured by an electric resistance detection member disposed along the height direction of the header 23*b* of the outdoor heat exchanger 23. During the cooling operation, the high-temperature and high-pressure gas refrigerant discharged from the compressor 21 is cooled and condensed into a high-pressure liquid refrigerant by the air supplied by an outdoor fan 28 inside the outdoor heat exchanger 23. In this state, the liquid level detection sensor 39 functions as a refrigerant detection mechanism for detecting a state quantity relating to the quantity of the refrigerant existing on the upstream side of the indoor expansion valve 41. Specifically, the liquid level detection sensor 39, which is an electric resistance detection member disposed along the height direction of the header 23*b* of the outdoor heat exchanger 23, detects the height of the liquid level which is the boundary between the region where the refrigerant exists in a gas state and the region where the refrigerant exists in a liquid state, by detecting the difference in electrical resistance between the portion covered by the liquid-state refrigerant and the portion covered by the gas-state refrigerant. As will be described hereinafter, the memory 19, which is connected to the controller 9 and is readably installed, stores in advance the volume from the indoor expansion valve 41 to the end of the outdoor heat exchanger 23 facing the liquid refrigerant connection pipe 6, as well as the bottom surface area of the outdoor heat exchanger 23 (or a value equivalent thereto). During a state in which the liquid refrigerant has reserved in the outdoor heat exchanger 23, the quantity of the liquid refrigerant is calculated by adding the quantity of refrigerant when the area from the indoor expansion valve 41 to the end of the outdoor heat exchanger 23 facing the liquid refrigerant connection pipe 6 has been filled with liquid refrigerant, and the quantity of refrigerant obtained by multiplying the height of the liquid level detected by the liquid level detection sensor 39 with the bottom surface area of the outdoor heat exchanger 23. Another option is to store in advance data corresponding to the amount of liquid refrigerant in the outdoor heat exchanger 23 as determined according to the height of the outdoor heat exchanger 23 rather than the bottom surface area of the outdoor heat exchanger 23.

The liquid bypass circuit 70 is provided inside the outdoor unit 2, and is a circuit for connecting the liquid refrigerant connection pipe 6 and the gas refrigerant connection pipe 7. The liquid bypass circuit 70 has a liquid bypass pipe 71 and a liquid bypass expansion valve 72. The liquid bypass pipe 71 has a high-pressure side liquid bypass pipe 71*a* connected to the liquid side, that is, the high-pressure side of the liquid bypass expansion valve 72, and a low-pressure side liquid bypass pipe 71*b* connected to the gas side, that is, the low-pressure side of the liquid bypass expansion valve 72. The liquid bypass expansion valve 72 is capable of directly regulating the quantity of liquid refrigerant flowing through the liquid bypass pipe 71 from the liquid refrigerant connection pipe 6 toward the gas refrigerant connection pipe 7.

The outdoor unit 2 has an outdoor fan 28 serving as a blowing fan. The outdoor fan 28 sucks outdoor air into the outdoor unit 2, causes heat exchange to be performed with the refrigerant in the outdoor heat exchanger 23, and discharges the air after heat exchange back out of the room. The outdoor fan 28 is a fan capable of varying the quantity of air supplied to the outdoor heat exchanger 23. The outdoor fan 28 is a propeller fan or the like, and is driven by a motor 28*m* composed of a DC fan motor or the like.

Various types of sensors are disposed in the outdoor unit 2 in addition to the liquid level detection sensor 39 described above. Specifically, a suction pressure sensor 29 that detects the suction pressure of the compressor 21, a discharge pressure sensor 30 that detects the discharge pressure of the compressor 21, a suction temperature sensor 31 that detects the suction temperature of the compressor 21, and a discharge temperature sensor 32 that detects the discharge temperature of the compressor 21 are disposed in the outdoor unit 2. An outdoor temperature sensor 36 that detects the temperature of the outdoor air (that is, the outdoor temperature) flowing into the inside of the unit is disposed on an outdoor air suction opening side of the outdoor unit 2. The suction temperature sensor 31, the discharge temperature sensor 32, the liquid pipe temperature sensor 35, and the outdoor temperature sensor 36 comprise thermistors.

The outdoor-side controller 37 is provided to the outdoor unit 2 and is used to control the actions of the components constituting the outdoor unit 2. The outdoor-side controller 37 has a microcomputer and the memory 19 disposed in order to perform control of the outdoor unit 2 and an inverter circuit that controls the motor 21*m*.

An indoor-side controller 47 is provided to each of the indoor units 4 and is used to control the actions of the components constituting the indoor units 4.

The outdoor-side controller 37 is capable of exchanging control signals and the like via transmission lines (not shown) with the indoor-side controllers 47 of the indoor units 4.

The indoor-side controllers 47, the outdoor-side controller 37, and the transmission lines (not shown) interconnecting them together constitute a controller 9 for performing operation control of the entire air conditioning apparatus 1.

The controller 9 is, as shown in FIG. 2, a control block diagram of the air conditioning apparatus 1, connected such that it can receive detection signals of the various types of sensors 29 to 32, 35, 36, 39, and 44 to 46. The controller 9 can control the various types of devices and valves 21, 22, 28, 28*m*, 41, 43, 43*m*, and 72 on the basis of these detection signals and the like. Further, the memory 19 is connected to the controller 9. Various types of data are stored in this memory 19. Examples of the various types of data stored include a relational expression for calculating the quantity of refrigerant reserved in the outdoor heat exchanger 23 from the liquid level height h detected by the liquid level detection sensor 39, the volume of the portion of the refrigerant circuit 10 upstream of the indoor expansion valves 41 and ending at the outdoor heat exchanger 23 (excluding the outdoor heat exchanger 23 itself and including the high-pressure side liquid bypass pipe 71*a*), liquid refrigerant density data corresponding to temperature conditions, and the proper refrigerant quantity of the refrigerant circuit 10 of the air conditioning apparatus 1 per property where, for example, pipe length has been considered after being installed in a building. Additionally, when performing proper refrigerant quantity charging operation and refrigerant leak detection operation described later, the controller 9 reads these data, charges the refrigerant circuit 10 with just the proper quantity of the refrigerant, and judges whether or not there is a refrigerant leak by comparison with the proper refrigerant quantity data.

(Refrigerant Connection Pipes)

The refrigerant connection pipes 6 and 7 are refrigerant pipes constructed on site when installing the air conditioning apparatus 1 in an installation location such as a building. Pipes having various lengths and pipe diameters are used as these refrigerant connection pipes depending on installation conditions such as the installation location and the combination of outdoor units and indoor units. For this reason, for example, when installing a new air conditioning apparatus, it is necessary to charge the air conditioning apparatus 1 with the proper quantity of the refrigerant corresponding to installation conditions such as the lengths and the pipe diameters of the refrigerant connection pipes 6 and 7.

As described above, the refrigerant circuit 10 of the air conditioning apparatus 1 is configured as a result of the indoor-side refrigerant circuits 10*a*, the outdoor-side refrigerant circuit 10*c*, and the refrigerant connection pipes 6 and 7 being connected. Additionally, the air conditioning apparatus 1 of the present embodiment is configured to perform operations by switching between the cooling operation and the heating operation with the four-way switching valve 22 and also to perform control of each device of the outdoor unit 2 and the indoor units 4 in accordance with the operating loads of the indoor units 4, using the controller 9 configured by the indoor-side controllers 47 and the outdoor-side controller 37.

<1.2> Operation of Air Conditioning Apparatus

Next, operation of the air conditioning apparatus 1 of the present embodiment will be described.

As operation modes of the air conditioning apparatus 1 of the present embodiment, there are a normal operation mode, a proper refrigerant quantity charging operation mode, and a refrigerant leak detection operation mode.

In the normal operation mode, control of the configural devices of the outdoor unit 2 and the indoor units 4 is performed in accordance with the operating loads of each of the indoor units 4. In the proper refrigerant quantity charging operation mode, the refrigerant circuit 10 is charged with the proper quantity of the refrigerant when test operation is performed, for example, after installation of the configural devices of the air conditioning apparatus 1. In the refrigerant leak detection operation mode, it is determined whether or not there is leakage of the refrigerant from the refrigerant circuit 10 after test operation including this proper refrigerant quantity charging operation is ended and normal operation is started.

Operation in each operation mode of the air conditioning apparatus 1 will be described below.

(Normal Operation Mode)

First, the cooling operation in the normal operation mode will be described using FIG. 1.

—Cooling Operation—

During the cooling operation, the four-way switching valve 22 is in the state indicated by the solid lines in FIG. 1, that is, a state where the discharge side of the compressor 21 is connected to the gas side of the outdoor heat exchanger 23 and where the suction side of the compressor 21 is connected to the gas sides of the indoor heat exchangers 42 via the gas refrigerant connection pipe 7. The controller 9 performs control of the indoor expansion valves 41 such that by regulating their opening degrees, the degree of superheating of the refrigerant in the outlets of the indoor heat exchangers 42 (that is, the gas sides of the indoor heat exchangers 42) becomes a degree-of-superheating target value and constant. The liquid bypass expansion valve 72 is in a completely closed state.

The degree of superheating of the refrigerant in the outlets of each of the indoor heat exchangers 42 is detected by subtracting the refrigerant temperature values (which correspond to the evaporation temperatures) detected by the liquid-side temperature sensors 44 from the refrigerant temperature values detected by the gas-side temperature sensors 45.

When the compressor 21, the outdoor fan 28 and the indoor fans 43 are operated in this state of the refrigerant circuit 10, low-pressure gas refrigerant is sucked into the compressor 21 and is compressed into high-pressure gas refrigerant. Thereafter, the high-pressure gas refrigerant is sent through the four-way switching valve 22 to the outdoor heat exchanger 23 via the outdoor equipment interconnection pipe 8. In the outdoor heat exchanger 23, the high-pressure gas refrigerant performs heat exchange with the outdoor air supplied by the outdoor fan 28, condenses, and becomes high-pressure liquid refrigerant.

The high-pressure liquid refrigerant condensed by the outdoor heat exchanger 23 is sent to the indoor units 4 via the liquid refrigerant connection pipe 6.

The high-pressure liquid refrigerant sent to the indoor units 4 is depressurized by the indoor expansion valves 41 to approximately the suction pressure of the compressor 21, and this refrigerant becomes low-pressure gas-liquid two-phase refrigerant. This low-pressure gas-liquid two-phase refrigerant is sent through the indoor equipment interconnection pipes 4*b* to the indoor heat exchangers 42, the refrigerant performs heat exchange with the room air in the indoor heat exchangers 42, evaporates, and becomes low-pressure gas refrigerant.

This low-pressure gas refrigerant is sent to the outdoor unit 2 via the gas refrigerant connection pipe 7. The low-pressure gas refrigerant sent to the outdoor unit 2 is again sucked into the compressor 21 via the four-way switching valve 22.

In this manner, the air conditioning apparatus 1 is capable of performing, as one form of an operation mode, a cooling operation in which the outdoor heat exchanger 23 is made to function as a condenser of the refrigerant compressed in the compressor 21 and the indoor heat exchangers 42 are made to function as evaporators of the refrigerant.

Figure 4:
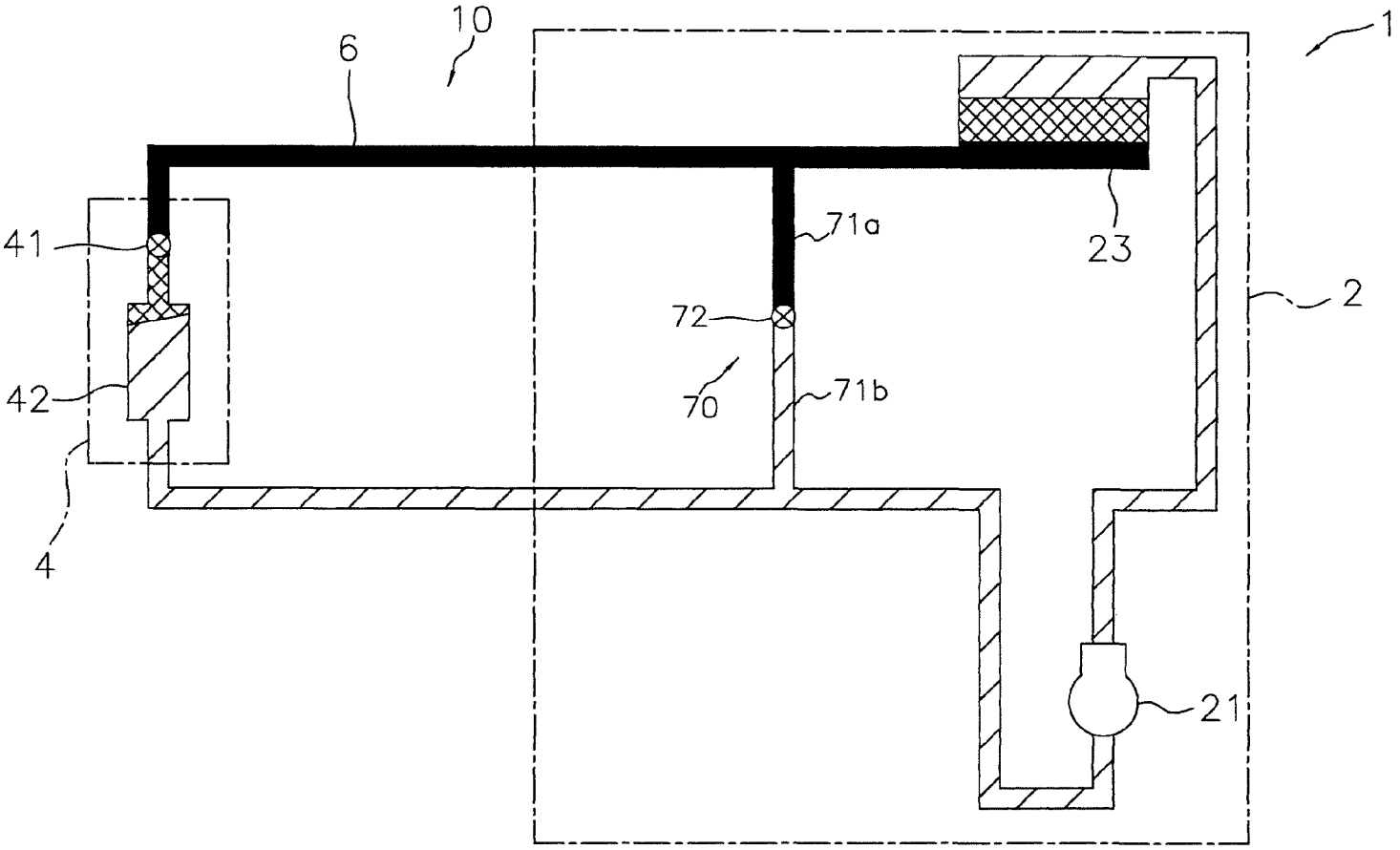
FIG. 4 is a schematic diagram showing states of refrigerant flowing through the inside of a refrigerant circuit during a cooling operation.

Here, the distribution state of the refrigerant in the refrigerant circuit 10 when performing the cooling operation in the normal operation mode is such that, as shown in FIG. 4, which is a schematic view showing the state of the refrigerant flowing through the refrigerant circuit 10 during the cooling operation, the refrigerant takes each of the states of a liquid state (the cross-hatched portion in FIG. 4), a gas-liquid two-phase state (the grid-like hatching portions in FIG. 4) and a gas state (the diagonally hatched portion in FIG. 4).

Specifically, the part of the refrigerant circuit 10 filled with liquid refrigerant extends from the interior of the outdoor heat exchanger 23 and the portion in proximity to the outlet of the outdoor heat exchanger 23 to the indoor expansion valves 41 via the liquid refrigerant connection pipe 6.

The parts of the refrigerant circuit 10 filled with the gas-liquid two-phase refrigerant are the portion in the middle of the outdoor heat exchanger 23 and the portions in proximity to the inlets of the indoor heat exchangers 42.

The parts of the refrigerant circuit 10 filled with the gas-state refrigerant are the portions extending from the middles of the indoor heat exchangers 42 to the inlet of the outdoor heat exchanger 23 via the gas refrigerant connection pipe 7 and the compressor 21, and the portion in proximity to the inlet of the outdoor heat exchanger 23.

In the cooling operation in the normal operation mode, the refrigerant is distributed inside the refrigerant circuit 10 in this distribution, but in refrigerant quantity determination operation in the proper refrigerant quantity charging operation mode and in the refrigerant leak detection operation mode described later, the distribution becomes one where the liquid refrigerant is collected in the liquid refrigerant connection pipe 6 and in the outdoor heat exchanger 23 (see FIG. 6).

—Heating Operation—

Next, the heating operation in the normal operation mode will be described.

During the heating operation, the four-way switching valve 22 is in the state indicated by the dotted lines in FIG. 1, that is, a state where the discharge side of the compressor 21 is connected to the gas sides of the indoor heat exchangers 42 via the gas refrigerant connection pipe 7 and where the suction side of the compressor 21 is connected to the gas side of the outdoor heat exchanger 23. The degree of subcooling of the refrigerant in the outlets of the indoor heat exchangers 42 is controlled so as to be constant at a degree of subcooling target value by regulating the opening degrees of the indoor expansion valves 41 with the controller 9. The liquid bypass expansion valve 72 is in a completely closed state.

The degree of subcooling of the refrigerant in the outlets of the indoor heat exchangers 42 is detected by converting the discharge pressure of the compressor 21 detected by the discharge pressure sensor 30 into a saturation temperature value corresponding to the condensation temperature and subtracting the refrigerant temperature values detected by the liquid-side temperature sensors 44 from this saturation temperature value of the refrigerant.

When the compressor 21, the outdoor fan 28, and the indoor fans 43 are operated while the refrigerant circuit 10 is in this state, the low-pressure gas refrigerant is sucked into the compressor 21 and compressed into high-pressure gas refrigerant, and is then sent to the indoor units 4 via the four-way switching valve 22 and the gas refrigerant connection pipe 7.

Then, the high-pressure gas refrigerant sent to the indoor units 4 performs heat exchange with the room air, condenses and becomes high-pressure liquid refrigerant in the indoor heat exchangers 42, and is thereafter sent through the indoor equipment interconnection pipes 4*b* to the indoor expansion valves 41. The high-pressure liquid refrigerant is then depressurized according to the valve opening degrees of the indoor expansion valves 41 when passing through the indoor expansion valves 41.

Having passed through the indoor expansion valves 41, the refrigerant is sent to the outdoor unit 2 via the liquid refrigerant connection pipe 6. The liquid refrigerant then flows into the outdoor heat exchanger 23. Having flowed into the outdoor heat exchanger 23, the low-pressure gas-liquid two-phase refrigerant then performs heat exchange with the outdoor air supplied by the outdoor fan 28 and evaporates into a low-pressure gas refrigerant. This low-pressure gas refrigerant is sucked again into the compressor 21 via the outdoor equipment interconnection pipe 8 and the four-way switching valve 22.

Operation control in the normal operation mode described above is performed by the controller 9 (more specifically, the indoor-side controllers 47, the outdoor-side controller 37, and the transmission line, not shown, that interconnects the controllers and enables correspondence between them) functioning as operation controlling means that performs normal operation including the cooling operation and the heating operation.

(Proper Refrigerant Quantity Charging Operation Mode)

Next, the proper refrigerant quantity charging operation mode performed at the time of test operation will be described using FIG. 5 to FIG. 7.

Figure 5:
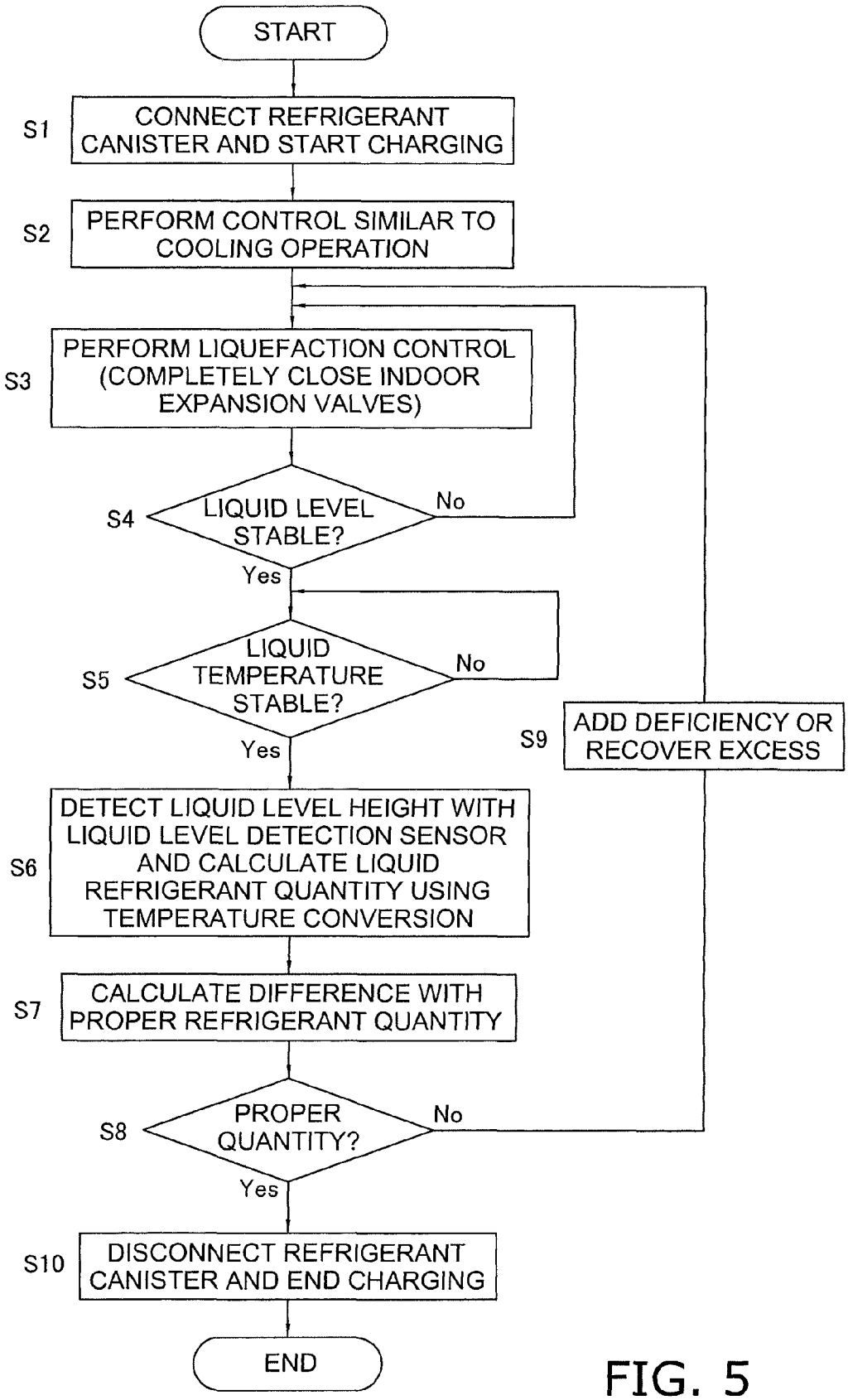
FIG. 5 is a flowchart of a proper refrigerant quantity charging operation.

FIG. 5 is a flowchart of a proper refrigerant quantity automatic charging operation.

Figure 6:
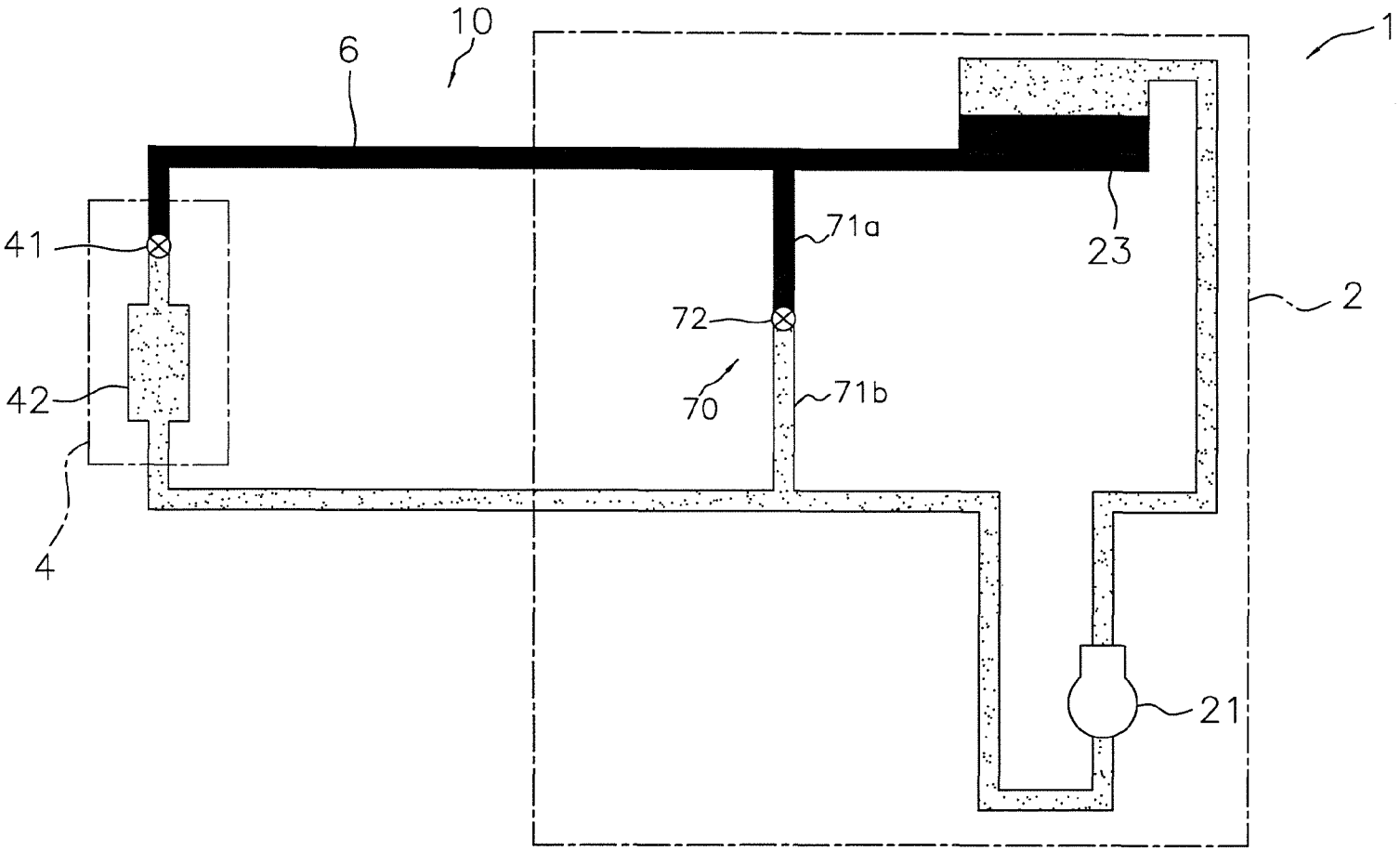
FIG. 6 is a diagram showing the liquid refrigerant accumulating in the outdoor heat exchanger when the indoor expansion valves are in a completely closed state.

FIG. 6 is a schematic diagram showing states of the refrigerant flowing through the inside of the refrigerant circuit 10 in the refrigerant quantity determination operation.

Figure 7:
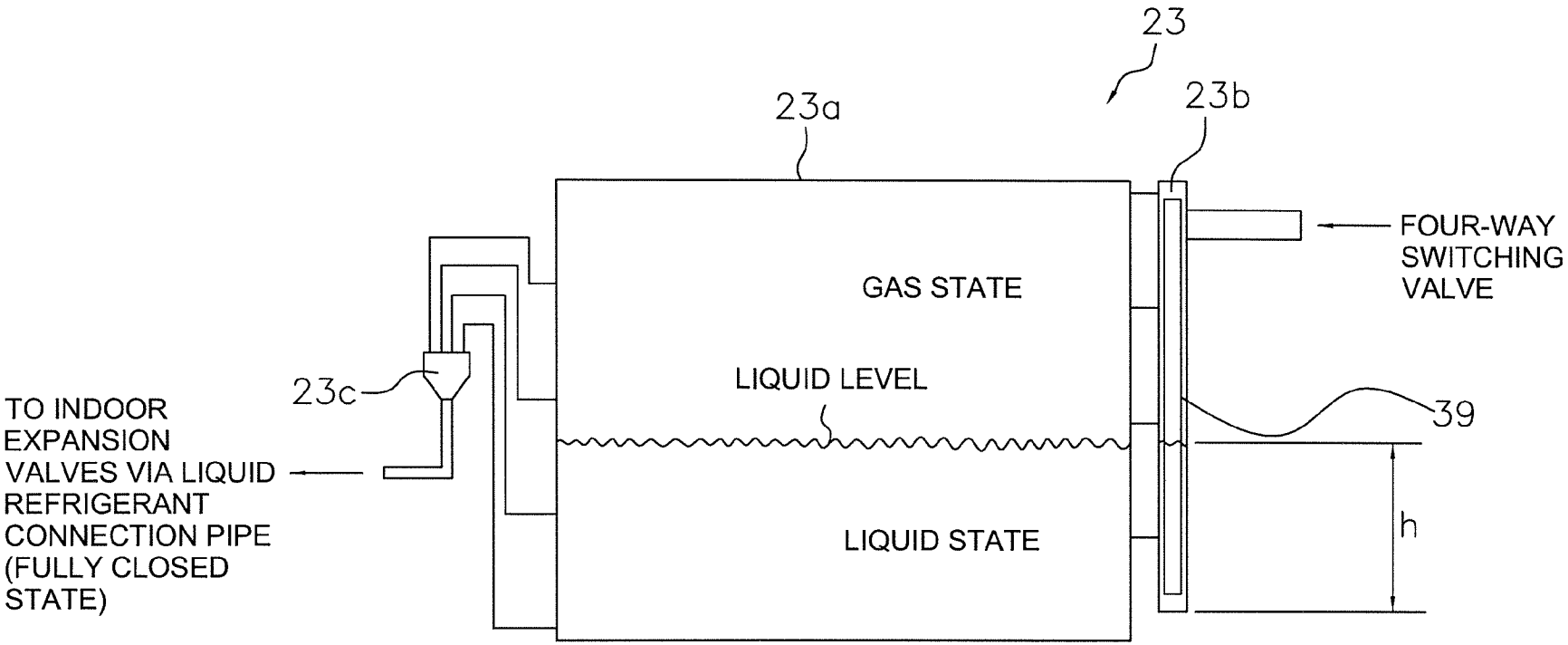
FIG. 7 is a schematic diagram showing the refrigerant accumulating in the outdoor heat exchanger.

FIG. 7 is a diagram schematically showing the insides of the heat exchanger body 23*a* and the header 23*b* of FIG. 2. FIG. 7 shows refrigerant accumulating in the outdoor heat exchanger 23 in the proper refrigerant quantity automatic charging operation.

The proper refrigerant quantity charging operation mode is an operation mode performed at the time of test operation after installation of the configural devices of the air conditioning apparatus 1, for example. This proper refrigerant quantity charging operation mode is an operation mode where the refrigerant circuit 10 is automatically charged with the proper quantity of the refrigerant corresponding to the capacities of the liquid refrigerant connection pipe 6 and the gas refrigerant connection pipe 7.

During installation, for example, the outdoor unit 2 has already been charged beforehand with the refrigerant used in the refrigerant circuit 10. The refrigerant with which the outdoor unit 2 is charged beforehand is allowed to fill the inside of the refrigerant circuit 10.

Next, the worker performing the proper refrigerant quantity charging operation connects a refrigerant canister for additional charging to the refrigerant circuit 10 and starts charging. The refrigerant canister for additional charging is additionally charged by being connected to, for example, the suction side of the compressor 21 of the refrigerant circuit 10.

Then, the worker issues, directly or with a remote controller (not shown) or the like, a command to the controller 9 to start the proper refrigerant quantity charging operation. The controller 9 thereby performs a refrigerant quantity determination operation and a determination of the properness of the refrigerant quantity accompanied by the processing performed by the sequence of step S1 to step S10 shown in FIG. 5. In the proper refrigerant quantity charging operation mode, the liquid bypass expansion valve 72 is in a completely closed state.

In step S1, while detecting that the connection of the refrigerant canister is complete, the controller 9 sets a valve (not shown) provided to a pipe extending from the refrigerant canister to a state which allows refrigerant to be supplied, and starts additional charging of the refrigerant.

In step S2, the controller 9 controls the devices so that the same operation is performed as that of the control described in the paragraph on the cooling operation of the normal operation mode described above. The inside of the refrigerant circuit 10 is thereby charged with additional refrigerant from the refrigerant canister for additional charging. At the conclusion of step S2, a service engineer or other technician experimentally determines whether or not additional charging has been performed to an extent which would allow the area from the indoor expansion valves 41 to the outdoor heat exchanger 23 to be filled with a liquid-state refrigerant. The service engineer then ends the additional charging for the time being.

In step S3, the controller 9 performs liquefaction control in which the indoor expansion valves 41 are placed in a completely closed state, and the compressor 21 and outdoor fan 28 continue to be operated. Performing this manner of control makes it possible to block the passage of refrigerant through the indoor expansion valves 41 and to stop the circulation of refrigerant inside the refrigerant circuit 10, as shown in FIG. 6. Since the controller 9 continues to operate the compressor 21 and the outdoor fan 28, the refrigerant performs heat exchange with the outdoor air supplied by the outdoor fan 28 in the outdoor heat exchanger 23 functioning as a condenser, and the refrigerant condenses due to being cooled. In this manner, in cases in which the circulation of refrigerant inside the refrigerant circuit 10 is stopped, the refrigerant condensed in the outdoor heat exchanger 23 gradually accumulates in the portion of the refrigerant circuit 10 that is upstream of the indoor expansion valve 41 and that is downstream of the compressor 21, including the outdoor heat exchanger 23.

Furthermore, with the indoor expansion valves 41 controlled to a completely closed state by the controller 9, the compressor 21 continues to perform suction. Therefore, the refrigerant located in the portion of the refrigerant circuit 10 downstream of the indoor expansion valves 41 and upstream of the compressor 21, such as the indoor heat exchangers 42 and the gas refrigerant connection pipe 7, continues to be sucked in by the compressor 21. The portion downstream of the indoor expansion valves 41 and upstream of the compressor 21 is thereby depressurized and becomes mostly devoid of refrigerant.

The refrigerant in the refrigerant circuit 10 thereby becomes a liquid state and collects intensively in the portion of the refrigerant circuit 10 upstream of the indoor expansion valves 41 and downstream of the compressor 21. More specifically, the refrigerant that has been condensed into a liquid state progressively accumulates inside the outdoor heat exchanger 23 from the upstream side of the indoor expansion valves 41, as shown in FIG. 7.

In step S4, the controller 9 determines whether or not the liquid level of the refrigerant in the outdoor heat exchanger 23 as detected by the liquid level detection sensor 39 has continued to be within a predetermined fluctuation range for a predetermined time duration or longer. The predetermined fluctuation range of the liquid level height can be within a range of plus or minus 5 cm, for example. The predetermined time duration, which is the time during which the liquid level height remains within the predetermined fluctuation range of plus or minus 5 cm, can be 5 minutes, for example.

In cases in which the controller 9 has determined that the liquid level has continued to remain within the predetermined fluctuation range for the predetermined time duration or longer, the sequence advances to step S5. In cases in which the controller 9 has determined that the liquid level has not continued to remain within the predetermined fluctuation range for the predetermined time duration or longer, the liquefaction control in step S3 is continued.

In step S5, the controller 9 performs temperature stabilization control for keeping constant the temperature of the liquid refrigerant that has intensively collected in the portion of the refrigerant circuit 10 upstream of the indoor expansion valves 41 and downstream of the compressor 21. Specifically, by placing the indoor expansion valves 41 in a completely closed state and continuing the operate the compressor 21 and the outdoor fan 28, the controller 9 performs control for keeping constant the temperature of the liquid refrigerant located in the portion of the refrigerant circuit 10 upstream of the indoor expansion valves 41 and downstream of the compressor 21 at approximately the surrounding temperature. The liquid refrigerant that has collected between the indoor expansion valves 41 and the compressor 21 in particular is blocked from passing through the indoor expansion valves 41, and therefore, not moving, the refrigerant is affected by the surrounding temperature in this location. In this manner, the controller 9 determines whether or not the temperature detected by the liquid pipe temperature sensor 35 has remained in the predetermined temperature range for a predetermined stabilization time duration or longer. The predetermined temperature range of the temperature detected by the liquid pipe temperature sensor 35 can be within a range of plus or minus 3° C., for example. The predetermined stabilization time duration, which is the time during which the temperature detected by the liquid pipe temperature sensor 35 remains within the predetermined temperature range, can be 10 minutes, for example.

In cases in which the controller 9 has determined that this temperature has continued to be within the predetermined temperature range for the predetermined stabilization time duration or longer, the sequence advances to step S6. In cases in which the controller 9 has determined that the temperature has not continued to be within the predetermined temperature range for the predetermined stabilization time duration or longer, step S5 is repeated.

In step S6, the liquid level height h of the liquid refrigerant accumulating in the outdoor heat exchanger 23 is detected by the liquid level detection sensor 39. The liquid level detection sensor 39 detects as the liquid level the boundary between the region where the refrigerant exists in a gas state and the region where the refrigerant exists in a liquid state. The timing of the detection by the liquid level detection sensor 39 is the time when the temperature of the liquid refrigerant is stabilized by the temperature stabilization control in step S5. The controller 9 thereby substitutes the height h of the liquid level found by the liquid level detection sensor 39 (see FIG. 7) into a relational expression between the liquid level height and the refrigerant quantity in the outdoor heat exchanger 23 stored in the memory 19. Furthermore, the controller 9 reads the volume of the portion of the refrigerant circuit 10 upstream of the indoor expansion valves 41 and downstream of the compressor 21, which is stored in the memory 19. The controller 9 calculates the quantity of liquid refrigerant by adding the effect of the change in liquid refrigerant density according to the value detected by the liquid pipe temperature sensor 35 to the sum of the volume of liquid refrigerant inside the outdoor heat exchanger 23 as determined from the relational expression of the outdoor heat exchanger 23 and the volume of the portion of the refrigerant circuit 10 upstream of the indoor expansion valves 41 and downstream of the compressor 21. The liquid refrigerant density corresponding to the temperature detected by the liquid pipe temperature sensor 35 is corrected by multiplying the density of the liquid refrigerant under the condition of the temperature detected by the liquid pipe temperature sensor 35. Density data of the liquid refrigerant corresponding to temperature conditions is stored beforehand in the memory 19.

The controller 9 can thereby compute the quantity of liquid refrigerant that has accumulated from the indoor expansion valves 41 to the inside of the outdoor heat exchanger 23.

In step S7, the controller 9 calculates the difference between the quantity of refrigerant calculated in step S5 described above and the proper quantity of refrigerant stored in the memory 19.

In step S8, the controller 9 determines whether or not the difference with the quantity of refrigerant calculated in step S7 is within a predetermined error range. In cases in which the controller 9 determines that the difference is within the predetermined error range, the proper refrigerant quantity charging operation mode is ended. At this time, the controller 9 quickly stops the operation of the compressor 21. In this manner, by quickly stopping the operation of the compressor 21 after detection, extreme depressurization in the indoor heat exchangers 42, the gas refrigerant connection pipe 7, and other components can be avoided, and the reliability of the equipment can be maintained. Excessive increases in the port temperature on the outlet side of the compressor 21 can also be prevented, and the reliability of the compressor 21 can also be maintained. In cases in which the controller 9 determines that the temperature difference is outside of the predetermined error range, the sequence advances to step S9.

In step S9, the controller 9 outputs the deficient quantity of refrigerant or the excess quantity of refrigerant. Based on the outputted specifics, the service engineer thereby either additionally charges the quantity of refrigerant deficient from the proper refrigerant quantity or recovers the quantity of refrigerant exceeding the proper refrigerant quantity from the refrigerant circuit 10. The sequence returns to step S2, and the same process is repeated until a determination that the temperature difference is within the predetermined error range is outputted by the controller 9.

In step S10, the controller 9 sets the valve (not shown) provided to the pipe extending from the refrigerant canister to a state which does not allow additional refrigerant charging, and ends the additional refrigerant charging.

(Refrigerant Leak Detection Operation Mode)

Next, the refrigerant leak detection operation mode will be described.

The refrigerant leak detection operation mode is substantially the same as the proper refrigerant quantity charging operation mode excluding being accompanied by refrigerant charging work.

The refrigerant leak detection operation mode is, for example, operation performed periodically (a time frame when it is not necessary to perform air conditioning, such as a holiday or late at night) when detecting whether or not the refrigerant is leaking to the outside from the refrigerant circuit 10.

Figure 8:
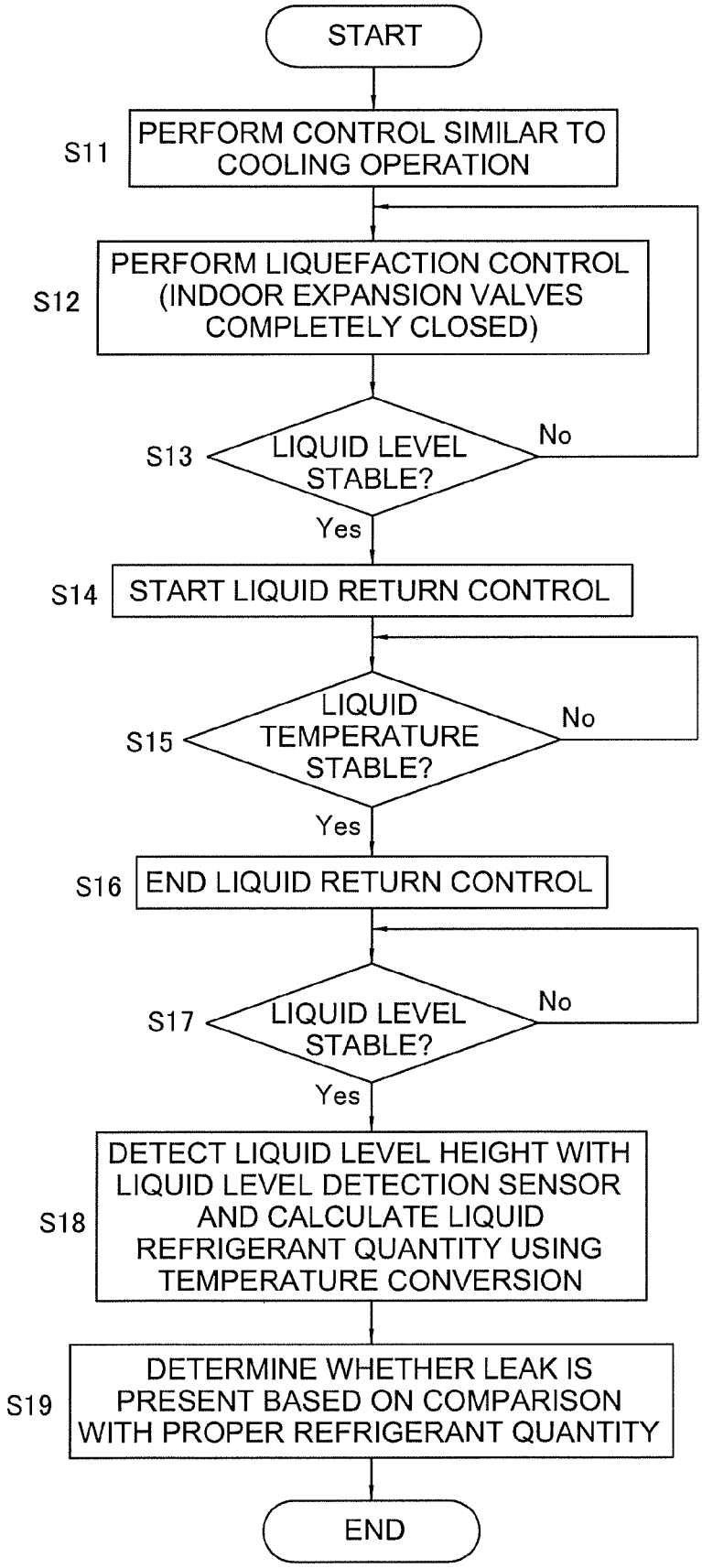
FIG. 8 is a flowchart of a refrigerant leak detection operation.

In the refrigerant leak detection operation, the processing performed by the sequence of steps S11 to S19 is performed as shown in FIG. 8.

In step S11, the controller 9 controls the equipment so that the same operation is performed as the control described in the paragraph of the cooling operation of the normal operation mode described above. The ending time point of the cooling operation of step S11 may be determined by the elapsing of a predetermined time from the start, or a service engineer may manually end the operation. In either case, the sequence advances to step S12 pending the refrigerant distribution in the refrigerant circuit 10 being stabilized at the state shown in FIG. 4 by the cooling operation.

In step S12, the controller 9 performs liquefaction control in which the indoor expansion valves 41 are placed in a completely closed state and the compressor 21 and outdoor fan 28 continue to be operated. Performing this manner of control makes it possible to block the passage of refrigerant through the indoor expansion valves 41 and to stop the circulation of refrigerant inside the refrigerant circuit 10, as shown in FIG. 6. Since the controller 9 continues to operate the compressor 21 and the outdoor fan 28, the refrigerant performs heat exchange with the outdoor air supplied by the outdoor fan 28 in the outdoor heat exchanger 23 functioning as a condenser, and the refrigerant condenses due to being cooled. In this manner, in cases in which the circulation of refrigerant inside the refrigerant circuit 10 is stopped, the refrigerant condensed in the outdoor heat exchanger 23 gradually accumulates in the portion of the refrigerant circuit 10 that is upstream of the indoor expansion valve 41 and that is downstream of the compressor 21, including the outdoor heat exchanger 23.

Furthermore, with the indoor expansion valves 41 controlled to a completely closed state by the controller 9, the compressor 21 continues to perform suction. Therefore, the refrigerant located in the portion of the refrigerant circuit 10 downstream of the indoor expansion valves 41 and upstream of the compressor 21, such as the indoor heat exchangers 42 and the gas refrigerant connection pipe 7, continues to be sucked in by the compressor 21. The portion downstream of the indoor expansion valves 41 and upstream of the compressor 21 is thereby depressurized and becomes mostly devoid of refrigerant.

The refrigerant in the refrigerant circuit 10 thereby becomes a liquid state and collects intensively in the portion of the refrigerant circuit 10 upstream of the indoor expansion valves 41 and downstream of the compressor 21. More specifically, the refrigerant that has been condensed into a liquid state progressively accumulates inside the outdoor heat exchanger 23 from the upstream side of the indoor expansion valves 41, as shown in FIG. 7.

In step S13, the controller 9 determines whether or not the liquid level of the refrigerant in the outdoor heat exchanger 23 as detected by the liquid level detection sensor 39 has continued to be within a predetermined fluctuation range for a predetermined time duration or longer. The predetermined fluctuation range of the liquid level height can be within a range of, e.g., plus or minus 5 cm. The predetermined time duration, which is the time during which the liquid level height remains within the predetermined fluctuation range of plus or minus 5 cm, can be, e.g., 5 minutes.

In cases in which the controller 9 has determined that the liquid level has continued to remain within the predetermined fluctuation range for the predetermined time duration or longer, the sequence advances to step S14. In cases in which the controller 9 has determined that the liquid level has not continued to remain within the predetermined fluctuation range for the predetermined time duration or longer, the liquefaction control in step S12 is continued.

In step S14, the controller 9 performs liquid return control in which the liquid bypass expansion valve 72 is slightly opened. In this liquid return control, control is performed in which an extremely small amount of the liquid refrigerant accumulated in the portion upstream of the indoor expansion valves 41 and downstream of the compressor 21 including the outdoor heat exchanger 23 is returned to the gas refrigerant connection pipe 7. The controller 9 regulates the opening degree of the liquid bypass expansion valve 72 and allows only an extremely small amount of the liquid refrigerant to pass through. The portion downstream of the indoor expansion valves 41 and upstream of the compressor 21 is thereby progressively depressurized, and even if this portion is mostly devoid of refrigerant, the small amount of liquid refrigerant circulating through the liquid bypass circuit 70 is capable of preventing an excessive increase in the temperature of the discharge pipe of the compressor 21.

In step S15, the controller 9 performs temperature stabilization control for keeping constant the temperature of the liquid refrigerant that has intensively collected in the portion of the refrigerant circuit 10 upstream of the indoor expansion valves 41 and downstream of the compressor 21. Specifically, by placing the indoor expansion valves 41 in a completely closed state and continuing to operate the compressor 21 and the outdoor fan 28, the controller 9 performs control for keeping constant the temperature of the liquid refrigerant located in the portion of the refrigerant circuit 10 upstream of the indoor expansion valves 41 and downstream of the compressor 21 at approximately the surrounding temperature. The liquid refrigerant that has collected between the indoor expansion valves 41 and the compressor 21 in particular is blocked from passing through the indoor expansion valves 41, and therefore, without moving, is affected by the surrounding temperature in this location. In this manner, the controller 9 determines whether or not the temperature detected by the liquid pipe temperature sensor 35 has remained in the predetermined temperature range for a predetermined stabilization time duration or longer. The predetermined temperature range of the temperature detected by the liquid pipe temperature sensor 35 can be within a range of plus or minus 3° C., for example. The predetermined stabilization time duration, which is the time during which the temperature detected by the liquid pipe temperature sensor 35 remains within the predetermined temperature range, can be, e.g., 10 minutes.

In cases in which the controller 9 has determined that this temperature has continued to be within the predetermined temperature range for the predetermined stabilization time duration or longer, the sequence advances to step S16. In cases in which the controller 9 has determined that the temperature has not continued to be within the predetermined temperature range for the predetermined stabilization time duration or longer, step S15 is repeated.

In step S16, the controller 9 ends the liquid return control. Circulation through the liquid bypass circuit 70 is thereby stopped, and all of the refrigerant inside the refrigerant circuit 10 collects in the portion upstream of the indoor expansion valves 41 and downstream of the compressor 21 including the outdoor heat exchanger 23.

In step S17, the controller 9 determines whether or not the liquid level of the refrigerant in the outdoor heat exchanger 23 as detected by the liquid level detection sensor 39 has continued to be within a predetermined fluctuation range for a predetermined time duration or longer. The predetermined fluctuation range of the liquid level height can be within a range of, e.g., plus or minus 5 cm. The predetermined time duration, which is the time during which the liquid level height remains within the predetermined fluctuation range of plus or minus 5 cm, can be, e.g., 5 minutes.

In cases in which the controller 9 has determined that the liquid level has continued to remain within the predetermined fluctuation range for the predetermined time duration or longer, the sequence advances to step S18. In cases in which the controller 9 has determined that the liquid level has not continued to remain within the predetermined fluctuation range for the predetermined time duration or longer, the liquefaction control in step S17 is continued.

In step S18, the controller 9 detects the liquid level height h of the liquid refrigerant accumulating in the outdoor heat exchanger 23 through the liquid level detection sensor 39. The liquid level detection sensor 39 detects as the liquid level the boundary between the region where the refrigerant exists in a gas state and the region where the refrigerant exists in a liquid state. The timing of the detection by the liquid level detection sensor 39 is the time when the liquid level height is determined to have stabilized in step S17. The controller 9 thereby substitutes the height h of the liquid level found by the liquid level detection sensor 39 (see FIG. 7) into a relational expression between the liquid level height and the refrigerant quantity in the outdoor heat exchanger 23 stored in the memory 19. Furthermore, the controller 9 reads the volume of the portion of the refrigerant circuit 10 upstream of the indoor expansion valves 41 and downstream of the compressor 21, which is stored in the memory 19. The controller 9 calculates the quantity of liquid refrigerant by adding the effect of the change in liquid refrigerant density according to the value detected by the liquid pipe temperature sensor 35 to the sum of the volume of liquid refrigerant inside the outdoor heat exchanger 23 as determined from the relational expression of the outdoor heat exchanger 23 and the volume of the portion of the refrigerant circuit 10 upstream of the indoor expansion valves 41 and downstream of the compressor 21. The liquid refrigerant density corresponding to the temperature detected by the liquid pipe temperature sensor 35 is corrected by multiplying the density of the liquid refrigerant under the condition of the temperature detected by the liquid pipe temperature sensor 35. Density data of the liquid refrigerant corresponding to temperature conditions is stored beforehand in the memory 19.

The controller 9 can thereby compute the quantity of liquid refrigerant that has accumulated from the indoor expansion valves 41 to the inside of the outdoor heat exchanger 23.

In step S19, the controller 9 determines whether or not the quantity of refrigerant computed in step S18 described above has reached the proper refrigerant quantity stored in the memory 19, and thereby determines whether or not there is a refrigerant leak in the refrigerant circuit 10.

After the data of the liquid level height h has been detected, the controller 9 quickly stops the operation of the compressor 21. In this manner, by quickly stopping the operation of the compressor 21 after detection, extreme depressurization in the indoor heat exchangers 42, the gas refrigerant connection pipe 7, and other components can be avoided, and the reliability of the equipment can be maintained. Excessive increases in the port temperature on the outlet side of the compressor 21 can also be prevented, and the reliability of the compressor 21 can also be maintained. The refrigerant leak detection operation is thereby ended.

<1.3> Characteristics of Air Conditioning Apparatus and Refrigerant Quantity Determination Method of First Embodiment (1)

In the air conditioning apparatus 1 of the first embodiment, when liquid refrigerant collects, liquid return control is performed in which the opening degree of the liquid bypass expansion valve 72 is regulated and only an extremely small amount of liquid refrigerant is allowed to pass through shortly before the liquid level height h of the outdoor heat exchanger 23 is detected. Therefore, in the latter half of the operation for determination, the portion downstream of the indoor expansion valves 41 and upstream of the compressor 21 is progressively depressurized, and even if there is very little refrigerant, an extremely small amount of liquid refrigerant continues to pass through the compressor 21 via the liquid bypass circuit 70. It is thereby possible to prevent the temperature in the discharge pipe of the compressor 21 from increasing excessively by circulating the liquid refrigerant before the liquid level height h is detected.

By having its opening degree regulated, the liquid bypass expansion valve 72 can directly regulate the quantity of refrigerant flowing to the gas refrigerant connection pipe 7 from the liquid refrigerant connection pipe 6 where the liquid refrigerant is accumulating.

(2)

In the air conditioning apparatus 1 of the first embodiment, the reliability of the compressor 21 is maintained by liquid return control, and the liquid return control is ended immediately before determination. The refrigerant to be subject to the determination can thereby be supplied to the greatest extent possible to the position where the liquid level is detected by the liquid level detection sensor 39, and detection precision can be improved.

<1.4> Modifications of First Embodiment (A)

In the first embodiment, an example was described in which the liquid bypass expansion valve 72 is used as means for regulating the flow rate of liquid refrigerant through the liquid bypass circuit 70, and the flow rate is controlled directly.

Figure 9:
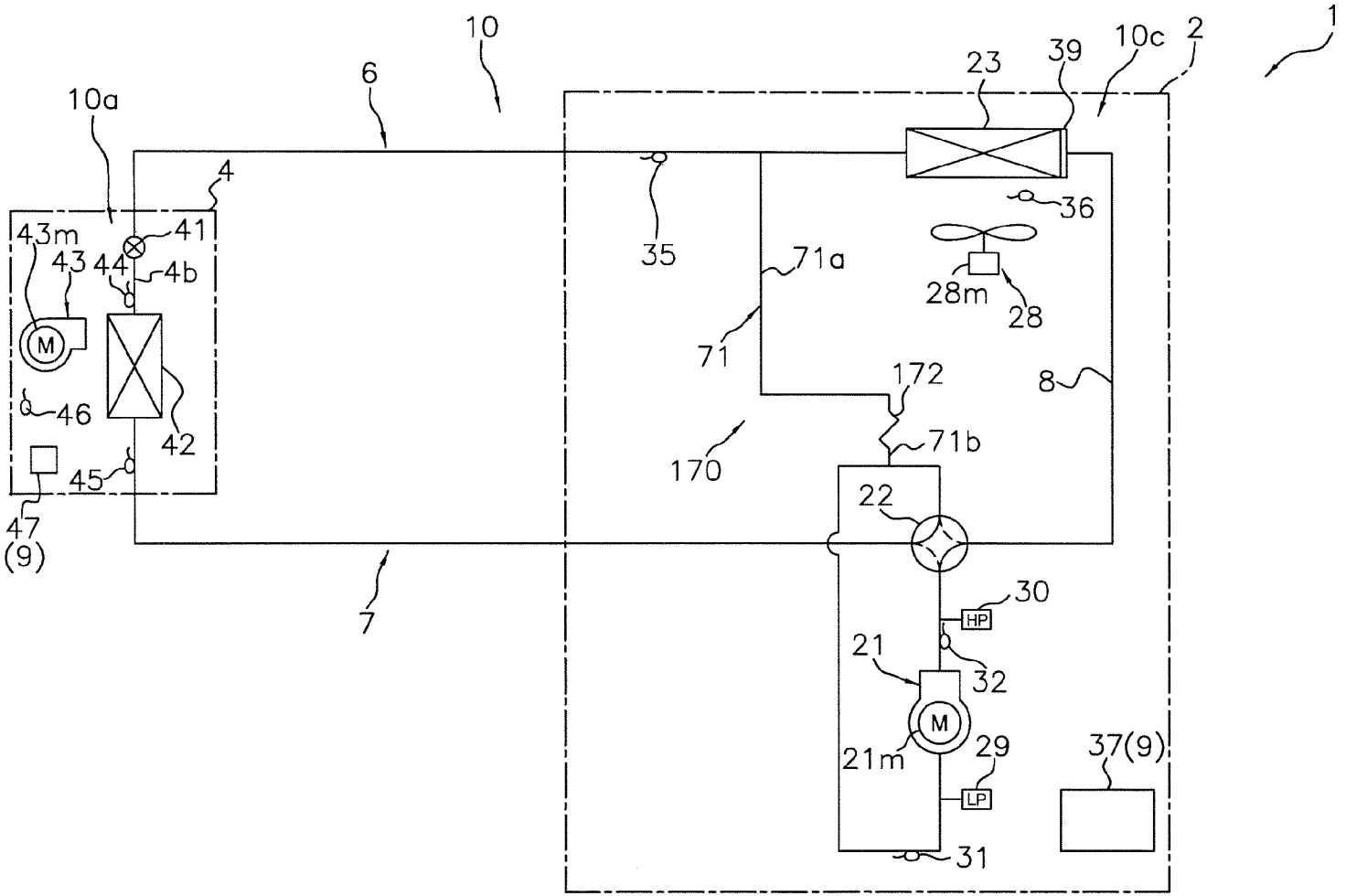
FIG. 9 is a general configuration diagram of the air conditioning apparatus of modification (A) of the first embodiment.

However, the present invention is not limited to this option alone; another option is to use a liquid bypass circuit 170 which uses a capillary tube 172 instead of the liquid bypass expansion valve 72, e.g., as shown in FIG. 9.

Figure 10:
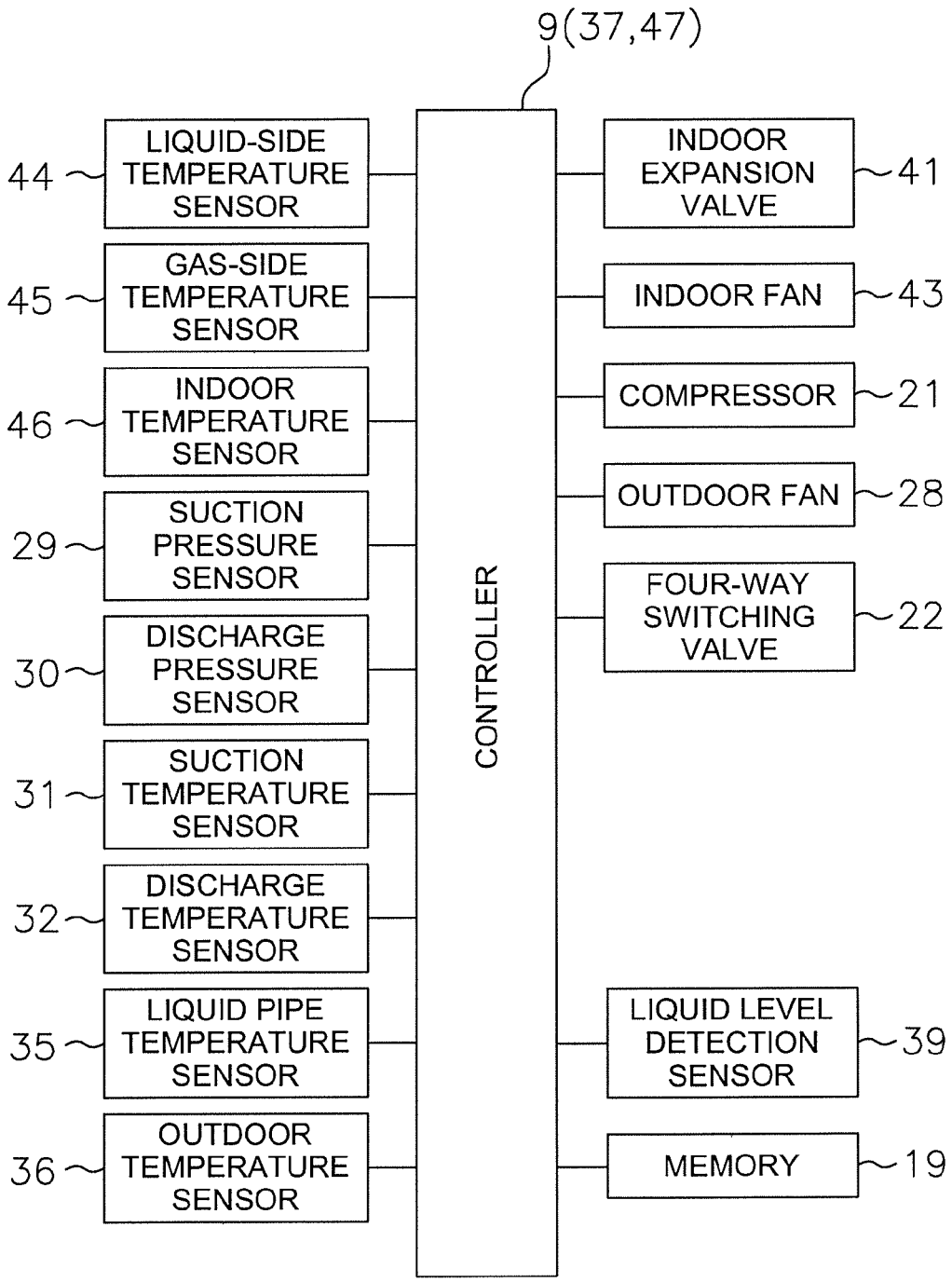
FIG. 10 is a control block diagram of the air conditioning apparatus of modification (A) of the first embodiment.
Figure 11:
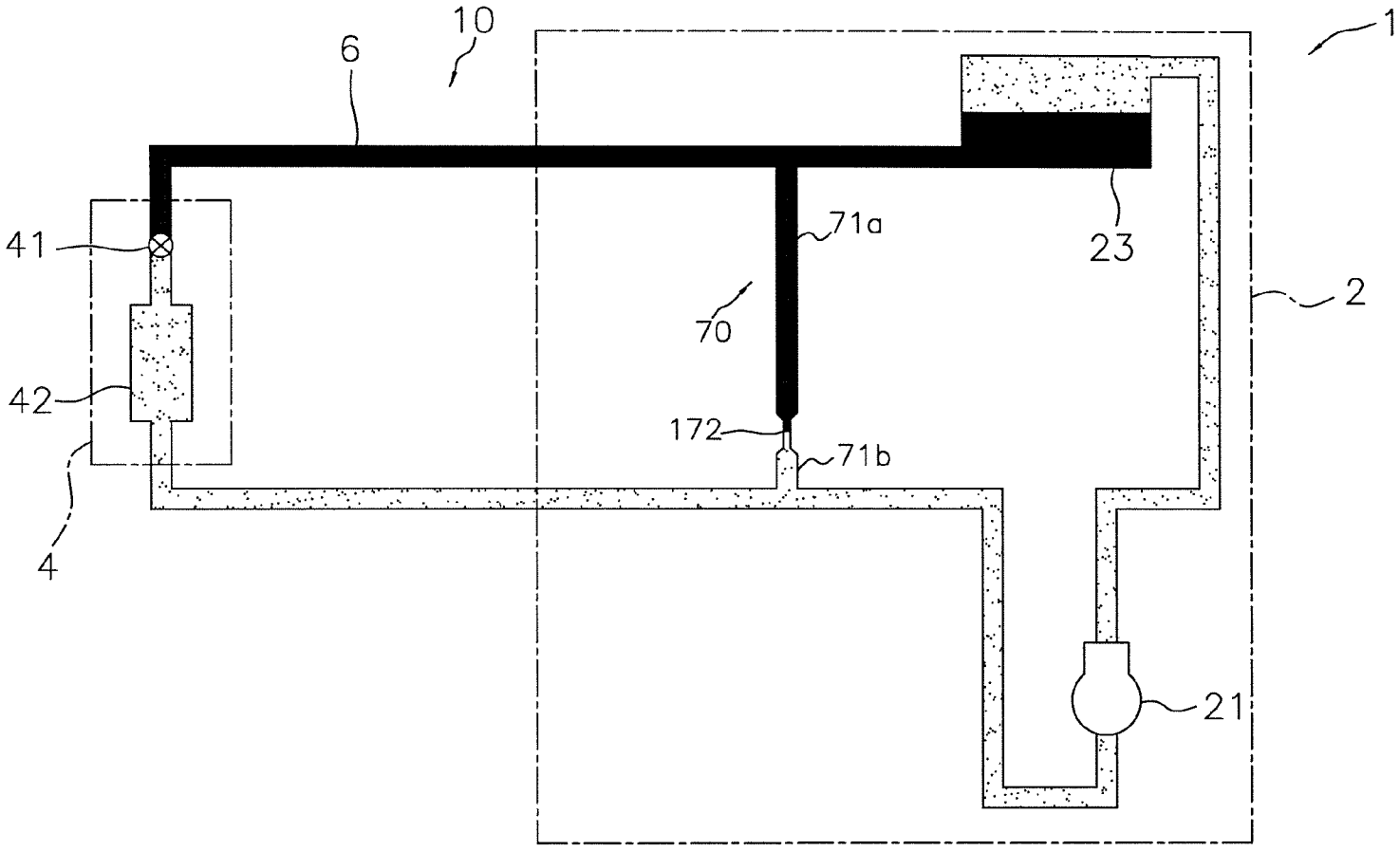
FIG. 11 is an illustrative diagram of a variation in which the liquid refrigerant accumulates in another portion in a case in which the liquid refrigerant accumulates in the outdoor heat exchanger of modification (A) of the first embodiment.

This capillary tube 172 is not directly controlled by the controller 9, as shown in FIG. 10. Due to the difference between the high pressure in the liquid refrigerant connection pipe 6 and the low pressure in the gas refrigerant connection pipe 7, the liquid refrigerant inside the high-pressure side liquid bypass pipe 71*a* of the liquid bypass circuit 170 flows through the capillary tube 172 to the low-pressure side liquid bypass pipe 71*b*, as shown in FIG. 11. Liquid refrigerant is thereby supplied to the compressor 21. In this manner, temperature increases in the discharge pipe of the compressor 21 can be indirectly suppressed.

(B)

In the previous embodiment, examples were described in which the four-way switching valve 22 of the refrigerant circuit 10 was placed in the connected state of the cooling operation during the proper refrigerant quantity charging operation and the refrigerant leak detection operation, and the operation for accumulating liquid refrigerant was performed.

However, the present invention is not limited to this option alone; another possibility is to place the four-way switching valve 22 of the refrigerant circuit 10 in the connected state of the heating operation, the proper refrigerant quantity charging operation and the refrigerant leak detection operation so that liquid refrigerant is accumulated. Specifically, the liquid level detection sensor 39 is provided to the indoor heat exchangers 42, and an operation is performed for accumulating liquid refrigerant inside the indoor expansion valves 41, the indoor equipment interconnection pipes 4*b*, and the indoor heat exchangers 42 in the heating operation circuit. In this case as well, it is possible to accurately determine the quantity of refrigerant and to determine whether or not there is a refrigerant leak by simple control, similar to the previous embodiment.

Unlike the first embodiment, in a refrigerant circuit in which indoor expansion valves 41 are not provided and the outdoor expansion valve 38 is provided between the outdoor heat exchanger 23 and the indoor heat exchangers 42, precise charging and leak detection can be performed even if the outdoor unit 2 and the indoor units 4 are disposed far apart from each other, due to the liquid refrigerant being accumulated through the heating operation.

(C)

In the previous embodiment, an example was described in which the liquid refrigerant density corresponding to the temperature detected by the liquid pipe temperature sensor 35 was multiplied by the perceived liquid refrigerant volume so that the quantity of refrigerant could be calculated from the density of the liquid refrigerant corresponding to temperature for the liquid refrigerant being detected.

However, the present invention is not limited to this option alone; another possibility, in cases in which the properties of the refrigerant cause the temperature to fall extremely close to the surrounding temperature, for example, is to use the temperature detected by the outdoor temperature sensor 36 rather than the liquid pipe temperature sensor 35.

(D)

In the previous embodiment, an example was described in which all of the refrigerant present inside the refrigerant circuit 10 was a target and was changed to a liquid state and collected in one location.

However, the present invention is not limited to this option alone; another possibility is to divide the refrigerant inside the refrigerant circuit 10 to a plurality of locations rather than collecting the refrigerant in a single location, for example.

Figure 12:
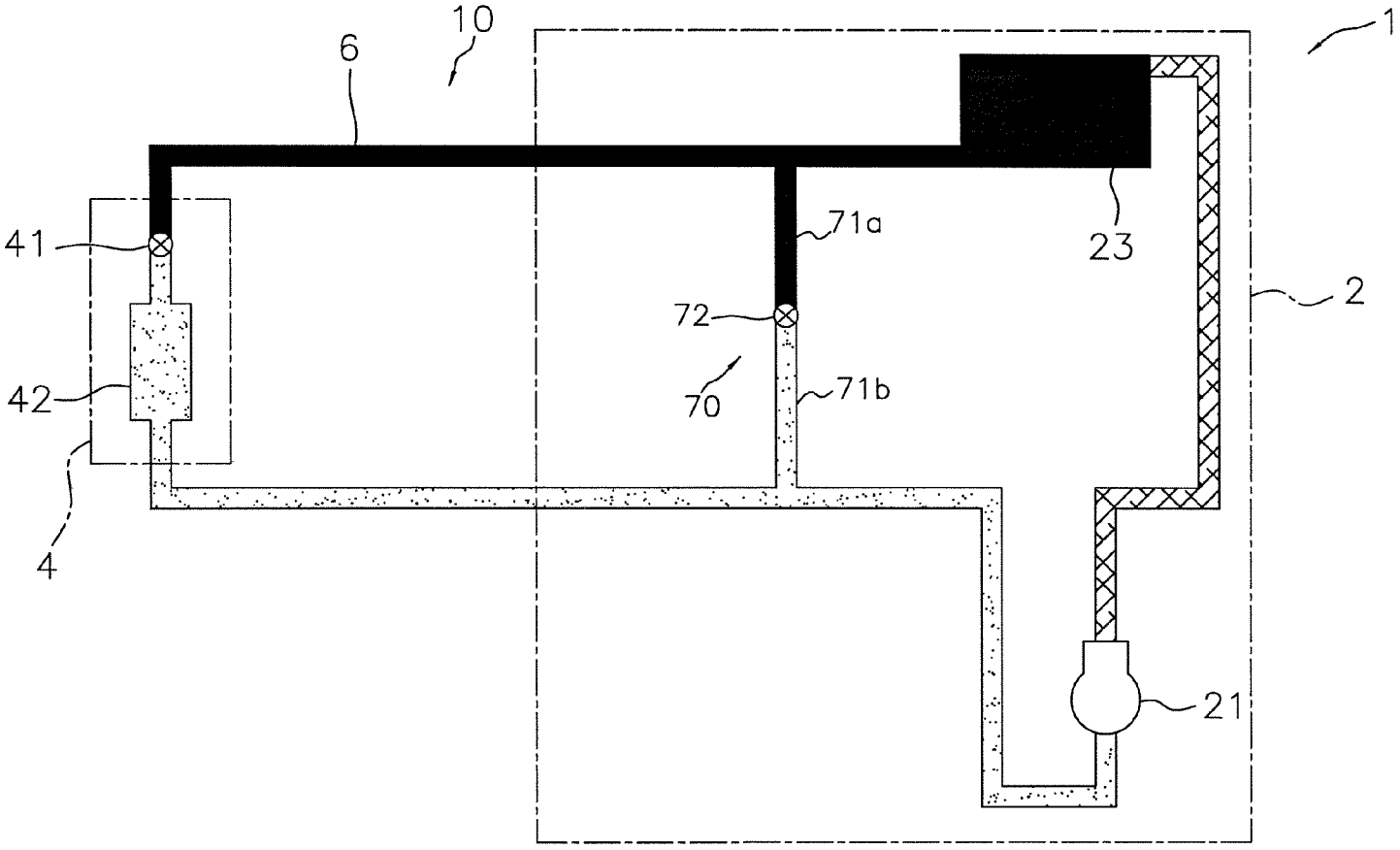
FIG. 12 is a schematic diagram showing the refrigerant overflowing in modification (D) of the first embodiment.

For example, depending on the type of refrigerant used in the air conditioning apparatus 1, there is a risk that not all of the refrigerant inside the refrigerant circuit 10 will collect without fail between the indoor expansion valves 41 and the upstream end of the outdoor heat exchanger 23, including the outdoor heat exchanger 23 itself, as shown in FIG. 12. In this case, a gas refrigerant of comparatively high density remains between the compressor 21 and the outdoor heat exchanger 23 and cannot be included in the refrigerant being detected.

Figure 13:
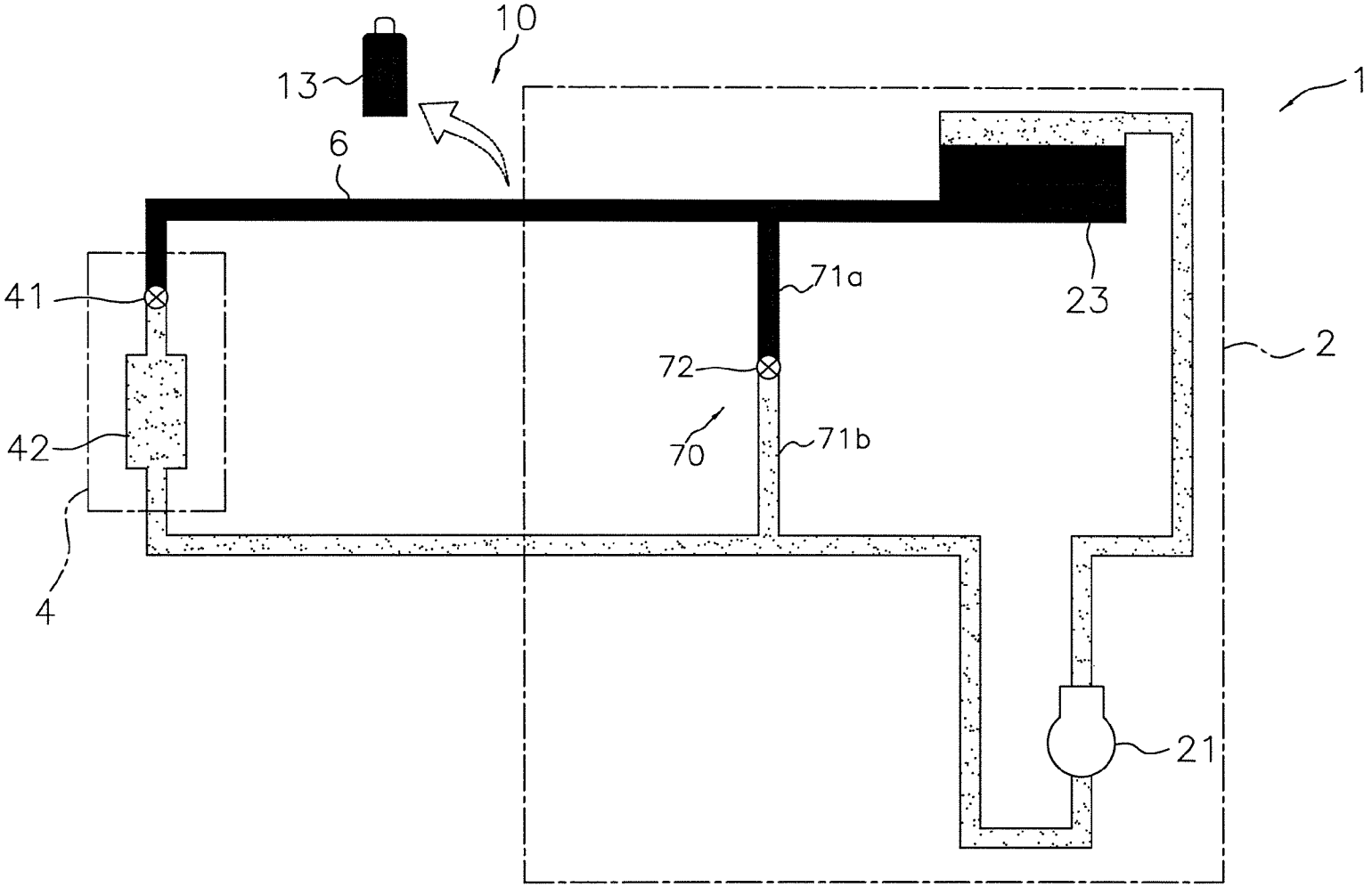
FIG. 13 is an illustrative diagram of a determination using the partial refrigerant recovery tank of modification (D) of the first embodiment.

In such a case, some of the entire amount of refrigerant throughout the refrigerant circuit 10 may be recovered by connecting a partial refrigerant recovery tank 13 to the refrigerant circuit 10, as shown in FIG. 13. In this manner, even in cases in which not all of the refrigerant inside the refrigerant circuit 10 can be collected between the indoor expansion valves 41 and the upstream end of the outdoor heat exchanger 23, including the outdoor heat exchanger 23 itself, using the partial refrigerant recovery tank 13 makes it possible to position the liquid level at the time of determination in a position where detection by the liquid level detection sensor 39 is possible. It is thereby possible to perform the proper refrigerant quantity charging operation, the refrigerant leak detection operation, and the determinations without being limited by the type or makeup of the refrigerant of the air conditioning apparatus 1.

(E)

In the first embodiment, cross-fin type fin-and-tube heat exchangers were described as examples of the outdoor heat exchanger 23 and the indoor heat exchangers 42, but the heat exchangers are not limited to such and other types of heat exchangers may be used.

In the first embodiment, a case in which a single compressor was provided was presented as an example of the compressor 21, but the present invention is not limited to this option alone; another possibility is to connect two or more compressors in parallel, depending on the number of indoor units connected.

In the first embodiment, a case of a subcooling expansion pipe 6*d* branching from a position between the outdoor expansion valve 38 and the subcooler 25 was presented as an example of the subcooling refrigerant pipe 61, but the present invention is not limited to this option alone; another possibility is that the subcooling expansion pipe 6*d* branch from a position between the outdoor expansion valve 38 and the liquid-side stop valve 26.

In the first embodiment, a setup was presented as an example of the header 23*b* and the distributor 23*c* in which the two components were provided on opposite side ends of the heat exchanger body 23*a*, but another possibility is to provide the header 23*b* and the distributor 23*c* on the same end side of the heat exchanger body 23*a*.

(F)

In the first embodiment, an example was described in which the degree of superheating of the refrigerant in the outlet of the indoor heat exchangers 42 during the cooling operation or the like was detected by subtracting the refrigerant temperature value (corresponding to the evaporation temperature) detected by the liquid-side temperature sensors 44 from the refrigerant temperature value detected by the gas-side temperature sensors 45.

However, the present invention is not limited to this option alone; another option, for example, is to detect the degree of superheating by converting the suction pressure of the compressor 21 detected by the suction pressure sensor 29 to a saturation temperature value corresponding to the evaporation temperature, and subtracting this refrigerant saturation temperature value from the refrigerant temperature value detected by the gas-side temperature sensors 45.

Furthermore, as another detection method, an another temperature sensor for detecting the temperature of the refrigerant flowing through the insides of the indoor heat exchangers 42 may be provided, and the degree of superheating may be detected by subtracting the refrigerant temperature value corresponding to the evaporation temperature detected by this temperature sensor from the refrigerant temperature value detected by the gas-side temperature sensors 45.

In the first embodiment, an example was described in which the degree of subcooling of the refrigerant in the outlets of the indoor heat exchangers 42 during the heating operation was detected by converting the discharge pressure of the compressor 21 detected by the discharge pressure sensor 30 to a saturation temperature value corresponding to the condensation temperature, and subtracting the refrigerant temperature value detected by the liquid-side temperature sensors 44 from this refrigerant saturation temperature value.

However, the present invention is not limited to this option alone; another option, for example, is to provide a temperature sensor for detecting the temperature of the refrigerant flowing through the insides of the indoor heat exchangers 42, and to detect the degree of subcooling by subtracting the refrigerant temperature value corresponding to the condensation temperature detected by this temperature sensor from the refrigerant temperature value detected by the liquid-side temperature sensors 44.

(G)

In the first embodiment, a method for calculating the quantity of liquid refrigerant was described as an example of the determination of the refrigerant leak detection.

However, the present invention is not limited to this option alone; another option, for example, is to determine beforehand a reference liquid level height H corresponding to the optimal refrigerant quantity according to the temperature of the liquid refrigerant, and to store this height in the memory 19. There is thereby no longer a need to compute the quantity of refrigerant in the previous embodiment, and refrigerant leak detection can be performed by directly comparing the detection liquid level height h being detected with a reference liquid level height H as an index.

(H)

In the embodiment described above, an example was described in which the liquid refrigerant was stabilized at approximately the surrounding temperature to detect the volume of the refrigerant.

Figure 14:
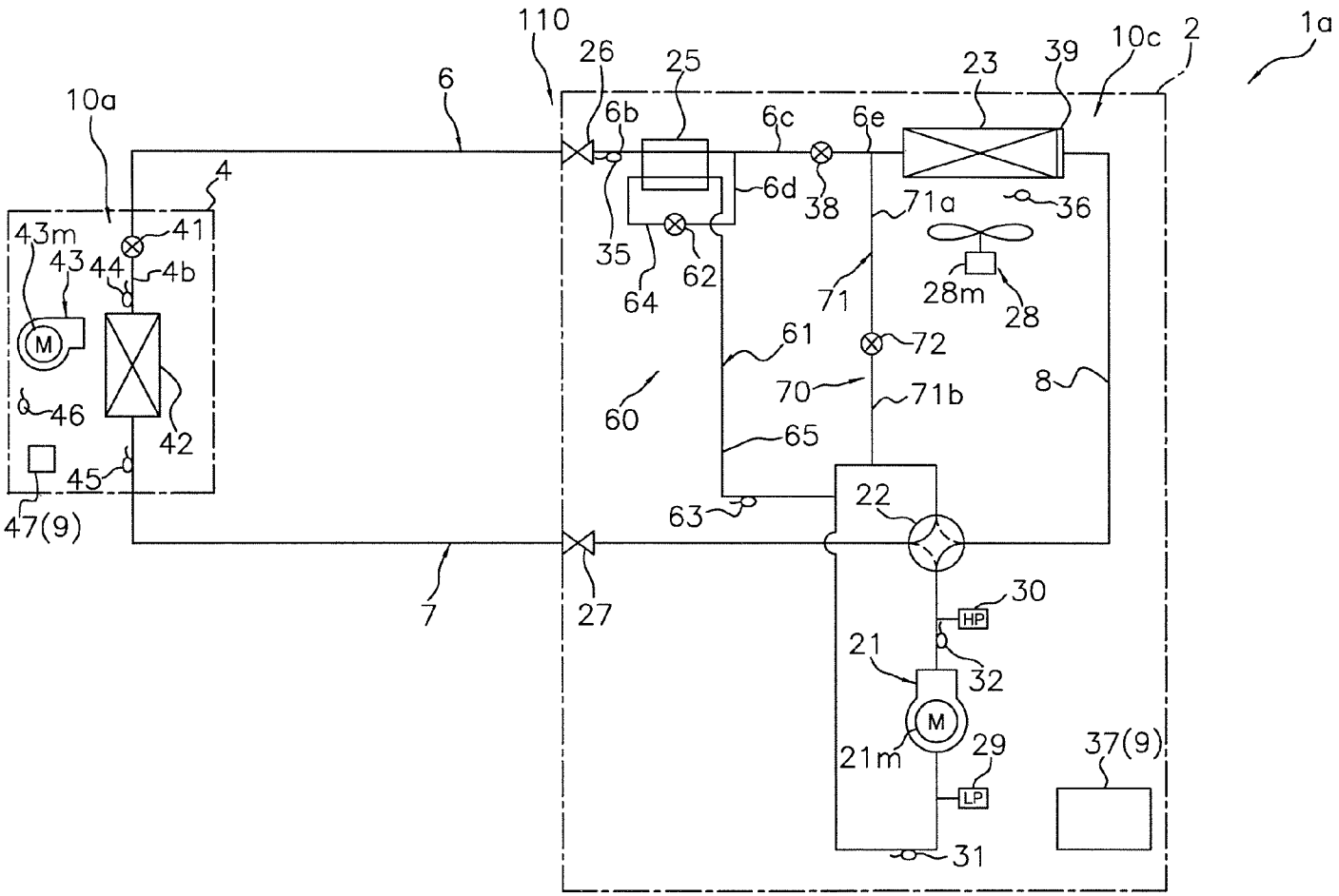
FIG. 14 is a general configuration diagram of the air conditioning apparatus of modification (H) of the first embodiment.

However, the present invention is not limited to this option alone; another option, for example, is to use a configuration such as that of the air conditioning apparatus 1*a* shown in FIG. 14, which uses a refrigerant circuit 110. According to this air conditioning apparatus 1*a*, the above-described proper refrigerant quantity charging operation, refrigerant leak detection operation, and determinations can be performed in temperature conditions different from the surrounding temperature.

The refrigerant circuit 110 is described hereinbelow with focus on the differences from the first embodiment described above.

(Refrigerant Circuit 110)

In addition to the configuration of the refrigerant circuit 10 of the first embodiment described above, this refrigerant circuit 110 is provided with an outdoor expansion valve 38, a subcooler 25 as a temperature regulation mechanism, a subcooling refrigerant circuit 60, a liquid-side stop valve 26, a gas-side stop valve 27, an outdoor heat exchange expansion interconnection pipe 6*e*, an outdoor expansion subcooling interconnection pipe 6*c*, and an outdoor subcooling liquid-side stop interconnection pipe 6*b*, as shown in FIG. 14.

The outdoor expansion valve 38 is a motor-driven expansion valve disposed on the downstream side of the outdoor heat exchanger 23 in the direction that refrigerant flows in the refrigerant circuit 110 during the cooling operation. The outdoor expansion valve 38 is connected to the liquid side of the outdoor heat exchanger 23 in the present modification. The outdoor expansion valve 38 can thereby regulate the pressure, flow rate, and other characteristics of the refrigerant flowing through the inside of the outdoor-side refrigerant circuit 10*c*. The outdoor expansion valve 38 is also capable of blocking the passage of refrigerant in this position.

The subcooler 25 is provided between the outdoor expansion valve 38 and the liquid-side stop valve 26. The subcooler 25 is either a double pipe heat exchanger, or a pipe heat exchanger configured by bringing a hereinafter-described subcooling refrigerant pipe 61 in contact with the refrigerant pipe through which flows the refrigerant condensed in the outdoor heat exchanger 23 as a heat source-side heat exchanger. In this manner, by performing heat exchange while preventing refrigerant mixing between the refrigerant condensed in the outdoor heat exchanger 23 as a heat source-side heat exchanger and the refrigerant flowing through the hereinafter-described subcooling refrigerant circuit 60, the refrigerant condensed in the outdoor heat exchanger 23 and sent to the indoor expansion valves 41 can be further cooled.

The subcooling refrigerant circuit 60 functions as a cooling source for cooling refrigerant in the subcooler 25, where in the refrigerant is sent from the outdoor heat exchanger 23 to the indoor expansion valves 41. This subcooling refrigerant circuit 60 has the subcooling refrigerant pipe 61 and a subcooling expansion valve 62. The subcooling refrigerant pipe 61 is a pipe connected so as to branch some of the refrigerant sent from the outdoor heat exchanger 23 to the indoor expansion valves 41, to allow the refrigerant to pass through the subcooler 25 described above, and to return the refrigerant to the suction side of the compressor 21. This subcooling refrigerant pipe 61 includes the subcooling expansion pipe 6*d*, a subcooling branching pipe 64, and a subcooling merging pipe 65. The subcooling expansion pipe 6*d* branches some of the refrigerant sent from the outdoor expansion valve 38 to the indoor expansion valves 41 from a position between the outdoor heat exchanger 23 and the subcooler 25, and extends so as to connect to the subcooling expansion valve 62. The subcooling branching pipe 64 interconnects the subcooling expansion valve 62 and the subcooler 25. The subcooling merging pipe 65 is connected to the suction side of the compressor 21 so as to return from the outlet of the subcooler 25 on the subcooling refrigerant circuit 60 side to the suction side of the compressor 21. The subcooling expansion valve 62 is located between the subcooling expansion pipe 6*d* and the subcooling branching pipe 64, interconnecting the two pipes, and is a motor-driven expansion valve which functions as a communication pipe expansion mechanism for regulating the flow rate of refrigerant passing through.

The subcooling refrigerant pipe 61 branches some of the refrigerant sent from the outdoor heat exchanger 23 to the indoor expansion valves 41 at the subcooling expansion pipe 6*d*, and feeds the refrigerant depressurized by the subcooling expansion valve 62 to the subcooler 25 through the subcooling branching pipe 64. Heat exchange can thereby be performed in the subcooler 25 between the refrigerant depressurized by passing through the subcooling expansion valve 62 and the refrigerant sent from the outdoor heat exchanger 23 to the indoor expansion valves 41 through the liquid refrigerant connection pipe 6. The refrigerant sent from the outdoor heat exchanger 23 to the indoor expansion valves 41 is thereby cooled in the subcooler 25 by the refrigerant flowing through the subcooling refrigerant pipe 61 after being depressurized by the subcooling expansion valve 62. In other words, ability control in the subcooler 25 can be performed by regulating the opening degree of the subcooling expansion valve 62.

The subcooling refrigerant pipe 61 also functions as a communication pipe for connecting the portion of the refrigerant circuit 110 between the liquid-side stop valve 26 and the outdoor expansion valve 38 with the portion on the suction side of the compressor 21, as will be described hereinafter.

The liquid-side stop valve 26 is a valve provided to the interconnection port between the liquid refrigerant connection pipe 6, which is an external component, and the outdoor unit 2. The liquid-side stop valve 26 is disposed on the downstream side of the subcooler 25 and the upstream side of the liquid refrigerant connection pipe 6 in the direction that refrigerant flows in the refrigerant circuit 10 during the cooling operation, and is capable of blocking the passage of refrigerant.

The gas-side stop valve 27 is a valve provided to the interconnection port between the gas refrigerant connection pipe 7, which is an external component, and the outdoor unit 2. The gas-side stop valve 27 is connected to the four-way switching valve 22.

The outdoor heat exchange expansion interconnection pipe 6*e* interconnects the outdoor heat exchanger 23 and the outdoor expansion valve 38. The outdoor expansion subcooling interconnection pipe 6*c* interconnects the outdoor expansion valve 38 and the subcooler 25. The outdoor subcooling liquid-side stop interconnection pipe 6*b* interconnects the subcooler 25 and the liquid-side stop valve 26.

The outdoor unit 2 is provided with various sensors other than the liquid level detection sensor 39 described above. Specifically, the outdoor unit 2 is provided with a liquid pipe temperature sensor 35 for detecting the temperature of the refrigerant directed to the indoor heat exchangers 42 from the subcooler 25 (that is, the liquid-pipe temperature). The subcooling merging pipe 65 of the subcooling refrigerant pipe 61 is provided with a subcooling temperature sensor 63 for detecting the temperature of the refrigerant flowing through the outlet on the bypass refrigerant pipe side of the subcooler 25. The liquid pipe temperature sensor 35 and the subcooling temperature sensor 63 are configured from thermistors. These sensors are controlled by the controller 9.

Various types of data are stored in the memory 19 which is readably connected to the controller 9. The various types of data stored include the volume of the interior of the pipes including the high-pressure side liquid bypass pipe 71*a* and the outdoor heat exchange expansion interconnection pipe 6*e* extending from the outdoor expansion valve 38 to the outdoor heat exchanger 23, a relational expression for calculating the quantity of refrigerant accumulating the outdoor heat exchanger 23 from the liquid level height h detected by the liquid level detection sensor 39, the volume of the interior of the pipe located on the upstream side of the indoor expansion valves 41 and extending to the liquid-side stop valve 26 in the refrigerant circuit 10, liquid refrigerant density data according to temperature conditions, and the proper refrigerant quantity of the refrigerant circuit 110 of the air conditioning apparatus 1*a* per property where pipe length and other factors have been considered after being installed in a building.

(Cooling Operation)

In the above-described refrigerant circuit 110 during the cooling operation, the four-way switching valve 22 is in the state shown by the solid lines in FIG. 14, that is, a state in which the discharge side of the compressor 21 is connected to the gas side of the outdoor heat exchanger 23, and the suction side of the compressor 21 is connected to the gas sides of the indoor heat exchangers 42 via the gas-side stop valve 27 and the gas refrigerant connection pipe 7. The outdoor expansion valve 38 is in a completely open state. The liquid-side stop valve 26 and the gas-side stop valve 27 are in open states. By regulating the opening degrees of the indoor expansion valves 41, the controller 9 performs control so that the degree of superheating of the refrigerant in the outlets of the indoor heat exchangers 42 (that is, the gas sides of the indoor heat exchangers 42) is constant at a degree of superheating target value. The liquid bypass expansion valve 72 is in a completely closed state. The degree of superheating of the refrigerant in the outlets of the indoor heat exchangers 42 is detected by subtracting the refrigerant temperature values (corresponding to the evaporation temperature) detected by the liquid-side temperature sensors 44 from the refrigerant temperature values detected by the gas-side temperature sensors 45. The opening degree of the subcooling expansion valve 62 is regulated (hereinbelow referred to as degree of superheating control) so that the degree of superheating of the refrigerant in the outlet on the subcooling refrigerant pipe 61 side of the subcooler 25 becomes the degree of superheating target value. The degree of superheating of the refrigerant in the subcooling refrigerant pipe 61 in the suction side of the compressor 21 after passing through the subcooler 25 is detected by converting the suction pressure of the compressor 21 detected by the suction pressure sensor 29 to a saturation temperature value corresponding to the evaporation temperature and subtracting this refrigerant saturation temperature value from the refrigerant temperature value detected by the subcooling temperature sensor 63.

When the compressor 21, the outdoor fan 28, and the indoor fans 43 are operated in this state of the refrigerant circuit 10, low-pressure gas refrigerant is sucked into the compressor 21 and is compressed into high-pressure gas refrigerant. Thereafter, the high-pressure gas refrigerant is sent through the four-way switching valve 22 to the outdoor heat exchanger 23. In the outdoor heat exchanger 23, the high-pressure gas refrigerant performs heat exchange with the outdoor air supplied by the outdoor fan 28, condenses, and becomes high-pressure liquid refrigerant. This high-pressure liquid refrigerant flows through the outdoor expansion valve 38 into the subcooler 25, performs heat exchange with the refrigerant flowing through the subcooling refrigerant pipe 61, and further cools to reach a subcooled state. At this time, some of the high-pressure liquid refrigerant condensed in the outdoor heat exchanger 23 is branched to the subcooling refrigerant pipe 61 and depressurized by the subcooling expansion valve 62, after which the refrigerant is returned to the suction side of the compressor 21. The refrigerant passing through the subcooling expansion valve 62 is depressurized to approximately the suction pressure of the compressor 21, whereby some of the refrigerant evaporates. The refrigerant flowing from the subcooling expansion valve 62 of the subcooling refrigerant pipe 61 toward the suction side of the compressor 21 passes through the subcooler 25 and performs heat exchange with the high-pressure liquid refrigerant sent from the outdoor heat exchanger 23 to the indoor units 4.

The high-pressure liquid refrigerant brought to a subcooled state by passing through the subcooler 25 is sent to the indoor units 4 via the liquid-side stop valve 26 and the liquid refrigerant connection pipe 6.

The high-pressure liquid refrigerant sent to the indoor units 4 is depressurized by indoor expansion valves 411 to approximately the suction pressure of the compressor 21, becoming low-pressure gas-liquid two-phase refrigerant.

This refrigerant is sent to the indoor heat exchangers 42, performs heat exchange with the room air in the indoor heat exchangers 42, and evaporates to become low-pressure gas refrigerant.

This low-pressure gas refrigerant is sent to the outdoor unit 2 via the gas refrigerant connection pipe 7. The low-pressure gas refrigerant sent to the outdoor unit 2 is again sucked into the compressor 21 via the gas-side stop valve 27 and the four-way switching valve 22.

The air conditioning apparatus 1*a* is thus capable of performing as one form of an operation mode a cooling operation in which the outdoor heat exchanger 23 is made to function as a condenser of the refrigerant compressed in the compressor 21 and the indoor heat exchangers 42 are made to function as evaporators of the refrigerant.

Figure 15:
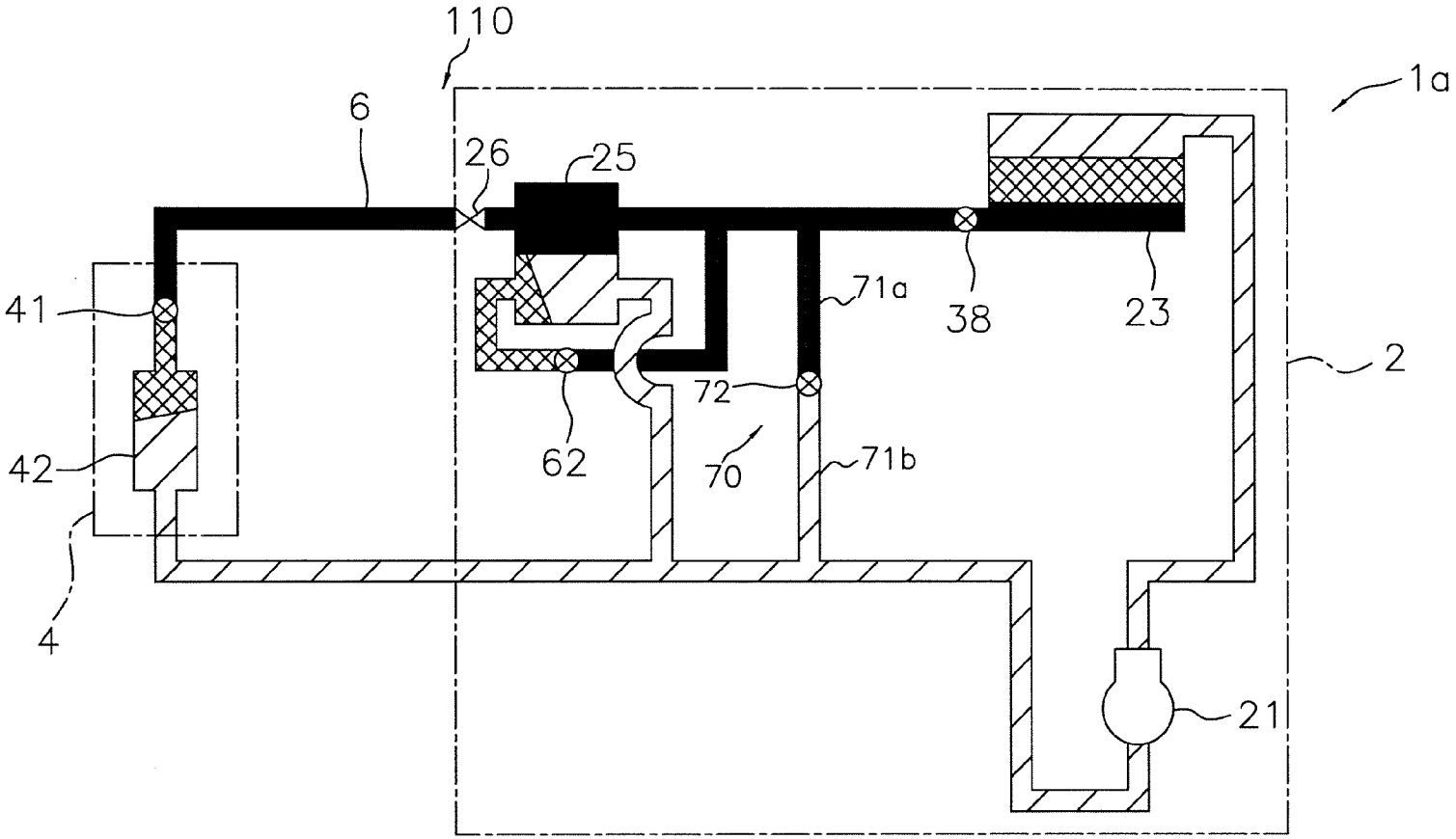
FIG. 15 is a schematic diagram showing states of refrigerant flowing through the inside of a refrigerant circuit during the cooling operation of modification (H) of the first embodiment.

Here, the distribution state of the refrigerant in the refrigerant circuit 110 when performing the cooling operation in the normal operation mode is such that, as shown in FIG. 15 which is a schematic view showing the state of the refrigerant flowing through the refrigerant circuit 110 during the cooling operation, the refrigerant takes each of the states of a liquid state (the filled-in hatching portion in FIG. 15), a gas-liquid two-phase state (the grid-like hatching portions in FIG. 15) and a gas state (the diagonal line hatching portion in FIG. 15). Specifically, the part of the refrigerant circuit 10 filled with liquid refrigerant contains the portion extending from the vicinity of the outlet of the outdoor heat exchanger 23 via the outdoor expansion valve 38, including the outdoor heat exchange expansion interconnection pipe 6*e* and the high-pressure side liquid bypass pipe 71*a*, and reaching the indoor expansion valves 41 via the liquid-side stop valve 26 portion of the subcooler 25 and the liquid refrigerant connection pipe 6; as well as the portion of the subcooling refrigerant pipe 61 upstream of the subcooling expansion valve 62. The parts of the refrigerant circuit 10 filled with the gas-liquid two-phase refrigerant are the portion in the middle of the outdoor heat exchanger 23, the portion of the subcooling refrigerant pipe 61 on the upstream side of the subcooling expansion valve 62, the portion of the subcooler 25 on the side facing the subcooling refrigerant circuit 60 and in proximity to the inlet, and the portions in proximity to the inlets of the indoor heat exchangers 42. The parts of the refrigerant circuit 10 filled with the gas-state refrigerant are the portions extending from the middles of the indoor heat exchangers 42 to the inlet of the outdoor heat exchanger 23 via the gas refrigerant connection pipe 7 and the compressor 21, the portion in proximity to the inlet of the outdoor heat exchanger 23, the portion extending from the middle portion of the subcooler 25 on the side facing the bypass refrigerant pipe to the merger between the subcooling refrigerant pipe 61 and the suction side of the compressor 21, and the portion of the low-pressure side liquid bypass pipe 71*b*.

(Proper Refrigerant Quantity Automatic Charging Operation Mode and Refrigerant Leak Detection Operation Mode)

In the present modification, a proper refrigerant quantity automatic charging operation mode for discerning the end of refrigerant charging and a refrigerant leak detection operation mode for discerning the presence or absence of a refrigerant leak are automatically performed.

The proper refrigerant quantity automatic charging operation mode and the refrigerant leak detection operation mode of the present modification resemble the cooling operation as well as the temperature stabilization control by the refrigerant circuit 10 in step S5 of the proper refrigerant quantity charging operation mode of the first embodiment, but differ in the following aspects.

During liquid temperature stabilization control by the refrigerant circuit 110, condensation pressure control and liquid pipe temperature control are performed while the liquid bypass expansion valve 72 is in a completely closed state.

In condensation pressure control, the controller 9 controls the quantity of outdoor air supplied to the outdoor heat exchanger 23 by the outdoor fan 28 so that the condensation pressure of the refrigerant in the outdoor heat exchanger 23 becomes constant. Since the condensation pressure of the refrigerant in the condenser varies greatly due to being affected by the outdoor temperature, the controller 9 controls the quantity of room air supplied to the outdoor heat exchanger 23 from the outdoor fan 28 by performing output control on the motor 28*m* in accordance with the temperature detected by the outdoor temperature sensor 36. The condensation pressure of the refrigerant in the outdoor heat exchanger 23 can thereby be kept constant, and the state of the refrigerant flowing within the condenser can be stabilized. The portion of the refrigerant circuit 110 from the outdoor heat exchanger 23 to the indoor expansion valves 41, that is, the high-pressure side liquid bypass pipe 71*a*, the outdoor heat exchange expansion interconnection pipe 6*e*, the outdoor expansion subcooling interconnection pipe 6*c*, the subcooling expansion pipe 6*d*, each of the outdoor subcooling liquid-side stop interconnection pipe 6*b* and the liquid refrigerant connection pipe 6 can be controlled to a state in which high-pressure liquid refrigerant flows. It is thereby possible to also stabilize the pressure of the refrigerant in the portions from the outdoor heat exchanger 23 to the indoor expansion valves 41 and to the subcooling expansion valve 62. In the condensation pressure control, the controller 9 performs control by using the discharge pressure of the compressor 21 detected by the discharge pressure sensor 30 as the condensation pressure.

In liquid pipe temperature control, unlike the degree of superheating control in the cooling operation of the normal operation mode described above, the ability of the subcooler 25 is controlled so that the temperature of the refrigerant sent from the subcooler 25 to the indoor expansion valves 41 becomes constant. More specifically, in liquid pipe temperature control, the controller 9 performs control for regulating the opening degree of the subcooling expansion valve 62 in the subcooling refrigerant pipe 61 so as to achieve stabilization at a liquid pipe temperature target value in the temperature of the refrigerant detected by the liquid pipe temperature sensor 35 provided to the outlet of the subcooler 25 on the side facing the stop interconnection pipe 6*b*. The refrigerant density in the refrigerant pipe including the liquid refrigerant connection pipe 6 extending from the outlet of the subcooler 25 on the side facing the stop interconnection pipe 6*b* to the indoor expansion valves 41 can be stabilized at a certain constant value.

The controller 9 continues this liquid temperature stabilization control until the change in the temperature detected by the liquid pipe temperature sensor 35 is maintained within a range of plus or minus 2° C. for five minutes, that is, until the temperature stabilizes.

Figure 16:
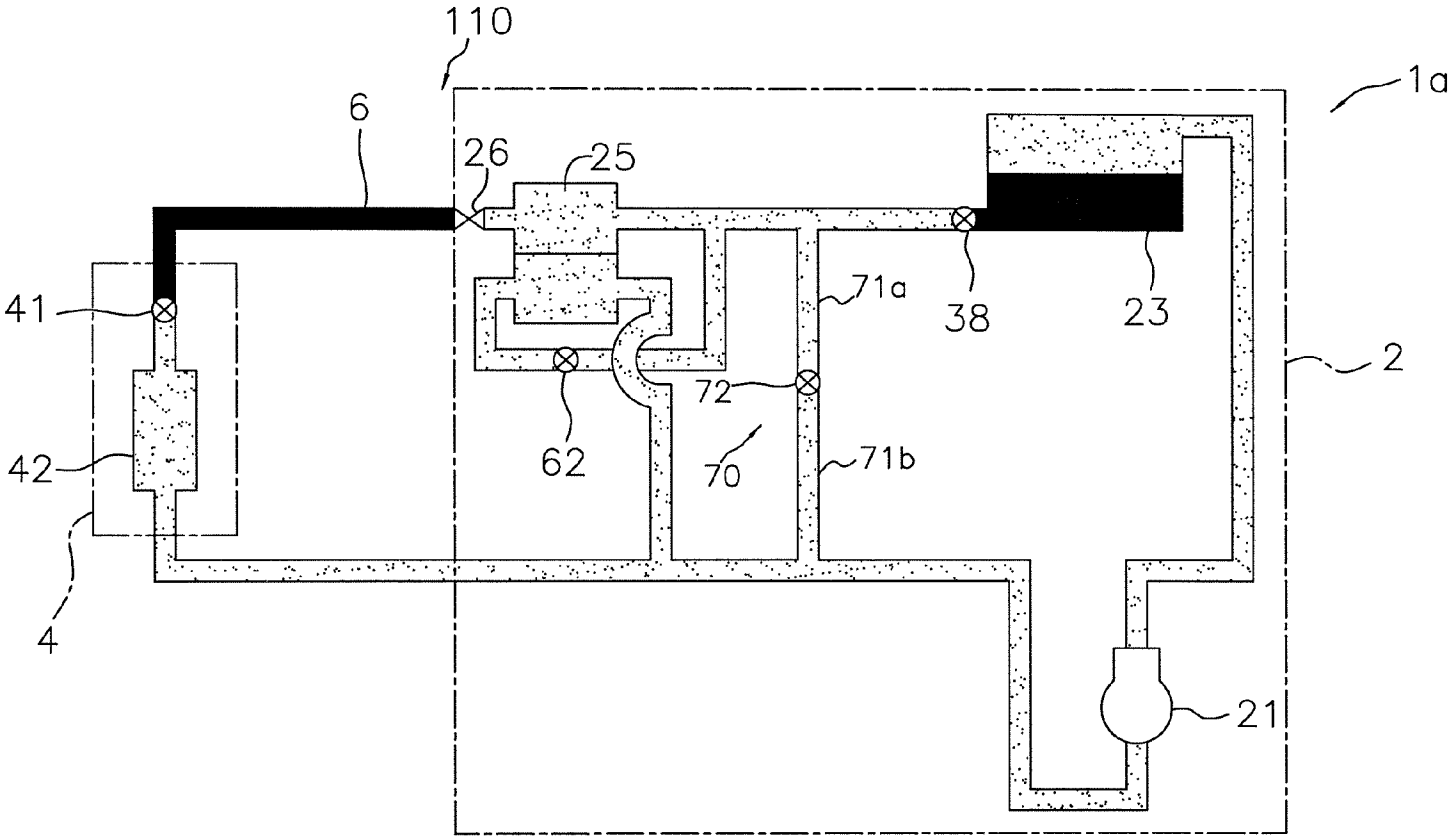
FIG. 16 is a diagram showing the liquid refrigerant accumulating in the outdoor heat exchanger of modification (H) of the first embodiment.

In cases in which it is determined that a stabilized state has been achieved by the liquid temperature stabilization control, the controller 9 performs stop control for completely closing the liquid-side stop valve 26 after the indoor expansion valves 41 have been completely closed. The liquid refrigerant between the indoor expansion valves 41 and the liquid-side stop valve 26 can thereby be defined as refrigerant which is controlled to a certain temperature by the liquid temperature stabilization control, and which has the volume of the pipe interior from the indoor expansion valves 41 to the liquid-side stop valve 26, as shown in FIG. 16. Specifically, the controller 9 reads volume data of the pipe interior in the refrigerant circuit 10 from the upstream side of the indoor expansion valves 41 to the liquid-side stop valve 26 as well as liquid refrigerant density data corresponding to temperature conditions, the data being stored in the memory 19. The controller 9 multiplies the liquid refrigerant density corresponding to the temperature detected by the liquid pipe temperature sensor 35 by the volume of the pipe interior from the upstream side of the indoor expansion valves 41 to the liquid-side stop valve 26, and the controller 9 can calculate a highly precise value for a liquid pipe fixed refrigerant quantity Y, which is the quantity of the liquid refrigerant inside the pipe from the indoor expansion valves 41 to the liquid-side stop valve 26. In this manner, even in cases in which the refrigerant quantity inside the refrigerant circuit 110 exceeds the capacity inside the outdoor heat exchanger 23, it is possible to determine a precise quantity of refrigerant which has been quantified by an accurate volume and an accurate liquid refrigerant density, at least for the refrigerant which has been controlled so as to be stopped.

The controller 9 then performs shut-off control for completely closing the outdoor expansion valve 38 after the stop control has been performed. From the refrigerant inside the refrigerant circuit 110, it is possible for the compressor 21 to suck in the refrigerant located in the portion from the indoor equipment interconnection pipe 4*b* sides of the indoor expansion valves 41 to the suction side of the compressor 21, and the refrigerant in the outdoor heat exchange expansion interconnection pipe 6*e*, the outdoor expansion subcooling interconnection pipe 6*c*, the subcooler 25, the outdoor subcooling liquid-side stop interconnection pipe 6*b*, and the refrigerant located in the portion from the subcooling refrigerant circuit 60 to the suction side of the compressor 21. The refrigerant in these portions can thereby be supplied as high-temperature high-pressure gas refrigerant to the outdoor heat exchanger 23 by the compressor 21. The high-temperature high-pressure gas refrigerant supplied to the outdoor heat exchanger 23 is condensed into a liquid refrigerant by heat exchange in the outdoor heat exchanger 23. Since circulation of the refrigerant is stopped by the shut-off control, the liquid refrigerant condensed inside the outdoor heat exchanger 23 accumulates on the side of the outdoor expansion valve 38 facing the outdoor heat exchange expansion interconnection pipe 6*e*. The refrigerant that has become a liquid state is lower than the uncondensed high-temperature high-pressure gas refrigerant inside the outdoor heat exchanger 23 due to gravity, and gradually accumulates from the bottom of the outdoor heat exchanger 23.

Since the quantity of refrigerant sucked in by the compressor 21 gradually decreases, the controller 9 slightly opens the valve opening degree of the liquid bypass expansion valve 72 and performs liquid return control. The discharge pipe temperature of the compressor 21 can thereby be prevented from increasing excessively.

When the liquid level height h detected by the liquid level detection sensor 39 stabilizes while the liquid return control continues, the controller 9 closes the liquid bypass expansion valve 72 and ends the liquid return control. The temperature of the discharge pipe of the compressor 21, which continues to increase after shut-off control until liquid level detection is performed, can thereby be suppressed.

Next, in order to wait until the quantity of liquid refrigerant accumulating in the outdoor heat exchanger 23 stabilizes, the controller 9 performs detection control for determining whether or not the liquid level height h detected by the liquid level detection sensor 39 has been maintained and stabilized within a range of plus or minus 2 cm for about 5 minutes.

When the liquid level height h is determined to have stabilized, the controller 9 detects the liquid level height h of the liquid refrigerant accumulating in the outdoor heat exchanger 23 through the liquid level detection sensor 39. The liquid level detection sensor 39 detects as the liquid level the boundary between the region where the refrigerant exists in a gas state and the region where the refrigerant exists as a liquid state. The controller 9 calculates the liquid level height h obtained by the liquid level detection sensor 39 (see FIG. 7) on the basis of the volume inside the outdoor heat exchange expansion interconnection pipe 6*e* from the outdoor expansion valve 38 to the outdoor heat exchanger 23, the relational expression of the liquid level height and the refrigerant quantity as pertains to the outdoor heat exchanger 23, and the temperature detected by the outdoor temperature sensor 36, which are stored in the memory 19. Specifically, a highly precise value can be calculated for a heat exchange refrigerant quantity X by calculating the sum of the refrigerant quantity obtained by multiplying the refrigerant density corresponding to the temperature detected by the outdoor temperature sensor 36 with the volume inside the outdoor heat exchange expansion interconnection pipe 6*e* from the outdoor expansion valve 38 to the outdoor heat exchanger 23, and the refrigerant quantity obtained by multiplying the refrigerant density corresponding to the temperature detected by the outdoor temperature sensor 36 with the refrigerant quantity obtained by substituting the liquid level height h detected by the liquid level detection sensor 39 into the relational expression of the liquid level height and the refrigerant quantity as pertains to the outdoor heat exchanger 23.

The controller 9 can accurately calculate the quantity of refrigerant inside the refrigerant circuit 110 by adding the liquid pipe fixed refrigerant quantity Y to the heat exchange refrigerant quantity X.

After the controller 9 has performed shut-off control in the proper refrigerant quantity automatic charging operation mode, the controller 9 thus continues the operation of the compressor 21 and the outdoor fan 28 until a condition is satisfied that the heat exchange refrigerant quantity X be the same as the value obtained by subtracting the liquid pipe fixed refrigerant quantity Y from the proper refrigerant quantity of the refrigerant circuit 110 of the air conditioning apparatus 1*a* per property where pipe length and other factors have been considered after being installed in a building, this proper refrigerant quantity being stored in the memory 19. When the heat exchange refrigerant quantity X has satisfied this condition, the controller 9 ends the automatic charging operation mode.

In the refrigerant leak detection operation mode, the controller 9 compares the sum of the heat exchange refrigerant quantity X and the liquid pipe fixed refrigerant quantity Y with the proper refrigerant quantity, which is stored in the memory 19, of the refrigerant circuit 110 of the air conditioning apparatus 1*a* per property where pipe length and other factors have been considered after being installed in a building. In cases in which the sum of the heat exchange refrigerant quantity X and the liquid pipe fixed refrigerant quantity Y does not meet the proper refrigerant quantity, the controller 9 determines that a refrigerant leak has occurred.

(Modifications of Modification H)

Figure 17:
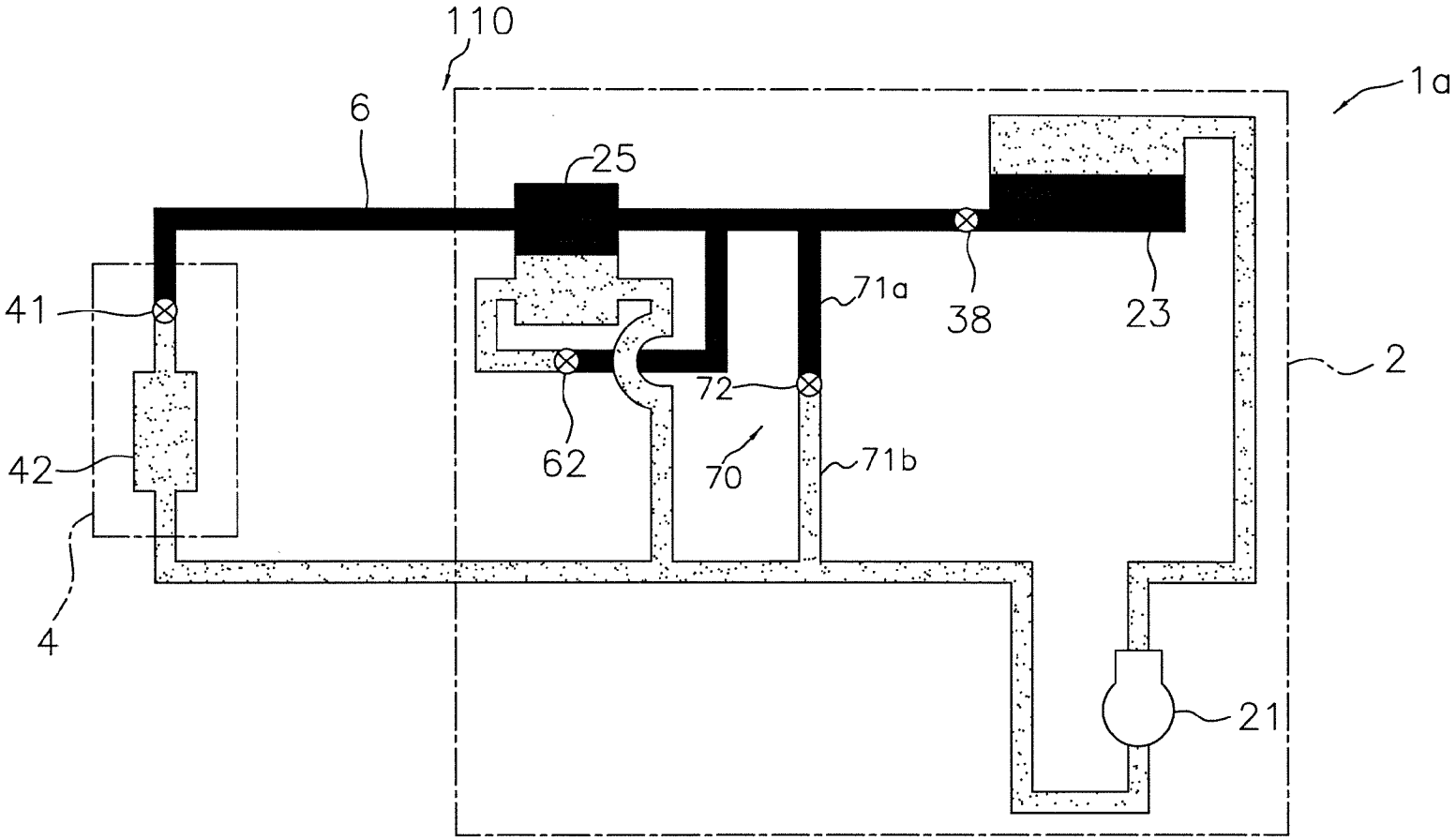
FIG. 17 is an illustrative diagram of a variation of a case in which liquid refrigerant is accumulated in the outdoor heat exchanger of modification (H) of the first embodiment, wherein the liquid refrigerant is accumulated in another portion.

In the stop control described above, the liquid refrigerant is stopped inside the pipe from the indoor expansion valves 41 to the liquid-side stop valve 26. However, the present invention is not limited to this option alone; another option is to stop the liquid refrigerant inside the pipe from the indoor expansion valves 41 to the outdoor expansion valve 38 and inside the pipe of the subcooling expansion pipe 6*d* which branches off and extends to the subcooling expansion valve 62, as shown in FIG. 17. In this case, the refrigerant inside the subcooling branching pipe 64 and the subcooling merging pipe 65, rather than the entire subcooling refrigerant circuit 60, is sucked into the compressor 21.

Figure 18:
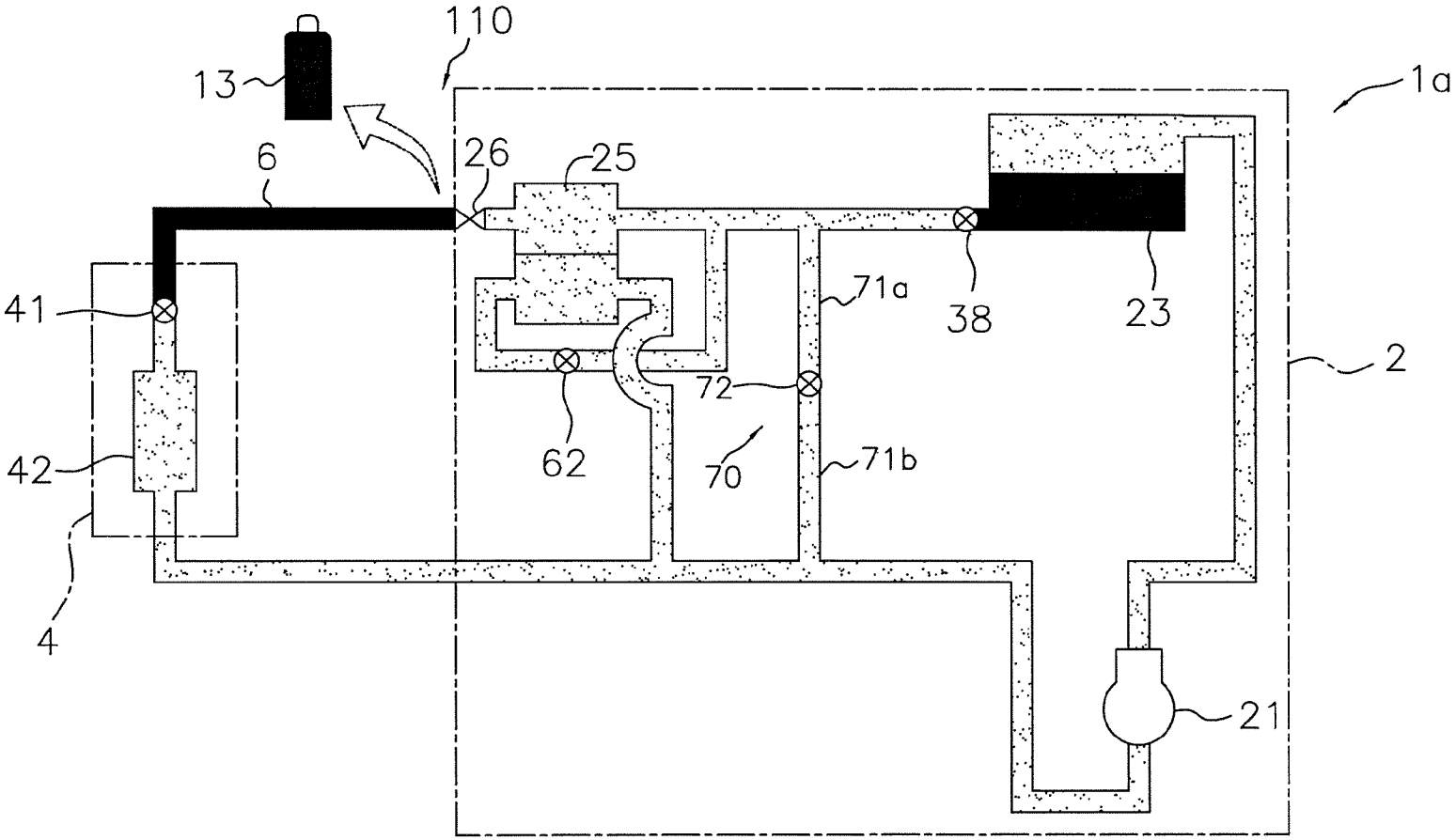
FIG. 18 is an illustrative diagram of a determination utilizing a partial refrigerant recovery tank of modification (H) of the first embodiment.

When the quantity of refrigerant in this type of refrigerant circuit 110 is determined, in cases in which all of the refrigerant in the refrigerant circuit 110 cannot be contained within the total volume between the volume inside the pipe from the indoor expansion valves 41 to the liquid-side stop valve 26 and the volume from the outdoor expansion valve 38 including the outdoor heat exchanger 23 itself, a partial refrigerant recovery tank 13 may be used as shown in FIG. 18, similar to modification (D) described above.

In modification (H) described above, an example was described in which the degree of superheating of the refrigerant in the suction side of the compressor 21 after passing through the subcooler 25 within the subcooling refrigerant pipe 61 is detected by converting the suction pressure of the compressor 21 detected by the suction pressure sensor 29 to a saturation temperature value corresponding to the evaporation temperature and subtracting this refrigerant saturation temperature value from the refrigerant temperature value detected by the subcooling temperature sensor 63. However, the present invention is not limited to this option alone; another option is to detect the degree of superheating of the refrigerant in the suction side of the compressor 21 after passing through the subcooler 25 within the subcooling refrigerant pipe 61 by providing another temperature sensor in the inlet on the bypass refrigerant pipe side of the subcooler 25, for example, and subtracting the refrigerant temperature value detected by this temperature sensor from the refrigerant temperature value detected by the subcooling temperature sensor 63.

Modification (H) above was described with reference to a case in which the controller 9 uses the discharge pressure of the compressor 21, detected by the discharge pressure sensor 30, as the condensation pressure during condensation pressure control, which is one type of control selected from the condensation pressure control and the liquid pipe temperature control carried out when liquid temperature stabilization control is performed. However, the present invention is not limited to this option alone; another option is to provide another temperature sensor for detecting the temperature of the refrigerant flowing within the outdoor heat exchanger 23, for example, to convert the refrigerant temperature value corresponding to the condensation temperature detected by the temperature sensor to a condensation pressure, and to use this condensation pressure in the condensation pressure control.

In modification (H) described above, the liquid-side stop valve 26 may be a manual valve, or an electromagnetic valve or another automatic valve which can be opened and closed by the controller 9. When the refrigerant quantity determination operation of modification (H) is performed, an opening/closing valve operated instead of the liquid-side stop valve 26 may be used, or the configuration may use an electromagnetic valve or another automatic valve capable of being opened and closed by the controller 9 and disposed between the liquid-side stop valve 26 and the subcooler 25.

In modification (H) described above, the configuration may have a receiver provided between the subcooler 25 and the outdoor expansion valve 38.

(I)

In modification (G) of the first embodiment, the air conditioning apparatus 1*a* employing the liquid bypass expansion valve 72 was described as an example.

Figure 19:
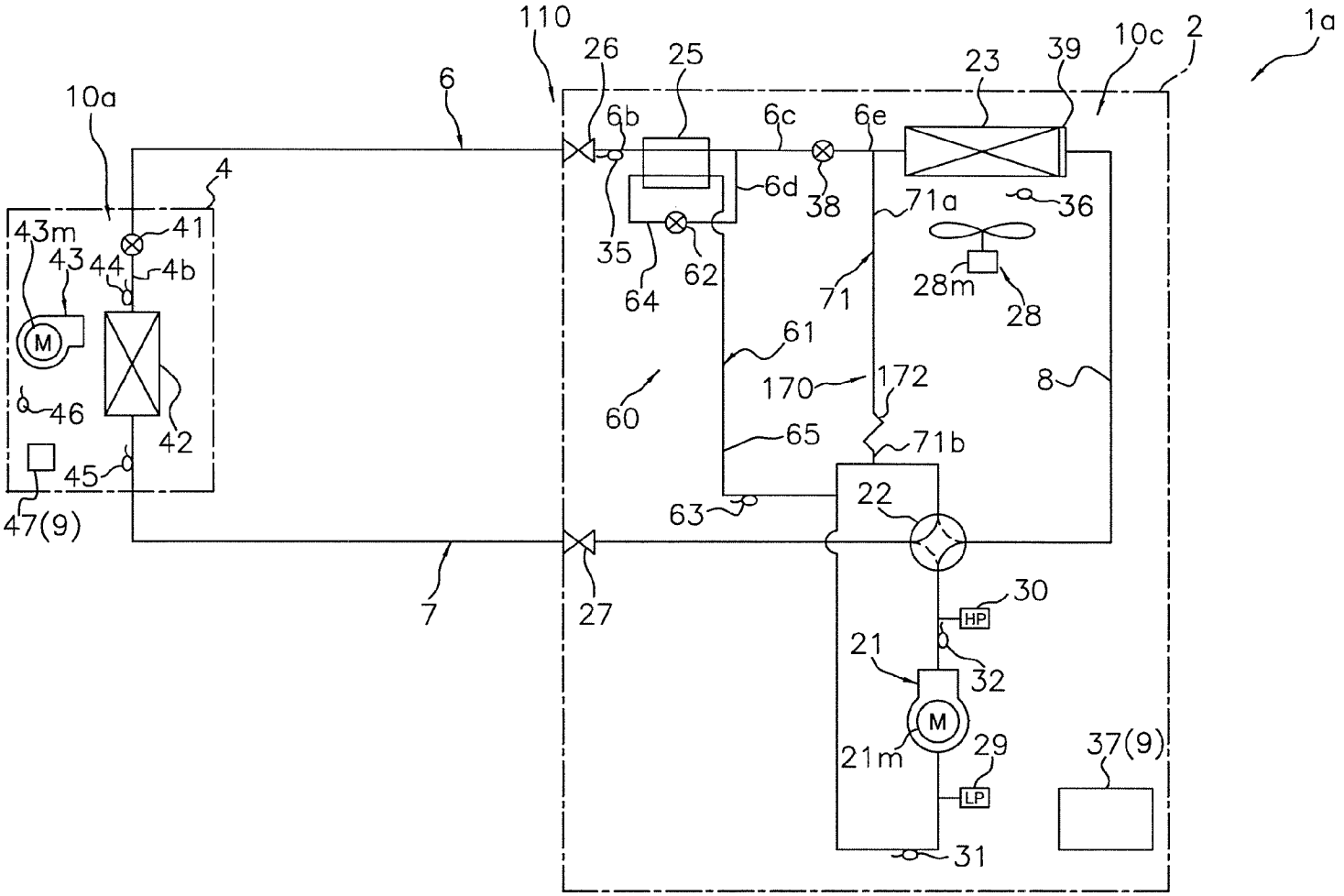
FIG. 19 is a general configuration diagram of an air conditioning apparatus employing a capillary tube of modification (I) of the first embodiment.

However, the present invention is not limited to this option alone; another option is an air conditioning apparatus that employs a liquid bypass circuit 170 which uses a capillary tube 172 as the liquid bypass expansion valve 72 in modification (G) of the first embodiment, as shown in FIG. 19, for example.

This capillary tube 172 is not directly controlled by the controller 9. The pressure difference between the high pressure in the liquid refrigerant connection pipe 6 and the low pressure in the gas refrigerant connection pipe 7 causes the liquid refrigerant inside the high-pressure side liquid bypass pipe 71*a* in the liquid bypass circuit 170 to pass through the capillary tube 172 and flow to the low-pressure side liquid bypass pipe 71*b*. Liquid refrigerant is thereby supplied to the compressor 21. Increases in the temperature of the discharge pipe of the compressor 21 can thus be indirectly suppressed.

(J)

In the first embodiment, an example was described of a case in which the liquid level height h is detected by the liquid level detection sensor 39 employed by the electric resistance detection member, from the difference between the electric resistance of the liquid-phase portion inside the outdoor heat exchanger 23 and the electric resistance of the gas-phase portion.

However, the present invention is not limited to this option alone; another option, for example, is a configuration in which the liquid level detection sensor 39 is disposed on the side surface of the outdoor heat exchanger 23 and on the upstream side of the liquid-side stop valve 26 in the direction that refrigerant flows in the refrigerant circuit 10 during the cooling operation, and the liquid level detection sensor 39 has thermistors disposed at different height positions along the height direction of the header 23*b* of the outdoor heat exchanger 23. Specifically, the liquid level detection sensor 39 detects as the liquid level height the boundary between the region where refrigerant exists in a gas state and the region where refrigerant exists in a liquid state, on the basis of the difference in the temperatures of these thermistors. When a temperature equal to or less than the saturation temperature is detected among the detected temperatures of the thermistors, the controller 9 determines that the refrigerant exists in a liquid state at the height where that thermistor is disposed. When a temperature exceeding the saturation temperature is detected among the detected temperatures of the thermistors, the controller 9 determines that the refrigerant exists in a gas state at the height where that thermistor is disposed. Thereby, since the thermistors of the liquid level detection sensor 39 detect the presence or absence of liquid refrigerant at a plurality of different height positions, the controller 9 can perceive that a liquid level exists at a position exceeding the highest position among the heights detected as liquid refrigerant temperatures.

Furthermore, in cases in which the liquid level height h of the outdoor heat exchanger 23 is detected by the liquid level detection sensor 39, the controller 9 may perform liquid level clarification control in which the interconnected state between the four-way switching valve 22 and the compressor 21 is switched immediately prior to the detection, whereby the temperature is suddenly reduced only in the gas-phase portion inside the outdoor heat exchanger 23, and either a temperature difference with the liquid phase is created or the temperature difference is increased.

Figure 20:
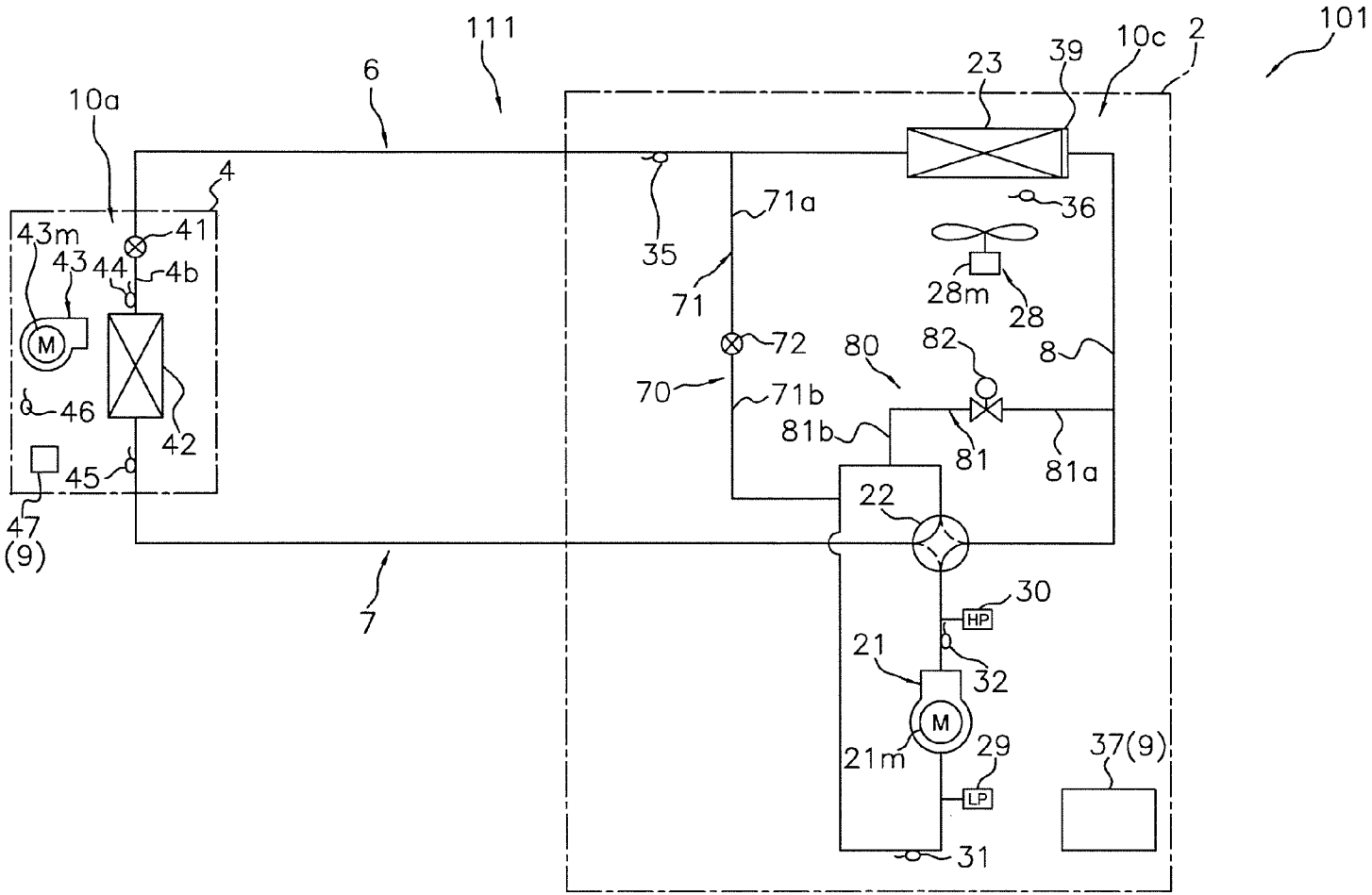
FIG. 20 is a general configuration diagram of the air conditioning apparatus of modification (J) of the first embodiment.

In a refrigerant circuit 111 having a hot gas bypass circuit 80 as shown in FIG. 20, the controller 9 may perform liquid level clarification control utilizing the hot gas bypass circuit 80.

This hot gas bypass circuit 80 has a hot gas bypass pipe 81 and a hot gas bypass valve 82, as shown in FIG. 20. The hot gas bypass pipe 81 has a four-way compression connection pipe 7*c* for connecting the suction side of the compressor 21 to the four-way switching valve 22, and an outdoor equipment interconnection pipe 8. The hot gas bypass valve 82 is provided in the path of the hot gas bypass pipe 81, and can be switched between an open state in which refrigerant in the hot gas bypass pipe 81 is allowed to pass through, and a closed state in which the refrigerant is not allowed to pass through. The portion of the hot gas bypass pipe 81 which extends from the hot gas bypass valve 82 to the outdoor equipment interconnection pipe 8 is a high-pressure side hot gas bypass pipe 81*a*. The portion of the hot gas bypass pipe 81 extending from the hot gas bypass valve 82 to the gas refrigerant connection pipe 7 is a low-pressure side hot gas bypass pipe 81*b*.

Figure 21:
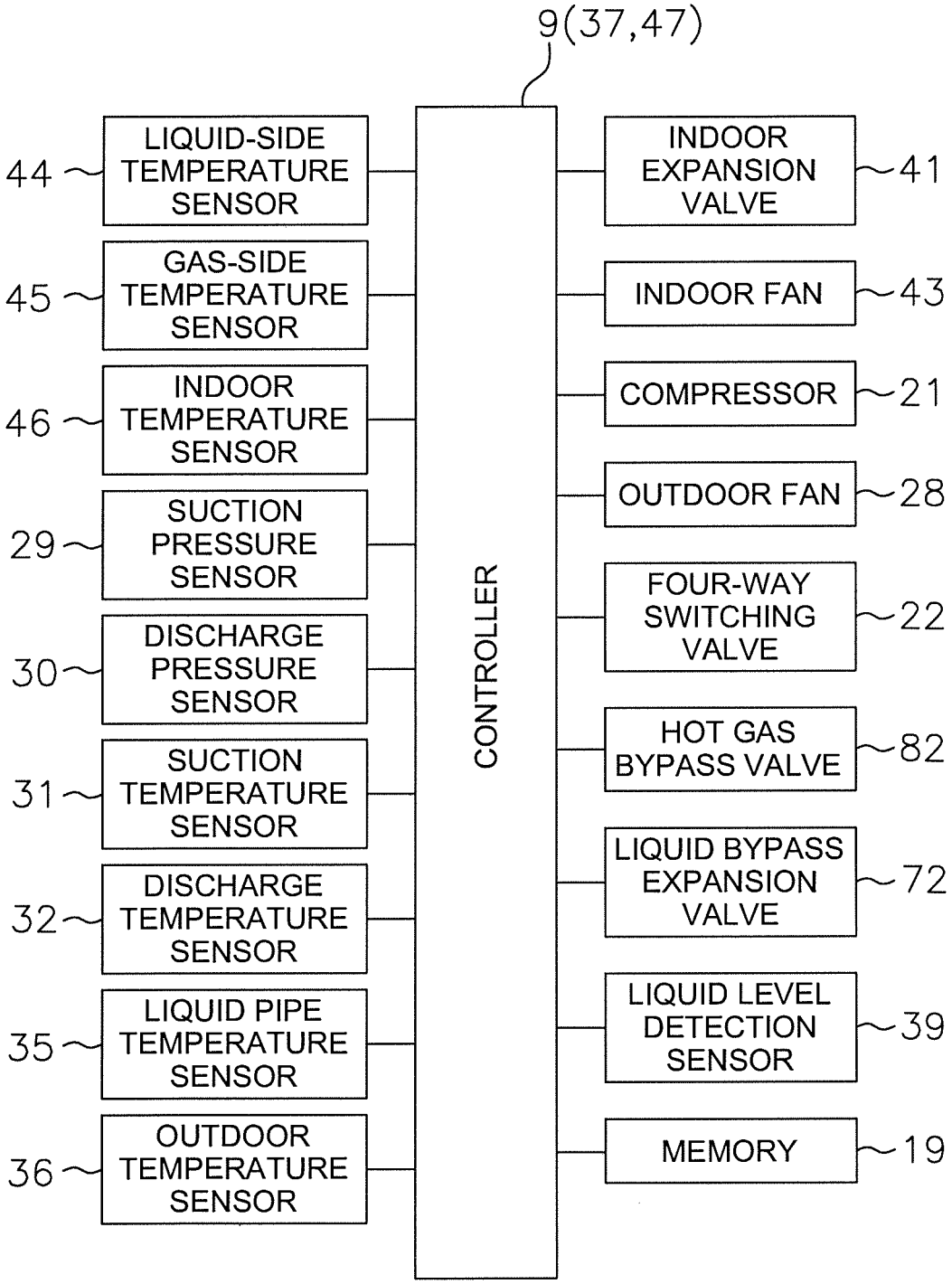
FIG. 21 is a control block diagram of the air conditioning apparatus of modification (J) of the first embodiment.

A block configuration diagram of the refrigerant circuit 111 herein has the addition of the hot gas bypass valve 82 as shown in FIG. 21.

The controller 9 performs the liquid level clarification control by controlling the opened and closed states of the hot gas bypass valve 82 in the following manner.

Figure 22:
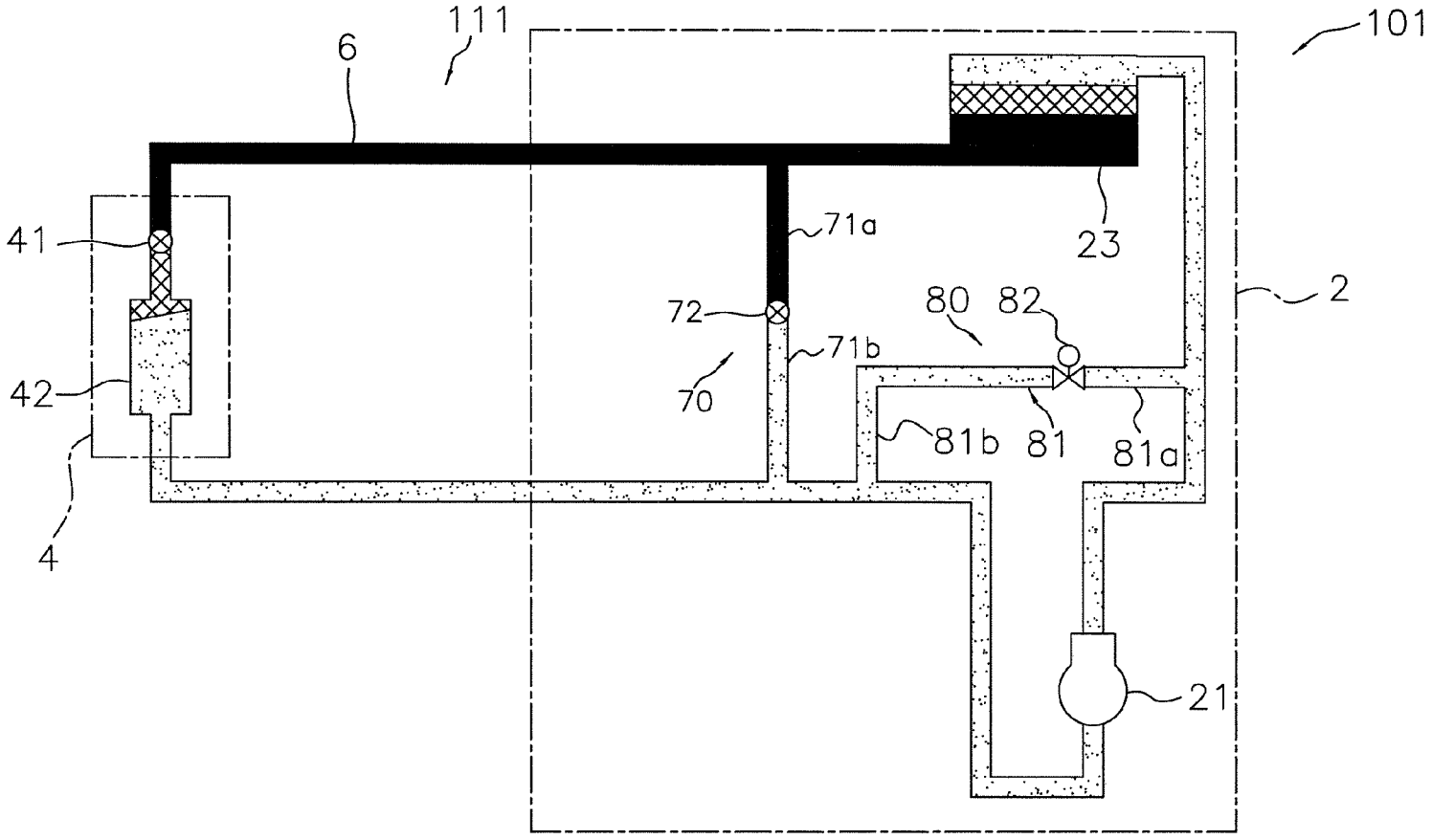
FIG. 22 is a schematic diagram showing a state of refrigerant flowing within the refrigerant circuit during the cooling operation of modification (J) of the first embodiment.

Specifically, in a control similar to the first cooling operation of step S2 of the proper refrigerant quantity charging operation mode or step S11 of the refrigerant leak detection operation mode, the controller 9 performs control similar to the cooling operation while leaving the liquid bypass expansion valve 72 completely closed and keeping the hot gas bypass valve 82 closed, as shown in FIG. 22. A refrigerant distribution state such as the one shown in FIG. 22 is thereby achieved inside the refrigerant circuit 111.

Figure 23:
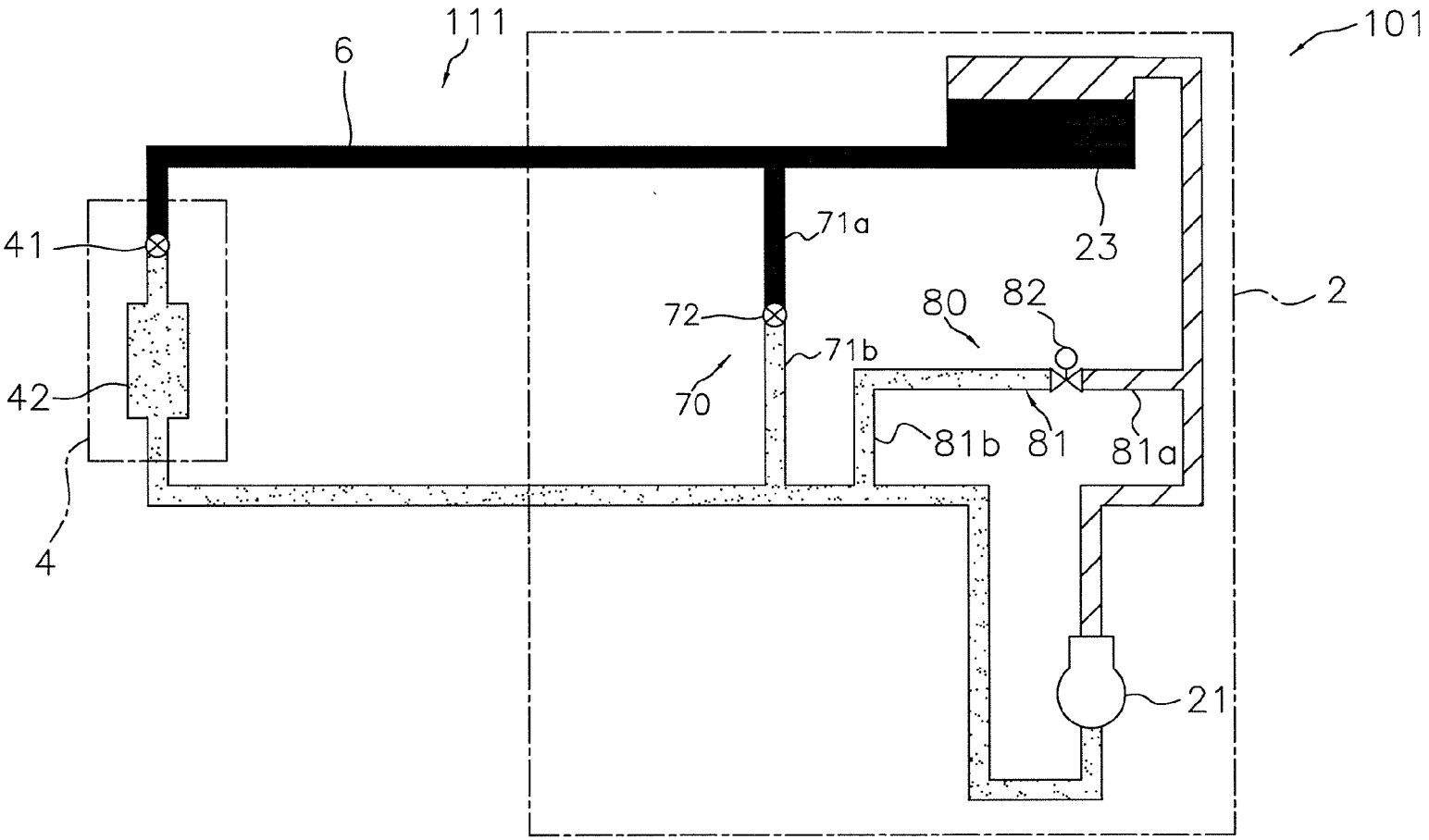
FIG. 23 is a diagram showing the liquid refrigerant accumulating in the outdoor heat exchanger while the indoor expansion valve is completely closed in modification (J) of the first embodiment.

Next, in the liquefaction control of step S3 of the proper refrigerant quantity charging operation mode or step S12 of the refrigerant leak detection operation mode, the controller 9 performs control for closing the indoor expansion valves 41 and causing the refrigerant inside the refrigerant circuit 111 to collect in a liquid state, while leaving the liquid bypass expansion valve 72 completely closed and leaving the hot gas bypass valve 82 closed, as shown in FIG. 23. By performing the liquefaction control in this manner, the passage of refrigerant in the indoor expansion valves 41 can be shut off, and the circulation of refrigerant inside the refrigerant circuit 111 can be stopped as shown in FIG. 23. Since the controller 9 continues the operation of the compressor 21 and the outdoor fan 28, the refrigerant undergoes heat exchange in the outdoor heat exchanger 23 functioning as a condenser with the outdoor air supplied by the outdoor fan 28, the refrigerant is cooled, and thereby condenses. Thus, in cases in which the circulation of the refrigerant inside the refrigerant circuit 111 is stopped, the refrigerant condensed in the outdoor heat exchanger 23 gradually accumulates in the portion of the refrigerant circuit 10 upstream of the indoor expansion valves 41 and downstream of the compressor 21, including the outdoor heat exchanger 23. Furthermore, suction by the compressor 21 is continued in a state in which the indoor expansion valves 41 are controlled by the controller 9 to a completely closed state. Therefore, refrigerant in the portion of the refrigerant circuit 111 upstream of the compressor 21 and downstream of the indoor expansion valves 41, including the indoor heat exchangers 42, the gas refrigerant connection pipe 7, the low-pressure side hot gas bypass pipe 81*b*, and other components, continues to be sucked in by the compressor 21. The portion downstream of the indoor expansion valves 41 and upstream of the compressor 21 is thereby progressively depressurized, resulting in a state mostly devoid of refrigerant. The refrigerant inside the refrigerant circuit 111 thereby becomes a liquid state and intensively collects in the portion of the refrigerant circuit 111 upstream of the indoor expansion valves 41 and downstream of the compressor 21.

Furthermore, in the liquid temperature stabilization control of step S5 of the proper refrigerant quantity charging operation mode or step S14 of the refrigerant leak detection operation mode, the controller 9 leaves the hot gas bypass valve 82 closed and waits for the temperature of the liquid refrigerant inside the refrigerant circuit 111 to stabilize at approximately the surrounding temperature, while performing the liquid return control in which the liquid bypass expansion valve 72 is slightly opened.

Figure 24:
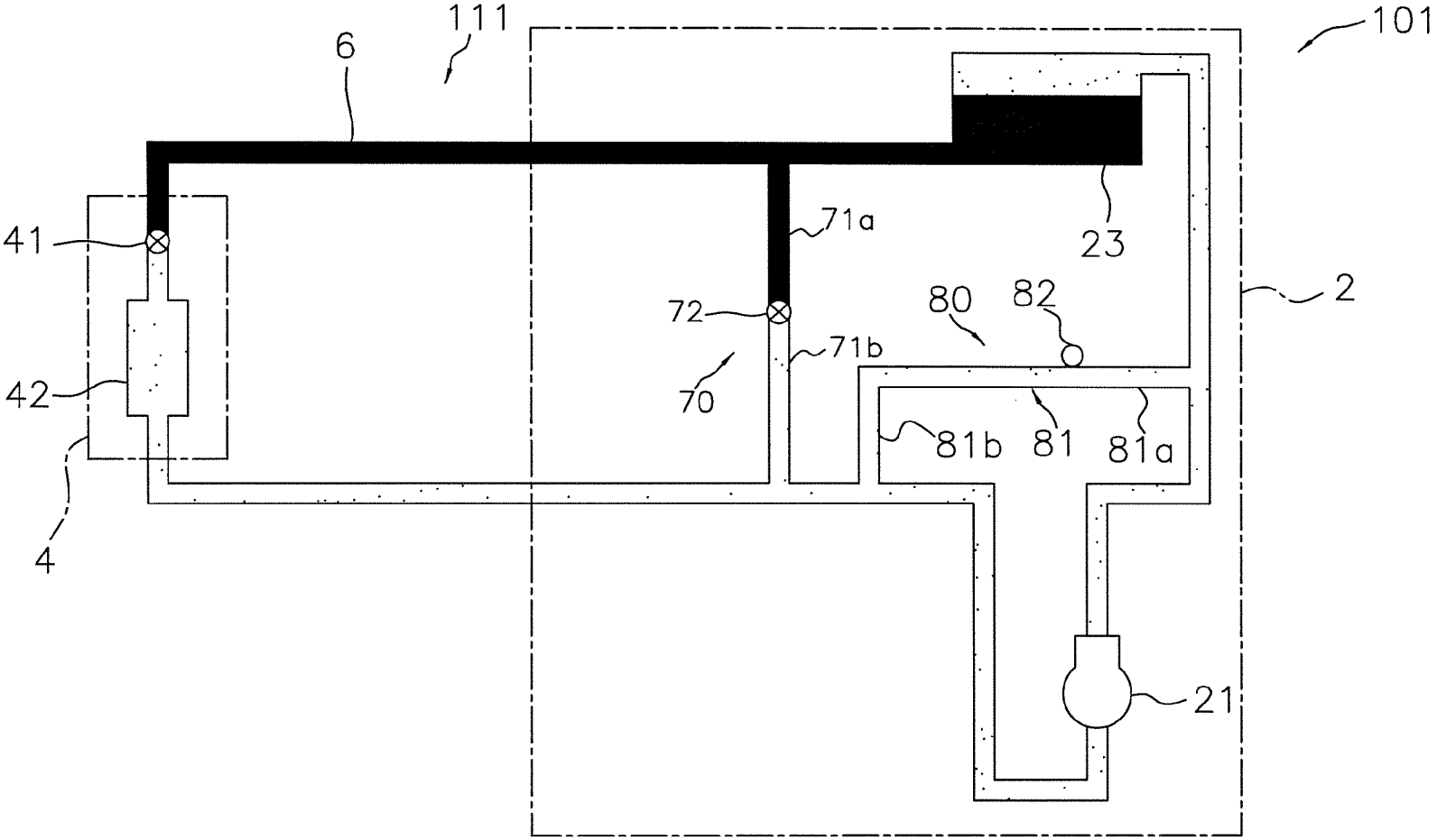
FIG. 24 is a diagram showing the liquid level clarification control being performed in modification (J) of the first embodiment.

When the temperature of the liquid refrigerant is determined to have stabilized, the controller 9 performs the liquid level clarification control by completely closing the liquid bypass expansion valve 72 and opening the hot gas bypass valve 82. This liquid level clarification control causes the outdoor equipment interconnection pipe 8 to be communicated with the suction side of the compressor 21 as shown in FIG. 24, and the refrigerant pressure inside the outdoor equipment interconnection pipe 8 therefore rapidly decreases. In this manner, since the pressure of the gas-phase refrigerant inside the outdoor heat exchanger 23 suddenly decreases, the temperature of the gas-phase refrigerant inside the outdoor heat exchanger 23 suddenly decreases. However, the temperature of the liquid refrigerant inside the outdoor heat exchanger 23 does not suddenly change. Thereby, either a temperature difference arises between the liquid-phase temperature and the gas-phase temperature of the refrigerant inside the outdoor heat exchanger 23, or the difference is increased. It is thereby possible for the liquid level detection sensor 39 to precisely determine the liquid level height inside the outdoor heat exchanger 23 by performing detection on the liquid level immediately after the liquid level clarification control is performed.

The hot gas bypass circuit 80 described above can be utilized, for example, in cases in which there is no intention to send cold refrigerant to the indoor units 4 at the start of the heating operation. That is, it is possible to warm the refrigerant inside the outdoor unit 2 by temporarily opening the hot gas bypass valve 82 at the start of the heating operation and connecting the discharge side and suction side of the compressor 21. An uncomfortable supply of cold air to an indoor user at the start of the heating operation can thereby be prevented. In this manner, the hot gas bypass circuit 80 is not merely utilized only during the liquid level clarification control described above, but can also be appropriated for temporarily warming the refrigerant at the start of the heating operation.

The liquid level clarification control may, for example, also involve the following.

For example, in a state in which the degree of variation in the liquid level height h inside the outdoor heat exchanger 23 has abated, the rotations of the compressor 21 and the motor 28*m* of the outdoor fan 28 are stopped. The compressor 21 alone is then again operated while the motor 28*m* of the outdoor fan 28 is not operated, in a state in which the refrigerant temperature inside the outdoor equipment interconnection pipe 8 has been affected by the surrounding temperature. The refrigerant pressure inside the outdoor equipment interconnection pipe 8 thereby suddenly increases, and the temperature of the gas refrigerant inside the outdoor equipment interconnection pipe 8 suddenly increases. In this manner, the gas-phase temperature inside the outdoor heat exchanger 23 suddenly increases due to a change in sensible heat. Since the rotation of the motor 28*m* of the outdoor fan 28 has been stopped, the sudden increase in the temperature of the gas phase does not readily subside. The liquid phase inside the outdoor heat exchanger 23 remains affected by the surrounding temperature, and even if heat from the gas phase is supplied, the heat is used in a change in latent heat, and there is no sudden increase in temperature. In this manner, the operation in which the compressor 21 alone is again operated either causes a temperature difference to arise between the high-temperature gas phase and the low-temperature liquid phase, or causes the temperature difference to increase. The liquid level detection sensor 39 can thereby precisely detect the liquid level height h inside the outdoor heat exchanger 23. The same effects as the first embodiment described above can be achieved in this case as well.

In addition, the liquid level clarification control may involve heating the vicinity of the liquid level of the outdoor heat exchanger 23 by a heater or the like immediately before detection is performed by the liquid level detection sensor 39, for example. In this case, the property of the liquid phase and the gas phase having different specific heats is utilized, and the liquid phase is quickly increased in temperature by the heater, while the gas phase is not increased much in temperature by the heater. Therefore, liquid level detection may be performed by the liquid level detection sensor 39 after temporary heating by a heater or the like is performed to a degree whereby the liquid level can be detected by the thermistors T1 to T5 and the heating by the heater is then stopped.

The liquid level clarification control may, for example, also involve the following.

For example, thermistor temperature calibration processing may be performed before the liquid level clarification control is performed. Under conditions in which the thermistors will likely detect the same temperature, for example, the controller 9 may calibrate the thermistors so that their temperatures show the same values. Specifically, the following processing is performed at the beginning of the proper refrigerant quantity automatic charging operation mode and the refrigerant leak detection operation mode.

Specifically, the controller 9 determines whether or not the temperature of the header 23*b* of the outdoor heat exchanger 23 in the refrigerant circuit 10 has stabilized. The controller 9 determines whether or not there have been any occasions of the outdoor unit 2 continuing in an operating state for predetermined time duration (e.g., 24 hours) or longer. In cases in which the controller 9 determines that operation has not continued for the predetermined time duration or longer, the controller 9 acquires the detection values of the thermistors T1 to T5 of the liquid level detection sensor 39 simultaneously.

The controller 9 then performs thermistor calibration, assuming that the same temperatures have been detected for the detection temperatures of the detected thermistors. Assuming that the temperature detected by the thermistor that detects the temperature nearest to the average value among the thermistor detected temperatures is detected by another thermistor, calibration of the other thermistor is performed.

Commonly, when the intention is to detect the liquid level height by detecting the temperature difference between the gas-state refrigerant not yet condensed and having a degree of superheating and the liquid-state refrigerant condensed and having a degree of subcooling, the gas-state refrigerant which has a small degree of superheating immediately before being condensed and the liquid-state refrigerant which has just been condensed and does not yet have much of a degree of subcooling have both come in proximity to the liquid level. To detect the liquid level height, precision is required to an extent whereby it is possible to detect the temperature difference between the gas-state refrigerant which has a small degree of superheating immediately before being condensed and the liquid-state refrigerant which has just been condensed and does not yet have much of a degree of subcooling in the proximity of the liquid level. In cases in which the thermistors have been calibrated in this manner, temperature detection errors within in the same environment can be reduced, and detection precision can be improved with respect of the quantity of liquid refrigerant inside the outdoor heat exchanger 23. That is, the liquid level height detection precision of the thermistors can be highly precise as though the temperatures at each of the heights were detected using a single sensor.

(K)

In the first embodiment and modification (J), an example was described in which the controller 9 suddenly reduces the refrigerant pressure of the outdoor equipment interconnection pipe 8 while performing the liquid level clarification control.

Thus, in cases in which the refrigerant pressure inside the outdoor equipment interconnection pipe 8 is suddenly reduced, there is a risk, depending on the configuration of the refrigerant circuit 10 or 111 and the type of refrigerant, that the liquid-state refrigerant accumulated inside the outdoor heat exchanger 23 will flow backward toward the outdoor equipment interconnection pipe 8 while bubbling. That is, due to a sudden decrease in refrigerant pressure inside the outdoor equipment interconnection pipe 8, the liquid refrigerant inside the outdoor heat exchanger 23 will be drawn toward the outdoor equipment interconnection pipe 8, the volume will attempt to suddenly expand, and there is a risk of bubbles forming. When the liquid refrigerant bubbles in this manner, it is difficult for detection to be performed by the liquid level detection sensor 39, which has clarified the temperature difference between the liquid and gas phases inside the outdoor heat exchanger 23.

Figure 25:
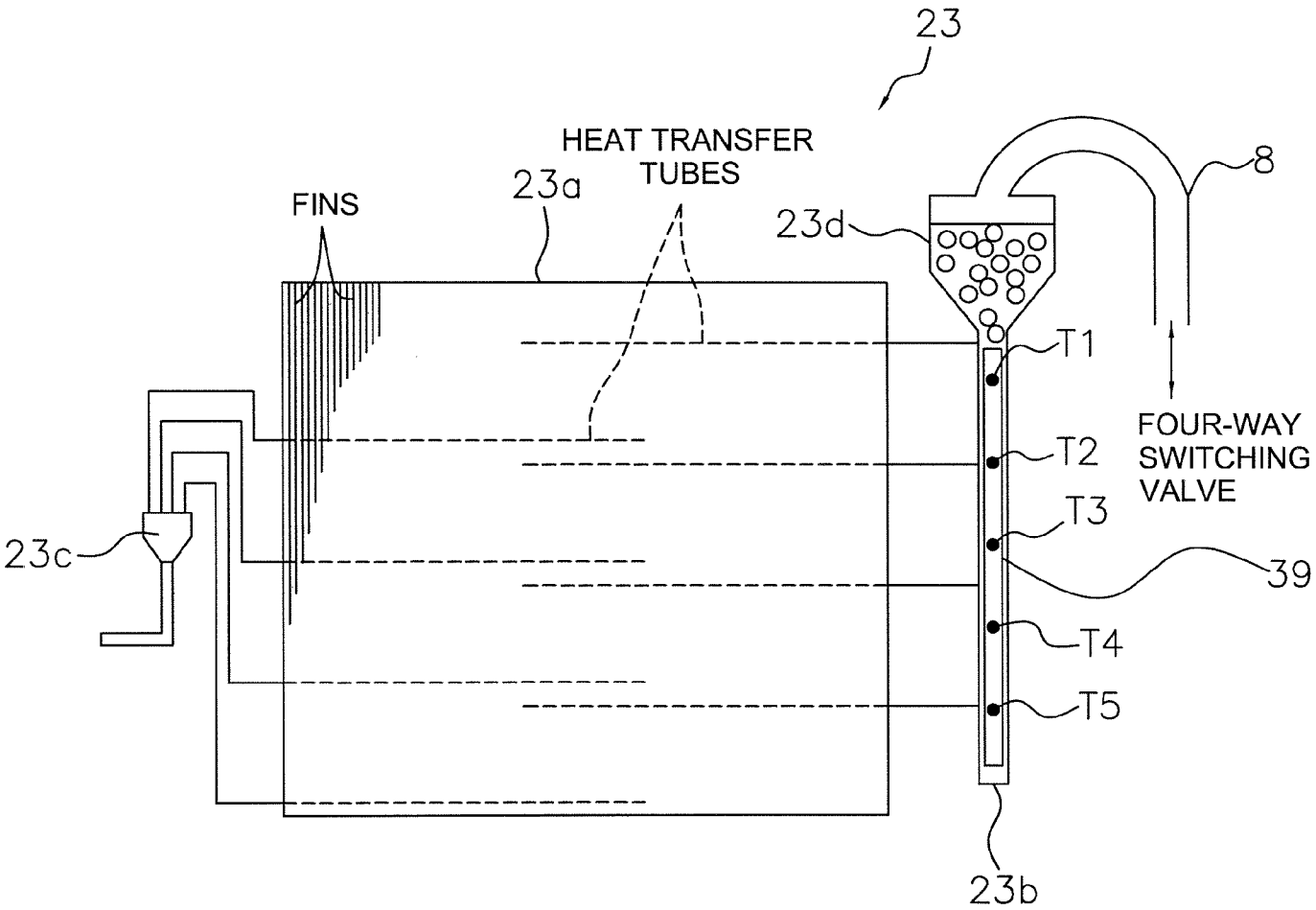
FIG. 25 is a general configuration diagram of the anti-backflow part of modification (K) of the first embodiment.

With respect thereto, an anti-backflow part 23*d* is provided in the top end vicinity of the header 23*b* portion of the outdoor heat exchanger 23 as shown in FIG. 25, for example, whereby this type of backflow of bubbling liquid refrigerant can be prevented.

This anti-backflow part 23*d* is provided at the top of the header 23*b* of the outdoor heat exchanger 23, at the end of the side to which the outdoor equipment interconnection pipe 8 is connected, as shown in FIG. 25. There is a portion which gradually increases in pipe inside diameter from the header 23*b* toward the outdoor equipment interconnection pipe 8. The strength of the refrigerant attempting to flow backward can thereby be suddenly weakened in the anti-backflow part 23*d*. The backflow of liquid refrigerant inside the outdoor heat exchanger 23 can thereby be effectively prevented, and reductions in the precision of the liquid level detection sensor 39 can be suppressed even in cases in which bubbled refrigerant backflow occurs during the liquid level clarification control.

(L)

In the first embodiment and modification (J), an example of an air conditioning apparatus employing the liquid bypass expansion valve 72 was described.

Figure 26:
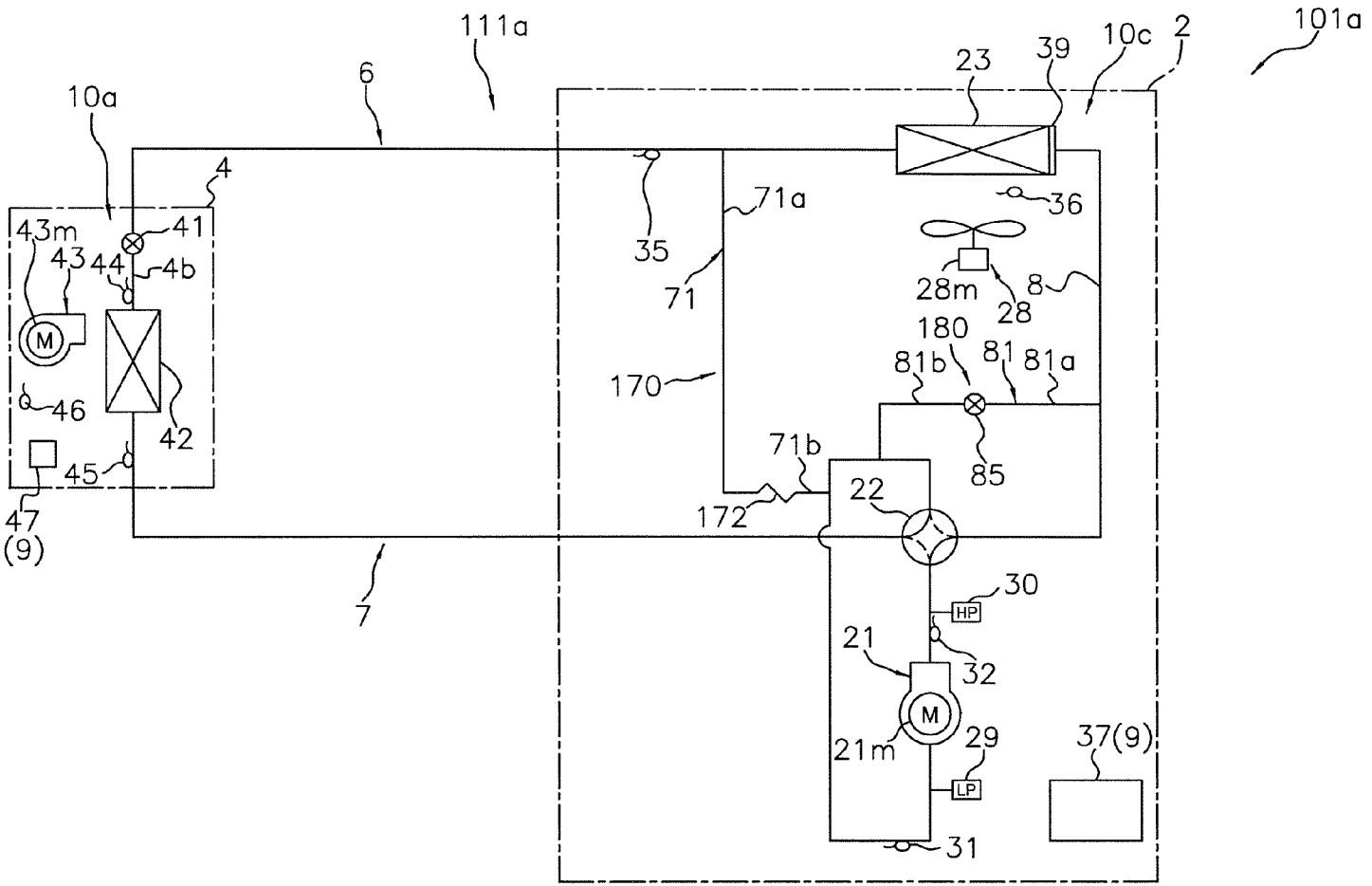
FIG. 26 is a general configuration diagram of the air conditioning apparatus of modification (L) of the first embodiment.

However, the present invention is not limited to this option alone; another option is an air conditioning apparatus 101*a* having a refrigerant circuit 111*a* including both a liquid bypass circuit 170 employing a capillary tube 172 instead of the liquid bypass expansion valve 72 in modification (J), and a hot gas bypass circuit 180 employing a hot gas bypass valve 82, as shown in FIG. 26, for example.

The capillary tube 172 is not controlled directly by the controller 9, as shown in FIG. 26. Here, the pressure difference between the high pressure in the liquid refrigerant connection pipe 6 and the low pressure in the gas refrigerant connection pipe 7 causes the liquid refrigerant inside the high-pressure side liquid bypass pipe 71*a* in the liquid bypass circuit 170 to travel through the capillary tube 172 and flow to the low-pressure side liquid bypass pipe 71*b*, as shown in FIG. 26. This pressure difference can be regulated by the controller 9 controlling the opening degree of the hot gas bypass expansion valve 82. In this manner, the quantity of liquid refrigerant supplied to the suction side of the compressor 21 can be indirectly regulated by regulating the opening degree of the hot gas bypass expansion valve 82. The temperature increase in the discharge pipe of the compressor 21 can thereby be indirectly suppressed.

(M)

In the first embodiment, an example was described in which liquid return control is performed slightly before the liquid level height h of the outdoor heat exchanger 23 is detected, wherein the valve opening degree of the liquid bypass expansion valve 72 is regulated and only a small quantity of liquid refrigerant is allowed to pass through.

However, the present invention is not limited to this option alone, and the controller 9 may regulate the opening degree of the liquid bypass expansion valve 72, for example, on the basis of the detected temperature of the discharged refrigerant temperature sensor 32 for detecting the discharged refrigerant temperature of the compressor 21. In this case, when the temperature detected by the discharged refrigerant temperature sensor 32 has risen, the controller 9 may perform control for increasing the opening degree of the liquid bypass expansion valve 72 and supplying a greater quantity of liquid refrigerant to the suction side of the compressor 21. When the temperature detected by the discharged refrigerant temperature sensor 32 has fallen, the controller 9 may perform control for reducing the opening degree of the liquid bypass expansion valve 72 and suppressing the quantity of refrigerant supplied to the suction side of the compressor 21.

Figure 27:
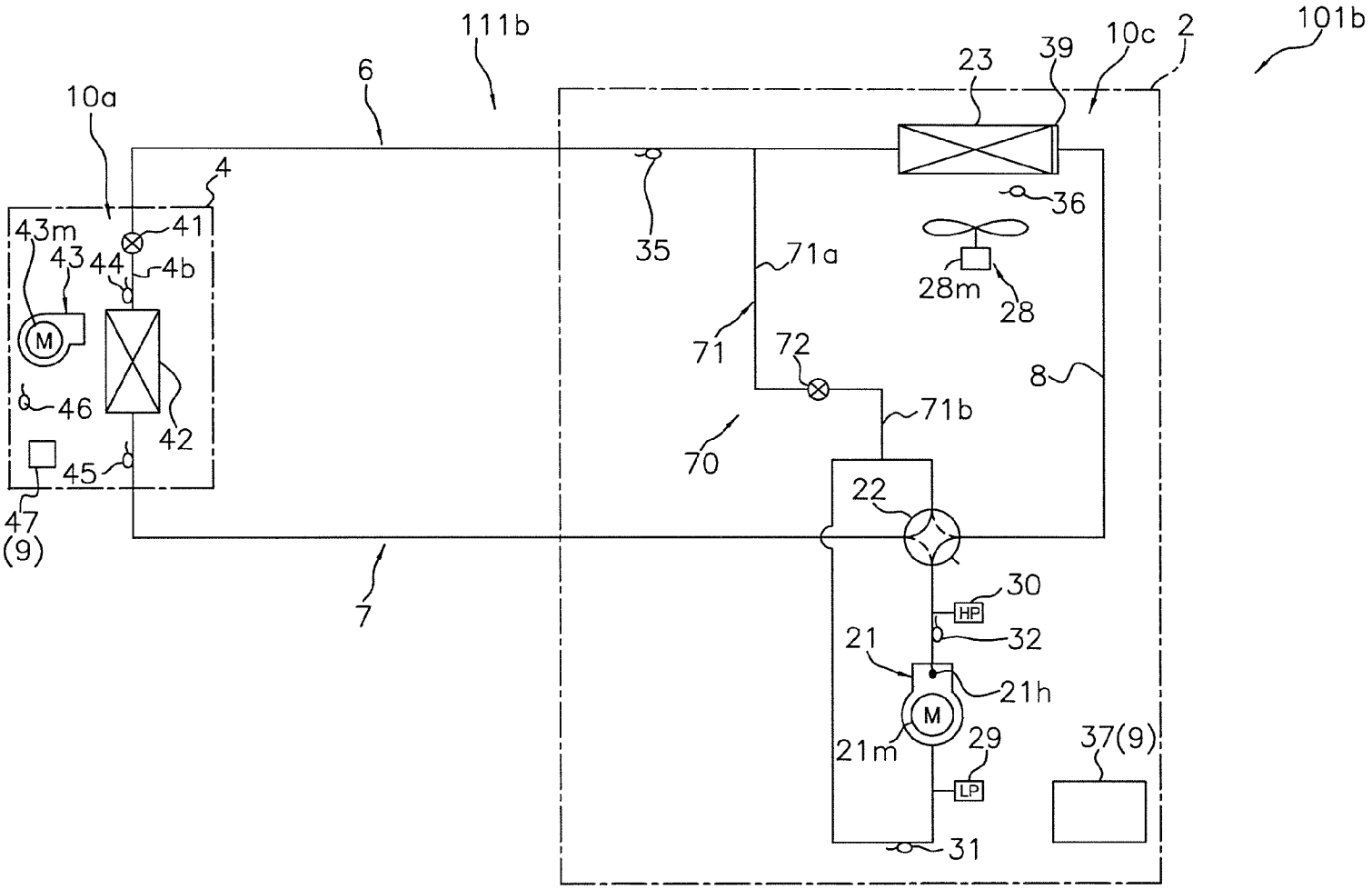
FIG. 27 is a general configuration diagram of the air conditioning apparatus of modification (M) of the first embodiment.

Another option is, for example, an air conditioning apparatus 101*b* having a refrigerant circuit 111*b* further provided with a compressor high-temperature-portion temperature sensor 21*h* capable of directly detecting the temperature of the output port through which passes the discharged refrigerant inside the compressor 21, as shown in FIG. 27. In this case, the control by the controller 9 of the present modification (M) may use the temperature detected by the compressor high-temperature-portion temperature sensor 21*h*, rather than using the temperature detected by the discharged refrigerant temperature sensor 32 as an index.

<2> Second Embodiment

<2.1> Configuration of Air Conditioning Apparatus

Figure 28:
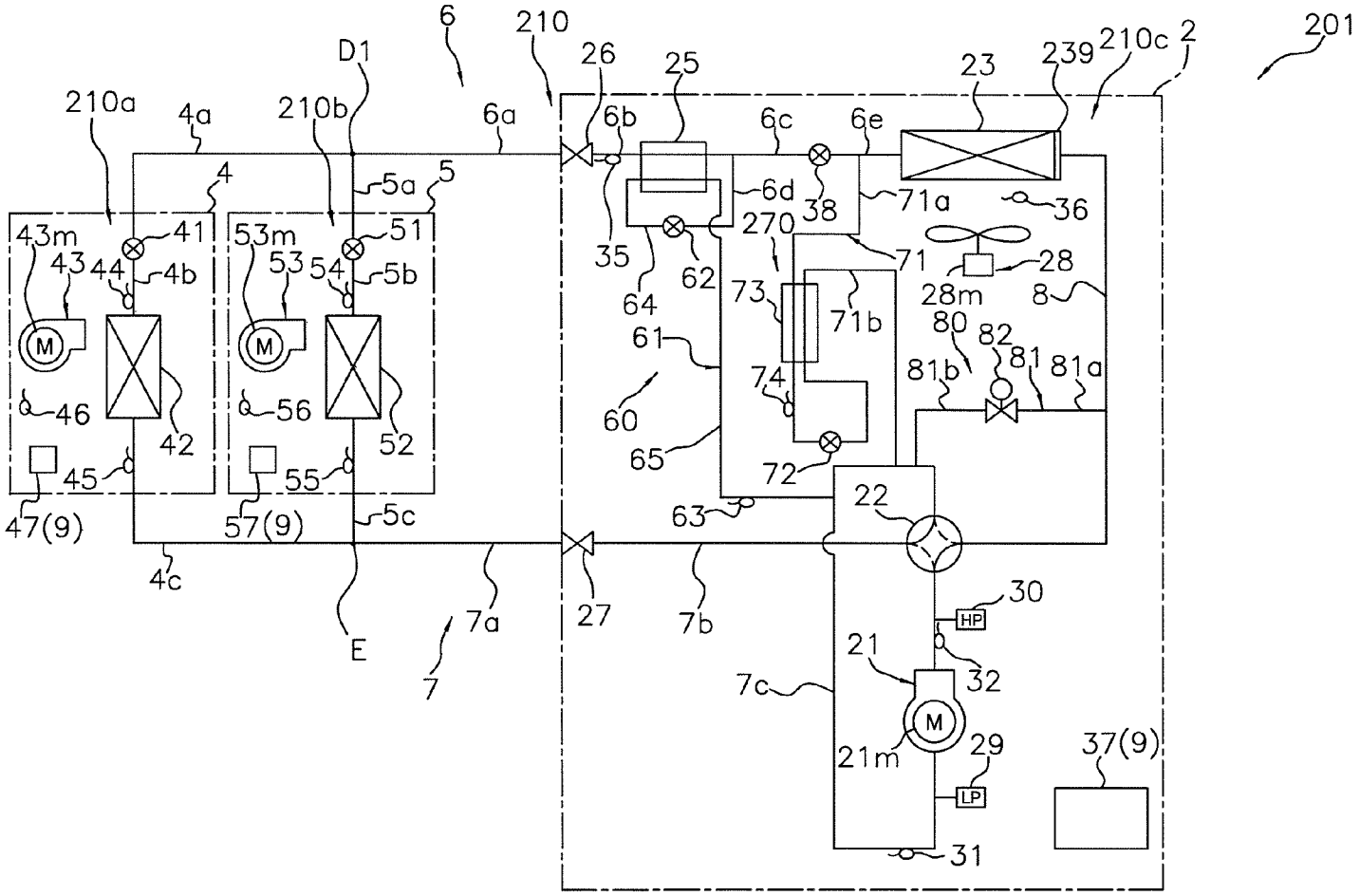
FIG. 28 is a general configuration diagram of the air conditioning apparatus of the second embodiment of the present invention.

FIG. 28 is a general configuration diagram of an air conditioning apparatus 201 of the second embodiment of the present invention.

The air conditioning apparatus 201 is an apparatus used to cool and heat the inside of a room in a building or the like by performing vapor compression refrigeration cycle operation.

The air conditioning apparatus 201 is mainly equipped with one outdoor unit 2 serving as a heat source unit, plural (in the present embodiment, two) indoor units 4 and 5 serving as utilization units that are connected in parallel to the outdoor unit 2, and a liquid refrigerant connection pipe 6 and a gas refrigerant connection pipe 7 serving as refrigerant connection pipes that interconnect the outdoor unit 2 and the indoor units 4 and 5. That is, a vapor compression refrigerant circuit 210 of the air conditioning apparatus 201 of the present embodiment is configured as a result of the outdoor unit 2, the indoor units 4 and 5 and the liquid refrigerant connection pipe 6 and the gas refrigerant connection pipe 7 being connected.

(Indoor Units)

The indoor units 4 and 5 are installed by being embedded in or suspended from a ceiling inside a room in a building or the like or by being mounted on a wall surface inside a room. The indoor units 4 and 5 are connected to the outdoor unit 2 via the liquid refrigerant connection pipe 6 and the gas refrigerant connection pipe 7 and configure part of the refrigerant circuit 210.

Next, the configuration of the indoor units 4 and 5 will be described.

The indoor unit 4 and the indoor unit 5 have the same configuration, so only the configuration of the indoor unit 4 will be described here, and in regard to the configuration of the indoor unit 5, reference numerals in the 50s will be added instead of reference numerals in the 40s representing each part of the indoor unit 4 and description of each part will be omitted.

The indoor unit 4 mainly has an indoor-side refrigerant circuit 210*a* (in the indoor unit 5, an indoor-side refrigerant circuit 210*b*) that configures part of the refrigerant circuit 210. This indoor-side refrigerant circuit 210*a* mainly has an indoor expansion valve 41 serving as a utilization-side expansion mechanism, an indoor heat exchanger 42 serving as a utilization-side heat exchanger, and an indoor equipment interconnection pipe 4*b* (in the indoor unit 5, an indoor equipment interconnection pipe 5*b*) that interconnects the indoor expansion valve 41 and the indoor heat exchanger 42.

In the present embodiment, the indoor expansion valve 41 is a motor-driven expansion valve connected to the liquid side of the indoor heat exchanger 42 in order to perform, for example, regulation of the flow rate of refrigerant flowing through the inside of the indoor-side refrigerant circuit 210*a*, and the indoor expansion valve 41 is also capable of shutting off passage of the refrigerant.

In the present embodiment, the indoor heat exchanger 42 is a cross-fin type fin-and-tube heat exchanger configured by heat transfer tubes and numerous fins and is a heat exchanger that functions as an evaporator of the refrigerant during cooling operation to cool the room air and functions as a condenser of the refrigerant during heating operation to heat the room air.

In the present embodiment, the indoor unit 4 has an indoor fan 43 serving as a blowing fan for sucking the room air into the inside of the unit, allowing heat to be exchanged with the refrigerant in the indoor heat exchanger 42, and thereafter supplying the air to the inside of the room as supply air. The indoor fan 43 is a fan capable of varying the volume of the air it supplies to the indoor heat exchanger 42 and, in the present embodiment, is a centrifugal fan or a multiblade fan driven by a motor 43*m* comprising a DC fan motor or the like.

Further, various types of sensors are disposed in the indoor unit 4.

A liquid-side temperature sensor 44 that detects the temperature of the refrigerant (that is, the temperature of the refrigerant corresponding to the condensation temperature during the heating operation or the evaporation temperature during the cooling operation) is disposed on the liquid side of the indoor heat exchanger 42. A gas-side temperature sensor 45 that detects the temperature of the refrigerant is disposed on the gas side of the indoor heat exchanger 42. An indoor temperature sensor 46 that detects the temperature of the room air (that is, the indoor temperature) flowing into the inside of the unit is disposed on a room air suction opening side of the indoor unit 4.

In the present embodiment, the liquid-side temperature sensor 44, the gas-side temperature sensor 45 and the indoor temperature sensor 46 comprise thermistors.

Further, the indoor unit 4 has an indoor-side controller 47 that controls the operation of each part configuring the indoor unit 4. Additionally, the indoor-side controller 47 is connected to a microcomputer and a memory 19 or the like disposed in order to perform control of the indoor unit 4. The microcomputer and the memory 19 or the like are configured such that they can exchange control signals and the like with a remote controller (not shown) for individually operating the indoor unit 4, and can also exchange control signals and the like with the outdoor unit 2 via a transmission line (not shown).

(Outdoor Unit)

The outdoor unit 2 is installed outdoors of a building or the like, is connected to the indoor units 4 and 5 via the liquid refrigerant connection pipe 6 and the gas refrigerant connection pipe 7, and configures the refrigerant circuit 210 together with the indoor units 4 and 5.

Next, the configuration of the outdoor unit 2 will be described.

The outdoor unit 2 mainly has an outdoor-side refrigerant circuit 210*c* that configures part of the refrigerant circuit 210. The outdoor-side refrigerant circuit 210*c* mainly has a compressor 21, a four-way switching valve 22, an outdoor heat exchanger 23, a liquid level detection sensor 239, an outdoor expansion valve 38, a subcooler 25, an outdoor heat exchange expansion interconnection pipe 6*e*, an outdoor expansion subcooling interconnection pipe 6*c*, an outdoor subcooling liquid-side stop interconnection pipe 6*b*, a gas stop four-way interconnection pipe 7*b*, a four-way compression connection pipe 7*c*, a subcooling refrigerant circuit 60, a liquid bypass circuit 270, a hot gas bypass circuit 80, a liquid-side stop valve 26, a gas-side stop valve 27, various sensors, and an outdoor-side controller 37.

The compressor 21 is a compressor capable of varying its operating capacity. The compressor 21 is a positive displacement compressor driven by a motor 21*m*. The number of revolutions is of the motor 21*m* is controlled by an inverter.

The four-way switching valve 22 is a valve for switching the direction of the flow of the refrigerant between a cooling operation and a heating operation. During the cooling operation, the four-way switching valve 22 interconnects the discharge side of the compressor 21 and the gas side of the outdoor heat exchanger 23 and also interconnects the suction side of the compressor 21 and the gas refrigerant connection pipe 7 (see the solid lines of the four-way switching valve 22 in FIG. 28). During the cooling operation, the outdoor heat exchanger 23 can thereby be made to function as a condenser of the refrigerant compressed by the compressor 21, and the indoor heat exchangers 42 and 52 can be made to function as evaporators of the refrigerant condensed in the outdoor heat exchanger 23. During the heating operation, the four-way switching valve 22 interconnects the discharge side of the compressor 21 and the gas refrigerant connection pipe 7 and also interconnects the suction side of the compressor 21 and the gas side of the outdoor heat exchanger 23 (see the dotted lines of the four-way switching valve 22 in FIG. 28). During the heating operation, the indoor heat exchangers 42 and 52 can thereby be made to function as condensers of the refrigerant compressed by the compressor 21, and the outdoor heat exchanger 23 can be made to function as an evaporator of the refrigerant condensed by the indoor heat exchangers 42 and 52.

Figure 30:
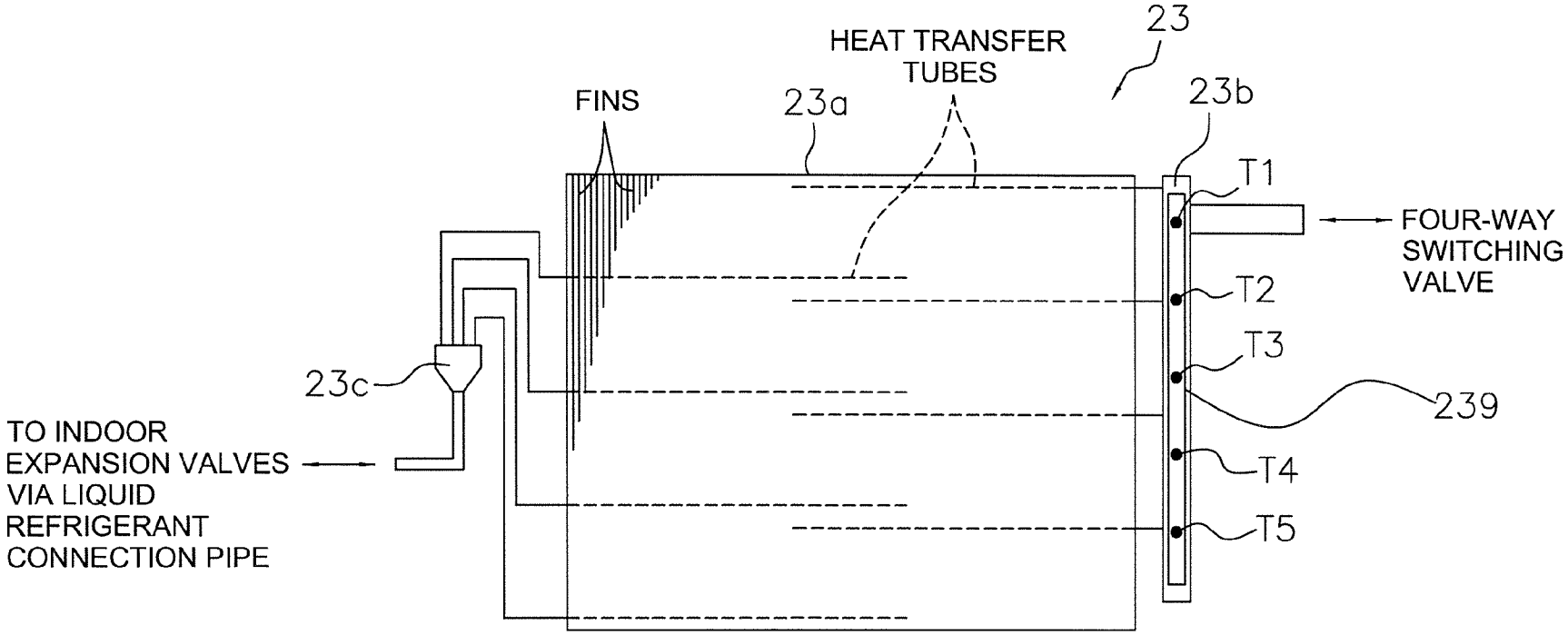
FIG. 30 is a general diagram of the outdoor heat exchanger.

The outdoor heat exchanger 23 is a cross-fin type fin-and-tube heat exchanger and, as shown in FIG. 30, which is a schematic diagram of the outdoor heat exchanger 23, mainly has a heat exchanger body 23*a* that is configured from heat transfer tubes and numerous fins, a header 23*b* that is connected to the gas side of the heat exchanger body 23*a*, and a distributor 23*c* that is connected to the liquid side of the heat exchanger body 23*a*. The outdoor heat exchanger 23 is a heat exchanger that functions as a condenser of the refrigerant during the cooling operation and functions as an evaporator of the refrigerant during the heating operation. The gas side of the outdoor heat exchanger 23 is connected to the four-way switching valve 22, and the liquid side of the outdoor heat exchanger 23 is connected to the outdoor expansion valve 38. The outdoor heat exchanger 23 has the heat exchanger body 23*a* and the header 23*b* as shown in FIG. 30. The heat exchanger body 23*a* receives high-temperature high-pressure gas refrigerant that has been pressurized by the compressor 21 at plural different heights, and condenses the gas refrigerant by performing heat exchange with the outside air temperature. In order to supply the high-temperature high-pressure gas refrigerant pressurized by the compressor 21 to each of the plural different heights of the above-described heat exchanger body 23*a*, the header 23*b* divides the gas refrigerant among the different heights.

On a side surface of the outdoor heat exchanger 23, as shown in FIG. 30, there is disposed a liquid level detection sensor 239 that is placed on the upstream side of the liquid-side stop valve 26 in the flow direction of the refrigerant in the refrigerant circuit 210 when performing the cooling operation. This liquid level detection sensor 239 has thermistors T1 to T5 disposed at different height positions along the height direction of the header 23*b* of the outdoor heat exchanger 23, and functions as a refrigerant detection mechanism for detecting a state quantity relating to the quantity of refrigerant existing on the upstream sides of the indoor expansion valves 41 and 51 including the inside of the outdoor heat exchanger 23. With this liquid level detection sensor 239, the quantity of liquid refrigerant accumulating in the outdoor heat exchanger 23 is detected as the state quantity relating to the quantity of refrigerant existing on the upstream sides of the indoor expansion valves 41 and 51. Here, in the case of the cooling operation, high-temperature and high-pressure gas refrigerant discharged from the compressor 21 is cooled by air supplied by the outdoor fan 28, condensed, and becomes high-pressure liquid refrigerant inside the outdoor heat exchanger 23. When a proper refrigerant quantity automatic charging operation mode and a refrigerant leak detection operation mode described hereinafter are carried out, the compressor 21, the outdoor heat exchanger 23 functioning as a condenser, and the outdoor fan 28 continue to be operated in a state in which refrigerant circulation has stopped, and the condensed liquid refrigerant therefore progressively accumulates in the outdoor heat exchanger 23. The liquid refrigerant herein is denser and heavier than the gas refrigerant and therefore accumulates in the bottom of the outdoor heat exchanger 23 due to gravity. In this case, since the liquid refrigerant collects at the bottom, the volume of the liquid refrigerant can be perceived if the liquid level height position of the liquid refrigerant can be detected. Specifically, the liquid level detection sensor 239 detects, as the liquid level height, the boundary between the region where the refrigerant exists in a gas state and the region where the refrigerant exists in a liquid state, on the basis of the difference in temperatures between the thermistors T1 to T5. Of the detected temperatures of the thermistors T1 to T5, when a temperature is detected to be equal to or less than the saturation temperature, the controller 9 determines that the refrigerant exists in a liquid state at the height where that thermistor is disposed. Of the detected temperatures of the thermistors T1 to T5, when a temperature is detected to exceed the saturation temperature, the controller 9 determines that the refrigerant exists in a gas state at the height where that thermistor is disposed. The controller 9 can thereby perceive that a liquid level exists at a position exceeding the highest position of the heights detected as liquid refrigerant temperatures, with the thermistors T1 to T5 of the liquid level detection sensor 239 detecting the presence or absence of liquid refrigerant at the plural different height positions.

The outdoor expansion valve 38 is a motor-driven expansion valve that is placed on the upstream side of the subcooler 25 of the outdoor heat exchanger 23 in the flow direction of the refrigerant in the refrigerant circuit 210 when performing the cooling operation. The outdoor expansion valve 38 is connected to the liquid side of the outdoor heat exchanger 23. The outdoor expansion valve 38 can thereby regulate, for example, the pressure and flow rate of the refrigerant flowing through the inside of the outdoor-side refrigerant circuit 210*c*. The outdoor expansion valve 38 is also capable of shutting off passage of the refrigerant in this position.

The outdoor unit 2 has an outdoor fan 28 serving as a blowing fan. The outdoor fan 28 sucks outdoor air into the inside of the outdoor unit 2, allowing heat to be exchanged with the refrigerant in the outdoor heat exchanger 23, and thereafter discharges the air back to the outdoors. This outdoor fan 28 is a fan capable of varying the volume of the air it supplies to the outdoor heat exchanger 23. The outdoor fan 28 is a propeller fan or the like driven by a motor 28*m* comprising a DC fan motor or the like.

The subcooler 25 is provided between the outdoor heat exchanger 23 and the liquid refrigerant connection pipe 6. More specifically, the subcooler 25 is connected between the outdoor expansion valve 38 and the liquid-side stop valve 26. This subcooler 25 is a double-pipe heat exchanger or a pipe heat exchanger configured by allowing the refrigerant pipe through which the refrigerant condensed in the heat source-side heat exchanger flows and a subcooling refrigerant pipe 61 described later to touch each other. In this manner, heat exchange is performed between the refrigerant condensed in the heat source-side heat exchanger and the refrigerant flowing through the subcooling refrigerant pipe 61 described later without allowing the refrigerants to mix, whereby the refrigerant condensed in the outdoor heat exchanger 23 and sent to the indoor expansion valves 41 and 51 can be further cooled.

The outdoor heat exchange expansion interconnection pipe 6*e* interconnects the outdoor heat exchanger 23 and the outdoor expansion valve 38. The outdoor expansion subcooling interconnection pipe 6*c* interconnects the outdoor expansion valve 38 and the subcooler 25. The outdoor subcooling liquid-side stop interconnection pipe 6*b* interconnects the subcooler 25 and the liquid-side stop valve 26.

The gas stop four-way interconnection pipe 7*b* connects the gas-side stop valve 27 and the four-way switching valve 22. The four-way compression connection pipe 7*c* connects the four-way switching valve and the suction side of the compressor 21.

The subcooling refrigerant circuit 60 functions as a cooling source for cooling the refrigerant sent from the outdoor heat exchanger 23 to the indoor expansion valves 41 and 51 inside the subcooler 25. This subcooling refrigerant circuit 60 has a subcooling refrigerant pipe 61 and a subcooling expansion valve 62.

The subcooling refrigerant pipe 61 is a pipe connected so as to branch some of the refrigerant sent from the outdoor heat exchanger 23 to the indoor expansion valves 41 and 51, to allow the refrigerant to pass through the above-described subcooler 25, and to return the refrigerant to the suction side of the compressor 21. The subcooling refrigerant pipe 61 includes a subcooling expansion pipe 6*d*, a subcooling branching pipe 64, and a subcooling merging pipe 65. This subcooling expansion pipe 6*d* branches some of the refrigerant sent from the outdoor expansion valve 38 to the indoor expansion valves 41 and 51 from a position between the outdoor expansion valve 38 and the subcooler 25, and extends to the subcooling expansion valve 62 which is described hereinafter. The subcooling branching pipe 64 interconnects the subcooling expansion valve 62 and the subcooler 25. The subcooling merging pipe 65 is connected to the suction side of the compressor 21 so as to return from the outlet in the subcooling refrigerant circuit 60 side of the subcooler 25 to the suction side of the compressor 21.

The subcooling expansion valve 62 is located between the subcooling expansion pipe 6*d* and the subcooling branching pipe 64, connecting them together, and is a motor-driven expansion valve which functions as a communication pipe expansion mechanism for regulating the flow rate of refrigerant passing through.

Some of the refrigerant sent from the outdoor heat exchanger 23 to the indoor expansion valves 41 and 51 is branched off by the subcooling expansion pipe 6*d* and depressurized by the subcooling expansion valve 62, and the refrigerant depressurized by the subcooling branching pipe 64 is fed to the subcooler 25. Heat exchange can thereby be performed in the subcooler 25 between the refrigerant depressurized by passing through the subcooling expansion valve 62 and the refrigerant sent from the outdoor heat exchanger 23 through the liquid refrigerant connection pipe 6 to the indoor expansion valves 41 and 51. The refrigerant sent from the outdoor heat exchanger 23 to the indoor expansion valves 41 and 51 is cooled in the subcooler 25 by the refrigerant flowing through the subcooling refrigerant pipe 61 after being depressurized by the subcooling expansion valve 62. That is, ability control in the subcooler 25 can be performed by opening degree regulation of the subcooling expansion valve 62.

As will be described later, the subcooling refrigerant pipe 61 also functions as a communication pipe for interconnecting the portion in the refrigerant circuit 210 between the liquid-side stop valve 26 and the outdoor expansion valve 38 and the portion on the suction side of the compressor 21.

The liquid bypass circuit 270 is provided inside the outdoor unit 2, and is a circuit for interconnecting the outdoor heat exchange expansion interconnection pipe 6*e* and the four-way compression connection pipe 7*c*. This liquid bypass circuit 270 has a liquid bypass pipe 71, a liquid bypass expansion valve 72, a pipe heat exchanger 73, and a liquid bypass temperature sensor 74. The liquid bypass pipe 71 has a high-pressure side liquid bypass pipe 71*a* connected to the liquid side, that is, the high-pressure side of the liquid bypass expansion valve 72, and a low-pressure side liquid bypass pipe 71*b* connected to the gas side, that is, the low-pressure side of the liquid bypass expansion valve 72. The liquid bypass expansion valve 72 can regulate the degree of expansion of the liquid refrigerant flowing through the liquid bypass pipe 71 from the outdoor heat exchange expansion interconnection pipe 6*e* where high-pressure liquid refrigerant flows toward the four-way compression connection pipe 7*c* where low-pressure gas refrigerant flows, and can also directly adjust the amount of refrigerant passing through. The pipe heat exchanger 73 performs heat exchange between the refrigerant flowing through the high-pressure side liquid bypass pipe 71*a* and the refrigerant flowing through the low-pressure side liquid bypass pipe 71*b*. The refrigerant flowing through the low-pressure side liquid bypass pipe 71*b* is herein depressurized when passing through the liquid bypass expansion valve 72, and the refrigerant becomes lower in temperature than it had been before passing through the liquid bypass expansion valve 72. Therefore, in the pipe heat exchanger 73, the refrigerant flowing within the high-pressure side liquid bypass pipe 71*a* can be cooled by the refrigerant flowing within the low-pressure side liquid bypass pipe 71*b*. At this time, the refrigerant flowing through the low-pressure side liquid bypass pipe 71*b* takes heat from the liquid refrigerant flowing within the high-pressure side liquid bypass pipe 71*a*, becomes a gas state, and flows toward the four-way compression connection pipe 7*c*. The controller herein regulates the valve opening degree of the liquid bypass expansion valve 72 on the basis of the temperature detected by the liquid bypass temperature sensor 74, such that of the refrigerant flowing within the high-pressure side liquid bypass pipe 71*a*, the refrigerant in the portion passing through the pipe heat exchanger 73 reliably becomes a liquid state. Furthermore, the controller 9 controls, via the liquid bypass expansion valve 72, the passing amount (passing capacity) of the liquid refrigerant controlled such that the refrigerant in the portion passing through the pipe heat exchanger 73 reliably becomes a liquid state from among the refrigerant flowing within the high-pressure side liquid bypass pipe 71*a*. It is thereby possible to prevent a gas state from coexisting in the refrigerant passing through the liquid bypass expansion valve 72 and to achieve an entirely liquid state, and it is therefore possible to guarantee that the density of the refrigerant passing through the liquid bypass expansion valve 72 will be substantially constant. The pipe heat exchanger 73 herein has the ability, size, and capacity sufficient to enable the liquid refrigerant flowing within the high-pressure side liquid bypass pipe 71*a* to reliably achieve a liquid state with a certain margin. The controller 9 thereby controls the refrigerant passage capacity per unit time in the liquid bypass expansion valve 72 while maintaining the liquid state within this margin range, whereby the quantity of refrigerant that is circulated using the liquid bypass circuit 270 can be stabilized.

The hot gas bypass circuit 80 has a hot gas bypass pipe 81 and a hot gas bypass valve 82. The hot gas bypass pipe 81 connects together an outdoor unit interconnection pipe 8 and a four-way compression connection pipe 7*c* for connecting the suction side of the compressor 21 to the four-way switching valve 22. The hot gas bypass valve 82 is provided within the path of the hot gas bypass pipe 81, and is capable of switching between an open state in which the refrigerant is allowed to pass through the hot gas bypass pipe 81, and a closed state in which the refrigerant is not allowed to pass through. The portion of the hot gas bypass pipe 81 which extends from the hot gas bypass valve 82 to the outdoor unit interconnection pipe 8 is a high-pressure side hot gas bypass pipe 81*a*. The portion of the hot gas bypass pipe 81 that extends from the hot gas bypass valve 82 to the gas refrigerant connection pipe 7 is a low-pressure side hot gas bypass pipe 81*b*. This hot gas bypass circuit 80 can be utilized in cases in which there is no intention to send cold refrigerant to the indoor units 4 and 5 during the heating operation, for example. That is, at the start of the heating operation, the refrigerant can be warmed in the inside of the outdoor unit 2 by temporarily opening the hot gas bypass valve 82 and connecting the discharge side of the compressor 21 with the suction side. It is thereby possible to prevent the supply of uncomfortable cold air to a user in the room at the start of the heating operation.

The liquid-side stop valve 26 is a valve provided to the connection port between the liquid refrigerant connection pipe 6 and the outdoor unit 2, which are external devices. The liquid-side stop valve 26 is disposed downstream of the subcooler 25 and upstream of the liquid refrigerant connection pipe 6 in the direction of refrigerant flow in the refrigerant circuit 210 during the cooling operation, and is capable of shutting off the passage of refrigerant. The liquid-side stop valve 26 of the second embodiment is connected to the subcooler 25 via the outdoor subcooling liquid-side stop interconnection pipe 6*b*.

The gas-side stop valve 27 is a valve provided to the connection port between the gas refrigerant connection pipe 7 and the outdoor unit 2, which are external devices. The gas-side stop valve 27 is connected to the four-way switching valve 22 via the gas stop four-way interconnection pipe 7*b*.

The outdoor unit 2 is provided with various sensors in addition to the liquid level detection sensor 239 described above. Specifically, the outdoor unit 2 is provided with a suction pressure sensor 29 for detecting the suction pressure of the compressor 21, a discharge pressure sensor 30 for detecting the discharge pressure of the compressor 21, a suction temperature sensor 31 for detecting the suction temperature of the compressor 21, and a discharge temperature sensor 32 for detecting the discharge temperature of the compressor 21. Furthermore, a liquid pipe temperature sensor 35 for detecting the temperature of the refrigerant (that is, the liquid pipe temperature) is provided to the outlet of the subcooler 25 on the side facing the outdoor heat exchange expansion interconnection pipe 6*e*. The subcooling merging pipe 65 of the subcooling refrigerant pipe 61 is provided with a subcooling temperature sensor 63 for detecting the temperature of refrigerant flowing through the outlet of the subcooler 25 on the bypass refrigerant pipe side. The side of the outdoor unit 2 having the outdoor air suction port is provided with an outdoor temperature sensor 36 for detecting the temperature of outdoor air flowing into the unit (that is, the outdoor air temperature). The suction temperature sensor 31, the discharge temperature sensor 32, the liquid pipe temperature sensor 35, the outdoor temperature sensor 36, and the subcooling temperature sensor 63 are configured from thermistors in the second embodiment.

The outdoor-side controller 37 is provided to the outdoor unit 2 and performs control of the actions of the respective components constituting the outdoor unit 2. The outdoor-side controller 37 has a microcomputer provided in order to perform control of the outdoor unit 2 as well as an inverter circuit or the like for controlling the motor 21*m*, and is connected with the memory 19.

The indoor-side controllers 47 and 57 are provided to the indoor units 4 and 5, and perform control of the actions of the respective components constituting the indoor units 4 and 5.

The outdoor-side controller 37 can exchange control signals and the like with the indoor-side controllers 47 and 57 of the indoor units 4 and 5 via a transmission line (not shown).

The controller 9 for controlling the operation of the entire air conditioning apparatus 201 is configured from the indoor-side controllers 47 and 57, the outdoor-side controller 37, and the transmission line (not shown) connecting these controllers.

Figure 29:
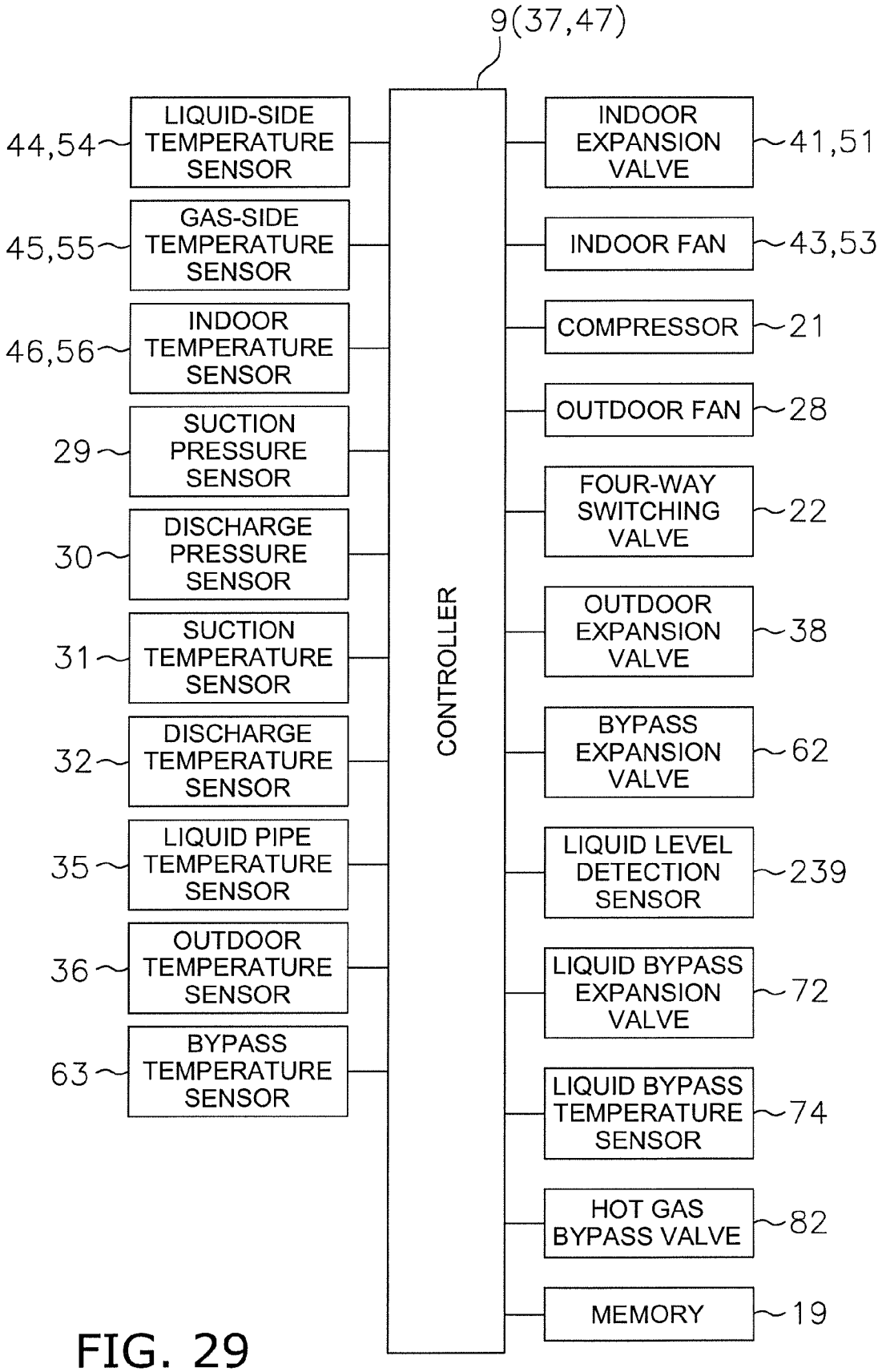
FIG. 29 is a control block diagram of the air conditioning apparatus.

The controller 9 is connected so as to be capable of receiving the detection signals of the various sensors 29 to 32, 35, 36, 239, 44 to 46, 54 to 56, 63, and 74 as shown in FIG. 29, which is a control block diagram of the air conditioning apparatus 201. The controller 9 can control the various devices and valves 21, 22, 28, 38, 41, 43, 51, 53, 62, 72, 82 on the basis of these detection signals and the like. Various types of data are stored in the memory 19 constituting the controller 9. Examples of the various types of data stored include the volume of the pipe interiors of the outdoor heat exchange expansion interconnection pipe 6*e* and the high-pressure side liquid bypass pipe 71*a* from the outdoor expansion valve 38 to the outdoor heat exchanger 23; a relational expression for calculating the quantity of refrigerant reserved in the outdoor heat exchanger 23 from the liquid level height h detected by the liquid level detection sensor 239; the total stop pipe volume which is a sum of the pipe interior volumes from the indoor expansion valve 41 to a liquid refrigerant indoor-side branching point D1, from the indoor expansion valve 51 to the liquid refrigerant indoor-side branching point D1, and from the liquid refrigerant indoor-side branching point D1 to the liquid-side stop valve 26; liquid refrigerant density data corresponding to temperature conditions; and the proper refrigerant quantity of the refrigerant circuit 210 of the air conditioning apparatus 201 per property where, for example, pipe length has been considered after being installed in a building. Additionally, when performing the proper refrigerant quantity automatic charging operation and the refrigerant leak detection operation described later, the controller 9 reads these data, charges the refrigerant circuit 210 with just the proper quantity of the refrigerant, and judges whether or not there is a refrigerant leak by comparison with the proper refrigerant quantity data.

(Refrigerant Connection Pipes)

The refrigerant connection pipes 6 and 7 are refrigerant pipes constructed on site when installing the air conditioning apparatus 201 in an installation location such as a building. Pipes having various lengths and pipe diameters are used as these refrigerant connection pipes depending on installation conditions such as the installation location and the combination of outdoor units and indoor units. For this reason, for example, when installing a new air conditioning apparatus, it is necessary to charge the air conditioning apparatus 201 with the proper quantity of the refrigerant corresponding to installation conditions such as the lengths and the pipe diameters of the refrigerant connection pipes 6 and 7.

The liquid refrigerant connection pipe 6 has indoor-side liquid branching pipes 4*a* and 5*a*, an outdoor-side liquid pipe 6*a*, and a liquid refrigerant indoor-side branching point D1. The indoor-side liquid branching pipe 4*a* is a pipe which extends from the indoor expansion valve 41. The indoor-side liquid branching pipe 5*a* is a pipe which extends from the indoor expansion valve 51. The indoor-side liquid branching pipe 4*a*, the indoor-side liquid branching pipe 5*a*, and the outdoor-side liquid pipe 6*a* merge at the liquid refrigerant indoor-side branching point D1.

The gas refrigerant connection pipe 7 has indoor-side gas branching pipes 4*c* and 5*c*, an outdoor-side gas pipe 7*a*, and a gas refrigerant indoor-side branching point E1. The indoor-side gas branching pipe 4*c* is a pipe which extends from the indoor heat exchanger 42. The indoor-side gas branching pipe 5*c* is a pipe which extends from the indoor heat exchanger 52. The indoor-side gas branching pipe 4*c*, the indoor-side gas branching pipe 5*c*, and the outdoor-side gas pipe 7*a* merge at the gas refrigerant indoor-side branching point E1.

As described above, the refrigerant circuit 210 of the air conditioning apparatus 201 is configured as a result of the indoor-side refrigerant circuits 210*a* and 210*b*, the outdoor-side refrigerant circuit 210*c*, and the refrigerant connection pipes 6 and 7 being connected. Additionally, the air conditioning apparatus 201 of the present embodiment is configured to perform operations by switching between the cooling operation and the heating operation with the four-way switching valve 22 and also to perform control of each device of the outdoor unit 2 and the indoor units 4 and 5 in accordance with the operating loads of each of the indoor units 4 and 5, using the controller 9 configured by the indoor-side controllers 47 and 57 and the outdoor-side controller 37.

<2.2> Operation of Air Conditioning Apparatus

Next, operation of the air conditioning apparatus 201 of the present embodiment will be described.

As operation modes of the air conditioning apparatus 201 of the present embodiment, there are a normal operation mode, an proper refrigerant quantity automatic charging operation mode, and a refrigerant leak detection operation mode.

In the normal operation mode, control of the configural devices of the outdoor unit 2 and the indoor units 4 and 5 is performed in accordance with the operating loads of each of the indoor units 4 and 5. In the proper refrigerant quantity automatic charging operation mode, the refrigerant circuit 210 is charged with the proper quantity of the refrigerant when test operation is performed, for example, after installation of the configural devices of the air conditioning apparatus 201. In the refrigerant leak detection operation mode, it is determined whether or not there is leakage of the refrigerant from the refrigerant circuit 210 after test operation including this proper refrigerant quantity automatic charging operation is ended and normal operation is started.

Operation in each operation mode of the air conditioning apparatus 201 will be described below.

(Normal Operation Mode)

First, the cooling operation in the normal operation mode will be described using FIG. 31.

—Cooling Operation—

During the cooling operation, the four-way switching valve 22 is in the state indicated by the solid lines in FIG.

28, that is, a state where the discharge side of the compressor 21 is connected to the gas side of the outdoor heat exchanger 23 and where the suction side of the compressor 21 is connected to the gas sides of the indoor heat exchangers 42 and 52 via the gas-side stop valve 27 and the gas refrigerant connection pipe 7. The outdoor expansion valve 38 is in a completely open state. The liquid-side stop valve 26 and the gas-side stop valve 27 are in an open state. The controller 9 performs control of each of the indoor expansion valves 41 and 51 such that by regulating their opening degrees, the degree of superheating of the refrigerant in the outlets of the indoor heat exchangers 42 and 52 (that is, the gas sides of the indoor heat exchangers 42 and 52) becomes a degree-of-superheating target value and constant. During the cooling operation, the liquid bypass expansion valve 72 and the hot gas bypass valve 82 are closed.

The degree of superheating of the refrigerant in the outlets of each of the indoor heat exchangers 42 and 52 is detected by subtracting the refrigerant temperature values (which correspond to the evaporation temperatures) detected by the liquid-side temperature sensors 44 and 54 from the refrigerant temperature values detected by the gas-side temperature sensors 45 and 55. The opening degree of the subcooling expansion valve 62 is regulated so that the degree of superheating of the refrigerant in the outlet of the subcooler 25 on the side facing the subcooling refrigerant pipe 61 reaches a degree-of-superheating target value (hereinbelow referred to as degree of superheating control).

Here, the degree of superheating of the refrigerant in the suction side of the compressor 21 after passing through the subcooler 25 in the subcooling refrigerant pipe 61 is detected by converting the suction pressure of the compressor 21 detected by the suction pressure sensor 29 to a saturation temperature value corresponding to the evaporation temperature and subtracting this refrigerant saturation temperature value from the refrigerant temperature value detected by the subcooling temperature sensor 63.

When the compressor 21, the outdoor fan 28, and the indoor fans 43 and 53 are operated in this state of the refrigerant circuit 210, low-pressure gas refrigerant is sucked into the compressor 21 and compressed to become high-pressure gas refrigerant. The high-pressure gas refrigerant is thereafter sent to the outdoor heat exchanger 23 via the four-way switching valve 22. In this outdoor heat exchanger 23, the high-pressure gas refrigerant performs heat exchange with outdoor air supplied by the outdoor fan 28 and is condensed into high-pressure liquid refrigerant. This high-pressure liquid refrigerant passes through the outdoor expansion valve 38, flows into the subcooler 25, performs heat exchange with the refrigerant flowing through the subcooling refrigerant pipe 61, and is further cooled to a subcooled state. At this time, some of the high-pressure liquid refrigerant condensed in the outdoor heat exchanger 23 is branched to the subcooling refrigerant pipe 61, depressurized by the subcooling expansion valve 62, and then returned to the suction side of the compressor 21. Here, some of the refrigerant passing through the subcooling expansion valve 62 evaporates due to being depressurized to approximately the suction pressure of the compressor 21. The refrigerant flowing from the subcooling expansion valve 62 of the subcooling refrigerant pipe 61 toward the suction side of the compressor 21 then passes through the subcooler 25 and performs heat exchange with the high-pressure liquid refrigerant sent from the outdoor heat exchanger 23 to the indoor units 4 and 5. The high-pressure liquid refrigerant that has reached a subcooled state by passing through the subcooler 25 is then sent to the indoor units 4 and 5 via the liquid-side stop valve 26 and the liquid refrigerant connection pipe 6.

This high-pressure liquid refrigerant sent to the indoor units 4 and 5 is depressurized by the indoor expansion valves 41 and 51 to approximately the suction pressure of the compressor 21, resulting in low-pressure gas-liquid two-phase refrigerant, which is sent to the indoor heat exchangers 42 and 52 where the refrigerant performs heat exchange with room air in the indoor heat exchangers 42 and 52 and evaporates into a low-pressure gas refrigerant.

This low-pressure gas refrigerant is sent to the outdoor unit 2 via the gas refrigerant connection pipe 7. The low-pressure gas refrigerant sent to the outdoor unit 2 is again sucked into the compressor 21 via the gas-side stop valve 27 and the four-way switching valve 22.

In this manner, the air conditioning apparatus 201 is capable of performing as one form of an operation mode a cooling operation in which the outdoor heat exchanger 23 is made to function as a condenser of the refrigerant compressed in the compressor 21 and the indoor heat exchangers 42 and 52 are made to function as evaporators of the refrigerant.

Figure 31:
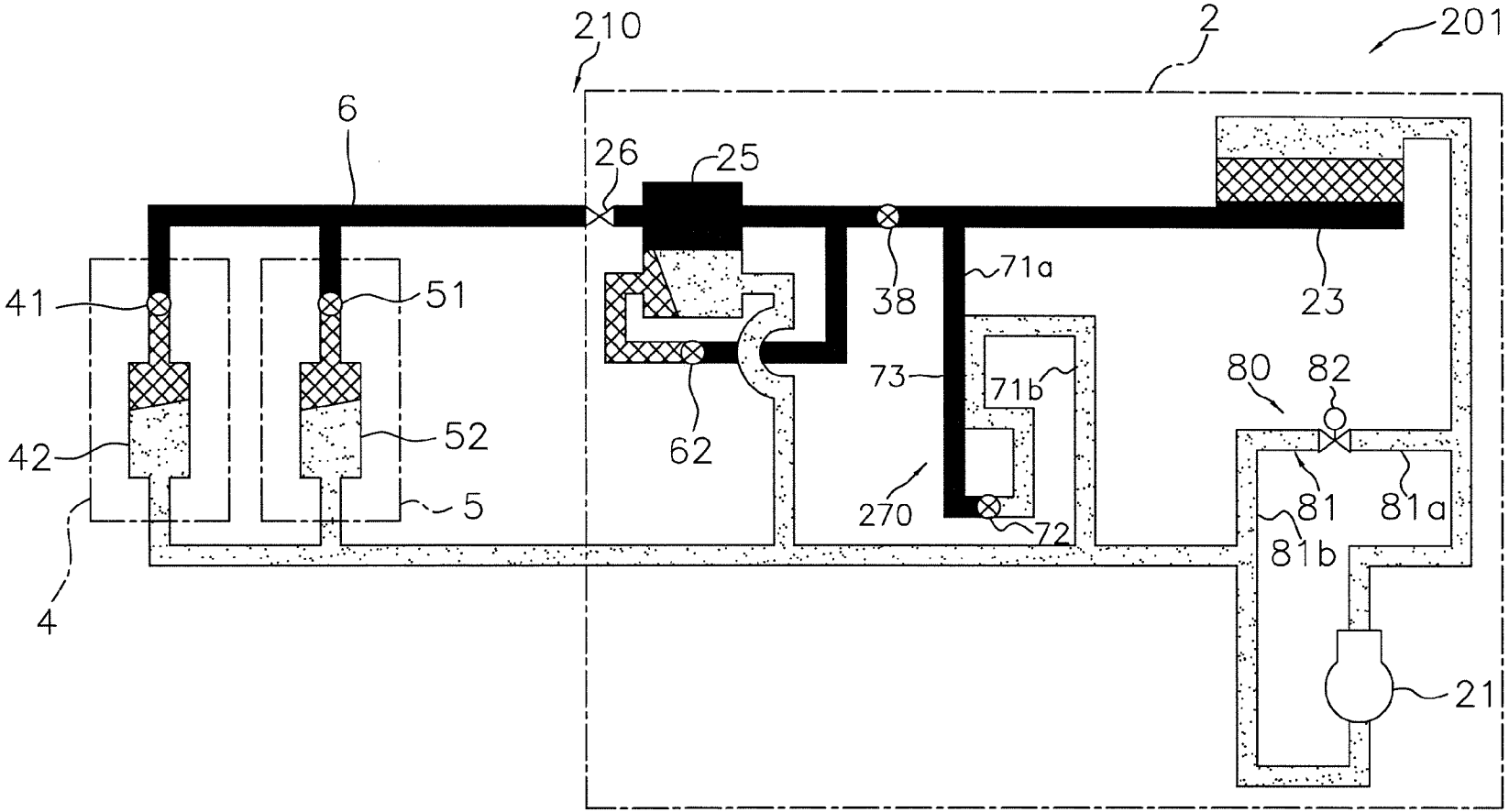
FIG. 31 is a schematic diagram showing the state of refrigerant flowing within the refrigerant circuit during the cooling operation.

Here, the distribution state of the refrigerant in the refrigerant circuit 210 when performing the cooling operation in the normal operation mode is such that, as shown in FIG. 31 which is a schematic view showing the state of the refrigerant flowing through the refrigerant circuit 210 during the cooling operation, the refrigerant is in each of the states of a liquid state (the filled-in hatching portion in FIG. 31), a gas-liquid two-phase state (the grid-like hatching portions in FIG. 31) and a gas state (the diagonal line hatching portion in FIG. 31). Specifically, the part of the refrigerant circuit 210 filled with liquid refrigerant corresponds to the portion extending from the vicinity of the outlet of the outdoor heat exchanger 23 to the indoor expansion valves 41 and 51 via the outdoor heat exchange expansion interconnection pipe 6*e*, the outdoor expansion valve 38, the outdoor expansion subcooling interconnection pipe 6*c*, the subcooler 25, the outdoor subcooling liquid-side stop interconnection pipe 6*b*, the liquid-side stop valve 26, and the liquid refrigerant connection pipe 6; as well as the subcooling expansion pipe 6*d*, which is the portion of the subcooling refrigerant pipe 61 upstream of the subcooling expansion valve 62. The parts of the refrigerant circuit 210 filled with the gas-liquid two-phase refrigerant are the portion of the subcooling branching pipe 64, the portion of the subcooler 25 on the side facing the subcooling refrigerant circuit 60 and in proximity to the inlet, and the portions in proximity to the inlets of the indoor heat exchangers 42 and 52. The parts of the refrigerant circuit 210 filled with the gas-state refrigerant are the portions extending from the middles of the indoor heat exchangers 42 and 52 to the inlet of the outdoor heat exchanger 23 via the gas refrigerant connection pipe 7 and the compressor 21, the portion in proximity to the inlet of the outdoor heat exchanger 23, and the portion extending from the middle portion of the subcooler 25 on the side of the subcooler 25 facing the subcooling refrigerant circuit 60 to the merging point between the subcooling merging pipe 65 and the suction side of the compressor 21.

In the cooling operation of the normal operation mode, the refrigerant is distributed inside the refrigerant circuit 210 with this type of distribution, but in the refrigerant quantity determination operations of the proper refrigerant quantity automatic charging operation mode and the refrigerant leak detection operation mode described hereinafter, the distribution is such that the liquid refrigerant is collected in the liquid refrigerant connection pipe 6 and the outdoor heat exchanger 23 (see FIG. 30).

—Heating Operation—

Next, the heating operation in the normal operation mode will be described.

During the heating operation, the four-way switching valve 22 is in the state indicated by the dotted lines in FIG. 28, that is, a state where the discharge side of the compressor 21 is connected to the gas sides of the indoor heat exchangers 42 and 52 via the gas-side stop valve 27 and the gas refrigerant connection pipe 7 and where the suction side of the compressor 21 is connected to the gas side of the outdoor heat exchanger 23. The opening degree of the outdoor expansion valve 38 is controlled by the controller 9 in order to depressurize the refrigerant flowing into the outdoor heat exchanger 23 to a pressure at which the refrigerant can be evaporated in the outdoor heat exchanger 23 (that is, an evaporation pressure). The liquid-side stop valve 26 and the gas-side stop valve 27 are in open states. The degree of subcooling of the refrigerant in the outlets of the indoor heat exchangers 42 and 52 is controlled so as to be constant at a degree of subcooling target value by regulating the opening degrees of the indoor expansion valves 41 and 51 with the controller 9.

At the start of the heating operation, in cases in which there is no intention to send cold refrigerant to the indoor units 4 and 5, the refrigerant can be warmed inside the outdoor unit 2 by temporarily opening the hot gas bypass valve 82 at the start of the heating operation and connecting the discharge side of the compressor 21 with the suction side. It is thereby possible to prevent uncomfortable cold air from being supplied to an indoor user at the start of the heating operation. The liquid bypass expansion valve 72 is in a closed state.

Here, the degree of subcooling of the refrigerant in the outlets of the indoor heat exchangers 42 and 52 is detected by converting the discharge pressure of the compressor 21 detected by the discharge pressure sensor 30 into a saturation temperature value corresponding to the condensation temperature and subtracting the refrigerant temperature values detected by the liquid-side temperature sensors 44 and 54 from this saturation temperature value of the refrigerant. During the heating operation, the subcooling expansion valve 62 is closed.

When the compressor 21, the outdoor fan 28, and the indoor fans 43 and 53 are operated while the refrigerant circuit 210 is in this state, the low-pressure gas refrigerant is sucked into the compressor 21 and compressed into high-pressure gas refrigerant, and is then sent to the indoor units 4 and 5 via the four-way switching valve 22, the gas-side stop valve 27, and the gas refrigerant connection pipe 7.

Then, the high-pressure gas refrigerant sent to the indoor units 4 and 5 performs heat exchange with the room air, is condensed and becomes high-pressure liquid refrigerant in the indoor heat exchangers 42 and 52, and is thereafter depressurized according to the valve opening degrees of the indoor expansion valves 41 and 51 when passing through the indoor expansion valves 41 and 51.

Having passed through the indoor expansion valves 41 and 51, the refrigerant is sent to the outdoor unit 2 via the liquid refrigerant connection pipe 6, the refrigerant is further depressurized via the liquid-side stop valve 26, the subcooler 25, and the outdoor expansion valve 38, and the refrigerant flows into the outdoor heat exchanger 23. Having flowed into the outdoor heat exchanger 23, the low-pressure gas-liquid two-phase refrigerant then performs heat exchange with the outdoor air supplied by the outdoor fan 28 and evaporates into a low-pressure gas refrigerant. This low-pressure gas refrigerant is sucked again into the compressor 21 via the four-way switching valve 22.

Operation control in the normal operation mode described above is performed by the controller 9 (more specifically, the indoor-side controllers 47 and 57, the outdoor-side controller 37, and the transmission line, not shown, that interconnects the controllers and enables correspondence between them) functioning as operation controlling means that performs normal operation including the cooling operation and the heating operation.

(Proper Refrigerant Quantity Automatic Charging Operation Mode)

Next, the proper refrigerant quantity automatic charging operation mode performed at the time of test operation will be described using FIG. 32 to FIG. 35.

Figure 32:
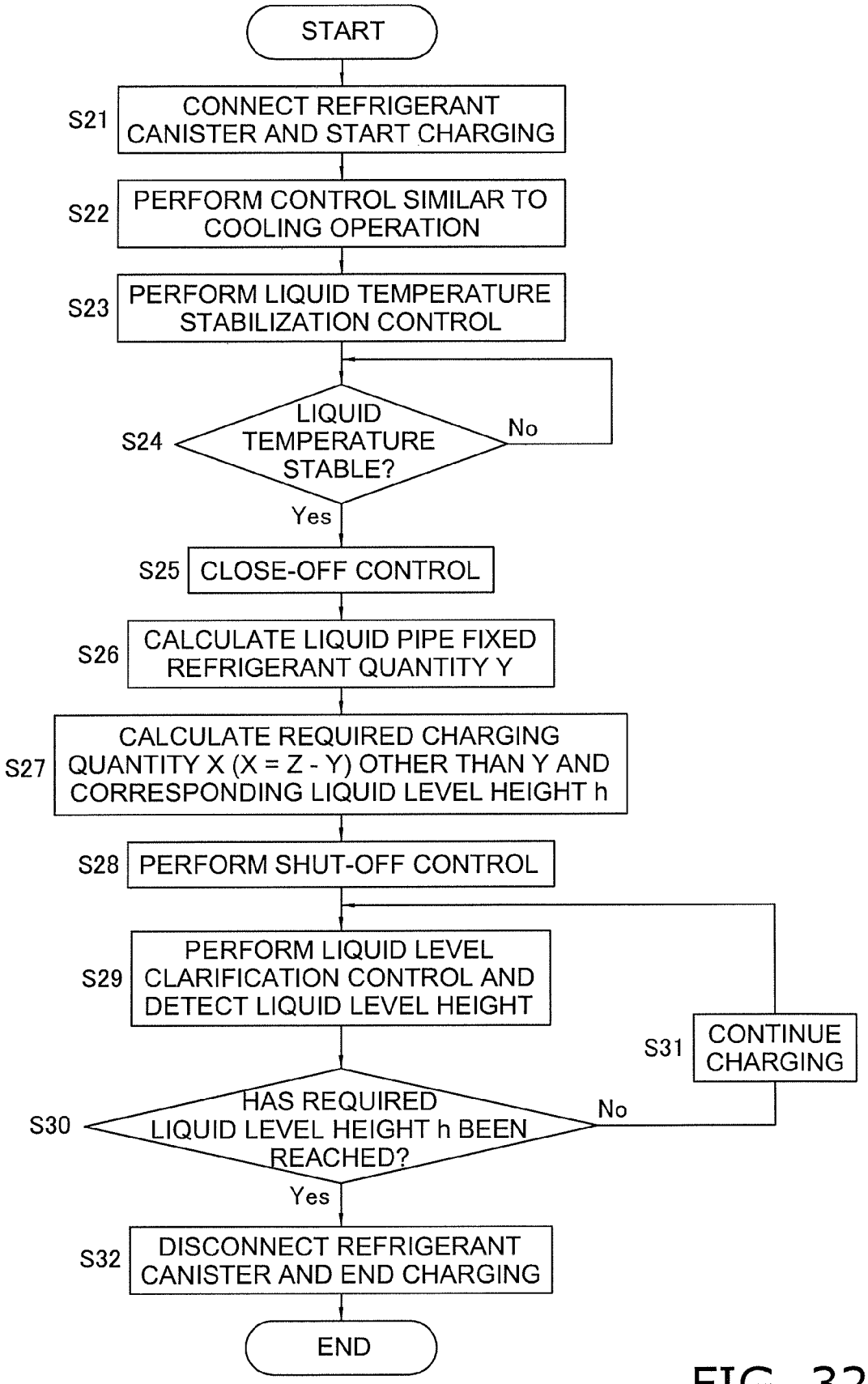
FIG. 32 is a flowchart of the proper refrigerant quantity charging operation.

FIG. 32 is a flowchart of a proper refrigerant quantity automatic charging operation.

Figure 33:
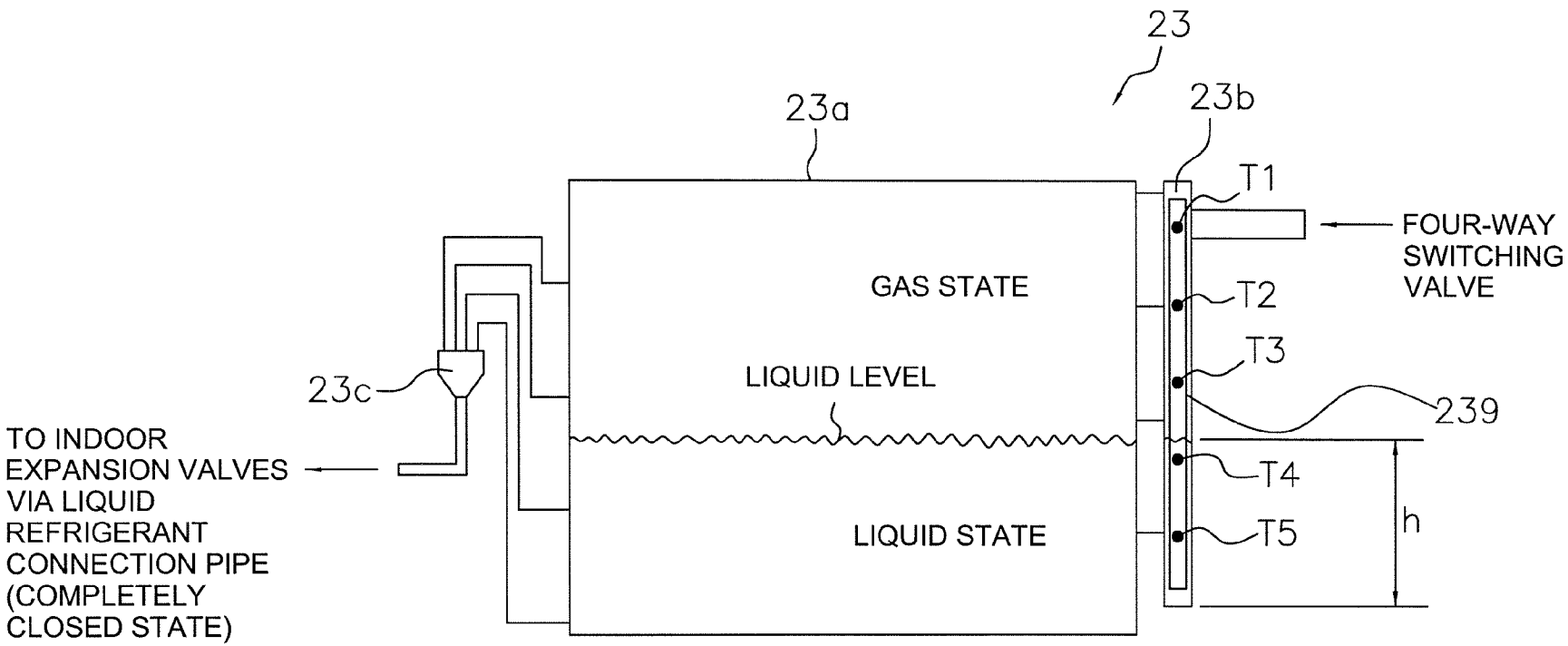
FIG. 33 is a schematic diagram showing the refrigerant accumulating in the outdoor heat exchanger.

FIG. 33 is a diagram schematically showing the insides of the heat exchanger body 23*a* and the header 23*b* of FIG. 2.

Figure 34:
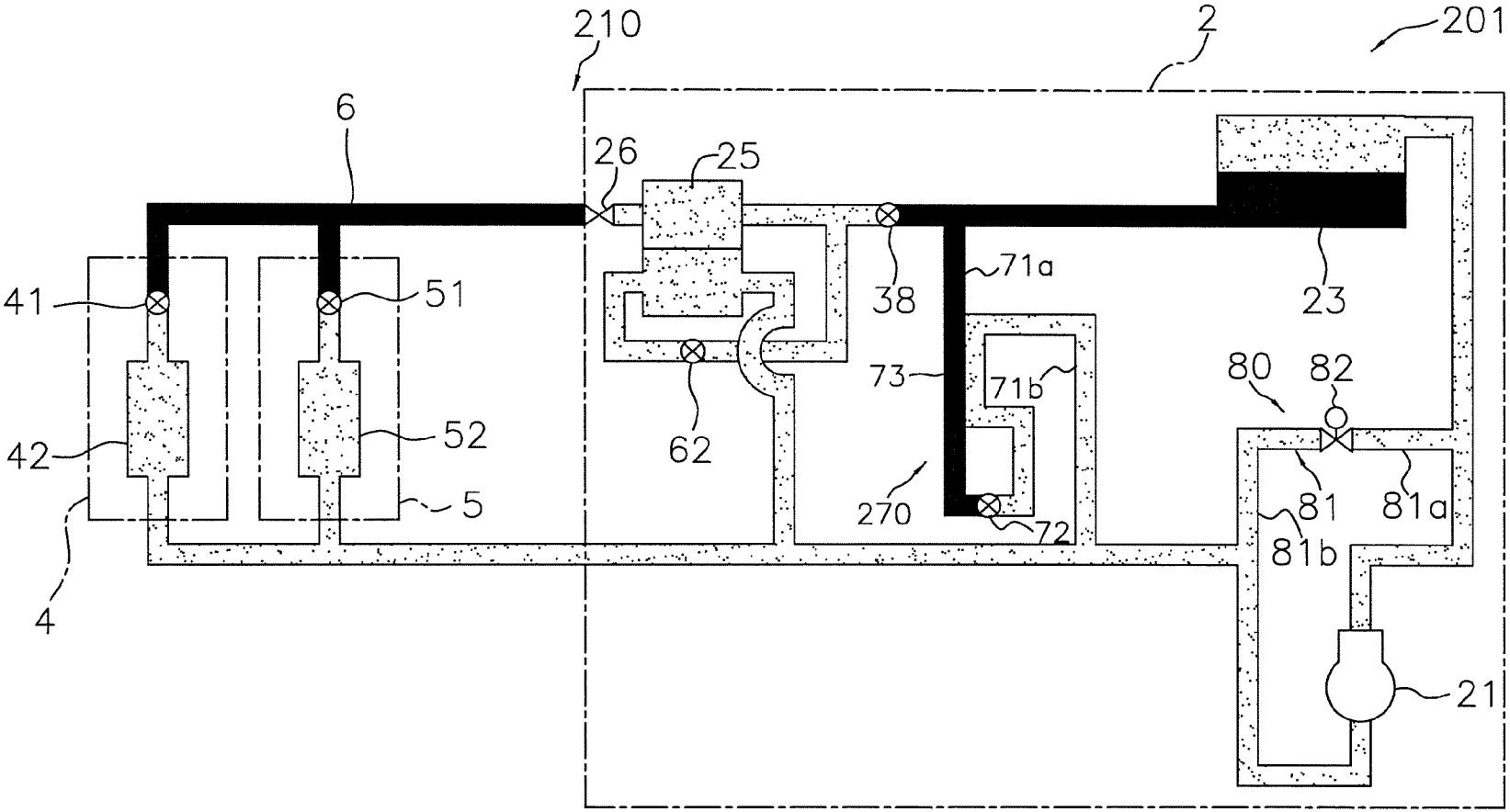
FIG. 34 is a diagram showing the liquid refrigerant accumulating in the outdoor heat exchanger when the indoor expansion valves are in a completely closed state.

FIG. 34 is a schematic diagram showing states of the refrigerant flowing through the inside of the refrigerant circuit 210 before detection in the proper refrigerant quantity automatic charging operation. FIG. 34 shows refrigerant accumulating in the outdoor heat exchanger 23 in the proper refrigerant quantity automatic charging operation.

The proper refrigerant quantity automatic charging operation mode is an operation mode performed at the time of test operation after installation of the configural devices of the air conditioning apparatus 201, for example. This proper refrigerant quantity automatic charging operation mode is an operation mode where the refrigerant circuit 210 is automatically charged with the proper quantity of the refrigerant corresponding to the capacities of the liquid refrigerant connection pipe 6 and the gas refrigerant connection pipe 7.

The liquid-side stop valve 26 and the gas-side stop valve 27 of the outdoor unit 2 are opened, and the refrigerant charged beforehand in the outdoor unit 2 fills the inside of the refrigerant circuit 210.

Next, the worker performing the proper refrigerant quantity automatic charging operation connects a refrigerant canister for additional charging to the refrigerant circuit 210 (for example, to the suction side of the compressor 21 or another location) and starts charging.

Then, the worker issues, directly or with a remote controller (not shown) or the like, a command to the controller 9 to start the proper refrigerant quantity automatic charging operation.

In this manner, the controller 9 performs a refrigerant quantity determination operation and a determination of the properness of the refrigerant quantity accompanied by the processing of step S21 to step S32 shown in FIG. 32.

In the proper refrigerant quantity charging operation mode, the liquid bypass expansion valve 72 is in a completely closed state.

In step S21, while detecting that the connection of the refrigerant canister is complete, the controller 9 sets a valve (not shown) provided to a pipe extending from the refrigerant canister to a state which allows refrigerant to be supplied, and starts additional charging of the refrigerant.

In step S22, with the hot gas bypass valve 82 in a closed state, the controller 9 controls the devices so that the same operation is performed as that of the control described in the paragraphs on the cooling operation of the normal operation mode described above. The inside of the refrigerant circuit 210 is thereby charged with additional refrigerant from the refrigerant canister for additional charging.

In step S23, temperature stabilization control is performed by the controller 9.

In liquid temperature stabilization control, the controller 9 performs condensation pressure control and liquid pipe temperature control. In condensation pressure control, the controller 9 controls the quantity of outdoor air supplied to the outdoor heat exchanger 23 by the outdoor fan 28 so that the condensation pressure of the refrigerant in the outdoor heat exchanger 23 becomes constant, while the hot gas bypass valve 82 is in a closed state. Since the condensation pressure of the refrigerant in the condenser varies greatly due to being affected by the outdoor temperature, the controller 9 controls the quantity of room air supplied to the outdoor heat exchanger 23 from the outdoor fan 28 by performing output control on the motor 28*m* in accordance with the temperature detected by the outdoor temperature sensor 36. The condensation pressure of the refrigerant in the outdoor heat exchanger 23 can thereby be kept constant, and the state of the refrigerant flowing within the condenser can be stabilized. The portion of the refrigerant circuit 210 from the outdoor heat exchanger 23 to the indoor expansion valves 41 and 51, that is, the interiors of the outdoor heat exchange expansion interconnection pipe 6*e*, the outdoor expansion subcooling interconnection pipe 6*c*, the subcooling expansion pipe 6*d*, the outdoor subcooling liquid-side stop interconnection pipe 6*b*, the outdoor-side liquid pipe 6*a*, the liquid refrigerant indoor-side branching point D1, and the indoor-side liquid branching pipes 4*a* and 5*a* can each be controlled to a state in which high-pressure liquid refrigerant flows. It is thereby possible to also stabilize the pressure of the refrigerant in the portions from the outdoor heat exchanger 23 to the indoor expansion valves 41 and 51 and to the subcooling expansion valve 62. In the condensation pressure control herein, the controller 9 performs control by using the discharge pressure of the compressor 21 detected by the discharge pressure sensor 30 as the condensation pressure. Furthermore, in liquid pipe temperature control, which is another control form of liquid temperature stabilization control, unlike the degree of superheating control in the cooling operation of the normal operation mode described above, the ability of the subcooler 25 is controlled so that the temperature of the refrigerant sent from the subcooler 25 to the indoor expansion valves 41 and 51 becomes constant. More specifically, in liquid pipe temperature control, while the hot gas bypass valve 82 remains in a closed state, the controller 9 performs control for regulating the opening degree of the subcooling expansion valve 62 in the subcooling refrigerant pipe 61 so as to achieve stabilization at a liquid pipe temperature target value in the temperature of the refrigerant detected by the liquid pipe temperature sensor 35 provided to the outlet of the subcooler 25 on the side facing the outdoor subcooling liquid-side stop interconnection pipe 6*b*. Thereby, the refrigerant density in the refrigerant pipe including the liquid refrigerant connection pipe 6 extending from the outlet of the subcooler 25 on the side facing the outdoor subcooling liquid-side stop interconnection pipe 6*b* to the indoor expansion valves 41 and 51 can be stabilized at a certain constant value.

In step S24, the controller 9 determines whether or not the change in the temperature detected by the liquid pipe temperature sensor 35 has been maintained within a range of plus or minus 2° C. for 5 minutes, that is, whether or not the temperature has stabilized. If the controller 9 determines that it has not stabilized, the controller 9 continues the liquid temperature stabilization control and an ability ratio control. If the controller 9 determines that the temperature has stabilized, the sequence advances to step S25.

In step S25, the controller 9 performs close-off control for completely closing the liquid-side stop valve 26 after the indoor expansion valves 41 and 51 have been completely closed. The liquid refrigerant from the indoor expansion valves 41 and 51 to the liquid-side stop valve 26 can thereby be specified as a refrigerant which has been controlled to a certain temperature by the liquid temperature stabilization control and which has the volume of the pipe interior from the indoor expansion valves 41 and 51 to the liquid-side stop valve 26.

In step S26, the controller 9 reads liquid refrigerant density data corresponding to temperature conditions as well as stopped pipe volume data, which is the total of pipe interior volumes in the refrigerant circuit 10 from the indoor expansion valve 41 to the liquid refrigerant indoor-side branching point D1, from the indoor expansion valve 51 to the liquid refrigerant indoor-side branching point D1, and from the liquid refrigerant indoor-side branching point D1 to the liquid-side stop valve 26; the data being stored in the memory 19. The controller 9 multiplies the liquid refrigerant density corresponding to the temperature detected by the liquid pipe temperature sensor 35 by the stopped pipe volume which is the total of pipe interior volumes from the indoor expansion valve 41 to the liquid refrigerant indoor-side branching point D1, from the indoor expansion valve 51 to the liquid refrigerant indoor-side branching point D1, and from the liquid refrigerant indoor-side branching point D1 to the liquid-side stop valve 26; and the controller 9 calculates a liquid pipe fixed refrigerant quantity Y, which is the quantity of the liquid refrigerant inside the pipe from the indoor expansion valves 41 and 51 to the liquid-side stop valve 26. A highly precise value which also accounts for the liquid refrigerant density corresponding to temperature can be obtained for this liquid pipe fixed refrigerant quantity Y. In this manner, even in cases in which the refrigerant quantity inside the refrigerant circuit 210 exceeds the capacity inside the outdoor heat exchanger 23, it is possible to determine a precise quantity of refrigerant which has been quantified by an accurate volume and an accurate liquid refrigerant density, at least for the refrigerant which has been controlled so as to be stopped.

In step S27, the controller 9 reads the proper refrigerant quantity in the refrigerant circuit 210, which is stored in the memory 19. The controller 9 then subtracts the liquid pipe fixed refrigerant quantity Y determined as an accurate quantity from this proper refrigerant quantity Z, and calculates a heat exchange refrigerant quantity X which must be accumulated from the outdoor expansion valve 38 to the outdoor heat exchanger 23. Furthermore, the controller 9 reads the volume inside the outdoor heat exchange expansion interconnection pipe 6*e* from the outdoor expansion valve 38 to the outdoor heat exchanger 23, a relational expression for calculating the quantity of refrigerant accumulating inside the outdoor heat exchanger 23 from the liquid level height h detected by the liquid level detection sensor 239, and liquid refrigerant density data corresponding to temperature conditions, these data being stored in the memory 19. The controller 9 calculates the liquid level height h of the outdoor heat exchanger 23 corresponding to the calculated heat exchange refrigerant quantity X. Specifically, the controller 9 subtracts from the heat exchange refrigerant quantity X the value obtained by multiplying the liquid refrigerant density corresponding to the temperature conditions by the volume inside the outdoor heat exchange expansion interconnection pipe 6*e* from the outdoor expansion valve 38 to the outdoor heat exchanger 23. The liquid level height h is calculated from the quantity obtained by this subtraction and from the relational expression for calculating the quantity of refrigerant accumulating inside the outdoor heat exchanger 23 from the liquid level height h detected by the liquid level detection sensor 239. The liquid level height h herein is calculated using the liquid refrigerant density corresponding to the surrounding temperature at the point in time when detection is performed by the liquid level detection sensor 239, which will be described later. That is, the liquid refrigerant volume herein is large when the liquid refrigerant temperature in the header 23*b* portion of the outdoor heat exchanger 23 is high, and the liquid refrigerant volume is small when the temperature is low. Consequently, the higher the temperature of the header 23*b* portion of the outdoor heat exchanger 23, the higher the controller 9 sets the height position where the determination is made as to whether or not the proper refrigerant quantity has been charged, and the lower the temperature, the lower the controller 9 sets the height position where the determination is made as to whether or not the proper refrigerant quantity has been charged.

In step S28, the controller 9 performs shut-off control for completely closing the outdoor expansion valve 38. From the refrigerant inside the refrigerant circuit 210, it is possible for the compressor 21 to suck in the refrigerant located in the indoor unit interconnection pipe 4*b*, the indoor heat exchanger 42, and the indoor-side gas branching pipe 4*c*, which are on the side of the indoor expansion valve 41 facing the suction side of the compressor 21; the indoor unit interconnection pipe 5*b*, the indoor heat exchanger 52, and the indoor-side gas branching pipe 5*c*, which are on the side of the indoor expansion valve 51 facing the suction side of the compressor 21; the gas refrigerant indoor-side branching point E1, the outdoor-side gas pipe 7*a*, the outdoor heat exchange expansion interconnection pipe 6*e*, the outdoor expansion subcooling interconnection pipe 6*c*, the subcooler 25, the outdoor subcooling liquid-side stop interconnection pipe 6*b*, as well as the subcooling refrigerant circuit 60, the low-pressure side liquid bypass pipe 71*b*, the low-pressure side hot gas bypass pipe 81*b*, the gas stop four-way interconnection pipe 7*b*, and the four-way compression connection pipe 7*c*, as shown in FIG. 34. The refrigerant in these portions can thereby be supplied as high-temperature high-pressure gas refrigerant to the outdoor heat exchanger 23 by the compressor 21. The high-temperature high-pressure gas refrigerant supplied to the outdoor heat exchanger 23 is condensed into a liquid refrigerant by heat exchange in the outdoor heat exchanger 23. Since circulation of the refrigerant is stopped by the shut-off control, the liquid refrigerant condensed inside the outdoor heat exchanger 23 accumulates on the side of the outdoor expansion valve 38 facing the outdoor heat exchange expansion interconnection pipe 6*e*. The refrigerant that has become a liquid state is lower than the uncondensed high-temperature high-pressure gas refrigerant inside the outdoor heat exchanger 23 due to gravity, and gradually accumulates from the bottom of the outdoor heat exchanger 23.

Figure 35:
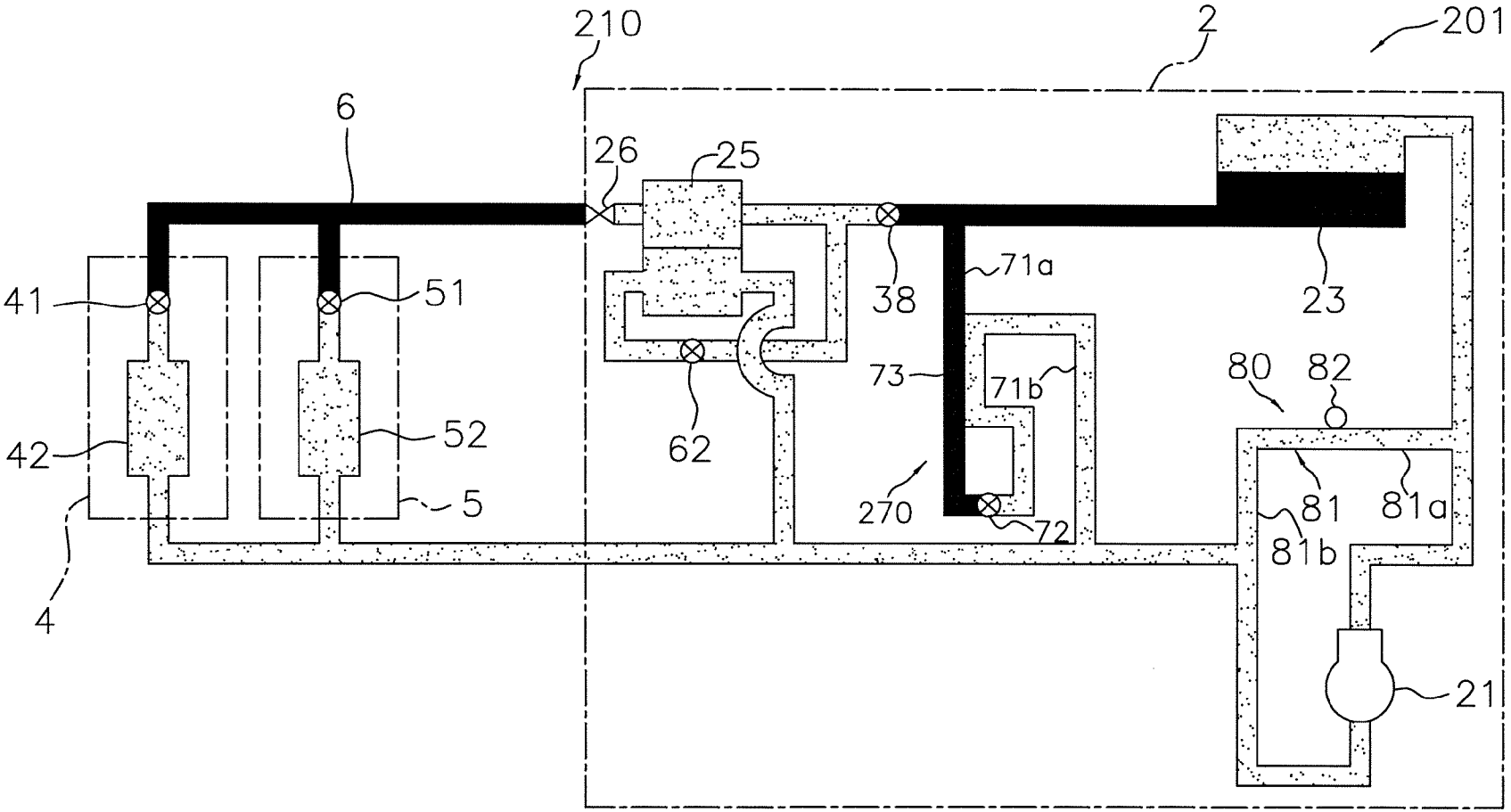
FIG. 35 is a diagram showing liquid level clarification control being performed.

In step S29, the controller 9 performs liquid level clarification control. In this liquid level clarification control, the controller 9 rapidly reduces the gas-phase refrigerant temperature inside the outdoor heat exchanger 23 by controlling the opened/closed state of the hot gas bypass valve 82 as described hereinbelow. Specifically, the controller 9 opens the hot gas bypass valve 82, thereby causing a state in which the outdoor unit interconnection pipe 8 is communicated with the suction side of the compressor 21, as shown in FIG. 35. The refrigerant pressure inside the outdoor unit interconnection pipe 8 thereby rapidly decreases, and the temperature of the gas-phase refrigerant inside the outdoor heat exchanger 23 therefore rapidly decreases. However, the temperature of the liquid refrigerant inside the outdoor heat exchanger 23 does not rapidly change. Thereby, either a difference arises between the liquid-phase temperature and the gas-phase temperature of the refrigerant inside the outdoor heat exchanger 23, or the difference is increased. The liquid level detection sensor 239 can thereby precisely determine the liquid level height inside the outdoor heat exchanger 23 by performing liquid level detection immediately after this liquid level clarification control has been performed.

In step S30, the controller 9 corrects the detected value of the liquid level detection sensor 239, i.e., the liquid level height h corresponding to the heat exchange refrigerant quantity X calculated in step S27 so that the height corresponds to the liquid refrigerant density at the current temperature condition detected by the outdoor temperature sensor 36 as described above, and the controller 9 determines whether or not the refrigerant has been charged up to this corrected liquid level height h. In cases in which the controller 9 determines that the liquid level height h has not been reached, the sequence moves to step S31. In cases in which the controller 9 determines that the liquid level height h has been reached, the sequence moves to step S32.

In step S31, the controller 9 continues further charging from the refrigerant tank to the refrigerant circuit 210 for a predetermined amount of time, and the sequence returns to step S29.

In step S32, the controller 9 ends the additional charging from the refrigerant canister. Specifically, the valve (not shown) provided to the pipe extending from the refrigerant canister is set to a state which does not allow the passage of refrigerant.

(Refrigerant Leak Detection Operation Mode)

Next, the refrigerant leak detection operation mode will be described.

The refrigerant leak detection operation mode is substantially the same as the proper refrigerant quantity charging operation mode excluding being accompanied by refrigerant charging work.

The refrigerant leak detection operation mode is, for example, operation performed periodically (a time frame when it is not necessary to perform air conditioning, such as a holiday or late at night) when detecting whether or not the refrigerant is leaking to the outside from the refrigerant circuit 210.

Figure 36:
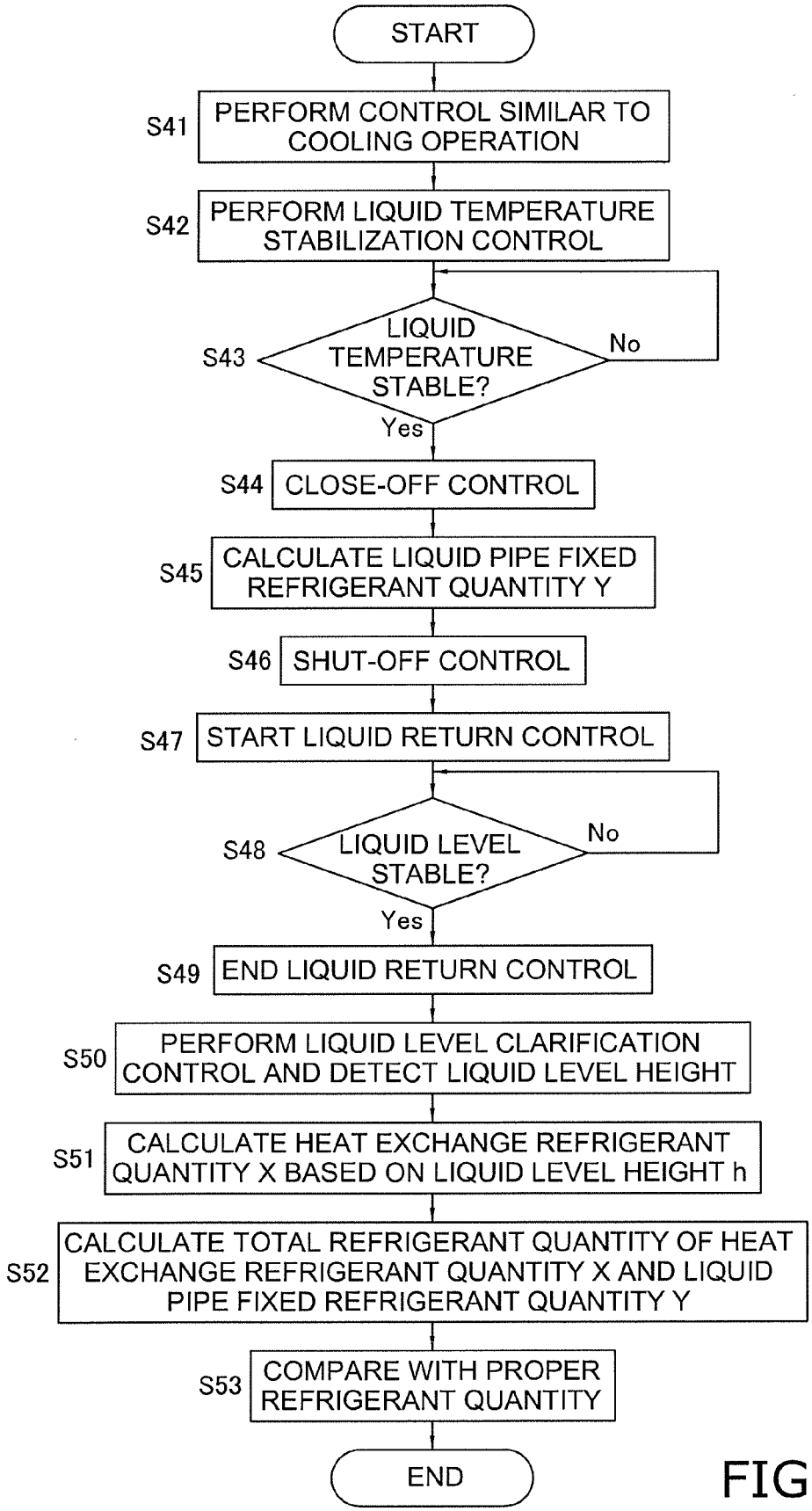
FIG. 36 is a flowchart of the refrigerant leak detection operation.

In the refrigerant leak detection operation mode, the processing performed by the sequence of steps S41 to S53 is performed as shown in FIG. 36.

Here, the liquid bypass expansion valve 72 is first started from a closed state by the controller 9.

In step S41, the controller 9 controls the devices so that the same operation is performed as that of the control described in the paragraphs on the cooling operation of the normal operation mode described above.

In step S42, temperature stabilization control is performed by the controller 9.

In liquid temperature stabilization control, the controller 9 performs condensation pressure control and liquid pipe temperature control. In condensation pressure control, the controller 9 controls the quantity of outdoor air supplied to the outdoor heat exchanger 23 by the outdoor fan 28 so that the condensation pressure of the refrigerant in the outdoor heat exchanger 23 becomes constant, while the hot gas bypass valve 82 is in a closed state. Since the condensation pressure of the refrigerant in the condenser varies greatly due to being affected by the outdoor temperature, the controller 9 controls the quantity of room air supplied to the outdoor heat exchanger 23 from the outdoor fan 28 by performing output control on the motor 28*m* in accordance with the temperature detected by the outdoor temperature sensor 36. The condensation pressure of the refrigerant in the outdoor heat exchanger 23 can thereby be kept constant, and the state of the refrigerant flowing within the condenser can be stabilized. The portion of the refrigerant circuit 210 from the outdoor heat exchanger 23 to the indoor expansion valves 41 and 51, that is, the interiors of the outdoor heat exchange expansion interconnection pipe 6*e*, the outdoor expansion subcooling interconnection pipe 6*c*, the subcooling expansion pipe 6*d*, the outdoor subcooling liquid-side stop interconnection pipe 6*b*, the outdoor-side liquid pipe 6*a*, the liquid refrigerant indoor-side branching point D1, and the indoor-side liquid branching pipes 4*a* and 5*a* can each be controlled to a state in which high-pressure liquid refrigerant flows. It is thereby possible to also stabilize the pressure of the refrigerant in the portions from the outdoor heat exchanger 23 to the indoor expansion valves 41 and 51 and to the subcooling expansion valve 62. In the condensation pressure control herein, the controller 9 performs control by using the discharge pressure of the compressor 21 detected by the discharge pressure sensor 30 as the condensation pressure. Furthermore, in liquid pipe temperature control, which is another control form of liquid temperature stabilization control, unlike the degree of superheating control in the cooling operation of the normal operation mode described above, the ability of the subcooler 25 is controlled so that the temperature of the refrigerant sent from the subcooler 25 to the indoor expansion valves 41 and 51 becomes constant. More specifically, in liquid pipe temperature control, while the hot gas bypass valve 82 remains in a closed state, the controller 9 performs control for regulating the opening degree of the subcooling expansion valve 62 in the subcooling refrigerant pipe 61 so as to achieve stabilization at a liquid pipe temperature target value in the temperature of the refrigerant detected by the liquid pipe temperature sensor 35 provided to the outlet of the subcooler 25 on the side facing the outdoor subcooling liquid-side stop interconnection pipe 6*b*. Thereby, the refrigerant density in the refrigerant pipe including the liquid refrigerant connection pipe 6 extending from the outlet of the subcooler 25 on the side facing the outdoor subcooling liquid-side stop interconnection pipe 6*b* to the indoor expansion valves 41 and 51 can be stabilized at a certain constant value.

In step S43, the controller 9 determines whether or not the change in the temperature detected by the liquid pipe temperature sensor 35 has been maintained within a range of plus or minus 2° C. for 5 minutes, that is, whether or not the temperature has stabilized. If the controller 9 determines that it has not stabilized, the controller 9 continues the liquid temperature stabilization control and an ability ratio control. If the controller 9 determines that the temperature has stabilized, the sequence advances to step S44.

In step S44, the controller 9 performs close-off control for completely closing the liquid-side stop valve 26 after the indoor expansion valves 41 and 51 have been completely closed. The liquid refrigerant from the indoor expansion valves 41 and 51 to the liquid-side stop valve 26 can thereby be specified as a refrigerant which has been controlled to a certain temperature by the liquid temperature stabilization control and which has the volume of the pipe interior from the indoor expansion valves 41 and 51 to the liquid-side stop valve 26.

In step S45, the controller 9 reads liquid refrigerant density data corresponding to temperature conditions as well as stopped pipe volume data, which is the total of pipe interior volumes in the refrigerant circuit 10 from the indoor expansion valve 41 to the liquid refrigerant indoor-side branching point D1, from the indoor expansion valve 51 to the liquid refrigerant indoor-side branching point D1, and from the liquid refrigerant indoor-side branching point D1 to the liquid-side stop valve 26; the data being stored in the memory 19. The controller 9 multiplies the liquid refrigerant density corresponding to the temperature detected by the liquid pipe temperature sensor 35 by the stopped pipe volume which is the total of pipe interior volumes from the indoor expansion valve 41 to the liquid refrigerant indoor-side branching point D1, from the indoor expansion valve 51 to the liquid refrigerant indoor-side branching point D1, and from the liquid refrigerant indoor-side branching point D1 to the liquid-side stop valve 26; and the controller 9 calculates a liquid pipe fixed refrigerant quantity Y, which is the quantity of the liquid refrigerant inside the pipe from the indoor expansion valves 41 and 51 to the liquid-side stop valve 26. A highly precise value which also accounts for the liquid refrigerant density corresponding to temperature can be obtained for this liquid pipe fixed refrigerant quantity Y. In this manner, even in cases in which the refrigerant quantity inside the refrigerant circuit 210 exceeds the capacity inside the outdoor heat exchanger 23, it is possible to determine a precise quantity of refrigerant which has been quantified by an accurate volume and an accurate liquid refrigerant density, at least for the refrigerant which has been controlled so as to be stopped.

In step S46, the controller 9 performs shut-off control for completely closing the outdoor expansion valve 38. From the refrigerant inside the refrigerant circuit 210, it is possible for the compressor 21 to suck in the refrigerant located in the indoor unit interconnection pipe 4*b*, the indoor heat exchanger 42, and the indoor-side gas branching pipe 4*c*, which are on the side of the indoor expansion valve 41 facing the suction side of the compressor 21; the indoor unit interconnection pipe 5*b*, the indoor heat exchanger 52, and the indoor-side gas branching pipe 5*c*, which are on the side of the indoor expansion valve 51 facing the suction side of the compressor 21; the gas refrigerant indoor-side branching point E1, the outdoor-side gas pipe 7*a*, the outdoor heat exchange expansion interconnection pipe 6*e*, the outdoor expansion subcooling interconnection pipe 6*c*, the subcooler 25, the outdoor subcooling liquid-side stop interconnection pipe 6*b*, as well as the subcooling refrigerant circuit 60, the low-pressure side liquid bypass pipe 71*b*, the low-pressure side hot gas bypass pipe 81*b*, the gas stop four-way interconnection pipe 7*b*, and the four-way compression connection pipe 7*c*, as shown in FIG. 34. The refrigerant in these portions can thereby be supplied as high-temperature high-pressure gas refrigerant to the outdoor heat exchanger 23 by the compressor 21. The high-temperature high-pressure gas refrigerant supplied to the outdoor heat exchanger 23 is thereby condensed into a liquid refrigerant by heat exchange in the outdoor heat exchanger 23. Since circulation of the refrigerant is herein stopped by the shut-off control, the liquid refrigerant condensed inside the outdoor heat exchanger 23 accumulates on the side of the outdoor expansion valve 38 facing the outdoor heat exchange expansion interconnection pipe 6*e*. The refrigerant that has become a liquid state is lower than the uncondensed high-temperature high-pressure gas refrigerant inside the outdoor heat exchanger 23 due to gravity, and gradually accumulates from the bottom of the outdoor heat exchanger 23.

In step S47, the controller 9 performs liquid return control in which the liquid bypass expansion valve 72 is slightly opened. In this liquid return control, control is performed in which an extremely small amount of the liquid refrigerant accumulated in the portion upstream of the indoor expansion valves 41 and 51 and downstream of the compressor 21 including the outdoor heat exchanger 23, which herein corresponds to inside of the outdoor heat exchange expansion interconnection pipe 6*e* and the high-pressure side liquid bypass pipe 71*a*, is returned to the four-way compression connection pipe 7*c* through the liquid bypass expansion valve 72. The controller 9 regulates the valve opening degree of the liquid bypass expansion valve 72 and allows only an extremely small amount of the liquid refrigerant to pass through. By controlling the valve opening degree of the liquid bypass expansion valve 72, the controller 9 can regulate the degree of expansion of the liquid refrigerant flowing through the liquid bypass pipe 71, from the outdoor heat exchange expansion interconnection pipe 6*e* where high-pressure liquid refrigerant flows, to the four-way compression connection pipe 7*c* where low-pressure gas refrigerant flows, and the controller 9 directly regulates the quantity of refrigerant passing through. At this time, the pipe heat exchanger 73 causes heat exchange to be performed between the refrigerant flowing through the high-pressure side liquid bypass pipe 71*a* and the refrigerant flowing through the low-pressure side liquid bypass pipe 71*b*. The refrigerant flowing through the low-pressure side liquid bypass pipe 71*b* is depressurized when passing through the liquid bypass expansion valve 72, and the refrigerant becomes lower in temperature than it had been before passing through the liquid bypass expansion valve 72. Therefore, in the pipe heat exchanger 73, the liquid refrigerant flowing within the high-pressure side liquid bypass pipe 71*a* can be cooled by the refrigerant flowing within the low-pressure side liquid bypass pipe 71*b*. At this time, the refrigerant flowing through the low-pressure side liquid bypass pipe 71*b* takes heat from the liquid refrigerant flowing within the high-pressure side liquid bypass pipe 71*a*, becomes a gas state, and flows toward the four-way compression connection pipe 7*c*. The controller regulates the valve opening degree of the liquid bypass expansion valve 72 on the basis of the temperature detected by the liquid bypass temperature sensor 74, so that of the refrigerant flowing within the high-pressure side liquid bypass pipe 71*a*, the refrigerant in the portion passing through the pipe heat exchanger 73 reliably becomes a liquid state. Furthermore, the controller 9 controls, via the liquid bypass expansion valve 72, the passing amount (passing capacity) of the liquid refrigerant resulting from the refrigerant in the portion passing through the pipe heat exchanger 73 being controlled so as to be reliably in a liquid state from among the refrigerant flowing within the high-pressure side liquid bypass pipe 71*a*. It is thereby possible to prevent a gas state from coexisting in the refrigerant passing through the liquid bypass expansion valve 72 and to achieve an entirely liquid state, and it is therefore possible to guarantee that the density of the refrigerant passing through the liquid bypass expansion valve 72 will be substantially constant. The controller 9 thereby controls the refrigerant passage capacity per unit time in the liquid bypass expansion valve 72, whereby the quantity of refrigerant that is circulated using the liquid bypass circuit 270 can be stabilized. The portion downstream of the indoor expansion valves 41 and 51 and upstream of the compressor 21 is thereby progressively depressurized, and even if this portion is mostly devoid of refrigerant, the extremely small amount of liquid refrigerant circulating through the liquid bypass circuit 270 is capable of preventing an excessive increase in the temperature of the discharge pipe of the compressor 21.

In step S48, the controller 9 determines whether or not the liquid level of the refrigerant in the outdoor heat exchanger 23 as detected by the liquid level detection sensor 239 has continued to be within a predetermined fluctuation range for a predetermined time duration or longer. The predetermined fluctuation range of the liquid level height can be within a range of, e.g., plus or minus 5 cm. The predetermined time duration, which is the time during which the liquid level height remains within the predetermined fluctuation range of plus or minus 5 cm, can be, e.g., 5 minutes.

In cases in which the controller 9 has determined that the liquid level has continued to remain within the predetermined fluctuation range for the predetermined time duration or longer, the sequence advances to step S48. In cases in which the controller 9 has determined that the liquid level has not continued to remain within the predetermined fluctuation range for the predetermined time duration or longer, step S47 is repeated.

In step S49, the controller 9 ends the liquid return control. Circulation through the liquid bypass circuit 270 is thereby stopped, and all of the refrigerant inside the refrigerant circuit 210 collects in the portion upstream of the outdoor expansion valve 38 and downstream of the compressor 21 including the outdoor heat exchanger 23; that is, in the outdoor heat exchange expansion interconnection pipe 6*e*, the high-pressure side liquid bypass pipe 71*a*, and the outdoor heat exchanger 23.

In step S48, the controller 9 performs liquid level clarification control. In this liquid level clarification control, the controller 9 rapidly reduces the gas-phase refrigerant temperature inside the outdoor heat exchanger 23 by controlling the opened/closed state of the hot gas bypass valve 82 as described hereinbelow. Specifically, the controller 9 opens the hot gas bypass valve 82, thereby causing a state in which the outdoor unit interconnection pipe 8 is communicated with the suction side of the compressor 21. The refrigerant pressure inside the outdoor unit interconnection pipe 8 thereby rapidly decreases, and the temperature of the gas-phase refrigerant inside the outdoor heat exchanger 23 therefore rapidly decreases. However, the temperature of the liquid refrigerant inside the outdoor heat exchanger 23 does not rapidly change. Thereby, either a difference arises between the liquid-phase temperature and the gas-phase temperature of the refrigerant inside the outdoor heat exchanger 23, or the difference is increased. The liquid level detection sensor 239 can thereby precisely determine the liquid level height inside the outdoor heat exchanger 23 by performing liquid level detection immediately after this liquid level clarification control has been performed.

In step S49, the controller 9 reads the volume inside the outdoor heat exchange expansion interconnection pipe 6*e* from the outdoor expansion valve 38 to the outdoor heat exchanger 23, the liquid refrigerant density corresponding to the temperature detected by the outdoor temperature sensor 36, a relational expression for calculating the quantity of refrigerant accumulating inside the outdoor heat exchanger 23 from the liquid level height h detected by the liquid level detection sensor 239, and liquid refrigerant density data corresponding to temperature conditions, these data being stored in the memory 19. Furthermore, in step S49, the volume of liquid refrigerant inside the outdoor heat exchanger 23 is calculated from the liquid level height h detected by the liquid level detection sensor 239 and the read relational expression. The volume inside the outdoor heat exchange expansion interconnection pipe 6*e* from the outdoor expansion valve 38 to the outdoor heat exchanger 23 and the volume of the liquid refrigerant inside the outdoor heat exchanger 23 are added together. The controller 9 then calculates the heat exchange refrigerant quantity X by multiplying the liquid refrigerant density corresponding to the temperature conditions by the total volume.

In step S50, the controller 9 adds the liquid pipe fixed refrigerant quantity Y calculated in step S45 and the heat exchange refrigerant quantity X calculated in step S49, and calculates the current total refrigerant quantity inside the refrigerant circuit 210.

In step S51, the controller 9 compares the proper refrigerant quantity stored in the memory 19 and the current total refrigerant quantity inside the refrigerant circuit 210 calculated in step S50. Here, the proper refrigerant quantity stored in the memory 19 is corrected using the liquid refrigerant density corresponding to the temperature detected by the outdoor temperature sensor 36 at the time of the determination of step S50, and the quantity obtained by this correction is used as a reference for comparison with the current total refrigerant quantity inside the refrigerant circuit 210. Here, in cases in which the current total refrigerant quantity has been less than the proper refrigerant quantity, it is determined that a refrigerant leak has occurred. In cases in which the current total refrigerant quantity is substantially the same as the proper refrigerant quantity, it is determined that a leak has not occurred.

After the data of the liquid level height h has been detected, the controller 9 quickly stops the operation of the compressor 21. By quickly stopping the operation of the compressor 21 after detection in this manner, extreme depressurization in the indoor heat exchangers 42 and 52, the gas refrigerant connection pipe 7, and other components can be avoided, and the reliability of the equipment can be maintained. Excessive increases in the port temperature of the output side of the compressor 21 can also be suppressed, and the reliability of the compressor 21 can be maintained as well. The refrigerant leak detection operation is ended in the manner described above.

<2.3> Characteristics of Air Conditioning Apparatus and Refrigerant Quantity Determination Method of Second Embodiment The air conditioning apparatus 201 and the refrigerant quantity determination method of the second embodiment have the following characteristics.

Here, an accurate determination of the refrigerant quantity can be performed by performing liquid level clarification control in the refrigerant circuit 210 provided with a plurality of indoor units 4 and 5.

In liquid temperature stabilization control, condensation pressure control and liquid pipe temperature control are performed, whereby a highly precise determination can be performed which is reflective of the temperature dependence of the liquid refrigerant density.

<2.4> Modifications of Second Embodiment (A)

In the second embodiment, an example was described in which the liquid bypass expansion valve 72 is employed as the means for regulating the flow rate of liquid refrigerant in the liquid bypass circuit 270, and the flow rate is controlled directly.

Figure 37:
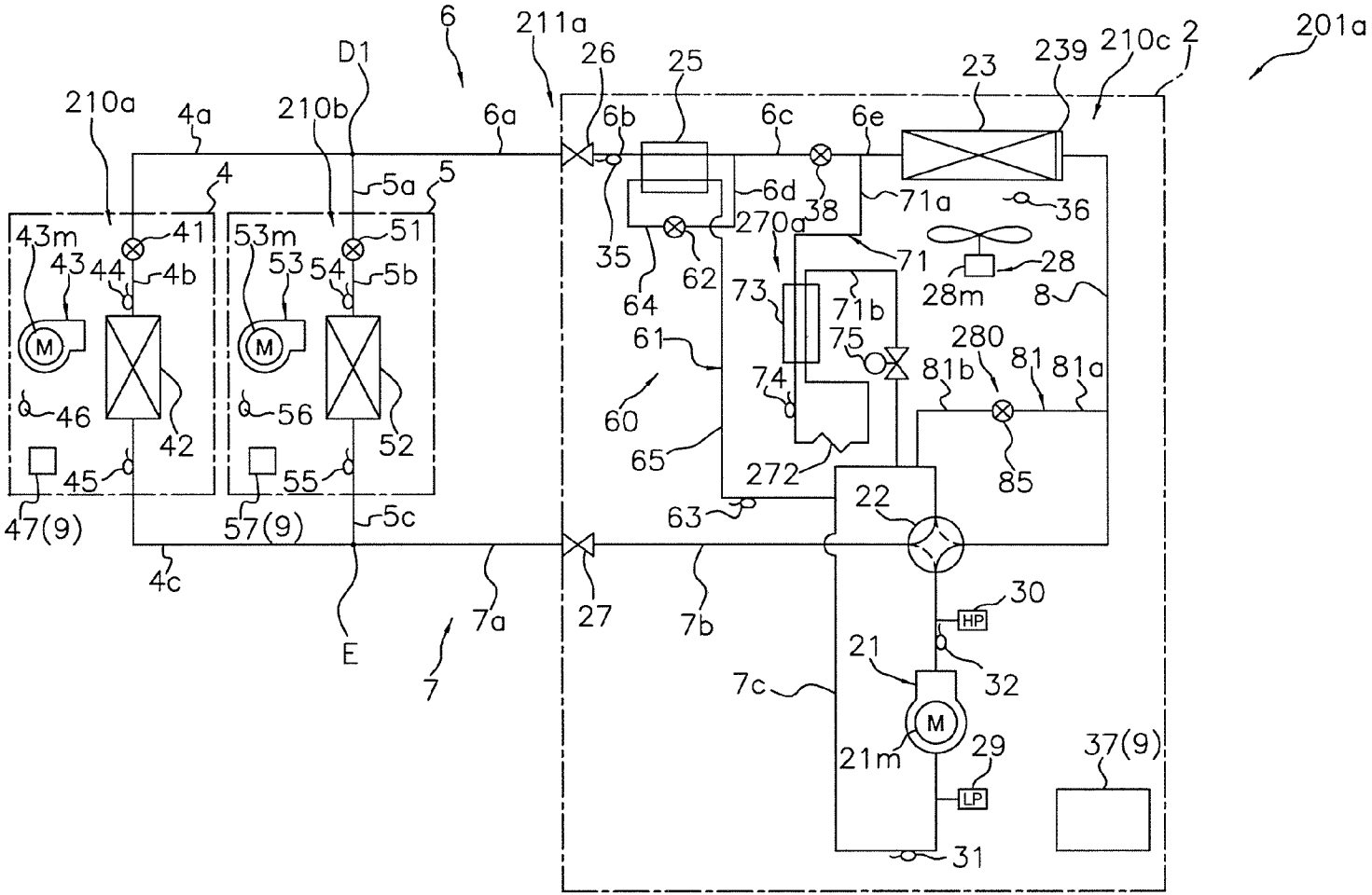
FIG. 37 is a general configuration diagram of an air conditioning apparatus which employs the capillary tube of modification (A) of the second embodiment.

However, the present invention is not limited to these examples, and the present invention may be an air conditioning apparatus 201*a* having a refrigerant circuit 211*a* which employs a liquid bypass circuit 270*a*, which in turn employs a capillary tube 272 instead of the liquid bypass expansion valve 72, as shown in FIG. 37, for example.

In this case, furthermore, a hot gas bypass circuit 280 may be employed, which employs a hot gas bypass expansion valve 85 instead of the hot gas bypass valve 82, as shown in FIG. 37.

Figure 38:
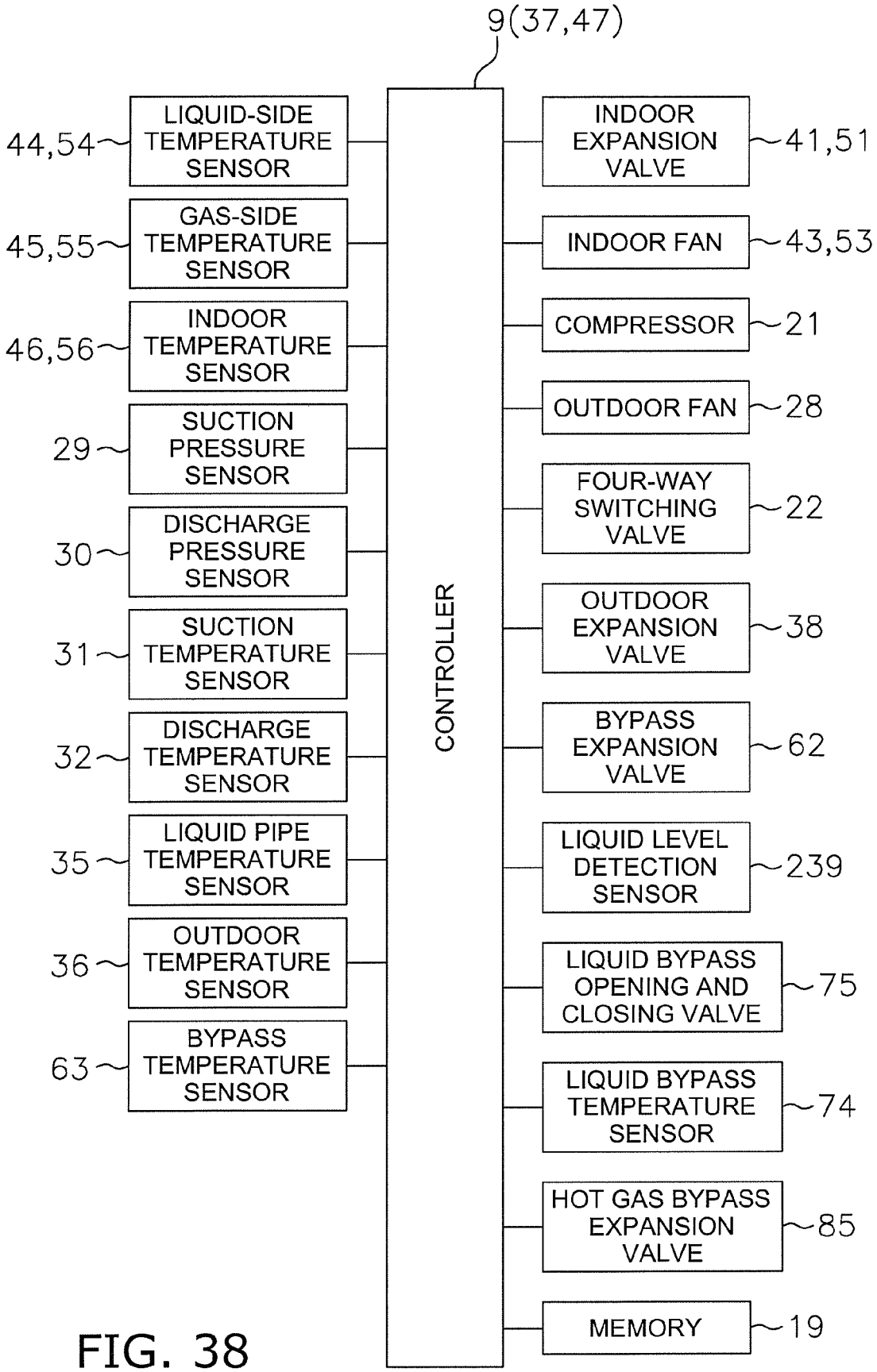
FIG. 38 is a block structure diagram of modification (A) of the second embodiment.

This capillary tube 272 is not directly controlled by the controller 9, as shown in FIG. 38. Due to the difference between the high pressure in the outdoor heat exchange expansion interconnection pipe 6*e* and the low pressure in the four-way compression connection pipe 7*c*, the liquid refrigerant inside the high-pressure side liquid bypass pipe 71*a* in the liquid bypass circuit 270*a* flows through the capillary tube 272 to the low-pressure side liquid bypass pipe 71*b*, as shown in FIG. 37. Liquid refrigerant is thereby supplied to the compressor 21. In this manner, temperature increases in the discharge pipe of the compressor 21 can be indirectly suppressed.

In the hot gas bypass expansion valve 85, the quantity of refrigerant from the outdoor unit interconnection pipe 8 to the four-way compression connection pipe 7*c* is controlled by the controller 9 as shown in FIG. 38. The refrigerant pressure in the four-way compression connection pipe 7*c* can thereby be controlled. The quantity of liquid refrigerant passing through the capillary tube 272 is thereby indirectly controlled as described above.

(B)

In the close-off control of the second embodiment, the liquid refrigerant inside the pipes from the indoor expansion valves 41 and 51 to the liquid-side stop valve 26 is stopped.

Figure 39:
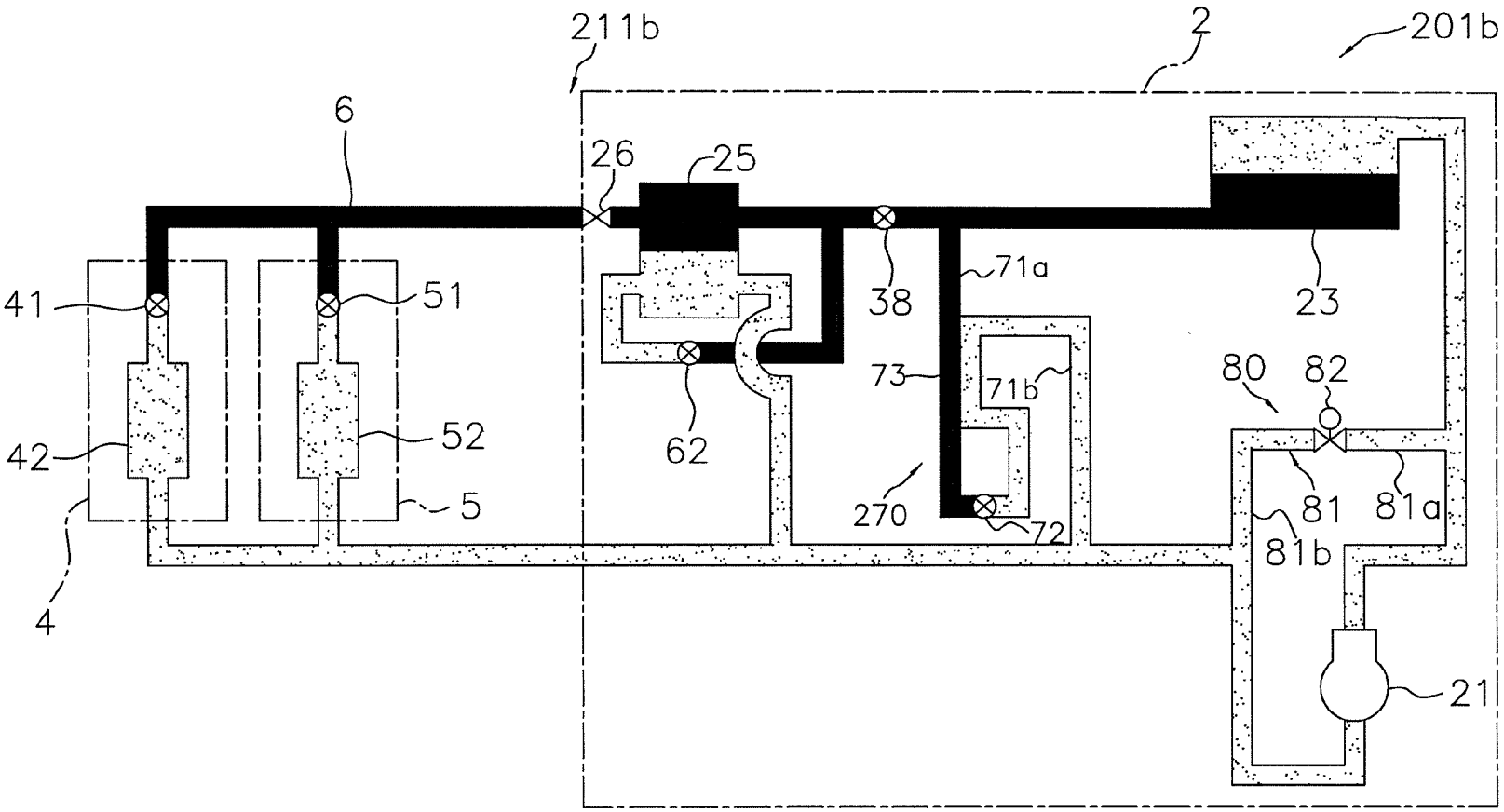
FIG. 39 is a schematic diagram showing the state of refrigerant flowing within the refrigerant circuit of modification (B) of the second embodiment.

However, the present invention is not limited to this option alone, and the close-off control may involve stopping the liquid refrigerant inside the pipes from the indoor expansion valves 41 and 51 to the outdoor expansion valve 38 in a refrigerant circuit 211*b* of an air conditioning apparatus 201*b*, as well as inside the pipe of the subcooling expansion pipe 6*d* which branches off and extends to the subcooling expansion valve 62, as shown in FIG. 39, for example.

In this case, the refrigerant inside the subcooling branching pipe 64 and the subcooling merging pipe 65, rather than the entire subcooling refrigerant circuit 60, is sucked into the compressor 21.

(C)

In the second embodiment, an example was described in which all of the refrigerant existing inside the refrigerant circuit 210 is liquefied and collected in a single location.

However, the present invention is not limited to this option alone; rather than being collected in a single location, the refrigerant inside the refrigerant circuit 210 may be divided among and collected in a plurality of locations, for example.

For example, depending on the type of refrigerant employed in the air conditioning apparatus 201, there is a risk that it will not necessarily be possible to collect all of the refrigerant existing in the refrigerant circuit 210 from the indoor expansion valves 41 and 51 to the liquid-side stop valve 26 and from the outdoor expansion valve 38 to the upstream-side end of the outdoor heat exchanger 23 including the outdoor heat exchanger 23 itself. In this case, a gas refrigerant of comparatively high density remains in an area spanning from the compressor 21 to the outdoor heat exchanger 23, and this refrigerant cannot be included in the target of detection.

Figure 40:
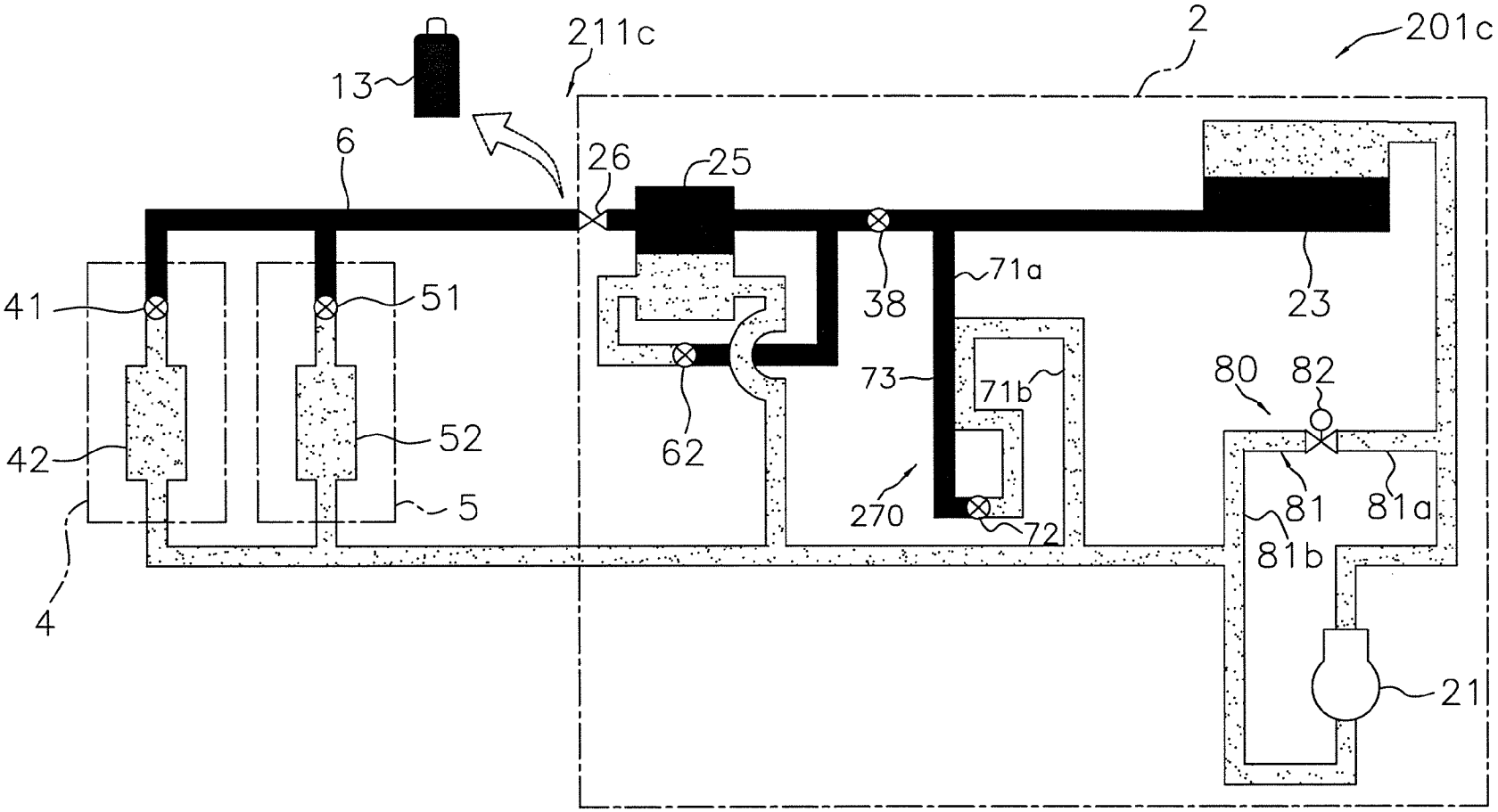
FIG. 40 is a schematic diagram showing the state of refrigerant flowing within the refrigerant circuit of modification (C) of the second embodiment.

Even in such cases, some of the entire amount of refrigerant throughout a refrigerant circuit 211*c* of an air conditioning apparatus 201*c* may be recovered by connecting a partial refrigerant recovery tank 13 to the refrigerant circuit 210, as shown in FIG. 40. In this manner, even in cases in which it is not possible to collect all of the refrigerant inside the refrigerant circuit 210 from the indoor expansion valves 41 and 51 to the liquid-side stop valve 26 and from the outdoor expansion valve 38 to the upstream-side end of the outdoor heat exchanger 23 including the outdoor heat exchanger 23 itself, using the partial refrigerant recovery tank 13 makes it possible to position the liquid level at the time of determination at a position where detection by the liquid level detection sensor 239 is possible. It is thereby possible to perform the proper refrigerant quantity charging operation, the refrigerant leak detection operation, and the various determinations without being limited by the type of refrigerant or the configuration of the air conditioning apparatus 201.

(D)

In the second embodiment, a cross-fin type fin-and-tube heat exchanger was presented as an example of the outdoor heat exchanger 23 and the indoor heat exchanger 42, but the present invention is not limited to this option alone and other types of heat exchangers may be used.

In the second embodiment, a case of a single compressor being provided was given as an example of the compressor 21, but the present invention is not limited to this option alone, and two or more compressors may be connected in parallel according to the number of connected indoor units.

In the second embodiment, a case of the subcooling expansion pipe 6*d* branching from a position between the outdoor expansion valve 38 and the subcooler 25 was presented as an example of the subcooling refrigerant pipe 61, but the present invention is not limited to this option alone, and the subcooling expansion pipe 6*d* may branch from a position between the outdoor expansion valve 38 and the liquid-side stop valve 26.

In the second embodiment, a setup in which the header 23*b* and distributor 23*c* were provided to ends on opposite sides of the heat exchanger body 23*a* was presented as an example of the header 23*b* and distributor 23*c*, but the header 23*b* and distributor 23*c* may also be provided on the same end of the heat exchanger body 23*a*.

(E)

In the second embodiment, an example was described in which the degree of superheating of refrigerant in the outlets of each of the indoor heat exchangers 42 and 52 during the cooling operation, for example, is detected by subtracting the refrigerant temperature values (corresponding to an evaporation temperature) detected by the liquid-side temperature sensors 44 and 54 from the refrigerant temperature values detected by the gas-side temperature sensors 45 and 55.

However, the present invention is not limited to this option alone; another option, for example, is to detect the degree of superheating by converting the suction pressure of the compressor 21 detected by the suction pressure sensor 29 to a saturation temperature value corresponding to the evaporation temperature and subtracting this refrigerant saturation temperature value from the refrigerant temperature values detected by the gas-side temperature sensors 45 and 55.

Furthermore, as another detection method, the degree of superheating may be detected by providing another temperature sensor for detecting the temperature of refrigerant flowing within each of the indoor heat exchangers 42 and 52, and subtracting the refrigerant temperature value corresponding to the evaporation temperature detected by this temperature sensor from the refrigerant temperature value detected by the gas-side temperature sensor 45.

In the second embodiment, an example was described in which the degree of subcooling of the refrigerant in the outlets of the indoor heat exchangers 42 and 52 during the heating operation, for example, is detected by converting the discharge pressure of the compressor 21 detected by the discharge pressure sensor 30 to a saturation temperature value corresponding to a condensation temperature, and subtracting the refrigerant temperature value detected by the liquid-side temperature sensors 44 and 54 from this refrigerant saturation temperature value.

However, the present invention is not limited to this option alone; another option, for example, is to detect the degree of subcooling by providing a temperature sensor for detecting the temperature of refrigerant flowing within each of the indoor heat exchangers 42 and 52 and subtracting the refrigerant temperature value corresponding to the condensation temperature detected by this temperature sensor from the refrigerant temperature value detected by the liquid-side temperature sensors 44 and 54.

(F)

In the second embodiment, a method for calculating the quantity of liquid refrigerant was described as an example of the determination in refrigerant leak detection.

However, the present invention is not limited to this option alone; another option, for example, is to determine beforehand a reference liquid level height H corresponding to the optimal refrigerant quantity corresponding to the liquid refrigerant temperature, and to store this reference liquid level height H in the memory 19 in advance. Thereby, there is no longer a need to calculate the refrigerant quantity in the embodiment described above, and the refrigerant leak detection can be performed by directly comparing the detected liquid level height h being detected with the reference liquid level height H as an index.

(G)

In the second embodiment, an example was described in which the degree of superheating of the refrigerant in the suction side of the compressor 21 after passing through the subcooler 25 in the subcooling refrigerant pipe 61 is detected by converting the suction pressure of the compressor 21 detected by the suction pressure sensor 29 to a saturation temperature value corresponding to an evaporation temperature, and subtracting this refrigerant saturation temperature value from the refrigerant temperature value detected by the subcooling temperature sensor 63.

However, the present invention is not limited to this option alone, and the degree of superheating of the refrigerant in the suction side of the compressor 21 after passing through the subcooler 25 in the subcooling refrigerant pipe 61 may also be detected by providing another temperature sensor in the inlet on the bypass refrigerant pipe side of the subcooler 25, for example, and subtracting the refrigerant temperature value detected by this temperature sensor from the refrigerant temperature value detected by the subcooling temperature sensor 63.

(H)

In the second embodiment, an example was described in which the controller 9 uses the discharge pressure of the compressor 21 detected by the discharge pressure sensor 30 as the condensation pressure in the condensation pressure control during the liquid temperature stabilization control and in the condensation pressure control during the liquid pipe temperature control.

However, the present invention is not limited to this option alone; another option, for example, is to provide another temperature sensor for detecting the temperature of the refrigerant flowing within the outdoor heat exchanger 23, convert the refrigerant temperature value corresponding to the condensation temperature detected by this temperature sensor to a condensation pressure, and use this condensation pressure in the condensation pressure control.

(I)

Another example of the refrigerant circuit for performing the refrigerant quantity determination operation in the second embodiment may be a refrigerant circuit which employs, as an opening and closing valve operating instead of the liquid-side stop valve 26, an electromagnetic valve or another automatic valve (possibly the outdoor expansion valve 38) which can be opened and closed by the controller 9 and which is disposed between the liquid-side stop valve 26 and the subcooler 25.

(J)

In the second embodiment, an example was described in which the temperature of the liquid refrigerant was made constant by liquid temperature stabilization control alone.

Figure 41:
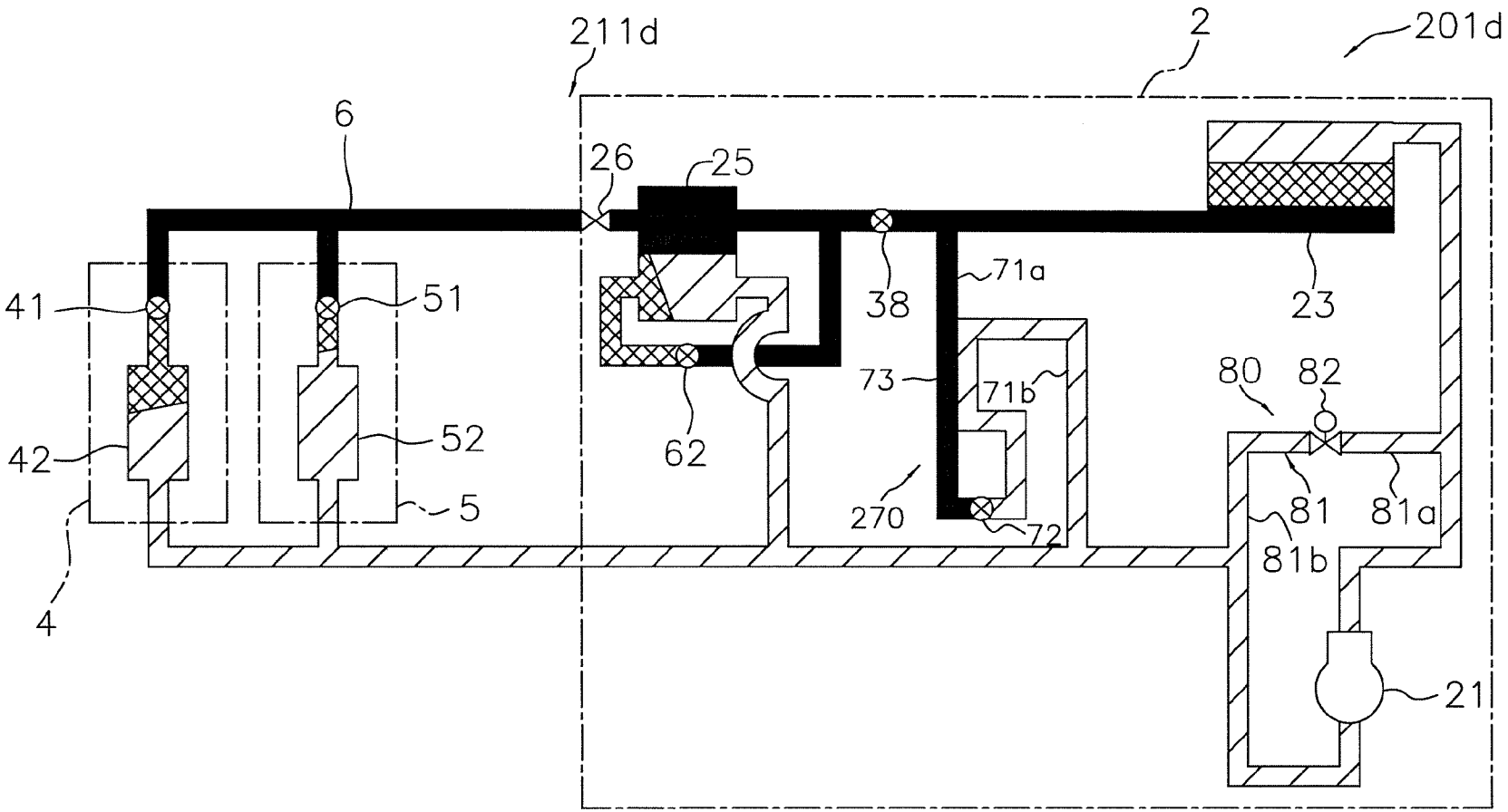
FIG. 41 is a diagram showing the distribution of refrigerant in the refrigerant circuit when the ability ratio control of modification (J) of the second embodiment is being performed.

However, the present invention is not limited to this option alone; another option, for example, is an air conditioning apparatus 201*d* having a refrigerant circuit 211*d* configured so that the indoor unit 5 has less ability than the indoor unit 4 as shown in FIG. 41, wherein the controller 9 may also performability ratio control in addition to liquid temperature stabilization control in order to quickly and reliably achieve liquid temperature stabilization through liquid temperature stabilization control. The term "ability" herein refers to the ability whereby the refrigerant in the indoor heat exchanger 42 can be evaporated in a state in which the output of the indoor fan 43 of the indoor unit 4 is increased to a state of maximum airflow, or to an equivalent quantity of heat, quantity of work, or the like. The same applies to the indoor unit 5, the term referring to the ability whereby the refrigerant in the indoor heat exchanger 52 can be evaporated in a state in which the output of the indoor fan 53 is increased to a state of maximum airflow, or to an equivalent quantity of heat, quantity of work, or the like.

Here, the liquid bypass expansion valve 72 is first started from a closed state by the controller 9.

In ability ratio control, the controller 9 performs control so that the ratio between the refrigeration capacity of the outdoor unit 2 and the total refrigeration capacity of the indoor units 4 and 5 reaches a predetermined ratio in a state of few operating units. That is, a control for regulating the operating states of each of the configural devices is performed so that a predetermined ratio established beforehand is achieved in the relationship between an outdoor unit refrigeration capacity, which is established based on the abilities of whichever of at least the compressor 21, the outdoor heat exchanger 23, the outdoor fan 28, and the motor 28*m* are operating; and an indoor unit refrigeration capacity, which is established based on the abilities of whichever of at least the indoor expansion valve 41, the indoor heat exchanger 42, the indoor fan 43, the motor 43*m*, the indoor expansion valve 51, the indoor heat exchanger 52, the indoor fan 53, and the motor 53*m* are operating. Here, since two indoor units 4 and 5 are provided, control is performed in a state of limiting the operating ability of either one, such that the ability ratio reaches a predetermined ratio. Specifically, the controller 9 preferentially limits the ability of the indoor unit 5, which has the lesser ability for evaporating refrigerant between the indoor units 4 and 5 as described above. Here, the opening degree of the indoor expansion valve 51 of the indoor unit 5 is reduced so as to be 1/20 or less of the opening degree of the indoor expansion valve 41 of the indoor unit 4, and the driving of the fan motor 53*m* for rotatably driving the indoor fan 53 is stopped. Thereby, the number of high-output operating devices of the indoor unit that causes errors can be reduced, and the indoor unit having the greater ability can be left operating; therefore, output can be regulated within the range of the greater ability, and a greater range of regulation can be guaranteed. The refrigerant distribution state can thereby be more reliably stabilized. This ability ratio control makes it possible to control the quantity of refrigerant passing through the indoor expansion valve 51 so as to be less than the quantity of refrigerant passing through the indoor expansion valve 41, as shown in FIG. 41. It is thereby possible to avoid the increased difficulty of liquid temperature stabilization that comes with changes in the environment surrounding the indoor heat exchanger 52. That is, the refrigerant distribution inside the refrigerant circuit 210 sometimes becomes unstable as a result of the room environment greatly changing, such as the room temperature in the room where the indoor heat exchanger 52 is installed, and the degree of superheating becoming unstable in the gas refrigerant flowing from the indoor heat exchanger 52 to the indoor-side gas branching pipe 5*c*. However, this type of instability in the refrigerant distribution inside the refrigerant circuit 210 can be avoided by performing ability ratio control in this manner and thereby mostly closing the indoor expansion valve 51, stopping the indoor fan 53, and keeping the ability of the indoor heat exchanger 52 low. It is thereby possible to quickly achieve stabilization in the temperature detected by the liquid pipe temperature sensor 35 (to perform liquid temperature stabilization).

Since the indoor expansion valve 51 is mostly closed by performing the ability ratio control, the refrigerant inside the indoor-side liquid branching pipe 5*a* from the liquid refrigerant indoor-side branching point D1 to the indoor expansion valve 51 thus tends to stagnate. Therefore, the liquid refrigerant that has stopped flowing through the inside of the indoor-side liquid branching pipe 5*a* continues to be affected by the surrounding temperature detected by the indoor temperature sensor 56, and it is difficult to maintain the liquid temperature controlled in the subcooler 25 by liquid temperature stabilization control. In view of this, in cases in which the ability ratio control is performed in this manner, the controller 9 may also performability-limiting unit branch pipe temperature stabilization control. In this ability-limiting unit branch pipe temperature stabilization control, the controller 9 can prevent the temperature of the above-described liquid refrigerant that tends to stop flowing through the inside of the indoor-side liquid branching pipe 5*a* from deviating from the temperature controlled by liquid temperature stabilization control. Specifically, in ability-limiting unit branch pipe temperature stabilization control, the controller 9 opens the opening degree of the indoor expansion valve 51, causing the liquid refrigerant stagnated inside the indoor-side liquid branching pipe 5*a* to flow to a degree whereby the ability of the indoor heat exchanger 52 is not overexerted and the refrigerant distribution stability of the refrigerant circuit 210 is not compromised, and new liquid refrigerant having just undergone liquid temperature stabilization control is fed into the indoor-side liquid branching pipe 5*a* from the upstream side of the liquid refrigerant indoor-side branching point D1. In this ability-limiting unit branch pipe temperature stabilization control, the controller 9 performs control whereby the greater the degree of disparity between the gas-side temperature sensor 55 and the temperature made constant by liquid temperature stabilization control, the more the opening degree of the indoor expansion valve 51 is increased. Liquid refrigerant in a temperature state controlled by liquid temperature stabilization control is thereby caused to flow through the indoor-side liquid branching pipe 5*a*, and the temperature inside the indoor-side liquid branching pipe 5*a* can be made to approach the temperature controlled by liquid temperature stabilization control.

The controller 9 may also perform this ability-limiting unit branch pipe temperature stabilization control instead of the above-described ability-limiting unit branch pipe temperature stabilization control as a control performed at predetermined time intervals for increasing the opening degree of the indoor expansion valve 51, to a degree that does not compromise the stability of the refrigerant distribution of the refrigerant circuit 210 due to overexertion of the ability of the indoor heat exchanger 52.

Because there is a problem with detection being difficult if liquid refrigerant has not finally accumulated in the outdoor heat exchanger 23 and with the temperature of the liquid refrigerant inside the indoor-side liquid branching pipe 5*a* changing depending on the time required for the refrigerant to accumulate, the controller 9 may perform control for increasing the opening degree of the indoor expansion valve 51 while performing control to a degree whereby the quantity of liquid refrigerant accumulating inside the outdoor heat exchanger 23 does not decrease. Here, the locations where liquid refrigerant will accumulate and the subsequent locations in the refrigerant circuit 210 must be vacuumed prior to the final determination performed, but since a state is maintained in which liquid refrigerant accumulates to a certain degree in the outdoor heat exchanger 23 so as not to decrease, the time required for this vacuuming can be reduced, and the precision of determination is improved.

(K)

In the second embodiment, an example was described in which liquid return control is performed slightly before the liquid level height h of the outdoor heat exchanger 23 is detected, wherein the valve opening degree of the liquid bypass expansion valve 72 is regulated and an extremely small amount of liquid refrigerant is allowed to pass through.

However, the present invention is not limited to this option alone, and the controller 9 may regulate the opening degree of the liquid bypass expansion valve 72 on the basis of the temperature detected by the discharge refrigerant temperature sensor 32 for detecting the discharged refrigerant temperature of the compressor 21, for example. In this case, when the temperature detected by the discharge refrigerant temperature sensor 32 has been high, the controller 9 may perform control for increasing the opening degree of the liquid bypass expansion valve 72 and supplying a greater quantity of liquid refrigerant to the suction side of the compressor 21. When the temperature detected by the discharge refrigerant temperature sensor 32 has been low, the controller 9 may perform control for reducing the opening degree of the liquid bypass expansion valve 72 and keeping the refrigerant quantity supplied to the suction side of the compressor 21 to a less amount.

Figure 42:
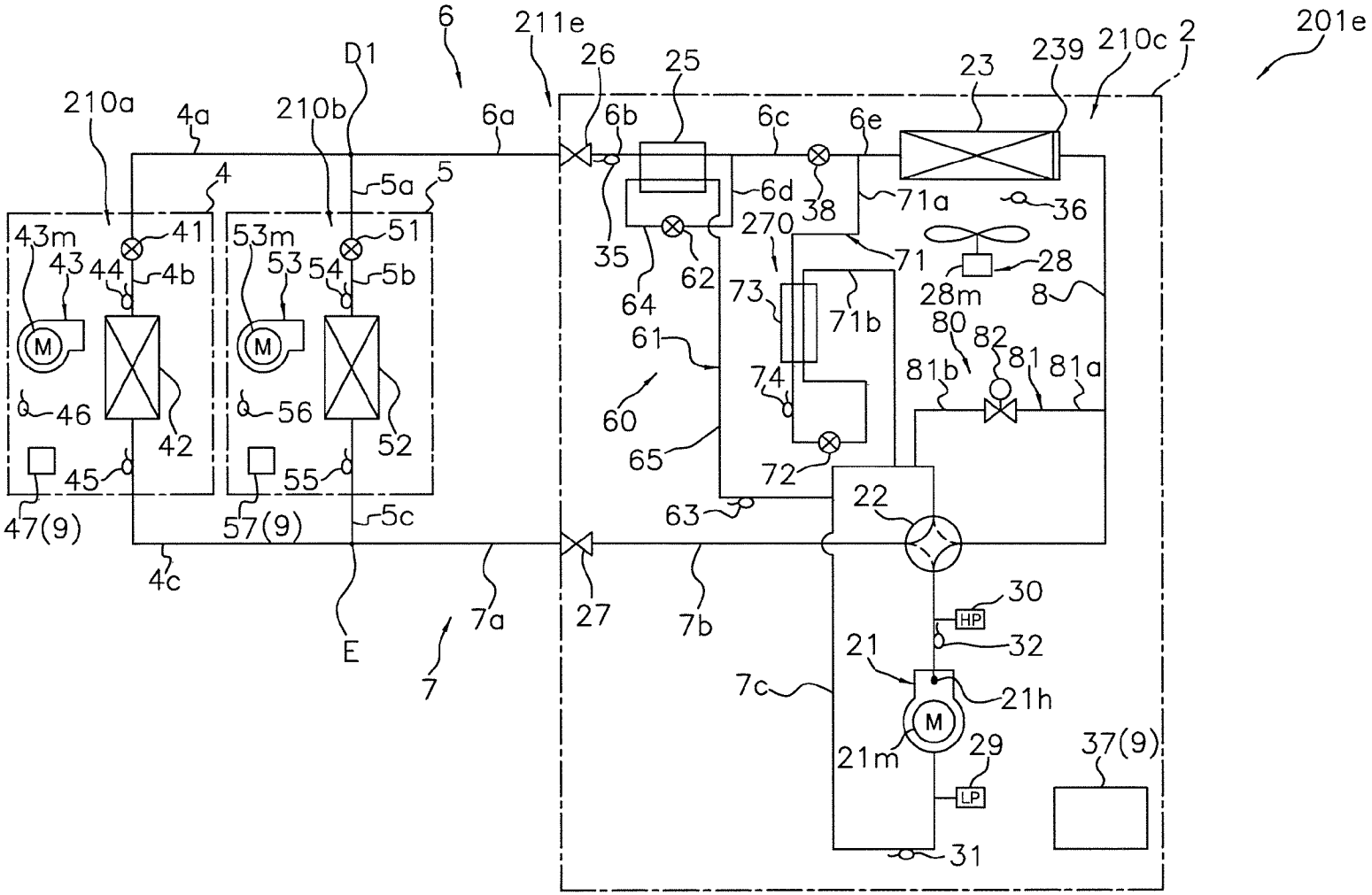
FIG. 42 is a general configuration diagram of the air conditioning apparatus of modification (K) of the second embodiment.

Another option, for example, is an air conditioning apparatus 201*e* having a refrigerant circuit 211*e* further provided with a compressor hot-area temperature sensor 21*h* which can directly detect the temperature of the output port through which discharged refrigerant passes inside the compressor 21, as shown in FIG. 42. In this case, the index of the control by the controller 9 of modification (M) may be the temperature detected by the compressor hot-area temperature sensor 21*h* instead of the temperature detected by the discharged refrigerant temperature sensor 32.

(L)

In the second embodiment, an example of a refrigerant circuit 210 having only one outdoor unit 2 was described.

Figure 43:
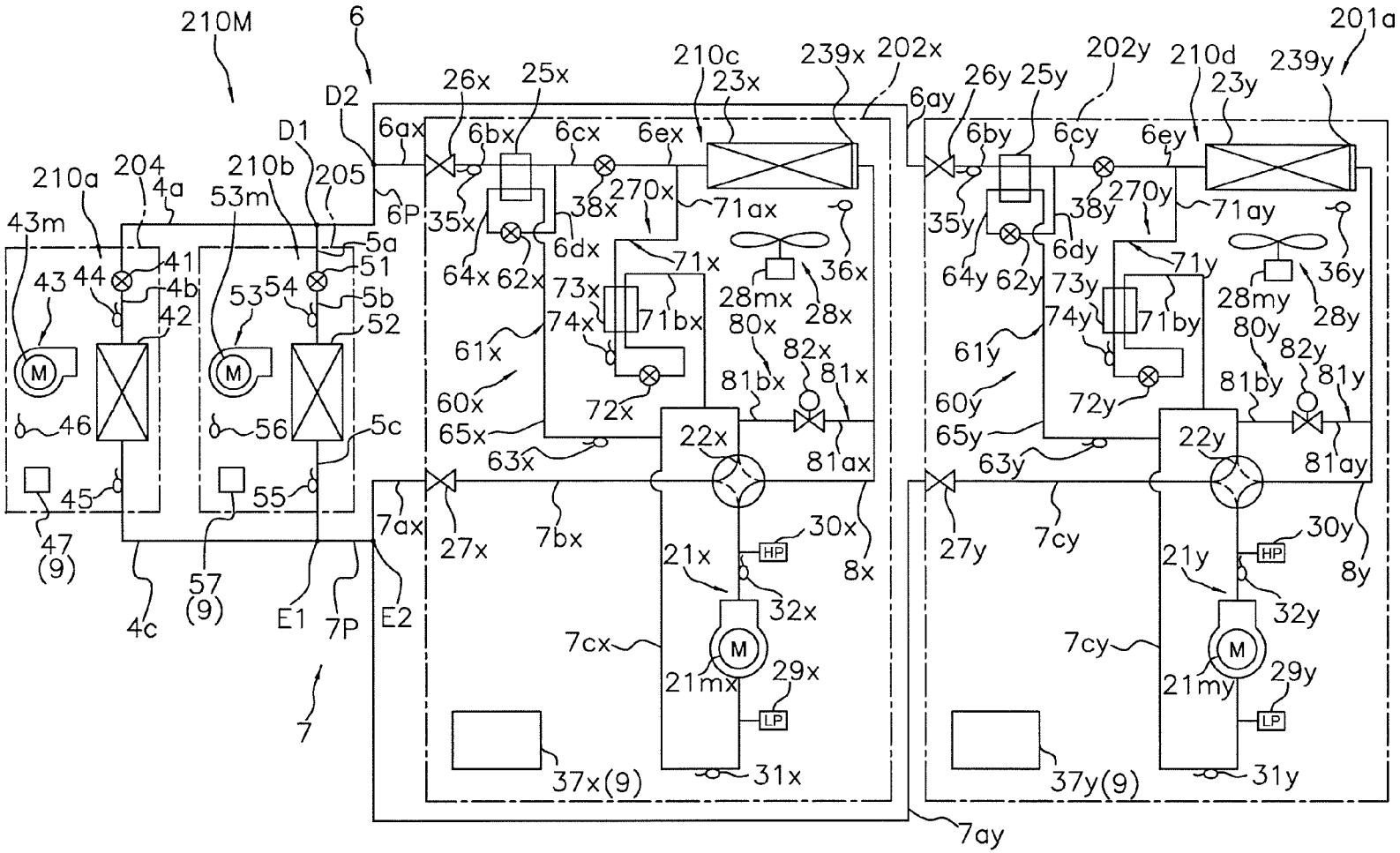
FIG. 43 is a general configuration diagram of the air conditioning apparatus of modification (L) of the second embodiment.

However, the present invention is not limited to this option alone; another option is an air conditioning apparatus 201*a* having a refrigerant circuit 210M provided with a plurality of outdoor units, including an outdoor unit 202*x* and an outdoor unit 202*y*, as shown in FIG. 43, for example.

Aside from being provided with a plurality of outdoor units, the refrigerant circuit 210M is the same as the refrigerant circuit 210 of the air conditioning apparatus 201 of the second embodiment described above, and therefore the description hereinbelow focuses on the differences.

Here, components associated with the outdoor unit 202*x* are denoted by the suffix x, and components associated with the outdoor unit 202*y* are denoted by the suffix y.

Components either having the same member numerals described in the second embodiment or having member numerals differing only in the suffixes x and y are the same as those of the refrigerant circuit 210 of the second embodiment described above. Here, the outdoor unit 202*y* having components denoted by the suffix y has a lesser refrigeration capacity than the outdoor unit 202*x* having components denoted by the suffix x. For example, the outdoor heat exchanger 23*y* has a smaller effective specific surface area for heat exchange than the outdoor heat exchanger 23*x*. The outdoor fan 28*y* is also smaller in size than the outdoor fan 28*x*. The motor 28*my* also has a lower output than the motor 28*mx*. Furthermore, the compressor 21*y* has a lesser capacity than the compressor 21*x*, as determined by frequency and other factors.

In this refrigerant circuit 210M, indoor-side refrigerant circuits 210*a* and 210*b* and outdoor-side refrigerant circuits 210*c* and 210*d* are configured by being interconnected by refrigerant connection pipes 6 and 7.

In the refrigerant circuit 210M, the configurations of the liquid refrigerant connection pipe 6 and the gas refrigerant connection pipe 7 are much different from those of the refrigerant circuit 210 of the second embodiment.

The liquid refrigerant connection pipe 6 has not only indoor-side liquid branching pipes 4*a* and 5*a* and a liquid refrigerant indoor-side branching point D1, but also outdoor-side liquid branching pipes 6*ax* and 6*ay*, a liquid refrigerant outdoor-side branching point D2, and a liquid branching point connection pipe 6P. Here, the indoor-side liquid branching pipe 4*a* is a pipe extending from the indoor expansion valve 41. The indoor-side liquid branching pipe 5*a* is a pipe extending from the indoor expansion valve 51. The indoor-side liquid branching pipe 4*a* and the indoor-side liquid branching pipe 5*a* merge at the liquid refrigerant indoor-side branching point D1. The outdoor-side liquid branching pipe 6*ax* is a pipe extending from a liquid-side stop valve 26*x*. The outdoor-side liquid branching pipe 6*ay* is a pipe extending from a liquid-side stop valve 26*y*. The outdoor-side liquid branching pipe 6*ax* and the outdoor-side liquid branching pipe 6*ay* merge at the liquid refrigerant outdoor-side branching point D2. The liquid refrigerant indoor-side branching point D1 and the liquid refrigerant outdoor-side branching point D2 are interconnected by a liquid branching point interconnection pipe 6P.

The gas refrigerant connection pipe 7 has not only indoor-side gas branching pipes 4*c* and 5*c* and a gas refrigerant indoor-side branching point E1, but also outdoor-side gas branching pipes 7*ax* and 7*ay*, a gas refrigerant outdoor-side branching point E2, and a gas branching point interconnection pipe 7P. Here, the indoor-side gas branching pipe 4*c* is a pipe extending from the indoor heat exchanger 42. The indoor-side gas branching pipe 5*c* is a pipe extending from the indoor heat exchanger 52. The indoor-side gas branching pipe 4*c* and the indoor-side gas branching pipe 5*c* merge at the gas refrigerant indoor-side branching point E1.

The outdoor-side gas branching pipe 7*ax* is a pipe extending from a gas-side stop valve 27*x*. The outdoor-side gas branching pipe 7*ay* is a pipe extending from a gas-side stop valve 27*y*. The outdoor-side gas branching pipe 7*ax* and the outdoor-side gas branching pipe 7*ay* merge at the gas refrigerant outdoor-side branching point E2. The gas refrigerant indoor-side branching point E1 and the gas refrigerant outdoor-side branching point E2 are interconnected by the gas branching point interconnection pipe 7P.

Here, a liquid level detection sensor is provided to each outdoor unit. A liquid level detection sensor 239*x* is provided to the outdoor unit 202*x*, and a liquid level detection sensor 239*y* is provided to the outdoor unit 202*y*.

As for the other aspects of the refrigerant circuit 210M, identical member numerals indicate similar components, and the same applies to cases in which the numerals differ only by having a suffix x or y.

The outdoor unit 202*y* employed herein has a lesser capacity than the outdoor unit 202*x* as described above.

(Temperature Stabilization Control and Ability Ratio Control)

When temperature stabilization control, ability ratio control, and hereinafter-described low-capacity unit priority stopping control, preliminary operation control, and saturated liquid control are performed by the refrigerant circuit 210M described above, the refrigerant distribution inside the refrigerant circuit 210M becomes the distribution shown in FIG. 44.

In this manner, in ability ratio control in the refrigerant circuit 210M having a plurality of connected outdoor units as well, the controller 9 not only minimizes the operation of the indoor unit 205 and performs operation focusing on the indoor unit 204, but also regulates the abilities of the outdoor units and performs control focusing on the outdoor unit 202*x* while limiting the ability of the outdoor unit 202*y*. Thereby, with a configuration provided with a plurality not only of indoor units but of outdoor units as well, the controller 9 minimizes as much as possible the effect of operating units which have become unstable elements, and performs control that makes it easier to stabilize the refrigerant distribution in the refrigerant circuit 210M while quickly and simply achieving liquid temperature stabilization that focuses on a single indoor unit 204 and a single outdoor unit 202*x*.

In low-capacity unit priority stopping control, when the controller 9 performs ability ratio control, the suppression of refrigeration capacity caused by operation of the compressor 21*y*, the outdoor heat exchanger 23*y*, the outdoor fan 28*y*, and the motor 28*my* in the lesser-capacity outdoor unit 202*y* is given priority over the suppression of refrigeration capacity caused by operation of the compressor 21*x*, the outdoor heat exchanger 23*x*, the outdoor fan 28*x*, and the motor 28*mx* in the greater-capacity outdoor unit 202*x*. Thereby, the refrigerant distribution inside the refrigerant circuit 210M reaches a state in which the liquid refrigerant accumulating inside the outdoor heat exchanger 23*x* is greater in quantity than the liquid refrigerant accumulating inside the outdoor heat exchanger 23*y*. Here, rather than simultaneously performing the operations of a plurality of outdoor units, control for limiting the refrigeration capacity with first priority given to the lesser-capacity outdoor unit is performed in order to reduce unstable elements. Thereby, unstable elements for achieving temperature stabilization control are reduced while a state is achieved in which mainly the unit of greater ability continues to be operated, the focus being on the outdoor unit 202*x*, and it is therefore possible to ensure a greater range of output control for stabilizing the refrigerant circuit 210M during liquid temperature stabilization control.

In saturated liquid control, when the low-capacity unit priority stopping control described above is performed, the controller 9 performs control so that the refrigerant has a degree of subcooling in both an outdoor heat exchange expansion interconnection pipe 6*ex* of the outdoor heat exchanger 23*x* and an outdoor heat exchange expansion interconnection pipe 6*ey* of the outdoor heat exchanger 23*y*. Herein the controller 9 controls the outputs of each of the outdoor fans 28*x* and 28*y* and the motors 28*mx* and 28*my* so that the degree of subcooling is 0° C. or greater and 5° C. or less. When the low-capacity unit priority stopping control described above is performed, the ability of the outdoor unit 202*y* is limited, whereby the condensing ability of the outdoor heat exchanger 23*y* decreases, and it is difficult for the refrigerant passing through the outdoor heat exchange expansion interconnection pipe 6*ey* of the outdoor heat exchanger 23*y* to have a degree of subcooling. However, since the controller 9 performs not only low-capacity unit priority stopping control but also performs saturated liquid control at the same time, the refrigerant passing through the outdoor heat exchange expansion interconnection pipe 6*ey* can be given a degree of subcooling of 0° C. or greater and 5° C. or less. It is thereby possible to ensure that liquid refrigerant that has undergone temperature stabilization control will fill the entire liquid refrigerant connection pipe 6, that is, the indoor-side liquid branching pipes 4*a* and 5*a*, the liquid refrigerant indoor-side branching point D1, the outdoor-side liquid branching pipes 6*ax* and 6*ay*, the liquid refrigerant outdoor-side branching point D2, and the liquid branching point interconnection pipe 6P. Not only is it thereby made possible to reduce unstable elements in order to achieve liquid temperature stabilization control and to reliably achieve temperature stabilization, but it is also possible to fill the inside of the liquid refrigerant connection pipe 6 with liquid refrigerant whose temperature is kept constant.

In preliminary operation control, the controller 9 performs control for operating both the outdoor unit 202*x* and the outdoor unit 202*y* under conditions in which the abilities of neither are limited, by temporarily performing the cooling operation of the normal operation before detection is performed by the liquid level detection sensors 239*x* and 239*y*. Here, the preliminary operation control is performed at the same time as the cooling operation performed in step S22 and step S41 of the second embodiment described above. It is thereby possible to avoid instances in which a large quantity of refrigerant is trapped inside the outdoor unit 202*y*, whose ability is limited by the low-capacity unit priority stopping control, and the quantity of liquid refrigerant existing inside the outdoor unit 202*y* can be reduced. The result of this is that refrigerant oil is warmed by the operation of the compressor 21*y*, refrigerant that had been mixed in with the refrigerant oil is separated from the refrigerant oil, and the refrigerant can be included in the detection target of the liquid level detection sensors 239*x* and 239*y*. Therefore, detection precision is improved.

(Proper Refrigerant Quantity Automatic Charging Operation Mode and Refrigerant Leak Detection Operation Mode)

Figure 44:
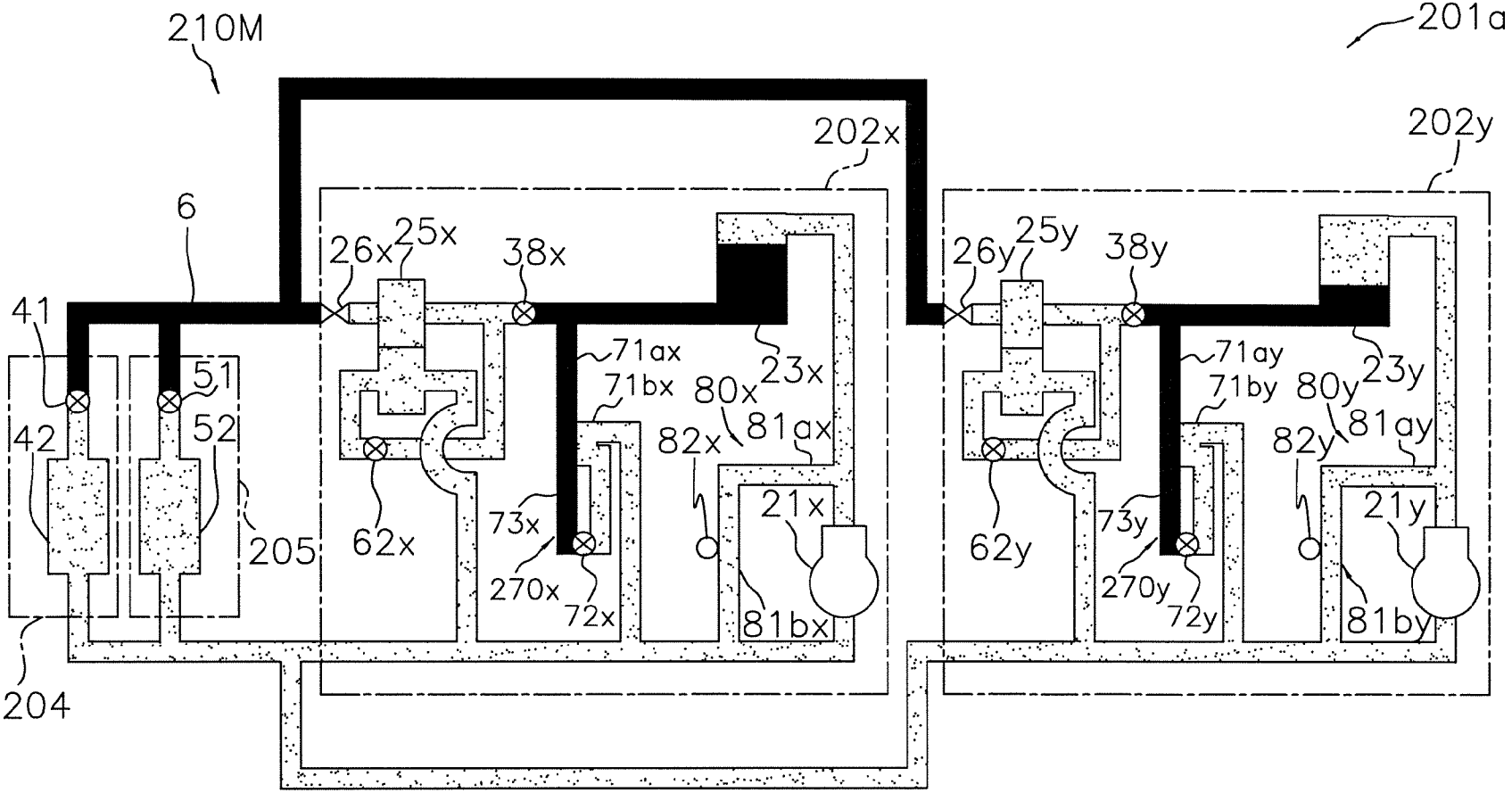
FIG. 44 is a schematic diagram showing the state of refrigerant flowing within the refrigerant circuit during the proper refrigerant quantity automatic charging operation and during the refrigerant leak detection operation in modification (L) of the second embodiment.

FIG. 44 shows the refrigerant distribution inside the refrigerant circuit 210M under the timing conditions by which liquid level clarification control is performed and detection is performed by the liquid level detection sensors 239*x* and 239*y* during the proper refrigerant quantity automatic charging operation mode and the refrigerant leak detection operation mode.

Specifically, the controller 9 performs close-off control similar to steps S23, S24, S42, and S43 of the second embodiment in cases in which the detected temperatures of both liquid pipe temperature sensors 35*x* and 35*y* have been stabilized and the temperatures of both gas-side temperature sensors 45 and 55 have been stabilized by liquid temperature stabilization control. In this stop control, both indoor expansion valves 41 and 51 are set to a closed state and both liquid-side stop valves 26*x* and 26*y* are set to a closed state. Shut-off control is performed in the same manner as steps S25 and S46 of the second embodiment. Here, the refrigerant inside the refrigerant circuit 210M is accumulated in both the outdoor heat exchanger 23*x* and the outdoor heat exchanger 23*y* in addition to the liquid refrigerant connection pipe 6. Therefore, the heat exchange refrigerant quantity X is calculated by adding together the liquid refrigerant accumulated in the outdoor heat exchanger 23*x* and the liquid refrigerant accumulated in the outdoor heat exchanger 23*y*. Detection of the liquid refrigerant quantity accumulated in the outdoor heat exchanger 23*x* is performed by the liquid level detection sensor 239*x*, and detection of the liquid refrigerant quantity accumulated in the outdoor heat exchanger 23*y* is performed by the liquid level detection sensor 239*y*. The flow is otherwise the same as that of the second embodiment.

The hot gas bypass valve 82 remains closed until liquid level clarification control is performed, and the controller 9 temporarily opens the hot gas bypass valve 82 when performing liquid level clarification control, similar to the second embodiment.

In this manner, the quantity of refrigerant can be determined in a simple and precise manner also in the refrigerant circuit 210M provided with a plurality of outdoor units, which include the outdoor unit 202*x* and the outdoor unit 202*y*, as shown in FIG. 43.

(Modifications of Modification L)

Figure 45:
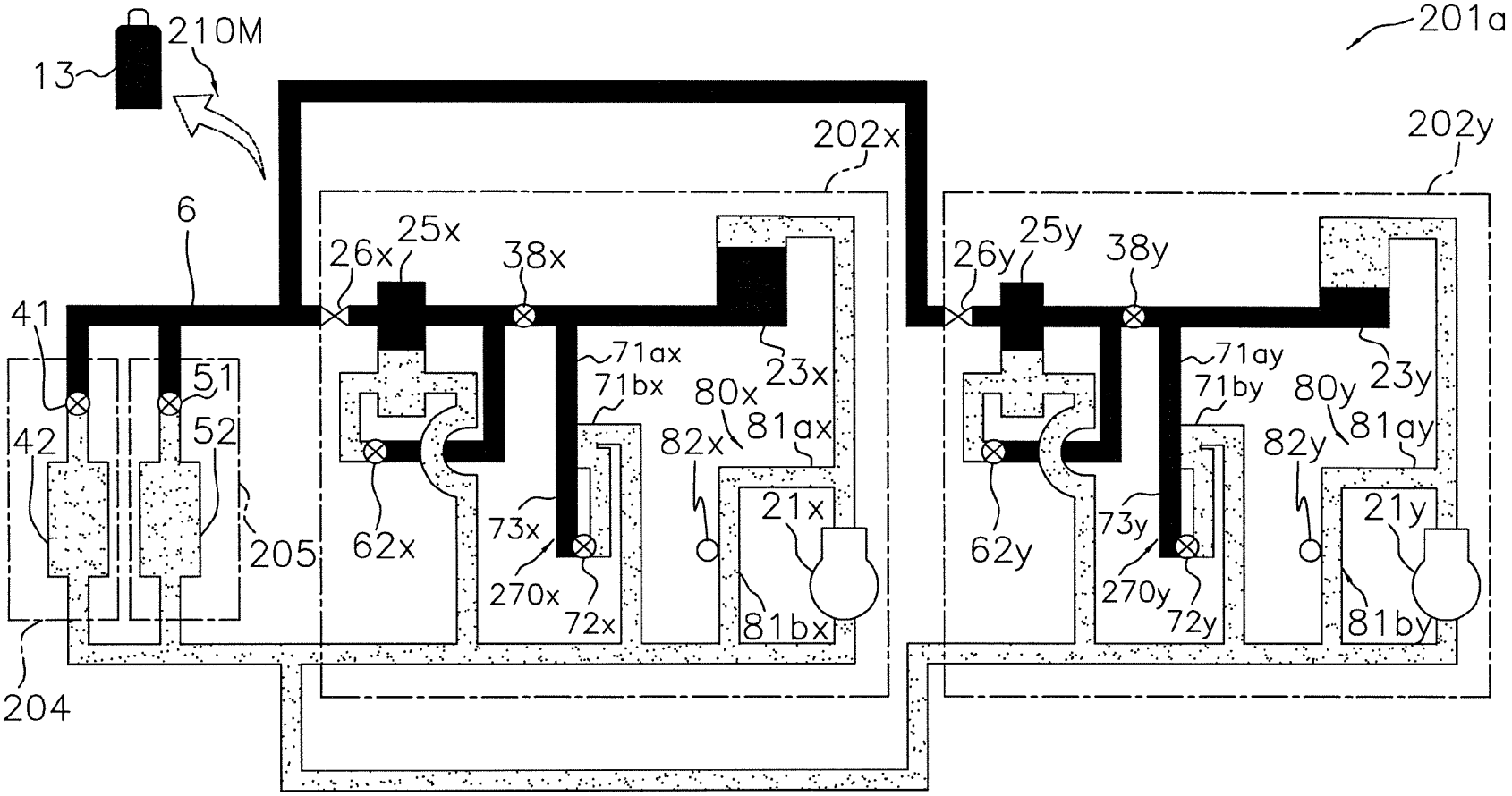
FIG. 45 is an illustrative diagram of a determination utilizing the partial refrigerant recovery tank of modification (L) of the second embodiment.

In modification (L), the refrigerant inside the refrigerant circuit 210M may be divided among and collected in a plurality of locations, rather than being collected as shown in FIG. 44. For example, depending on the type of refrigerant employed in the air conditioning apparatus 201, there is a risk that it will not necessarily be possible to collect all of the refrigerant inside the refrigerant circuit 210M from the indoor expansion valves 41 and 51 to the upstream ends of the outdoor heat exchangers 23*x* and 23*y*, including the outdoor heat exchangers 23*x* and 23*y* themselves. In this case, gas refrigerant of comparatively high density remains from the compressors 21*x* and 21*y* to the outdoor heat exchangers 23*x* and 23*y* and cannot be included in the target of detection. In this case, some of the entire quantity of refrigerant throughout the refrigerant circuit 210M may be recovered by connecting a partial refrigerant recovery tank 13 to the refrigerant circuit 210M, as shown in FIG. 45. In this manner, even in cases in which not all of the refrigerant inside the refrigerant circuit 210M can be collected from the indoor expansion valves 41 and 51 to the upstream ends of the outdoor heat exchangers 23*x* and 23*y* including the outdoor heat exchangers 23*x* and 23*y* themselves, using the partial refrigerant recovery tank 13 makes it possible to position the liquid levels at the time of determination in positions where detection by the liquid level detection sensors 239*x* and 239*y* is possible. It is thereby possible to perform the above-described proper refrigerant quantity charging operation, the refrigerant leak detection operation, and each of the determinations without being limited by the type or makeup of the refrigerant of the air conditioning apparatus 201*a*.

Figure 46:
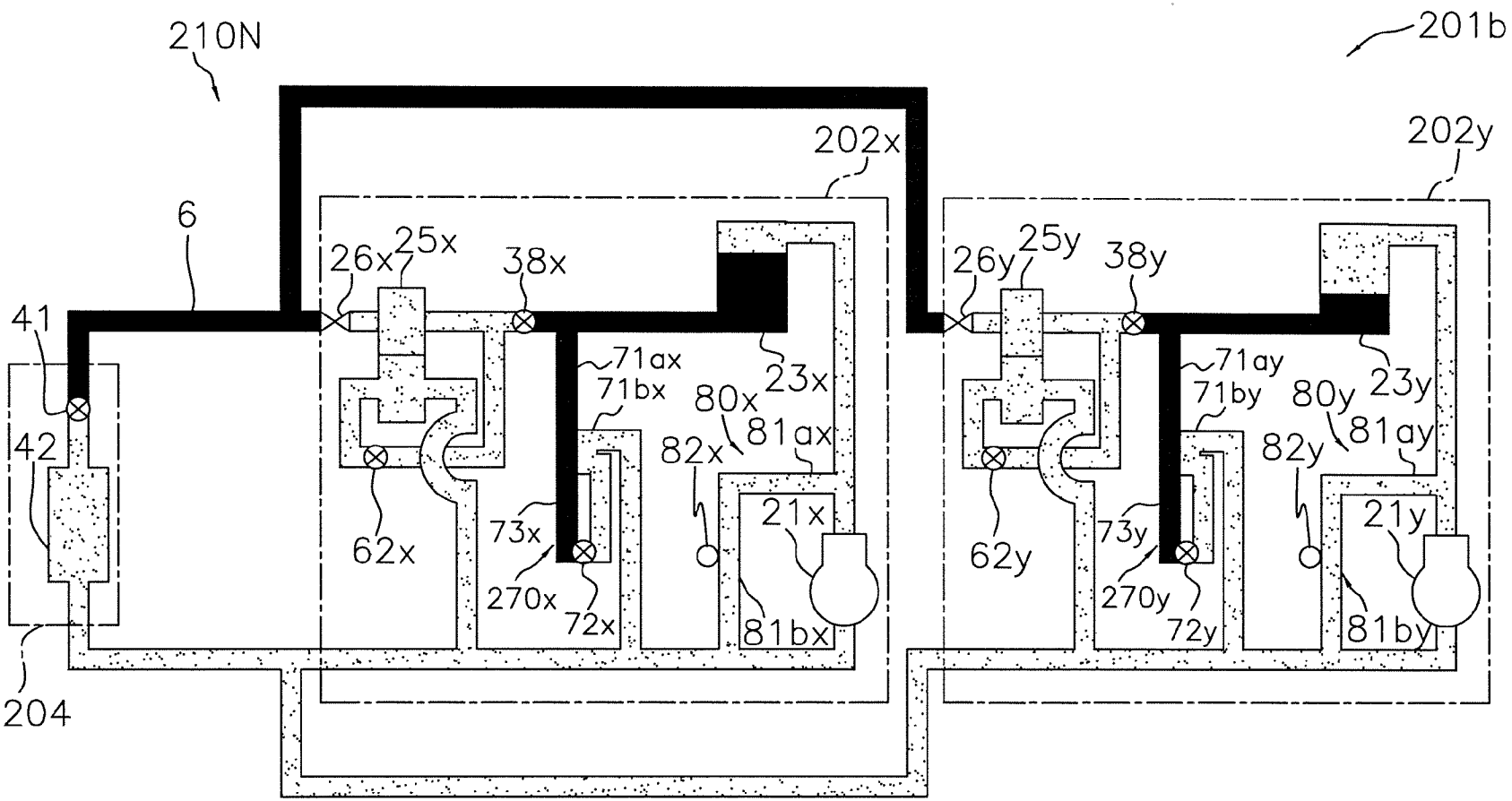
FIG. 46 is a general configuration diagram of an air conditioning apparatus having a single indoor unit of modification (L) of the second embodiment.

The configuration need not be provided with a plurality of indoor units, as is the case with the indoor unit 204 and the indoor unit 205 of modification (L). For example, a refrigerant circuit 210N may be used which employs a refrigerant circuit 201*b* having only an indoor unit 204, as shown in FIG. 46. In this case as well, a control is performed in ability ratio control for preferentially suppressing the lower-capacity unit between the outdoor units 202*x* and 202*y*, and the same effects as modification (L) can be achieved.

In the refrigerant circuit 210M of modification (L), an example was described in which all components of the outdoor unit 202*y* have less capacity than the components of the outdoor unit 202*x*. However, the present invention is not limited to this option alone, and some components of the components of the outdoor unit 202*y* may have approximately the same capacity as components of the outdoor unit 202*x*.

In modification (L), an example was described in which an operating state of the compressor 21*y* is ensured even though the output of the compressor 21*y* is limited by performing low-capacity unit priority stopping control during ability ratio control, whereby the refrigerant oil is warmed, the refrigerant mixed in with the refrigerant oil can be separated from the refrigerant oil and included in the target detected by the liquid level detection sensors 239*x* and 239*y*, and detection precision is improved. However, the present invention is not limited to this option alone, and a crank case heater (not shown) may be provided, for example, and the refrigerant mixed in with the refrigerant oil may be separated from the refrigerant oil by this crank case heater.

Figure 47:
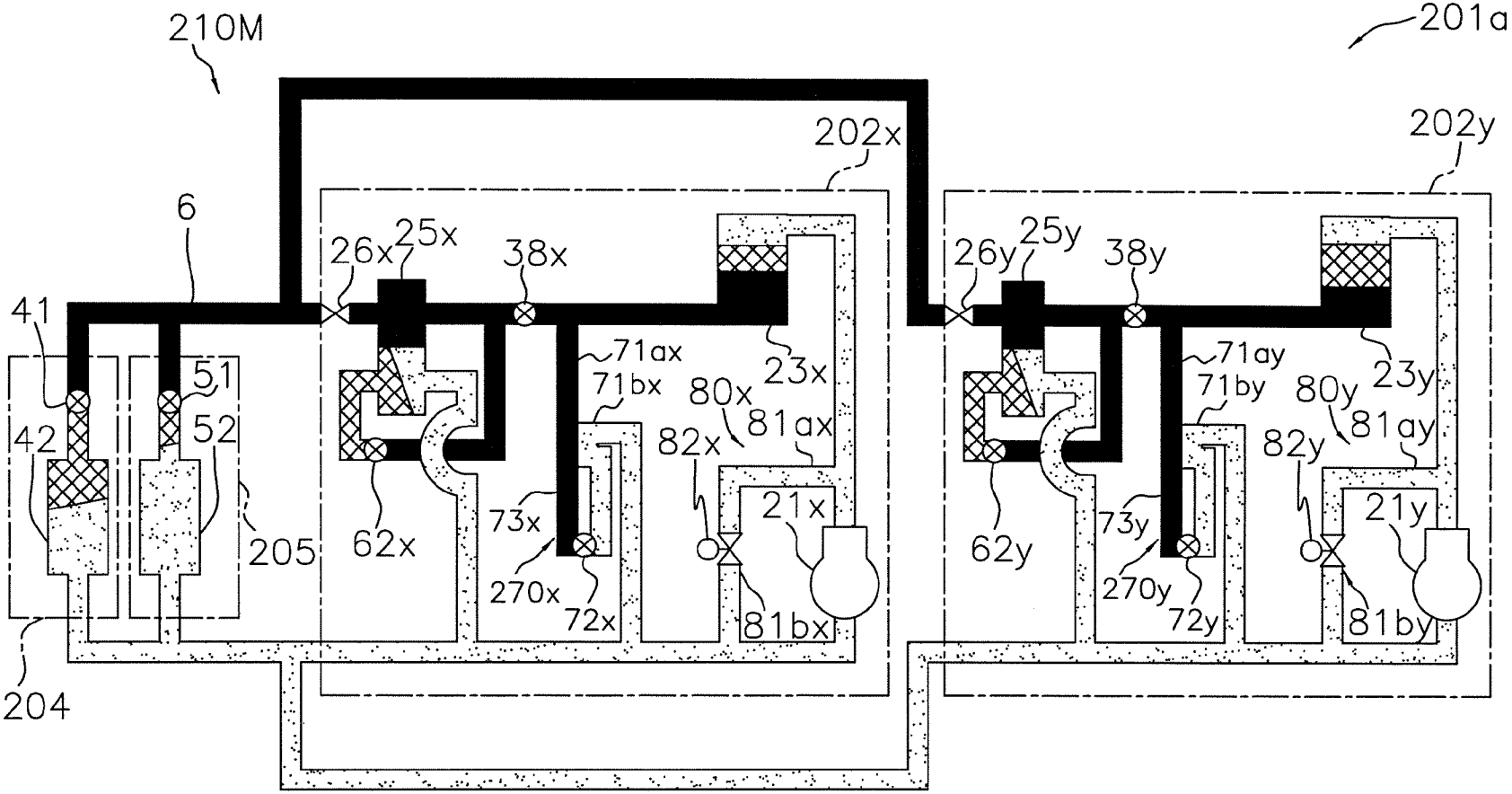
FIG. 47 is a diagram showing the distribution of refrigerant in the refrigerant circuit when ability ratio control is being performed in modification (L) of the second embodiment.

The ability ratio control in modification (J) of the second embodiment described above may be performed between the indoor units 204 and 205 and the outdoor units 202*x* and 202*y* in the refrigerant circuit 210M, as shown in FIG. 47.

(M)

In the second embodiment and the modifications, the configuration may have a receiver provided between the subcooler 25 and the outdoor expansion valve 38.

(N)

In the second embodiment and its modifications (A) through (M), an example was described in which condensation pressure control and liquid pipe temperature control are performed during liquid temperature stabilization control when the proper refrigerant quantity automatic charging operation mode and the refrigerant leak detection operation mode are being performed.

However, the present invention is not limited to this option alone; another option in the second embodiment and its modifications (A) through (M) is to perform liquid temperature stabilization by leaving the liquid refrigerant that has accumulated inside the outdoor heat exchanger 23, continuing to operate the compressor 21, the outdoor heat exchanger 23, the outdoor fan 28, and other components for some time, and waiting until the liquefied refrigerant reaches the surrounding temperature. In this case, the controller 9 detects the liquid level height h in a state in which the difference between the temperature detected by the liquid pipe temperature sensor 35 and the temperature detected by the outdoor temperature sensor 36 is less than a predetermined value. The liquid temperature can thereby be made constant merely by waiting for some time, for example, without performing any other active processing. The refrigerant quantity may then be calculated by the density of the liquid refrigerant corresponding to the detection value of the liquid pipe temperature sensor 35 at this stabilized stage.

Furthermore, the outdoor temperature sensor 36 may be used in the detection of the surrounding temperature for performing density correction according to the liquid refrigerant temperature, but any one of the detected temperatures of the thermistors T1 to T5 for detecting the liquid level may also be used in the detection of the surrounding temperature.

In this case, the number of thermistors can be reduced.

(O)

In the second embodiment and its modifications (A) through (M), an example was described in which the thermistors T1 to T5 of the liquid level detection sensor 239 are arranged from the top end vicinity of the header 23*b* to the bottom end vicinity.

However, the present invention is not limited to this option alone, and in the second embodiment and any of the modifications (A) through (L), another option is to provide the thermistors T1 to T5 of the liquid level detection sensor 239 only within a certain range between the top end vicinity and bottom end vicinity of the header 23*b*. Another option is to provide the thermistors to the heat exchanger body 23*a*, or only within a certain range between the top end vicinity and bottom end vicinity of the heat exchanger body 23*a*. In this case, if the same number of thermistors T1 to T5 are used, the detection precision is improved because the distance in the height direction between each of the thermistors T1 to T5 is shorter. In cases in which the thermistors T1 to T5 are arranged from the bottom end vicinity to the top end vicinity of the heat exchanger body 23*a*, the width whereby the liquid level can be measured can be increased in proportion to the width of the thermistor arrangement, but depending on the user's preferences, the type of air conditioning apparatus 201 being used, the type of refrigerant, or other factors, the thermistors T1 to T5 may be provided collectively at a height position in the vicinity of the liquid level height expected to be detected when the proper quantity of refrigerant has entered the refrigerant circuit 210. It is thereby possible to make the liquid level detection sensor 239 more compact or lower in cost by providing thermistors T1 to T5 only to the necessary locations.

(P)

In the second embodiment and its modifications (A) through (M), an example was described in which the height serving as a reference for determination is regulated according to the surrounding temperature at the time of the determination.

However, the present invention is not limited to this option alone; in the second embodiment and any of its modifications (A) through (M), for example, instead of correcting or otherwise modifying the height serving as a predetermined determination reference stored beforehand in the memory 19 or the like, another option is that the liquid level height h actually detected by the liquid level detection sensor 239 may be corrected based on the surrounding temperature at the time of determination. In this case, the corrected value of the actually measured liquid level height h is compared with the height serving as the predetermined determination reference.

Furthermore, in cases in the present modification in which the surrounding temperature is detected in order to correct the liquid level height h detected so that the height corresponds to the liquid refrigerant density according to temperature, or in cases in the second embodiment, for example, in which the surrounding temperature is detected in order to correct the reference height in accordance with the liquid refrigerant temperature, the outdoor temperature sensor 36 may be used, but the detected temperature of any one of the thermistors T1 to T5 for detecting the liquid level may also be used in the detection of the surrounding temperature. In this case, the number of thermistors can be reduced.

(Q)

In the second embodiment and its modifications (A) through (M), an example was described in which temperature correction is performed in a state in which the outdoor unit 2 has continually not been operating for some time.

However, the present invention is not limited to this option alone; another option is that a heater/cooler capable of heating/cooling any of the thermistors T1 to T5 of the liquid level detection sensor 239 may be provided, for example, and the controller 9 can actively create conditions in which the surrounding temperatures of the thermistors T1 to T5 will be the same. In this case, the controller 9 can perform temperature correction after having created conditions in which the surrounding temperatures are the same.

As the method of actively creating same-temperature conditions in this case, the conditions in which the surrounding temperatures of each of the thermistors T1 to T5 are the same may be created by the controller 9 controlling the refrigerant distribution conditions inside the refrigerant circuit 210, for example.

In this manner, the controller 9 creates conditions in which the same temperatures are expected to be detected in all of the positions provided with the thermistors T1 to T5. Under these conditions in which the same temperatures are expected to be detected, even if there is a difference among the values actually detected by each of the thermistors T1 to T5 at the different height positions, the performing of correction processing by the controller 9 can guarantee that each of the thermistors T1 to T5 will exhibit the same temperature, and the precision with which the liquid level height is detected by each of the thermistors T1 to T5 placed at different height positions can be as high as if the temperatures at the different heights were detected using a single sensor.

(R)

In the second embodiment and its modifications (A) through (M), an example was described in which the determination in the refrigerant leak detection operation uses the proper refrigerant quantity as a reference.

However, the present invention is not limited to this option alone; another option, for example, is to calculate a liquid level height which is the liquid level height at which the proper refrigerant quantity is filled and which corresponds to the liquid refrigerant density of the temperature at the time of determination, and the liquid level height h detected by the liquid level detection sensor 239 may be compared with this proper liquid level height.

(S)

In the second embodiment and its modifications (A) through (M), an example was described in which clarification of the boundary between the gas phase and the liquid phase was performed by performing liquid level clarification control.

However, the present invention is not limited to this option alone, and temperature correction processing of the thermistors T1 to T5 may be performed before the liquid level clarification control is performed, similar to the first embodiment and modification (J), for example. Under conditions in which the thermistors T1 to T5 are expected to detect the same temperature, for example, the controller 9 may perform correction so that each of the thermistors T1 to T5 exhibit the same temperature value.

<3> Third Embodiment

In the air conditioning apparatuses 1 and 201 in the above-described Embodiments 1 and 2 and their modifications, an example was described in which the present invention was applied to a configuration capable of switching between the cooling operation and the heating operation.

Figure 48:
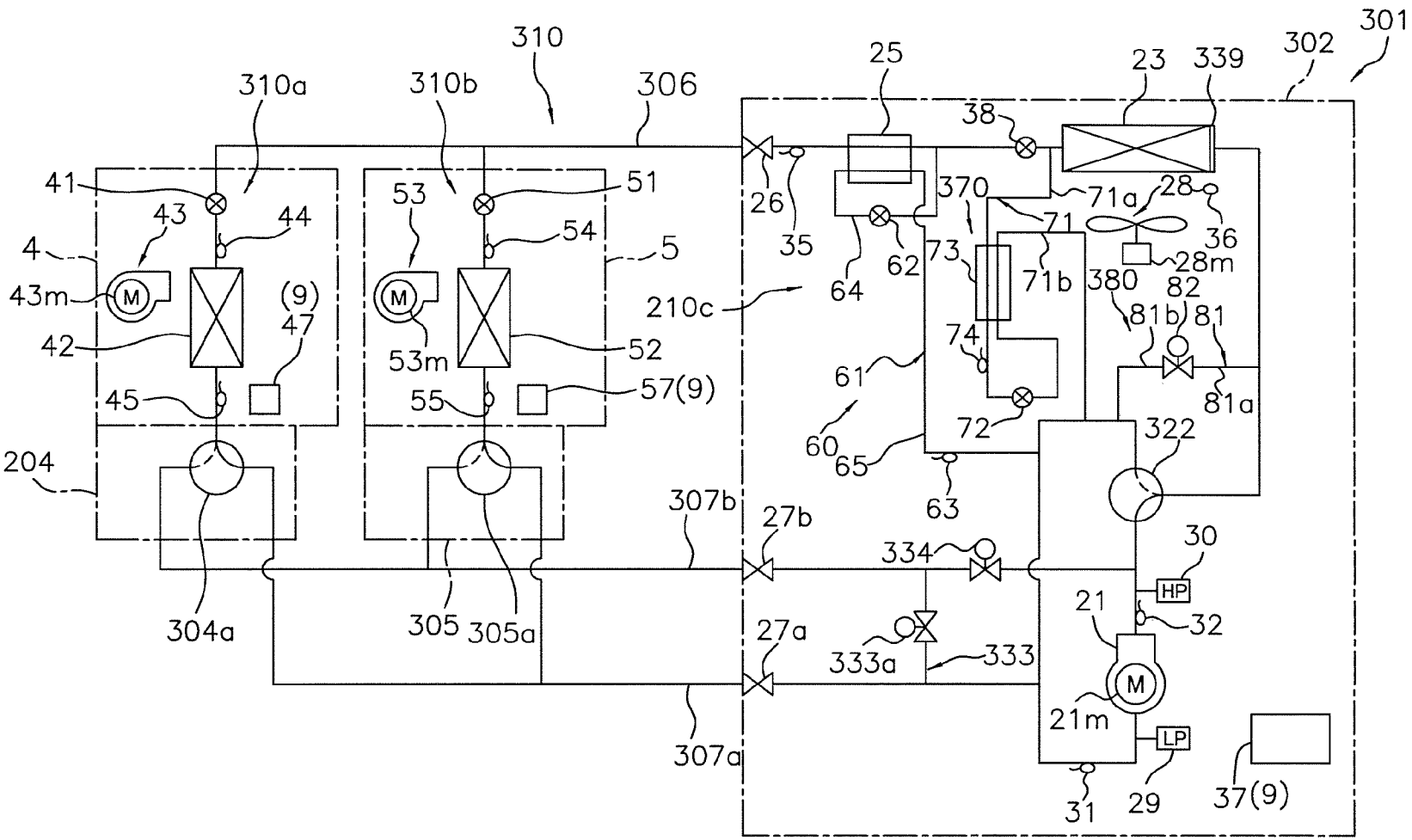
FIG. 48 is a general configuration diagram of the air conditioning apparatus of the third embodiment of the present invention.

However, the present invention is not limited to this option alone, and the present invention may be applied to a configuration capable of a cooling/heating simultaneous operation according to the requirements of different air-conditioned spaces in rooms in which the indoor units 4 and 5 are installed, such as, for example, performing a cooling operation in one air-conditioned space while performing a heating operation in another air-conditioned space, as is the case with an air conditioning apparatus 301 of the present embodiment shown in FIG. 48, for example.

<3.1> Configuration of Third Embodiment

The air conditioning apparatus 301 of the present embodiment mainly comprises indoor units 4 and 5 as a plurality of utilization units (two here), an outdoor unit 302 as a heat source unit, and refrigerant connection pipes 306, 307*a*, and 307*b*.

The indoor units 4 and 5 are connected to the outdoor unit 302 via a suction gas refrigerant connection pipe 307*a* and a discharge gas refrigerant connection pipe 307*b* as gas refrigerant connection pipes, as well as connection units 304 and 305; and together with the outdoor unit 302, the indoor units 4 and 5 constitute a refrigerant circuit 310. The indoor units 4 and 5 have the same configurations as the indoor units 4 and 5 in the first and second embodiments described above, and are therefore not described herein.

The outdoor unit 302 mainly constitutes part of the refrigerant circuit 310 and comprises an outdoor-side refrigerant circuit 310*c*.

The outdoor-side refrigerant circuit 310*c* mainly has a compressor 21, a three-way switching valve 322, an outdoor heat exchanger 23, a liquid level detection sensor 339 as a refrigerant detection mechanism, an outdoor expansion valve 38, a subcooler 25, a subcooling refrigerant circuit 60, a hot gas bypass circuit 80, a liquid-side stop valve 26, a suction gas-side stop valve 27*a*, a discharge gas-side stop valve 27*b*, a high-low pressure communication pipe 333, a high-pressure shut-off valve 334, and an outdoor fan 28.

Here, aside from the three-way switching valve 322, the suction gas-side stop valve 27*a*, the discharge gas-side stop valve 27*b*, the high-low pressure communication pipe 333, and the high-pressure shut-off valve 334, the other devices and valves have the same configurations as the devices and valves of the outdoor unit 2 in the first and second embodiments described above, and are therefore not described.

The three-way switching valve 322 connects the discharge side of the compressor 21 and the gas side of the outdoor heat exchanger 23 when the outdoor heat exchanger 23 is made to function as a condenser. The interconnection state of the three-way switching valve 322 in which the outdoor heat exchanger 23 is made to function as a condenser is referred to as the condensing operation state. The three-way switching valve 322 interconnects the suction side of the compressor 21 and the gas side of the outdoor heat exchanger 23 when the outdoor heat exchanger 23 is made to function as an evaporator. The interconnection state of the three-way switching valve 322 in which the outdoor heat exchanger 23 is made to function as an evaporator is referred to as the evaporating operation state. The three-way switching valve 322 is a valve for switching between the condensing operation state and the evaporating operation state by switching the flow path of the refrigerant inside the outdoor-side refrigerant circuit 210*c*.

The discharge gas refrigerant connection pipe 307*b* is connected via the discharge gas-side stop valve 27*b* between the discharge side of the compressor 21 and the three-way switching valve 322. It is thereby possible for high-pressure gas refrigerant compressed in and discharged from the compressor 21 to be supplied to the indoor units 4 and 5 regardless of the switching action of the three-way switching valve 322.

The suction gas refrigerant connection pipe 307*a* is connected via the suction gas-side stop valve 27*a* to the suction side of the compressor 21. It is thereby possible for low-pressure gas refrigerant returning from the indoor units 4 and 5 to be returned to the suction side of the compressor 21 regardless of the switching action of the three-way switching valve 322.

The high-low pressure communication pipe 333 is a refrigerant pipe for allowing mutual communication between a refrigerant pipe connecting the discharge gas refrigerant connection pipe 307*b* with a position between the discharge side of the compressor 21 and the three-way switching valve 322, and a refrigerant pipe connecting the suction gas refrigerant connection pipe 307*a* with the suction side of the compressor 21. The high-low pressure communication pipe 333 has a high-low pressure communication valve 333*a* capable of shutting off the passage of refrigerant. It is thereby possible to establish, as necessary, a state in which the suction gas refrigerant connection pipe 307*a* and the discharge gas refrigerant connection pipe 307*b* are communicated with each other.

The high-pressure shut-off valve 334 is provided to a refrigerant pipe connecting the discharge gas refrigerant connection pipe 307*b* to a position between the discharge side of the compressor 21 and the three-way switching valve 322, and is capable of shutting off, as necessary, the high-pressure gas refrigerant discharged from the compressor 21 from being sent to the discharge gas refrigerant connection pipe 307*b*. This high-pressure shut-off valve 334 is disposed in the path of the refrigerant pipe connecting the discharge gas refrigerant connection pipe 307*b* to a position between the discharge side of the compressor 21 and the three-way switching valve 322, nearer to the discharge side of the compressor 21 than the position where the high-low pressure communication pipe 333 is connected. The high-low pressure communication valve 333*a* and the high-pressure shut-off valve 334 are electromagnetic valves.

The hot gas bypass circuit 80 has a hot gas bypass pipe 81 and a hot gas bypass valve 82. The hot gas bypass pipe 81 interconnects a pipe connecting the suction side of the compressor 21 to the four-way switching valve 322, and a pipe extending from the four-way switching valve 322 to the outdoor heat exchanger 23. The hot gas bypass valve 82 is provided in the path of the hot gas bypass pipe 81, and is capable of switching between an open state in which refrigerant is allowed to pass through the hot gas bypass pipe 81, and a closed state in which refrigerant is not allowed to pass through.

The outdoor unit 302 is provided with various sensors and an outdoor-side controller 37. These various sensors, the outdoor-side controller 37, and the like have the same configurations as the various sensors and outdoor-side controller 37 of the outdoor unit 2 in the first and second embodiments described above and are therefore not described.

In the indoor units 4 and 5, the gas sides of the indoor heat exchangers 42 and 52 are connected to the suction gas refrigerant connection pipe 307*a* and the discharge gas refrigerant connection pipe 307*b* via connection units 304 and 305. The connected states between the connection units 304 and 305 and the suction gas refrigerant connection pipe 307*a* and discharge gas refrigerant connection pipe 307*b* can each be freely switched.

The connection units 304 and 305 mainly comprise cooling/heating switching valves 304*a* and 305*a*. When the indoor units 4 and 5 are performing the cooling operation, the state is such that the gas sides of the indoor heat exchangers 42 and 52 of the indoor units 4 and 5 are connected with the suction gas refrigerant connection pipe 307*a*. The connected state when the indoor units 4 and 5 perform the cooling operation is referred to as the cooling operation state. When the indoor units 4 and 5 are performing the heating operation, the state is such that the gas sides of the indoor heat exchangers 42 and 52 of the indoor units 4 and 5 are connected with the discharge gas refrigerant connection pipe 307*b*. The connected state when the indoor units 4 and 5 perform the heating operation is referred to as the heating operation state. Cooling/heating switching valves 304*a* and 305*a* are valves which function as switching mechanisms for switching between the cooling operation state and the heating operation state.

With this type of configuration of the air conditioning apparatus 301, the indoor units 4 and 5 are capable of performing a so-called cooling/heating simultaneous operation in which the indoor unit 4 performs the cooling operation and the indoor unit 5 performs the heating operation, for example.

In the air conditioning apparatus 301 capable of this cooling/heating simultaneous operation, the three-way switching valve 322 is set to the condensing operation state, causing the outdoor heat exchanger 23 to function as a condenser of the refrigerant, and the cooling/heating switching valves 304*a* and 305*a* are set to the cooling operation state, causing the indoor heat exchangers 42 and 52 to function as evaporators of the refrigerant, whereby it is possible to perform the same refrigerant quantity determination operation and refrigerant quantity properness determination as the air conditioning apparatus 1 in the first and second embodiments described above.

The air conditioning apparatus 301 of the present embodiment has the suction gas refrigerant connection pipe 307*a* and the discharge gas refrigerant connection pipe 307*b* as the gas refrigerant connection pipe 7. Therefore, when a state is such that the high-pressure gas refrigerant discharged from the compressor 21 can be sent to the discharge gas refrigerant connection pipe 307*b* without allowing communication between the suction gas refrigerant connection pipe 307*a* and the discharge gas refrigerant connection pipe 307*b* by completely closing the high-low pressure communication valve 333*a* and completely opening the high-pressure shut-off valve 334, as is the case with the cooling operation in the normal operation mode, there is a risk that the precision of determination will be adversely affected. Specifically, since the high-pressure gas refrigerant accumulated in the discharge gas refrigerant connection pipe 307*b* can no longer be condensed in the outdoor heat exchanger 23 and accumulated in the portion upstream of the outdoor expansion valve 38 including the outdoor heat exchanger 23, there is a risk that the precision of determining the properness of the refrigerant quantity inside the refrigerant circuit 310 will be adversely affected.

Therefore, in the refrigerant quantity determination operation, the high-low pressure communication valve 333*a* is completely closed and the high-pressure shut-off valve 334 is completely open, whereby the suction gas refrigerant connection pipe 307*a* and the discharge gas refrigerant connection pipe 307*b* are communicated. Furthermore, the high-pressure gas refrigerant discharged from the compressor 21 is shut off from being sent to the discharge gas refrigerant connection pipe 307*b*.

A state is thereby achieved in which the pressure of the refrigerant inside the discharge gas refrigerant connection pipe 307*b* is the same as the pressure of the refrigerant inside the suction gas refrigerant connection pipe 307*a*, and the refrigerant does not accumulate in the discharge gas refrigerant connection pipe 307*b*. Therefore, the high-pressure gas refrigerant accumulated in the discharge gas refrigerant connection pipe 307*b* can be condensed in the outdoor heat exchanger 23 and accumulated in the portion upstream of the outdoor expansion valve 38, including the outdoor heat exchanger 23. It is thereby possible to reduce the adverse effects on the precision of determining the properness of the refrigerant quantity inside the refrigerant circuit 310.

The hot gas bypass valve 82 remains closed until liquid level clarification control is performed and the controller 9 temporarily opens the hot gas bypass valve 82 when performing liquid level clarification control, similar to the first and second embodiments.

In this manner, the air conditioning apparatus 301 of the present embodiment differs from the air conditioning apparatuses 1 and 201 in the first and second embodiments in the following aspects. Specifically, in the air conditioning apparatus 301 of the present embodiment, during the refrigerant quantity determination operation, the high-low pressure communication valve 333*a* is completely closed and the high-pressure shut-off valve 334 is completely opened, whereby the suction gas refrigerant connection pipe 307*a* and the discharge gas refrigerant connection pipe 307*b* are communicated, an operation is performed for shutting off the high-pressure gas refrigerant discharged from the compressor 21 from being sent to the discharge gas refrigerant connection pipe 307*b*, and this type of operation is not performed in the first and second embodiments. However, the essential operation is otherwise the same as the determination of the properness of the refrigerant quantity inside the refrigerant circuit 10 in the first and second embodiments described above.

Figure 49:
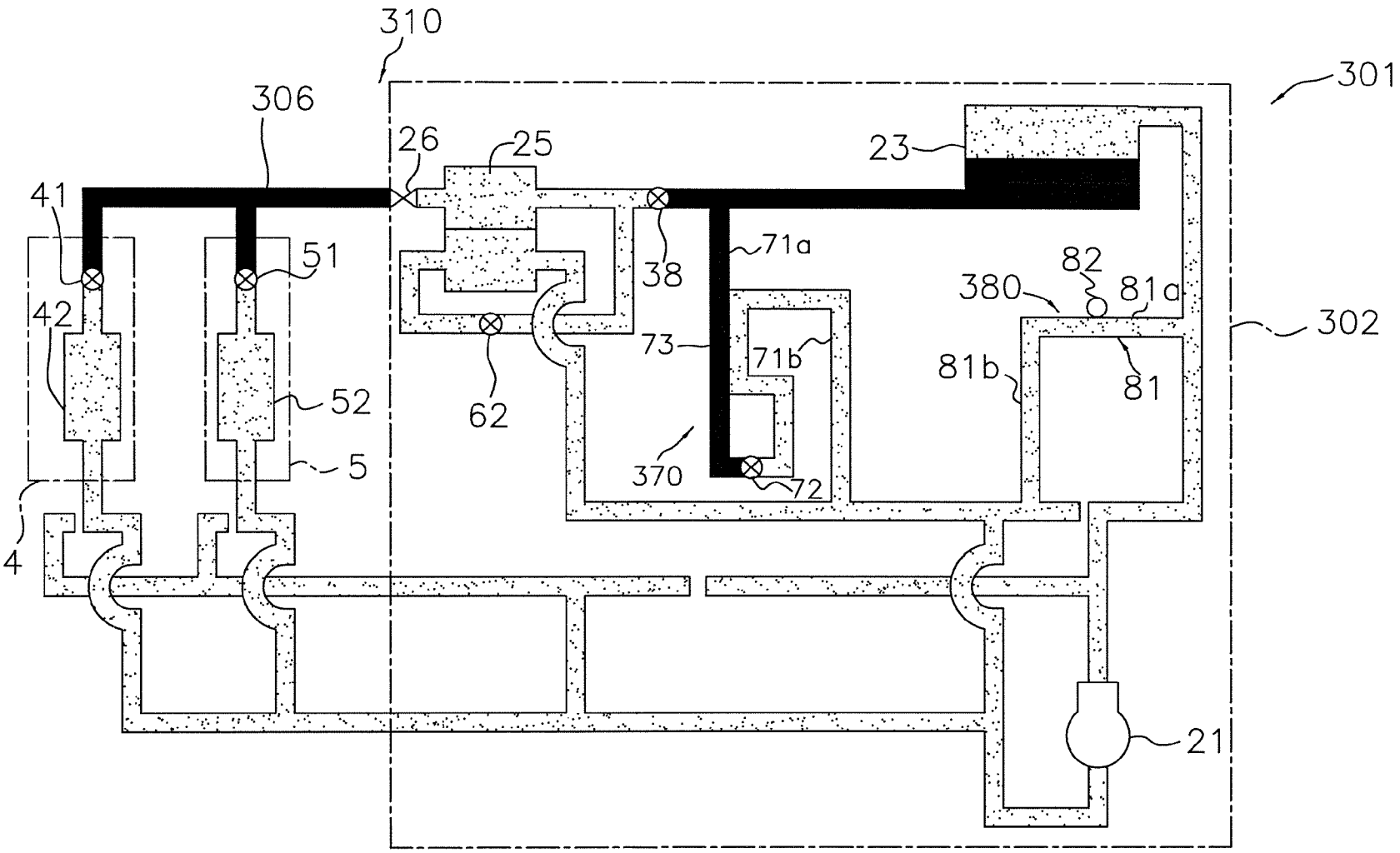
FIG. 49 is a schematic diagram showing the state of refrigerant flowing within the refrigerant circuit during the proper refrigerant quantity automatic charging operation and the refrigerant leak detection operation in the third embodiment.

A refrigerant distribution such as the one shown in FIG. 49 is achieved in the refrigerant circuit 310 under conditions in which the proper refrigerant quantity automatic charging operation mode and the refrigerant leak detection operation mode are performed in this manner and detection is performed by the liquid level detection sensor 339.

<3.2> Modifications of Third Embodiment (A)

In the third embodiment, an example was described in which the three-way switching valve 322 was used as the mechanism for switching between the condensing operation state and the evaporating operation state.

However, the present invention is not limited to this option alone, and the configuration may use a configuration of a four-way switching valve, a plurality of electromagnetic valves, or the like, for example.

(B)

In the third embodiment, an example was described in which cooling/heating switching valves 304*a* and 305*a* composed of three-way switching valves are used as the mechanism for switching between the cooling operation state and the heating operation state. However, the present invention is not limited to this option alone; the configuration may use a configuration of four-way switching valves, a plurality of electromagnetic valves, and the like, for example.

(C)

In the third embodiment, an example was described in which all of the refrigerant existing inside the refrigerant circuit 310 is the target for being liquefied and collected in a single location.

However, the present invention is not limited to this option alone; the refrigerant inside the refrigerant circuit 310 may be divided among and collected in a plurality of locations rather than being collected in a single location, for example.

For example, depending on the type of refrigerant employed in the air conditioning apparatus 301, there is a risk that not necessarily all of the refrigerant existing in the refrigerant circuit 310 will be collected in the portion shown in FIG. 49. In this case, gas refrigerant of comparatively high density remains from the compressor 21 to the outdoor heat exchanger 23 and cannot be included in the detection target.

Figure 50:
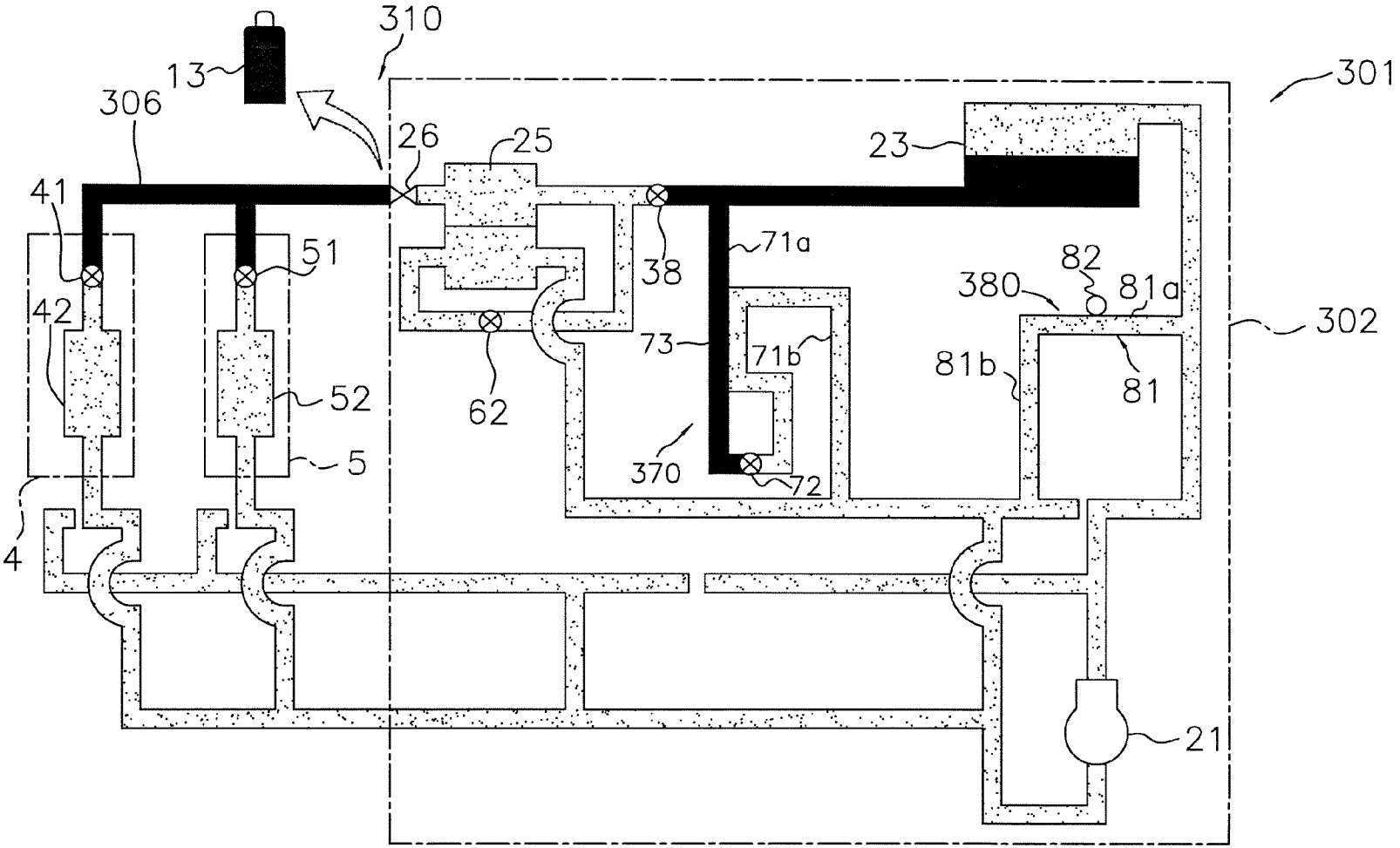
FIG. 50 is an illustrative diagram of determination utilizing the partial refrigerant recovery tank of modification (C) of the third embodiment.

Even in this type of case, some the entire quantity of refrigerant inside the refrigerant circuit 310 may be recovered by connecting a partial refrigerant recovery tank 13 to the refrigerant circuit 310, as shown in FIG. 50. In this manner, using the partial refrigerant recovery tank 13 makes it possible to position the liquid level at the time of determination at a position that can be detected by the liquid level detection sensor 339. It is thereby possible to perform the proper refrigerant quantity charging operation, the refrigerant leak detection operation, and each of the determinations without being limited by the type or makeup of the refrigerant of the air conditioning apparatus 301.

(D)

In the air conditioning apparatus 301 of the third embodiment, the same configurations as the modifications of the first and second embodiments described above may be applied, or a configuration having a plurality of connected outdoor units 202*x* and 202*y* may be used, as in modification (J) of the air conditioning apparatus 201 of the second embodiment.

INDUSTRIAL APPLICABILITY

By utilizing the present invention, determination of refrigerant quantity is performed in a simple and accurate manner to a degree that does not compromise the reliability of the compressor, and the present invention can therefore be applied particularly to an air conditioning apparatus and a determination method thereof in which the refrigerant filled in a refrigerant circuit is liquefied and the quantity thereof is determined.

What is claimed is:

1. An air conditioning apparatus comprising:

a refrigerant circuit having a compressor, a condenser arranged and configured to condense refrigerant, an expansion mechanism, an evaporator arranged and configured to evaporate refrigerant, an evaporator-side interconnection pipe arranged and configured to interconnect the expansion mechanism and the evaporator, a liquid refrigerant pipe arranged and configured to interconnect the expansion mechanism and the condenser, a gas refrigerant pipe arranged and configured to interconnect the evaporator and the suction side of the compressor, and a gas discharge pipe arranged and configured to interconnect the compressor and the condenser;

a controller configured to control the refrigerant circuit to perform liquefaction control, which causes refrigerant present inside the refrigerant circuit to be present in a liquid state in a liquid reserving portion located between the expansion mechanism and an end of the condenser on a side opposite the expansion mechanism;

a liquid bypass circuit arranged and configured to interconnect the liquid reserving portion and the gas refrigerant pipe, the liquid bypass circuit including a liquid bypass expansion valve; and a refrigerant quantity detection unit arranged and configured to detect at least one of either a volume of liquid refrigerant in the liquid reserving portion or a physical quantity equivalent to the volume, the controller and the liquid bypass circuit being arranged and configured to, in the following order perform the liquefaction control with the liquid bypass expansion valve of the liquid bypass circuit closed in the beginning of the liquefaction control while the compressor continues to compress the refrigerant present inside the refrigerant circuit prior to the beginning of the liquefaction control and throughout the liquefaction control, open the liquid bypass expansion valve to open the closed liquid bypass circuit after the controller judged that the volume of liquid refrigerant or the physical quantity equivalent to the volume has continued to be within a predetermined fluctuation range for a predetermined time duration or longer, prior to the refrigerant quantity detecting unit detecting at least one of the volume of liquid refrigerant in the liquid reserving portion or the physical quantity equivalent to the volume while the compressor continues to compress the refrigerant present inside the refrigerant circuit prior to the liquid bypass circuit being open and throughout the opening and maintaining open of the liquid bypass circuit, and regulate an amount of refrigerant passing through the liquid bypass circuit while the compressor continues to compress the refrigerant present inside the refrigerant circuit prior to and during the regulating of the amount of refrigerant passing through the liquid bypass circuit;

such that the compressor continues to compress the refrigerant present inside the refrigerant circuit prior to the beginning of the liquefaction control and throughout completion of the regulating of the amount of refrigerant passing through the liquid bypass circuit.

2. The air conditioning apparatus according to claim 1, wherein the controller is further configured to control the refrigerant circuit to perform temperature stabilization control, which stabilizes the temperature of refrigerant liquefied by the liquefaction control.

3. The air conditioning apparatus according to claim 2, further comprising:

a subcooling circuit branching from between the condenser and the expansion mechanism, and connected to the suction side of the compressor;

a subcooling expansion mechanism provided in a path of the subcooling circuit; and a subcooling heat exchanger arranged and configured to perform heat exchange between refrigerant expanded by the subcooling expansion mechanism and refrigerant moving from the condenser toward the expansion mechanism, the controller being further configured to perform the temperature stabilization control by regulating a degree of expansion of the subcooling expansion mechanism.

4. The air conditioning apparatus according to claim 3, further comprising:

flow rate regulation structure arranged and configured directly or indirectly regulate a rate at which refrigerant flows through the liquid bypass circuit from the liquid reserving portion toward the gas refrigerant pipe.

5. The air conditioning apparatus according to claim 2, further comprising:

flow rate regulation structure arranged and configured directly or indirectly regulate a rate at which refrigerant flows through the liquid bypass circuit from the liquid reserving portion toward the gas refrigerant pipe.

6. The air conditioning apparatus according to claim 1, further comprising:

flow rate regulation structure arranged and configured directly or indirectly regulate a rate at which refrigerant flows through the liquid bypass circuit from the liquid reserving portion toward the gas refrigerant pipe.

7. The air conditioning apparatus according to claim 6, wherein the flow rate regulation structure includes a liquid bypass valve which is provided in a path of the liquid bypass circuit and is capable of regulating quantity of refrigerant passing therethrough.

8. The air conditioning apparatus according to claim 7, wherein the liquid bypass valve is a liquid bypass expansion mechanism arranged and configured to reduce pressure of refrigerant passing through; and the flow rate regulation structure further includes a liquid bypass heat exchanger arranged and configured to perform heat exchange between refrigerant moving from the liquid reserving portion toward the liquid bypass expansion mechanism and refrigerant passing through the liquid bypass expansion mechanism toward the gas refrigerant pipe.

9. The air conditioning apparatus according to claim 8, wherein the controller is further configured to regulate a degree of depressurization of refrigerant in the liquid bypass expansion mechanism, thereby causing the heat exchange amount in the liquid bypass heat exchanger to fluctuate so as to regulate flow rate of a liquid single-phase refrigerant passing through the liquid bypass expansion mechanism while ensuring that refrigerant flowing into the liquid bypass expansion mechanism is in a liquid single phase.

10. The air conditioning apparatus according to claim 9, wherein the flow rate regulation structure further includes a gas return circuit arranged and configured to interconnect the gas discharge pipe and the gas refrigerant pipe; and the controller is further configured to regulate flow rate of refrigerant passing through the liquid bypass valve, thereby regulating a ratio of a mixture of gas refrigerant fed to the gas refrigerant pipe via the gas return circuit and liquid refrigerant fed to the gas refrigerant pipe via the liquid bypass circuit.

11. The air conditioning apparatus according to claim 7, wherein the flow rate regulation structure further includes a gas return circuit arranged and configured to interconnect the gas discharge pipe and the gas refrigerant pipe; and the controller is further configured to regulate flow rate of refrigerant passing through the liquid bypass valve, thereby regulating a ratio of a mixture of gas refrigerant fed to the gas refrigerant pipe via the gas return circuit and liquid refrigerant fed to the gas refrigerant pipe via the liquid bypass circuit.

12. The air conditioning apparatus according to claim 11, further comprising:

a discharged refrigerant temperature sensor arranged and configured to detect temperature of refrigerant discharged by the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the discharged refrigerant temperature sensor.

13. The air conditioning apparatus according to claim 11, further comprising:

a compressor hot-area temperature sensor arranged and configured to detect temperature of a hot area inside the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the compressor hot-area temperature sensor.

14. The air conditioning apparatus according to claim 11, further comprising:

a discharged refrigerant temperature sensor arranged and configured to detect temperature of refrigerant discharged by the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the discharged refrigerant temperature sensor.

15. The air conditioning apparatus according to claim 11, further comprising:

a compressor hot-area temperature sensor arranged and configured to detect temperature of a hot area inside the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the compressor hot-area temperature sensor.

16. The air conditioning apparatus according to claim 6, wherein the flow rate regulation structure further includes a gas return circuit arranged and configured to interconnect the gas discharge pipe and the gas refrigerant pipe, and a gas return valve arranged and configured to regulate refrigerant quantity moving from the gas discharge pipe toward the gas refrigerant pipe, the gas return valve being provided to the gas return circuit; and the controller is further configured to regulate flow rate of refrigerant passing through the gas return valve, and thereby regulates ratio of mixture of gas refrigerant fed to the gas refrigerant pipe via the gas return circuit and liquid refrigerant fed to the gas refrigerant pipe via the liquid bypass circuit.

17. The air conditioning apparatus according to claim 16, further comprising:

a discharged refrigerant temperature sensor arranged and configured to detect temperature of refrigerant discharged by the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the discharged refrigerant temperature sensor.

18. The air conditioning apparatus according to claim 16, further comprising:

a compressor hot-area temperature sensor arranged and configured to detect temperature of a hot area inside the compressor, the controller being further configured to regulate mixture ratio of gas refrigerant fed to the gas refrigerant pipe via the gas return circuit and liquid refrigerant fed to the gas refrigerant pipe via the liquid bypass circuit based on a value detected by the compressor hot-area temperature sensor.

19. The air conditioning apparatus according to claim 1, wherein at least one of the controller and the liquid bypass circuit is further configured and arranged to regulate the amount of refrigerant passing through the liquid bypass circuit when a detected liquid level remains within a predetermined fluctuation range for a predetermined time duration or longer.

20. The air conditioning apparatus according to claim 19, wherein the liquid bypass circuit includes a liquid bypass expansion valve, and the controller is configured and arranged to control the liquid bypass expansion valve to regulate the amount of refrigerant passing through the liquid bypass circuit.

21. The air conditioning apparatus according to claim 1, wherein the refrigerant quantity detection unit includes a liquid level detection sensor arranged and configured to detect a height of a liquid level, which is a boundary between the gas phase region and the liquid phase region of the refrigerant inside the condenser, at least one of the controller and the liquid bypass circuit being arranged and configured to open the liquid bypass circuit which is closed after the controller judges that the liquid level of the refrigerant in the condenser as detected by the liquid level detection sensor has continued to be within a predetermined fluctuation range for a predetermined time duration or longer, and prior to the refrigerant quantity detecting unit detecting at least one of the volume of liquid refrigerant in the liquid reserving portion or the physical quantity equivalent to the volume.

22. A method to determine quantity of refrigerant of an air conditioning apparatus including a refrigerant circuit having a compressor, a condenser arranged and configured to condense refrigerant, an expansion mechanism, an evaporator arranged and configured to evaporate refrigerant, an evaporator-side interconnection pipe arranged and configured to interconnect the expansion mechanism and the evaporator, a liquid refrigerant pipe arranged and configured to interconnect the expansion mechanism and the condenser, a gas refrigerant pipe arranged and configured to interconnect the evaporator and the suction side of the compressor, a gas discharge pipe arranged and configured to interconnect the compressor and the condenser, and a liquid bypass circuit arranged and configured to interconnect a liquid reserving portion and the gas refrigerant pipe, the liquid bypass circuit including a liquid bypass expansion valve; the method comprising the steps of:

performing liquefaction control, which causes refrigerant present inside the refrigerant circuit to be present in a liquid state in the liquid reserving portion, the liquid receiving portion being located between the expansion mechanism and an end of the condenser on a side opposite the expansion mechanism;

directing at least some refrigerant accumulated in the liquid reserving portion to the gas refrigerant pipe through the liquid bypass circuit without passing through the evaporator before a volume of liquid refrigerant in the liquid reserving portion or a physical quantity equivalent to the volume is detected; and regulating an amount of refrigerant passing through the liquid bypass circuit, the liquid bypass expansion valve of the liquid bypass circuit being closed in the beginning of the liquefaction control to close the liquid bypass circuit while the compressor continues to compress the refrigerant present inside the refrigerant circuit prior to the beginning of the liquefaction control and throughout the liquefaction control, the closed liquid bypass expansion valve being open to open the closed liquid bypass circuit after judging that the volume of liquid refrigerant or the physical quantity equivalent to the volume has continued to be within a predetermined fluctuation range for a predetermined time duration or longer, while the compressor continues to compress the refrigerant present inside the refrigerant circuit prior to the liquid bypass circuit being closed and throughout the closing and maintaining closed of the liquid bypass circuit, and prior to the refrigerant quantity detecting unit detecting at least one of the volume of liquid refrigerant in the liquid reserving portion or the physical quantity equivalent to the volume while the compressor continues to compress the refrigerant present inside the refrigerant circuit prior to the liquid bypass expansion valve being open to open the liquid bypass circuit and throughout the opening and maintaining open of the liquid bypass circuit, and the amount of refrigerant passing through the liquid bypass circuit being regulated after the liquid bypass expansion valve opens the liquid bypass circuit and while the compressor continues to compress the refrigerant present inside the refrigerant circuit prior to and during the regulating of the amount of refrigerant passing through the liquid bypass circuit;

such that the compressor continues to compress the refrigerant present inside the refrigerant circuit prior to the beginning of the liquefaction control and throughout completion of the regulating of the amount of refrigerant passing through the liquid bypass circuit.

23. The method according to claim 22, wherein the amount of refrigerant passing through the liquid bypass circuit is regulated when a detected liquid level remains within a predetermined fluctuation range for a predetermined time duration or longer.

24. The method according to claim 23, wherein the liquid bypass circuit includes a liquid bypass expansion valve, and the regulating the amount of refrigerant passing through the liquid bypass circuit is achieved by controlling the liquid bypass expansion valve.

* * * * *